US007364352B2

(12) United States Patent
Akahane et al.

(10) Patent No.: US 7,364,352 B2
(45) Date of Patent: Apr. 29, 2008

(54) TIME MEASUREMENT DEVICE AND METHOD

(75) Inventors: Hidehiro Akahane, Suwa (JP); Kenichi Okuhara, Suwa (JP); Akihiko Maruyama, Suwa (JP); Nobuhiro Koike, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 798 days.

(21) Appl. No.: 10/370,741

(22) Filed: Feb. 21, 2003

(65) Prior Publication Data

US 2003/0137900 A1 Jul. 24, 2003

Related U.S. Application Data

(62) Division of application No. 09/446,449, filed on Apr. 19, 2000, now Pat. No. 6,724,692.

(51) Int. Cl.
*G04F 7/10* (2006.01)
*G04F 8/08* (2006.01)

(52) U.S. Cl. ..... 368/101; 368/110; 368/238

(58) Field of Classification Search ..... 368/89, 368/97, 101, 102, 106, 107, 108, 110, 112, 368/113, 121, 228, 238
See application file for complete search history.

(56) References Cited

U.S. PATENT DOCUMENTS

| | | | | |
|---|---|---|---|---|
| 490,123 | A * | 1/1893 | Nicolet | 368/104 |
| 1,459,006 | A * | 6/1923 | Von Kerzburg | 368/288 |
| 1,521,208 | A * | 12/1924 | Von Kersburg | 368/106 |
| 3,686,880 | A | 8/1972 | Samejima | |
| 4,023,345 | A | 5/1977 | Imamura | |
| 4,211,066 | A | 7/1980 | Kusumoto et al. | |
| 4,270,197 | A | 5/1981 | Minowa | |
| 4,364,669 | A | 12/1982 | Thoenig et al. | |
| 4,523,857 | A | 6/1985 | Ushikoshi | |
| 4,588,305 | A | 5/1986 | Piguet et al. | |
| 4,615,625 | A | 10/1986 | Moriya | |
| 4,748,603 | A * | 5/1988 | Ray et al. | 368/80 |
| 5,001,685 | A | 3/1991 | Hayakawa | |
| 5,077,708 | A * | 12/1991 | Schneider | 368/107 |
| 5,220,541 | A * | 6/1993 | Vuilleumier | 368/88 |
| 5,740,132 | A | 4/1998 | Ohshima et al. | |
| 5,889,736 | A * | 3/1999 | Fujita et al. | 368/66 |
| 5,959,941 | A * | 9/1999 | Murakami et al. | 368/80 |
| 5,978,318 | A | 11/1999 | Kawaguchi et al. | |
| 6,144,621 | A | 11/2000 | Sase | |
| 6,542,120 | B1 * | 4/2003 | Gilbertson | 342/419 |

FOREIGN PATENT DOCUMENTS

| | | |
|---|---|---|
| JP | 48-25156 | 7/1973 |
| JP | 50-61890 | 10/1973 |
| JP | 49-123366 | 11/1974 |

(Continued)

*Primary Examiner*—P. Austin Bradley
*Assistant Examiner*—Jeanne-Marguerite Goodwin

(57) ABSTRACT

A mechanism having at least a function of measuring an arbitrary elapsed time is provided, which disables the function from being reset after the function is started, and enables the function to be reset after the function is stopped. The function is continuously held in an electrical ON state after being started, except when being normally stopped. This provides a time measurement device and method in which an electrical operating state and a mechanical operating state can coincide.

13 Claims, 66 Drawing Sheets

FOREIGN PATENT DOCUMENTS

| | | | |
|---|---|---|---|
| JP | 50-9464 | | 1/1975 |
| JP | 55-172895 | | 5/1979 |
| JP | 55047478 | A * | 3/1980 |
| JP | 56-2583 | | 1/1981 |
| JP | 56-108990 | | 8/1981 |
| JP | 58-196481 | | 11/1983 |
| JP | 59-13973 | | 1/1984 |
| JP | 62-47575 | | 3/1987 |
| JP | 62-69190 | | 3/1987 |
| JP | 5-80165 | | 4/1993 |
| JP | 5-215868 | | 8/1993 |
| JP | 6-265646 | | 9/1994 |
| JP | 7-78543 | | 8/1995 |
| JP | 7-306275 | | 11/1995 |
| JP | 7-333364 | | 12/1995 |
| JP | 9-101380 | | 4/1997 |
| JP | 9-274526 | | 10/1997 |

* cited by examiner

TIME MEASUREMENT DEVICE AND METHOD

CONTINUING APPLICATION DATA

This application is a divisional of application Ser. No. 09/446,449, filed Apr. 19, 2000 now U.S. Pat. No. 6,724,692, the contents of which are incorporated by reference herein.

BACKGROUND OF THE INVENTION

1. Technical Field

The present invention relates to a multifunctional time measurement device having hands, and to a time measurement method.

2. Background Art

Conventionally available as a multifunctional time measurement device having hands is, for example, a timepiece having an analog-display chronograph function.

Such a timepiece has, for example, a chronograph hour hand, a chronograph minute hand, and a chronograph second hand for chronograph purposes, and starts time measurement in response to the push of a start/stop button provided therein, so that the chronograph hour hand, the chronograph minute hand, and the chronograph second hand turn. When the start/stop button is pushed again, time measurement is finished, and the chronograph hour hand, the chronograph minute hand, and the chronograph second hand stop, thereby indicating the measured time. At the push of a reset button provided in the electronic timepiece, the measured time is reset, and the chronograph hour hand, the chronograph minute hand, and the chronograph second hand return to zero positions (hereinafter referred to as "return to zero").

In a reset method, the hands are returned to zero by being moved quickly by a chronograph motor when the timepiece is of an electronic type, and are mechanically returned when the timepiece is of a mechanical type. Some of such mechanical return mechanisms have a safety mechanism for preventing a return operation from being performed due to an inadvertent press of the reset button during time measurement. This safety mechanism is a mechanism that disables time measurement from being reset after the start thereof, and enables time measurement to be reset after the stop thereof.

In addition, the timepiece has a function of automatically stopping the chronograph hour hand, the chronograph minute hand, and the chronograph second hand at, for example, the hand positions at the start of time measurement when the maximum measurement time is over. This function can prevent power from being consumed in vain even when the start/stop button fails to be pushed during time measurement.

The above-described safety mechanism is configured to mechanically and alternatively repeat the return impossible state and the return enabling state every time the start/stop button is operated. Since such a safety mechanism has been provided in mechanical timepieces hitherto, there is no special problem. When an electronic timepiece is provided with a mechanical return mechanism and a safety mechanism, however, the recognition of the return impossible state and the return possible state in a control circuit of the timepiece and the recognition of the return impossible state and the return possible state in the safety mechanism are sometimes reversed.

For example, as shown in FIG. 22, when a start signal is output in response to the push of the start/stop button at a point T1, measurement recognition (motor pulse output) of the control circuit is started, and the safety mechanism is put into the return impossible state. Subsequently, when the power-supply voltage falls below the operating voltage required for the operation of the control circuit at a point T2 due to discharging or for other reasons, measurement recognition (motor pulse output) of the control circuit is stopped, whereas the safety mechanism is held in the return impossible state. These states are maintained even after the power-supply voltage is recovered above the above-described operating voltage at a point T3 by charging or by other methods.

Therefore, when a start signal is output at the push of the start/stop button at a subsequent point T4, measurement recognition (motor pulse output) of the control circuit is started, whereas the safety mechanism is put into the return possible state. Furthermore, when a stop signal is output at the push of the start/stop button at a subsequent point T5, measurement recognition (motor pulse output) of the control circuit is turned off, whereas the safety mechanism is put into the return impossible state.

For this reason, when a reset signal is output due to an inadvertent push of the reset button between the point T4 and the point T5, since the safety mechanism is in the return possible state, a returning operation is performed during time measurement. Even when a reset signal is output at the push of the reset button at a point T6, and the reset recognition of the control circuit is turned on, a returning operation is impossible though time measurement has been stopped, because the safety mechanism is in the return impossible state. In this way, when the chronograph function abnormally stops, the recognition by the control circuit and the state of the safety mechanism are reversed in the chronograph start/stop and reset operations.

An object of the present invention is to solve the above problems, and to provide a time measurement device and method in which an electric operating state and a mechanical operating state can always coincide with each other.

Conventionally available as a multifunctional time measurement device having hands is, for example, an electronic timepiece having an analog-display chronograph function.

Such an electronic timepiece has, for example, a chronograph hour hand, a chronograph minute hand, and a chronograph second hand for chronograph purposes, and starts time measurement in response to the push of a start/stop button provided therein, so that the chronograph hour hand, the chronograph minute hand, and the chronograph second hand turn. When the start/stop button is pushed again, time measurement is finished, and the chronograph hour hand, the chronograph minute hand, and the chronograph second hand stop, thereby indicating the measured time. At the push of a reset button provided in the electronic timepiece, the measured time is reset, and the chronograph hour hand, the chronograph minute hand, and the chronograph second hand return to zero positions (hereinafter referred to as "return to zero").

In a reset method, the hands are returned to zero by being moved quickly by a chronograph motor when the timepiece is of an electronic type, and are mechanically returned when the timepiece is of a mechanical type. Some of such mechanical return mechanisms have a safety mechanism for preventing a return operation from being performed due to an inadvertent press of the reset button during time measurement. This safety mechanism is a mechanism that disables time measurement from being reset after the start thereof, and enables time measurement to be reset after the stop thereof.

Some of such electronic timepieces have a chronograph hand for measuring time more finely than the chronograph second hand and showing time in the minimum measurement unit, for example, a chronograph ⅕-second hand, or a chronograph 1/10-second hand. Since large electric power is needed to continuously move the chronograph hand for showing time in the minimum measurement unit, however, the hand is set to stop its movement after a predetermined time elapses from the start of measurement. When time measurement is stopped, the hand is moved quickly by the motor to the hand position indicating time finely, so that reading the measured time is allowed.

In addition, the electronic timepiece has a function of automatically stopping the chronograph hour hand, the chronograph minute hand, and the chronograph second hand at, for example, the hand positions at the start of time measurement when the maximum measurement time is over. This function can prevent power from being consumed in vain even when measurement fails to be stopped by pushing the start/stop button during time measurement.

In the electronic timepiece provided with the chronograph thus having the mechanical return function and the function for preventing return during time measurement, even when the maximum measurement time is over during time measurement and the movement of the chronograph hour hand, the chronograph minute hand, and the chronograph second hand is automatically stopped, this state appears to the user that the chronograph hour hand, the chronograph minute hand, and the chronograph second hand have been returned to zero because the hands are stopped at, for example, the time measurement start positions. Even when the user attempts to start time measurement by pushing the start/stop button in this state, since time measurement has been already stopped halfway by the automatic stop function, it is merely mechanically stopped. That is, the operation the user intends to perform and the actual operation of the electronic timepiece do not coincide with each other. That is, the user loses a good timing of measurement. Moreover, the user may falsely recognize that the electronic timepiece is out of order.

Furthermore, when the chronograph hand for finely measuring time is stopped after a predetermined time has elapsed, it is impossible to read time in the minimum measurement unit during measurement, and false recognition that the timepiece is out of order is apt to be made.

An object of the present invention is to solve the above problems, to provide a time measurement device and method in which the user is informed that time measurement is automatically stopped after the maximum measurement time has elapsed from the start thereof, and is urged to perform a stop operation and a reset operation in the next use so as not to lose a good timing of measurement, and to provide a time measurement device and method that allows the elapsed time to be known in the minimum measurement unit at any time during time measurement and that provides excellent usability.

Conventionally available as a multifunctional time measurement device having hands is, for example, an electronic timepiece having an analog-display chronograph function.

Such an electronic timepiece has, for example, a chronograph hour hand, a chronograph minute hand, and a chronograph second hand for chronograph purposes, and starts time measurement in response to the push of a start/stop button provided therein, so that the chronograph hour hand, the chronograph minute hand, and the chronograph second hand turn. When the start/stop button is pushed again, time measurement is terminated, and the chronograph hour hand, the chronograph minute hand, and the chronograph second hand stop, thereby indicating the measured time. At the push of a reset button provided in the electronic timepiece, the measured time is reset, and the chronograph hour hand, the chronograph minute hand, and the chronograph second hand return to zero positions (hereinafter referred to as "return to zero").

Such an electronic timepiece has a split function in which the chronograph hour hand, the chronograph minute hand, and the chronograph second hand are stopped by the push of the reset button during time measurement while time measurement continues, are moved quickly by a continuously measured time when the reset button is pushed again, and subsequently turn in an ordinary manner. This function allows the user to visually recognize the measured time with precision at a plurality of points during time measurement, and, for example, to record the measured time.

In addition, the electronic timepiece has a function of automatically stopping the chronograph hour hand, the chronograph minute hand, and the chronograph second hand at, for example, the hand positions at the start of time measurement when the maximum measurement time is over. This function can prevent power from being consumed in vain even when the start/stop button fails to be pushed during time measurement.

Some of these types of electronic timepieces have power generators. In such an electronic time piece, for example, the user ordinarily wears the electronic timepiece and gives small vibrations or the like thereto, thereby causing the power generator provided inside the electronic timepiece to generate power. A secondary battery or the like is charged with the generated power so as to be used as a power-supply battery for the electronic timepiece.

In the above-described electronic timepiece having a chronograph, however, time measurement sometimes stops halfway due to a fall in voltage resulting from a shortage of charge capacity in the power-supply battery. In such a case, even when the user attempts to charge the power-supply battery by generating power by the power generator in a stopped electronic timepiece, it is impossible to immediately ensure sufficient charge capacity. When the chronograph is driven again in such a state in which the charge capacity in the power-supply battery is insufficient, a more power is consumed by the chronograph than the amount of power generated by the power generator, so the operation of the electronic timepiece is stopped again. Even if measurement is restarted when the voltage of the power-supply battery rises from this state, the indicated measured time, is inaccurate, and the user may read an incorrect measured time.

An object of the present invention is to solve the above problems, and to provide a time measurement device and method in which, even when the user is measuring time with the time measurement device having a time measuring function and the operation of the time measurement device is stopped due to the fall of voltage resulting from a shortage of charge capacity in a power-supply battery, the measurement operation does not stop immediately after restarting measurement since it is not performed until the power-supply battery is recharged by a power generator and the voltage or capacity for allowing reliable measurement is obtained, in which wasteful power consumption is prevented because the measurement operation is not started until the operation (input) is performed by the user even when the voltage or capacity reaches the voltage or charge for allowing reliable operation, and in which inaccurate measured time that the user does not intend is not indicated.

SUMMARY OF THE INVENTION

The invention provides a multifunctional time measurement device including a mechanism having a function of measuring at least an arbitrary elapsed time, for disabling the function from being reset after the function is started and enabling the function to be reset after the function is stopped, wherein the function is continuously held in an electrical ON state after being started, except when being normally stopped.

The invention also provides a time measurement method having a function of measuring at least an arbitrary elapsed time so as to disable the function from being reset after the function is started and to enable the function from being reset after the function is stopped, wherein the function is continuously held in an electrical ON state after being started, except when being normally stopped.

In the present invention a mechanical mechanism prevents measurement of an elapsed time from being reset until the measurement of the elapsed time is stopped after being started, and an electrical function holds the measurement of the elapsed time in the electric ON state until the measurement of the elapsed time is normally stopped after being started. Therefore, the reset impossible state of the mechanical mechanism and the reset impossible state of the electrical function always coincide with each other, which prevents faulty operation of resetting measurement of the elapsed time halfway after measurement of the elapsed time is abnormally stopped.

The invention provides a time measurement device, wherein the electrical ON state of the function is also maintained even when the power-supply voltage falls below the operating voltage for the function, and then reaches the voltage for allowing the operation again.

Even when the power-supply voltage rapidly falls below the measurement operating voltage during measurement of the elapsed time and the measurement operation is stopped, the reset impossible state of the mechanical mechanism and the reset impossible state of the electrical function always coincide with each other. Therefore, even if the power-supply voltage recovers above the measurement operating voltage after the measurement operation is stopped, it is possible to prevent faulty operation in which subsequent measurement of the elapsed time is reset halfway.

The invention provides a time measurement device, further including an actuating section for operating the start and stop of the function, wherein the electrical ON state of the function is switched to the OFF state by stopping the function by the actuating section.

Since the electrical ON state of measurement of the elapsed time is switched to the OFF state by the operation of the actuating section for stopping the measurement of the elapsed time, it is possible to subsequently reset the mechanical mechanism.

The invention also provides a time measurement device, wherein the function is normally stopped when the function is stopped by operating the actuating section.

Additionally, it is possible to switch the electrical ON state of measurement of the elapsed time to the OFF state by the operation of the actuating section for stopping the measurement of the elapsed time, and to subsequently reset the mechanical mechanism.

The invention also provides a time measurement device having a hand for indicating at least an arbitrary measured elapsed time, and a mechanism for disabling the hand from being returned to zero after the hand is driven and for enabling the hand to be returned to zero after the hand is stopped, wherein a driving signal for the hand is continuously maintained after the driving of the hand is started, except when the hand is normally stopped.

The invention includes a mechanical mechanism that prevents the hand from being returned, to zero until the driving of the hand is stopped after the hand starts to be driven to measure the elapsed time, and an electrical function for continuously outputting a driving signal for the hand until the driving of the hand is normally stopped after the hand is driven to measure the elapsed time. Therefore, the return impossible state of the mechanical mechanism and the reset impossible state of the electrical function always coincide with each other, and this prevents faulty operation in which the hand is returned to zero during driving thereof after the driving of the hand is abnormally stopped.

The invention provides a time measurement device, wherein the driving signal for the hand is also maintained when the power-supply voltage falls below the driving voltage for the hand, and then reaches again the voltage for allowing the operation.

Even when the power-supply voltage rapidly falls below the driving voltage of the hand while driving the hand to measure the elapsed time, and the driving of the hand is thereby stopped, since the return impossible state of the mechanical mechanism and the reset impossible state of the electrical function always coincide with each other, it is possible to prevent faulty operation in which the hand is returned to zero during driving subsequent to the recovery of the power-supply voltage above the voltage for allowing the hand to be driven after the stop of hand driving.

The invention provides a time measurement device, further including an actuating section for operating the start and stop of the hand, wherein a driving signal for the hand is switched to a stop signal by operating the stop of the hand by the actuating section.

Since the driving signal for the hand is switched to the stop signal by the operation of the actuating section for stopping the driving of the hand to stop measurement of the elapsed time, the hand is allowed to be subsequently returned to zero.

The invention provides a time measurement device, wherein the hand is normally stopped when the stop of the hand is operated by the actuating section.

The driving signal for the hand can be switched to the stop signal by the operation of the actuating section for stopping the driving of the hand to stop measurement of the elapsed time, and the hand is allowed to be subsequently return to zero.

The invention provides a multifunctional time measurement device having a hand for indicating at least an arbitrary measured elapsed time, a first actuating section for actuating the starting and stopping operations of the hand, a second actuating section for actuating an operation of returning the hand to zero, and a safety mechanism for disabling the second actuating section when the hand is driven by operating the first actuating section and for enabling the second actuating section when the hand is stopped by operating the first actuating section, further including a control section for continuously maintaining a driving signal for the hand after the hand is driven by operating the first actuating section, except when the hand is normally stopped.

The present invention provides a mechanical mechanism that disables the hand from being returned to zero by the second actuating section until the driving of the hand is stopped by operating the first actuating section after the hand is driven by operating the first actuating section in order to measure the elapsed time, and an electric control section for continuously outputting a driving signal for the hand until the driving of the hand is normally stopped operating by the first actuating section after the hand is driven by operating the first actuating section in order to measure the elapsed time. Therefore, the return impossible state of the mechanical mechanism and the reset impossible state of the electric control section always coincide with each other, and it is possible to prevent faulty operation in which the hand is returned to zero by inadvertently pushing the second actuating section during driving thereof after the driving of the hand is abnormally stopped.

The invention provides a time measurement device, wherein the control section has a pattern on a circuit board, and a lever for making mechanical contact with the pattern, and the driving signal for the hand is continuously maintained by keeping the lever in contact with the pattern.

Since the contact of the lever with the pattern is maintained, the return impossible state of the mechanical mechanism and the reset impossible state of the electrical function always coincide with each other, and it is possible to prevent faulty operation in which the hand is returned to zero by inadvertently pushing the second actuating section during driving after the driving of the hand is abnormally stopped.

The invention provides a time measurement device, wherein the control section includes a pull-up resistor or a pull-down resistor for determining a signal output to the pattern, a sampling circuit for intermittently operating the pull-up resistor or the pull-down resistor, and a holding circuit for recognizing the signal to the pattern during a sampling period in which the pull-down resistor or the pull-up resistor is intermittently operated by the sampling circuit and for holding and outputting the recognized signal except when the signal is recognized.

The invention provides a mechanical mechanism for disabling the hand from being returned to zero by the second actuating section until the driving of the hand is stopped by operating the first actuating section after the hand is driven by operating the first actuating section in order to measure the elapsed time, and a control section for recognizing and holding, based on the signal output to the pattern intermittently determined, a state in which the contact of the lever and the pattern is held until the driving of the hand is normally stopped by the first actuating section after the hand is driven by operating the first actuating section in order to measure the elapsed time. Therefore, the return impossible state of the mechanical mechanism and the reset impossible state of the electric control section always coincide with each other, which makes it possible to prevent faulty operation in which the hand is returned to zero (the measured time is reset) by inadvertently pushing the second actuating section after the driving of the hand is abnormally stopped. Furthermore, since the signal output to the pattern is intermittently recognized, power consumption can be reduced.

The invention provides a time measurement device, wherein the driving signal for the hand is also maintained when the power-supply voltage falls below the driving voltage for the hand and then rises again to the voltage that permits operation.

In the invention even when the power-supply voltage rapidly falls below the driving voltage for the hand while the hand is being driven in order to measure the elapsed time, and the driving of the hand is thereby stopped, since the return impossible state of the mechanical mechanism and the reset impossible state of the electric control section always coincide with each other, it is possible to prevent faulty operation in which the hand is returned to zero during subsequent driving in a case in which the power-supply voltage recovers above the voltage that allows the hand to be driven after the driving of the hand is stopped.

The invention provides a time measurement device wherein the hand is normally stopped when the stop of the hand is operated by the first actuating section.

Since a driving signal for the hand is switched to a stop signal by the operation of the first actuating section for stopping the driving of the hand in order to stop measurement of the elapsed time, the hand is allowed to be subsequently returned to zero.

The invention provides a time measurement device, wherein a driving signal for the hand is switched to a stop signal by the operation of the first actuating section of stopping the hand.

The driving signal for the hand can be switched to the stop signal by the operation of the first actuating section for stopping the driving of the hand in order to stop measurement of the elapsed time, and the hand can be subsequently returned to zero.

In the present invention the time measurement device is an electronic timepiece, for example a chronograph electronic timepiece. Even when the power-supply voltage rapidly falls below the driving voltage for the hand and the driving of the hand is thereby stopped during driving of the hand to measure the elapsed time, since the return impossible state of the mechanical mechanism and the reset impossible state of the electric control section always coincide with each other, it is possible to prevent faulty operation in which the hand is returned to zero during subsequent driving in a case in which the power-supply voltage recovers above the voltage that allows the hand to be driven after the driving of the hand is stopped.

The invention provides a time measurement device having a hand, wherein the hand is stopped at a position a predetermined time elapsed from the maximum measurement time when the time measured by a time measurement function exceeds the maximum measurement time.

The invention provides a time measurement method using a hand, wherein the hand is stopped at a position a predetermined time elapsed from the maximum measurement time when the time measured by a time measurement function exceeds the maximum measurement time.

According to the features of the present invention, when a predetermined maximum measurement time has elapsed from the start of measurement of time by the time measurement function, the hand automatically stops at a preset hand position. For this reason, the user is allowed to visually recognize with ease that time measurement has been automatically stopped.

The invention further includes a safety mechanism for preventing the measured time from being initialized during time measurement, and an actuating mechanism for mechanically initializing the measured time after the time measurement.

Since measured time is prevented by the safety mechanism from being initialized during time measurement, the time measurement will not be made inaccurate due to the user's inadvertent operation using the time measurement function during the time measurement. Furthermore, according to this structure, when the predetermined maximum measurement time elapses from the start of time measurement by the time measurement function, the hand automatically stops at a preset hand position. For this reason, the user can visually recognize with ease that time measurement has been automatically stopped.

The invention provides a time measurement device having a hand, including a measuring section for measuring time, a hand moving section for moving the hand when time measurement is started in the measuring section, a comparing section for comparing the value measured by the measuring section with a preset value, and a hand movement stopping section for stopping the movement of the hand at a hand position a predetermined time elapsed from the maximum measurement time based on the result of comparison by the comparing section.

The invention provides a time measurement method using a hand, including the steps of measuring time by a measuring section, moving the hand by a hand moving section when time measurement is started in the measuring section, comparing the value measured by the measuring section with a preset value by a comparing section, and stopping the movement of the hand at a hand position a predetermined time elapsed from the maximum measurement time by a hand movement stopping section based on the result of comparison by the comparing section.

According to the features of the present invention, time measurement is started in the measuring section, and the hand is moved by the hand moving section. It is determined by the comparing section whether the preset maximum measurement time has elapsed. When the hand is moved to the preset hand position by the hand moving section, the hand movement stopping section causes the hand moving section to automatically stop the movement of the hand. Since the hand position in this state is different from the time measurement start position, the user can visually recognize, with ease, that time measurement has been automatically stopped.

The invention provides a time measurement device having a hand, including a time measuring function having the capability of measuring time, a motor for driving the time measuring function, a control circuit for controlling the driving of the motor so as to start/stop time measurement by the time measurement function, and a control section having an automatic stop counter for measuring the elapsed time from the start of time measurement based on a signal from the control circuit and outputting an automatic stop signal to the control circuit when the maximum measurement time elapses, wherein the automatic stop counter stops the driving of the time measuring function when the hand turns to the preset hand position after a predetermined time elapses from the maximum measurement time during time measurement by the time measuring function.

The invention also provides a time measurement method using a hand, including the steps of measuring time by a time measuring function, driving the time measuring function by a motor, controlling the driving of the motor by a control circuit so as to start/stop time measurement by the time measurement function, and measuring an elapsed time from the start of time measurement by an automatic stop counter based on a signal from the control circuit and outputting an automatic stop signal to the control circuit when the maximum measurement time elapses, wherein the control section controls the control circuit and the automatic stop counter, and the automatic stop counter stops the driving of the time measuring function when the hand turns to the preset hand position after a predetermined time elapses from the maximum measurement time during time measurement-by the time measuring function.

Time measurement is started by the time measuring function, and the hand is moved by the motor. It is determined by the control section whether the preset maximum measurement time has elapsed. When the hand is moved to the preset hand position by the motor, the control section causes the motor to stop the movement of the hand. Since the hand position in this state is different from the time measurement start position, the user can visually recognize with ease that time measurement has been automatically stopped.

When the hands in the time measuring function turn to the preset hand positions, the automatic stop counter outputs the automatic stop signal.

Additionally, the automatic stop counter counts pulses for timing the output of motor pulses for driving the motor, and outputs an automatic stop signal when the count reaches a value corresponding to the automatic stop position.

According to the features of the present invention, the user can visually recognize with ease that time measurement has been automatically stopped after the maximum measurement time has elapsed from the start of time measurement.

The predetermined time is a time in which a sub-hand is advanced a preset time from the maximum measurement time.

Alternatively, the predetermined time is a time in which a plurality of sub-hands are positioned in a preset direction after the maximum measurement time.

Additionally, the predetermined time is a time in which a plurality of sub-hands are positioned at almost the same angle position after the maximum measurement time.

When the predetermined maximum measurement time elapses after time measurement is started by the time measuring function, the hand automatically stops at a hand position that is different from the time measurement start position and that is easily recognized. For this reason, the user can visually recognize with ease that time measurement has been automatically stopped.

According to the present invention, the time measuring function is a chronograph.

When the predetermined maximum measurement time elapses since time measurement is started by the chronograph, the hand automatically stops at a preset hand position. For this reason, the user can visually recognize with ease that time measurement has been automatically stopped.

According to the features of the present invention, the power-supply battery is a secondary battery, and is charged by a power-generating device.

Since there is no fear that time measurement will be stopped halfway due to a shortage of capacitance in the battery, it is possible to continuously indicate time in the minimum measurement unit that requires large power.

Additionally, the hand for measuring the minimum unit time is continuously turning during time measurement.

Since the hand for measuring the minimum unit time is continuously turning during time measurement, it is possible to read the elapsed time in the minimum measurement unit at any time during time measurement. In this way, since the movement of the hand is not stopped halfway in the time measurement device, the user will not falsely recognize that trouble has occurred. Furthermore, clear indication of the minimum unit time is continuously given during time measurement in the time measurement device, and this can delight the eyes of the user.

The invention also includes an ordinary time indicating section for indicating ordinary time, a time measuring section for measuring the elapsed time, an external input section for starting and stopping the operation of the time measuring section from the outside, and a holding section for holding an electric signal for determining the operation state of the time measuring section based on the operation of the external input section, wherein the holding section enables the input from the external input section after disabling of the time measuring section is cancelled when a state in which the time measuring section in an enabled state does not operate due to low power-supply voltage or no voltage application is turned into a state the power-supply voltage for allowing the time measuring section to operate is applied.

While the user is measuring time with the time measurement device having the time measuring function, even if the operation of the time measurement device is stopped due to the voltage fall resulting from a shortage of capacitance in the power-supply battery, the time measurement device can be reliably driven again by recharging the power-supply battery.

The invention further includes a detecting section for intermittently detecting an H-level or L-level signal held by the holding section, wherein the detecting section is stopped in a state in which the time measuring function is to be disabled.

Since the detecting section is stopped in the state in which the time measurement device is disabled, it is possible to reduce the power by the power to be consumed by the detecting section in the state in which the time measurement device is disabled.

The invention further includes a second time measuring section for measuring time, wherein the second time measuring section measures time since the operation is enabled, and disabling of the time measuring section is cancelled when a predetermined time has elapsed.

Since the second time measuring section is provided to measure time, the time measurement device prevented from being driven with the power-supply voltage being low by being driven again after a predetermined time has elapsed since the time measurement device is enabled.

The invention further includes a voltage detecting section for detecting the power-supply voltage. The power-supply voltage is detected by the voltage detecting section, and disabling of the operation is cancelled when the power-supply voltage exceeds a preset voltage.

Even when the time measurement is disabled due to insufficient power-supply voltage, when the power-supply voltage rises above a preset voltage, disabling of the operation of the time measurement device can be cancelled. This makes it possible to prevent the time measurement device from being driven again with the power-supply voltage being low, and to ensure reliable starting ability.

The invention further includes a second time measuring section for measuring time, and a voltage detecting portion for detecting the power-supply voltage. The time in which the power-supply voltage detected by the voltage detecting section is higher than the preset voltage is measured by the second time measuring section, and disabling of the time measuring section is cancelled after a predetermined time has elapsed.

According to the features of the present invention, even when the time measurement device is disabled due to insufficient power-supply voltage, and the power-supply voltage then instantaneously returns to the preset voltage, this voltage in this state is not regarded sufficient. When a predetermined time has elapsed since the power-supply voltage exceeds the preset voltage, disabling of the time measurement device is cancelled so that the time measurement device can reliably operate.

While the time measuring section is disabled, the signal held by the holding section is switched from the L level to the H level or from the H level to the L level, and disabling of the time measuring section is thereby cancelled.

According to the features of the present invention, even when the power source recovers after the time measurement device is disabled due to insufficient power-supply voltage, the time measurement device will not be operated against the intention of the user.

In accordance with one feature of the present invention, the time measuring section is a chronograph.

In accordance with another feature of the present invention, the time measuring section is a timer function.

While time is being measured by the time measurement device having the function of measuring an arbitrary time, even when the operation of the time measurement device is stopped due to voltage drop resulting from a shortage of capacitance in the power-supply battery, the time measurement device can be reliably driven again by recharging the power-supply battery.

T time measuring section has a safety mechanism for mechanically preventing the measured time from being initialized during time measurement.

Since the time measurement device has the safety mechanism for mechanically preventing the user from initializing the measured time by the time measuring function during time measurement, a false operation of the user can be prevented.

The invention further includes a power-generating means including a rechargeable charge section, and a power-generating section for charging the charge section.

Further, the power-generating means includes a rechargeable charge section, and a power-generating section for charging the charge section.

Since the time measurement device has the power-generating means, when the power-supply voltage runs short and is then recovered by generating power again, the operation is prohibited in the state in which the voltage of the power-supply battery is low or the power amount is small, which can ensure reliable starting ability. That is, the ordinary time indication means and the like serving as the main function in the time measurement device will not be stopped immediately. In the time measurement device, when the power-supply voltage exceeds the preset voltage after a predetermined time has elapsed, it is determined that the charge amount is sufficient to operate the time measurement device. Therefore, the time measurement device can ensure reliable starting ability.

In the present invention the generator rotor is rotated by an oscillating weight.

While the user is measuring time with the time measurement device having the time measuring function, even when the operation of the time measurement device is stopped due to the voltage drop resulting from a shortage of capacitance in the power-supply battery, the user operates a crown to rotate the generator rotor and to generate power, and recharges the power-supply voltage, whereby the time measurement device can be reliably driven again.

In the present invention the generator rotor is rotated by operating a crown.

While the user is measuring time with the time measurement device having the time measuring function, even when the operation of the time measurement device is stopped due to the voltage drop resulting from a shortage of capacitance in the power-supply battery, the user operates the crown to rotate the generator rotor and to generate power, and recharges the power-supply voltage, whereby the time measurement device can be reliably driven again.

In accordance with one embodiment of the present invention, the time measurement device is a wristwatch.

When the operation of the wristwatch, which the user usually wears, is stopped due to the voltage drop resulting from a shortage of capacitance in the power-supply battery, the time measurement device can be reliably driven again by recharging the power-supply battery by the power-generating device.

In the present invention ordinary time is indicated by an ordinary time indicating section, the elapsed time is measured by a time measuring section, the operation of the time measuring section is started and stopped from the outside by an external input section, an electric signal for determining the operation state of the time measuring section in response to the operation of the external input section is held by a holding section. The holding section cancels disabling of the time measuring section when a state in which the time measuring section in an enable state does not operate because the power-supply voltage is low or is not applied is switched into a state in which the power-supply voltage for allowing the time measuring section to operate is applied.

While the user is measuring time by the time measurement method having the time measuring function, even when the operation is stopped due to the voltage drop resulting from a shortage of capacitance in the power-supply battery, the operation can be reliably restarted by recharging he power-supply battery.

DESCRIPTION OF THE PREFERRED EMBODIMENTS

A preferred embodiment of the present invention will be described below with reference to the drawings.

Figure 1:
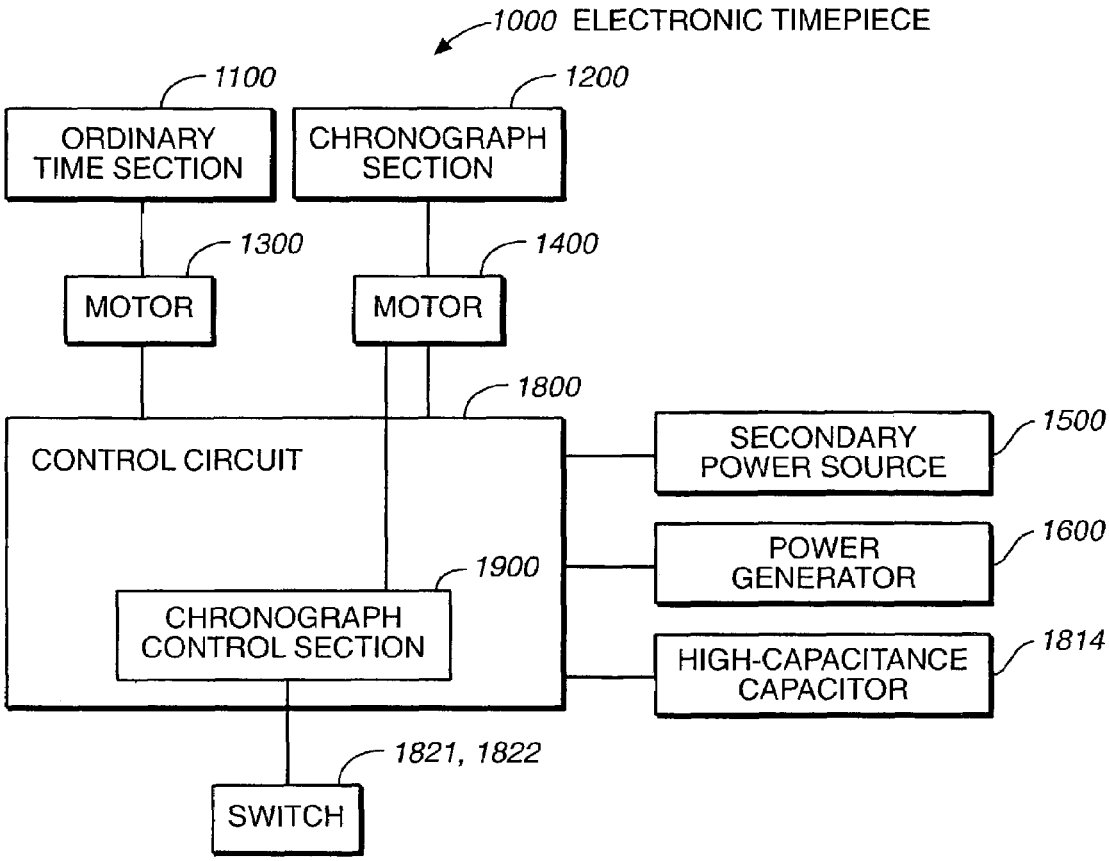
FIG. 1 is a schematic block diagram of an electronic timepiece serving as a time measurement device according to an embodiment of the present invention.

FIG. 1 is a schematic block diagram showing an electronic timepiece serving as a time measurement device according to an embodiment of the present invention.

This electronic timepiece 1000 comprises two motors 1300 and 1400 for driving an ordinary time section 1100 and a chronograph section 1200, a large-capacity capacitor 1814 and a secondary power source 1500 for supplying electric power for driving the motors 1300 and 1400, a power generator 1600 for charging the secondary power source 1500, and a control circuit 1800 for controlling the overall watch. Furthermore, the control circuit 1800 includes a chronograph control section 1900 having switches 1821 and 1822 for controlling the chronograph section 1200 by a method that will be described later.

This electronic timepiece 1000 is an analog type of electronic timepiece having a chronograph function, in which the two motors 1300 and 1400 are separately driven by using electric power generated by the single power generator 1600 to move the hands in the ordinary time section 1100 and the chronograph section 1200. The chronograph section 1200 is not reset (returned to zero) by motor driving, but is mechanically reset, as will be described later.

Figure 2:
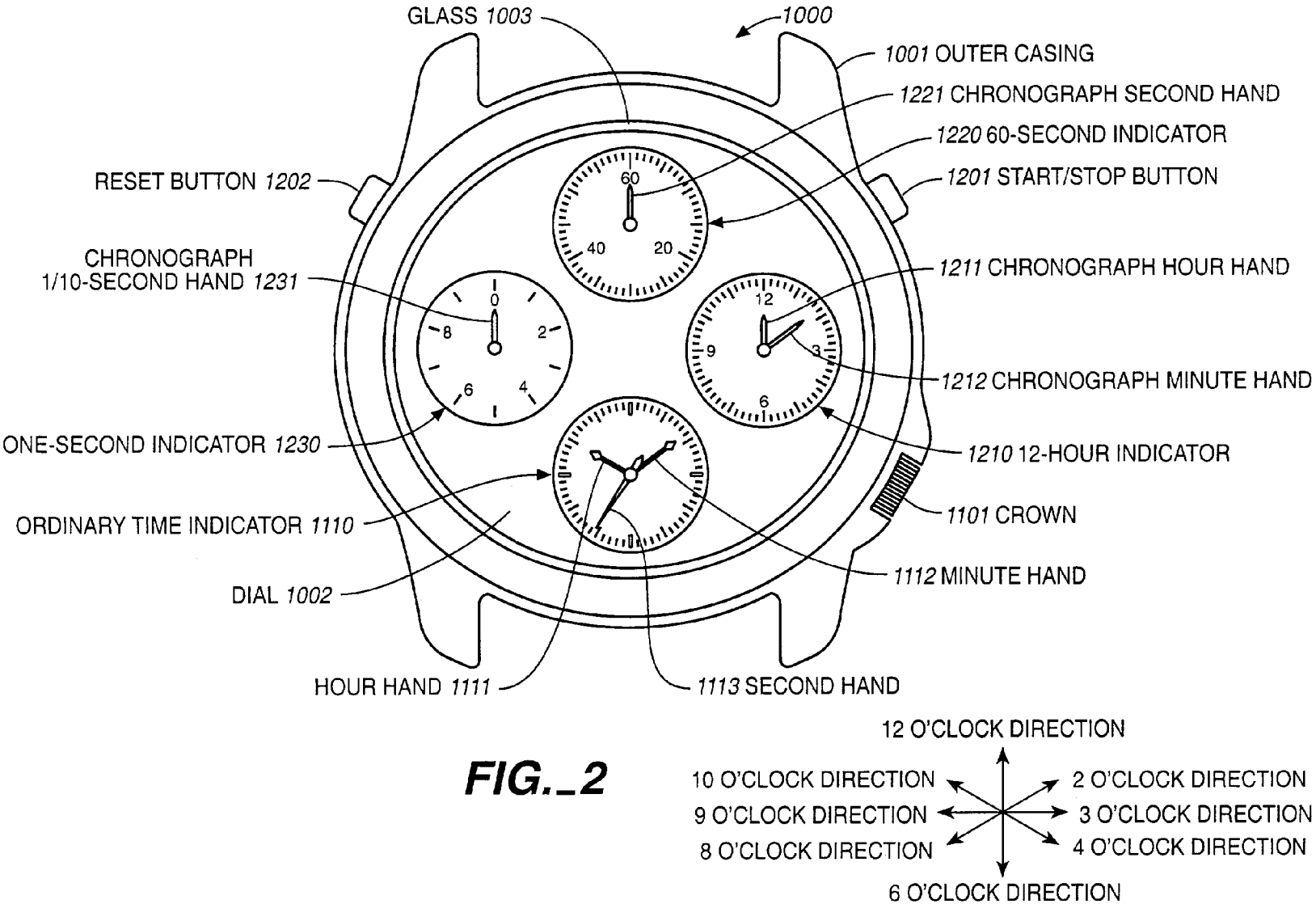
FIG. 2 is a plan view showing an example of the outward appearance of a finished article of the electronic timepiece shown in FIG. 1.

FIG. 2 is a plan view showing an example of the outward appearance of a completed article of the electronic timepiece shown in FIG. 1.

In this electronic timepiece 1000, a dial 1002 and a transparent glass 1003 are fitted inside an outer casing 1001. A crown 1101 serving as an external operating member is placed at 4 o'clock position of the outer casing 1001, and a start/stop button (first actuating section) 1201 and a reset button (second actuating section) 1202 for a chronograph are placed at 2 o'clock and 10 o'clock positions.

Furthermore, an ordinary time indicator 1110 having an hour hand 1111, a minute hand 1112, and a second hand 1113, which serve as ordinary time pointers, is placed at 6 o'clock position of the dial 1002, and indicators 1210, 1220, and 1230 having sub-hands for the chronograph are placed at 3 o'clock, 12 o'clock, and 9 o'clock positions. That is, the 12-hour indicator 1210 having chronograph hour and minute hands 1211 and 1212 is placed at 3 o'clock position, the 60-second indicator 1220 having a chronograph second hand 1221 is placed at 12 o'clock position, and a one-second indicator 1230 having a chronograph 1/10-second hand 1231 is placed at 9 o'clock position.

Figure 3:
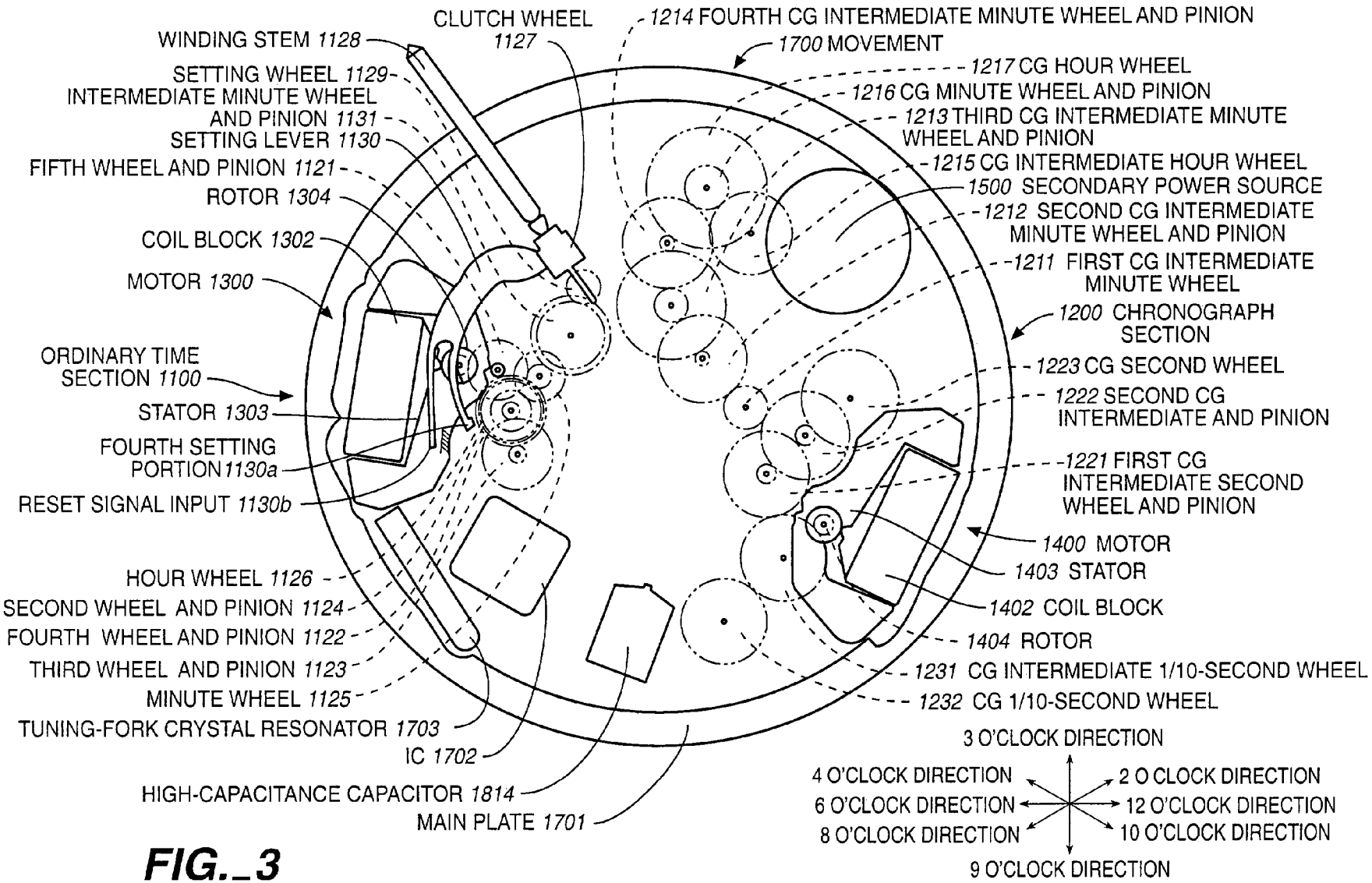
FIG. 3 is a plan view schematically showing an example of a structure of a movement in the electronic timepiece shown in FIG. 2, as viewed from the back side.

FIG. 3 is a plan view schematically showing an example of the structure of a movement in the electronic timepiece shown in FIG. 2.

In this movement 1700, the ordinary time section 1100, the motor 1300, and an IC 1702, a tuning-fork quartz resonator 1703, and the like are placed on 6 o'clock side of a main plate 1701, and the chronograph section 1200, the motor 1400, and the secondary power source 1500, such as a lithium-ion power source, are placed on 12 o'clock side.

The motors 1300 and 1400 are stepping motors, and include coil blocks 1302 and 1402 having magnetic cores made of a high-permeability material, stators 1303 and 1403 made of a high-permeability material, and rotors 1304 and 1404 composed of a rotor magnet and a rotor pinion.

The ordinary time section 1100 has a train of wheels, a fifth wheel and pinion 1121, a fourth wheel and pinion 1122, a third wheel and pinion 1123, a second wheel and pinion 1124, a minute wheel 1125, and an hour wheel 1126. The second, minute, and hour in the ordinary time are indicated by these wheels.

Figure 4:
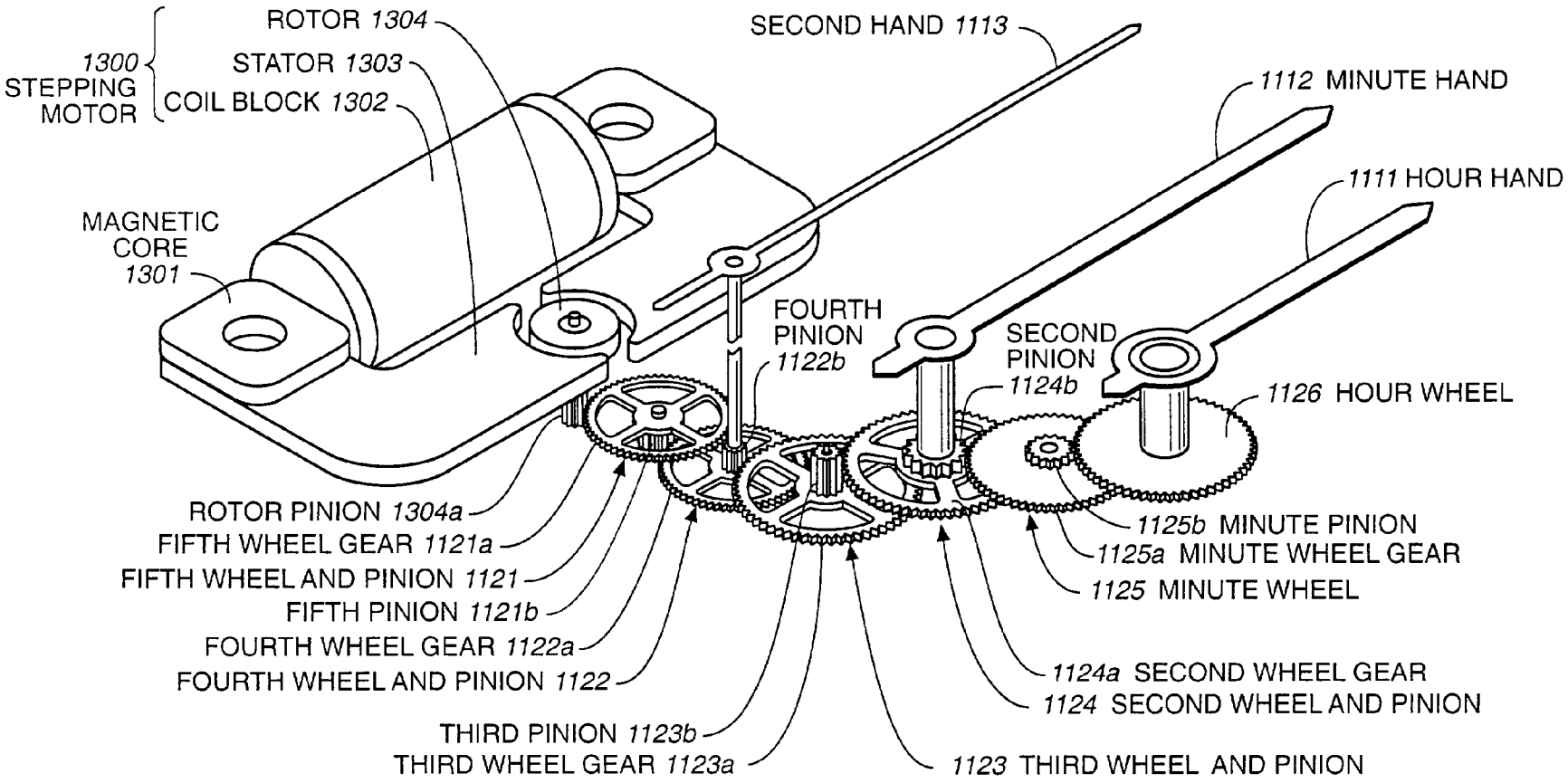
FIG. 4 is a perspective view showing the engagement state of a train of wheels in an ordinary time section in the movement in the electronic timepiece shown in FIG. 2.

FIG. 4 is a schematic perspective view showing the engagement state of the wheels in the ordinary time section 1100.

A rotor pinion 1304*a* is meshed with a fifth wheel gear 1121*a*, and a fifth pinion 1121*b* is meshed with a fourth wheel gear 1122*a*. The reduction ratio from the rotor pinion 1304*a* to the fourth wheel gear 1122*a* is set at 1/30. By outputting an electric signal from the IC 1702 so that the rotor 1304 rotates a half-turn per second, the fourth wheel and pinion 1122 makes one turn in sixty seconds, and the second hand 1113 fitted at the leading end thereof allows the second in ordinary time to be indicated.

A fourth pinion 1122*b* is meshed with a third wheel gear 1123*a*, and a third pinion 1123*b* is meshed with a second wheel gear 1124*a*. The reduction ratio from the fourth pinion 1122*b* to the second wheel gear 1124*a* is set at 1/60. The second wheel and pinion 1124 makes one turn in sixty minutes, and the minute hand 1112 fitted at the leading end thereof allows the minute in ordinary time to be indicated.

A second pinion 1124*b* is meshed with a minute wheel gear 1125*a*, and a minute pinion 1125*b* is meshed with the hour wheel 1126. The reduction ratio from the second pinion 1124*b* to the hour wheel 1126 is set at 1/12. The hour wheel 1126 makes one turn in twelve hours, and the hour hand 1111 fitted at the leading end thereof allows the hour in ordinary time to be indicated.

In FIGS. 2 and 3, the ordinary time section 1100 further comprises a winding stem 1128 that is fixed at one end to the crown 1101 and is fitted at the other end in a clutch wheel 1127, a setting wheel 1129, a winding stem positioning portion, and a setting lever 1130. The winding stem 1128 is structured to be drawn out stepwise by the crown 1101. A state in which the winding stem 1128 is not drawn out (zero stage) is an ordinary state. When the winding stem 1128 is drawn out to the first stage, the hour hand 1111 and the like are not stopped, and calendar correction is allowed. When the winding stem 1128 is drawn out to the second stage, the motion of the hands is stopped, and time correction is allowed.

When the winding stem 1128 is drawn out to the second stage by pulling the crown 1101, a reset signal input portion 1130*b* provided in the setting lever 1130 engaged with the winding stem positioning portion makes contact with a pattern formed on a circuit board having the IC 1702 mounted thereon, whereby the output of a motor pulse is stopped, and the motion of the hands is also stopped. In this case, the turn of the fourth wheel gear 1122*a* is regulated by a fourth setting portion 1130*a* provided in the setting lever 1130. When the winding stem 1128 is rotated together with the crown 1101 in this state, the rotation force is transmitted to the minute wheel 1125 via the sliding wheel 1127, the setting wheel 1129, and an intermediate minute wheel 1131. Since the second wheel gear 1124*a* is connected to the second pinion 1124*b* with a fixed sliding torque therebetween, even when the fourth wheel and pinion 1122 is regulated, the setting wheel 1129, the minute wheel 1125, the second pinion 1124*b*, and the hour wheel 1126 are allowed to turn. Since the minute hand 1112 and the hour hand 1111 are thereby turned, it is possible to set an arbitrary time.

In FIGS. 2 and 3, the chronograph section 1200 includes a train of wheels, a CG (chronograph) intermediate 1/10-second wheel 1231 and a CG 1/10-second wheel 1232. The CG 1/10-second wheel 1232 is placed at the center of the one-second indicator 1230. The structure of these train wheels allows 1/10-second indication in the chronograph at 9 o'clock position of the watch body.

In FIGS. 2 and 3, the chronograph section 1200 also includes a train of wheels, a CG first intermediate second wheel 1221, a CG second intermediate second wheel 1222, and a CG second wheel 1223. The CG second wheel 1223 is placed at the center of the sixty-minute indicator 1220. The structure of these train wheels allows second indication in the chronograph at 12 o'clock position of the watch body.

In FIGS. 2 and 3, the chronograph section 1200 also includes a train of wheels, a CG first intermediate minute wheel 1211, a CG second intermediate minute wheel 1212, a CG third intermediate minute wheel 1213, a CG fourth intermediate minute wheel 1214, a CG intermediate hour wheel 1215, a CG minute wheel 1216, and a CG hour wheel 1217. The CG minute wheel 1216 and the CG hour wheel 1217 are coaxially placed at the center of the 12-hour indicator 1220. The structure of the train wheels allows hour and minute indication in the chronograph at 3 o'clock position of the watch body.

Figure 5:
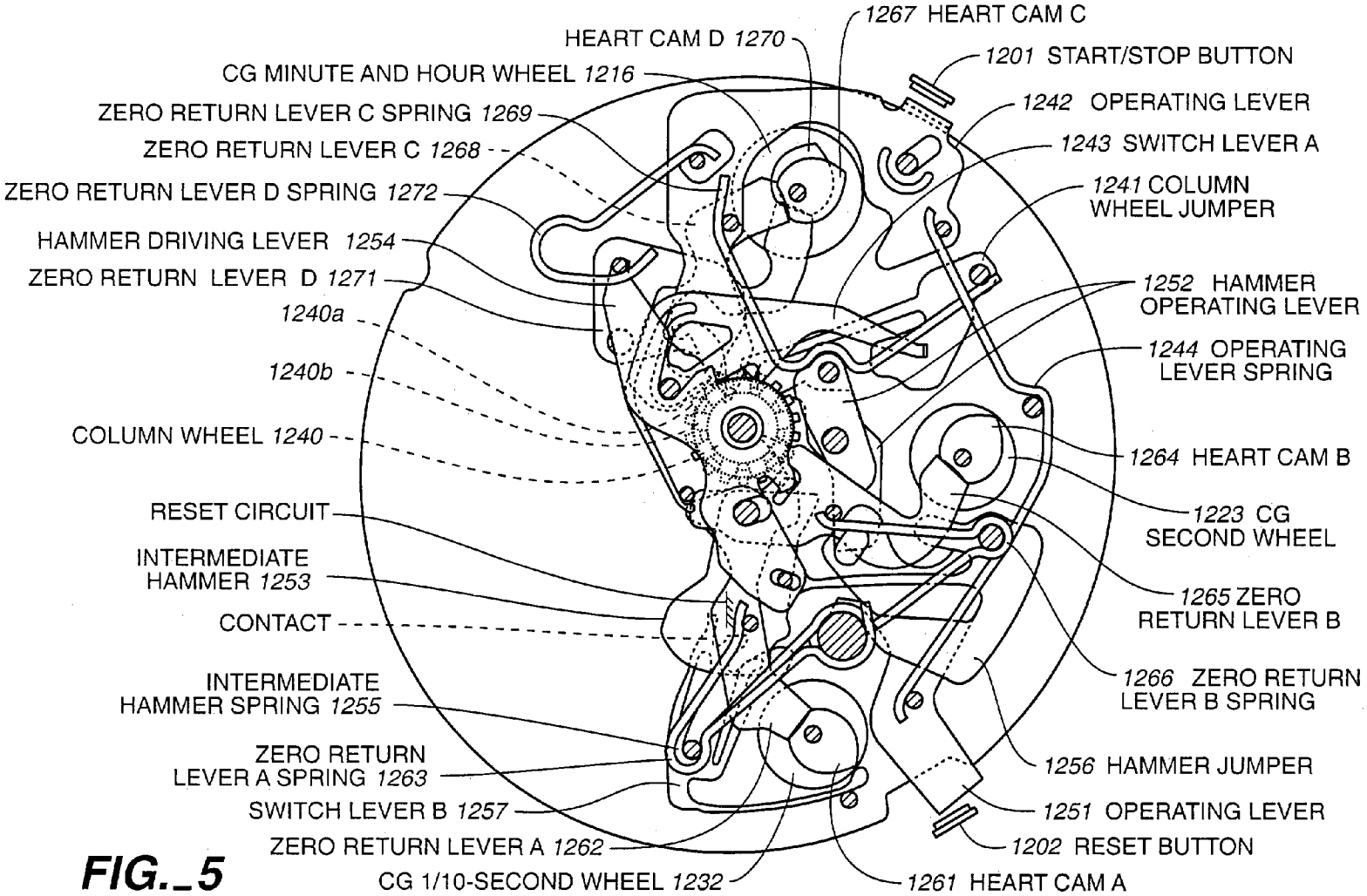
FIG. 5 is a schematic plan view showing an example of a structure of start/stop and reset (return to zero) operating mechanisms in a chronograph section in the electronic timepiece shown in FIG. 2.
Figure 6:
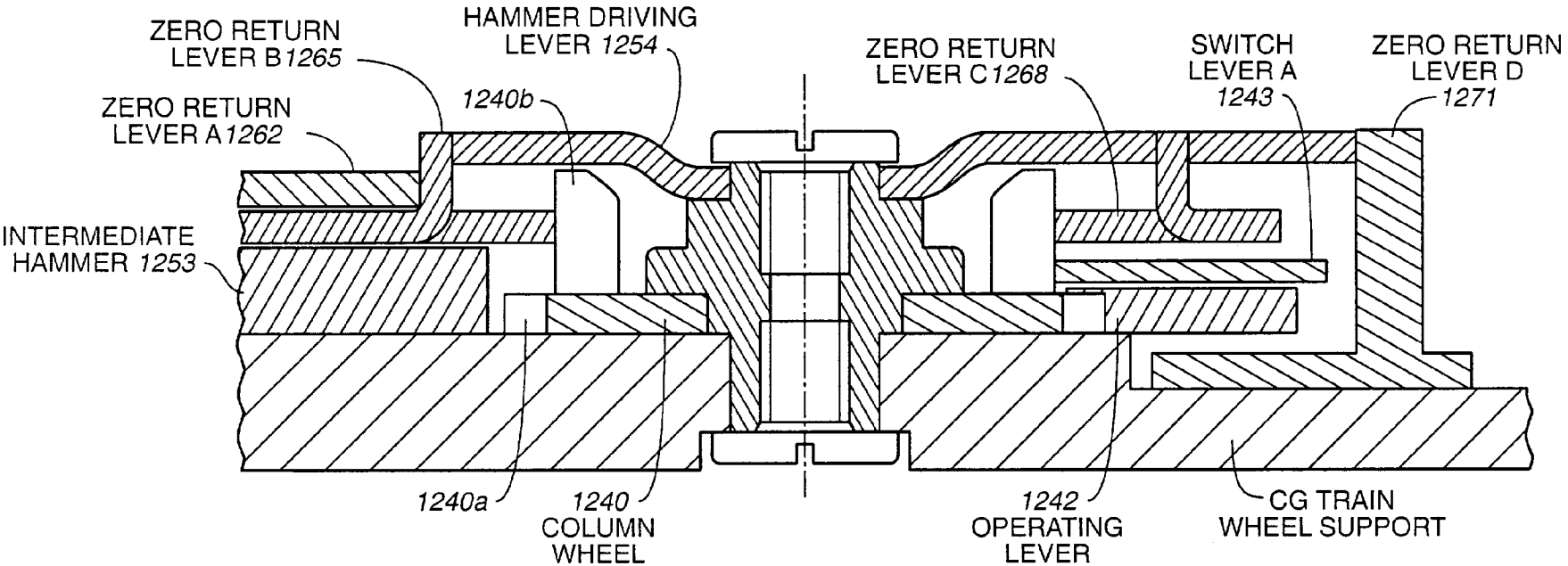
FIG. 6 is a schematic sectional side view showing an example of a structure of the principal part of the start/stop and reset (return to zero) operating mechanisms in the chronograph section shown in FIG. 5.

FIG. 5 is a plan view schematically showing an example of the structure of start/stop and reset operating mechanisms in the chronograph section 1200, as viewed from the side of a rear cover of the watch. FIG. 6 is a sectional side view schematically showing an example of the structure of the principal part thereof. These figures show a reset state.

The start/stop and reset operating mechanisms in the chronograph section 1200 are placed on the movement shown in FIG. 3, in which start/stop and reset operations are mechanically performed by the rotation of a column wheel 1240 disposed at about the center of the movement. The column wheel 1240 is cylindrically formed. The column wheel 1240 has on its side face teeth 1240*a* arranged with a fixed pitch along the periphery, and has on one end face columns 1240*b* arranged with a fixed pitch along the periphery. The phase of the column wheel 1240 at rest is regulated by a column wheel jumper 1241 retained between the teeth 1240*a*, and the column wheel 1240 is turned counterclockwise by a column wheel turning portion 1242*d* disposed at the leading end of an operating lever 1242.

Figure 7:
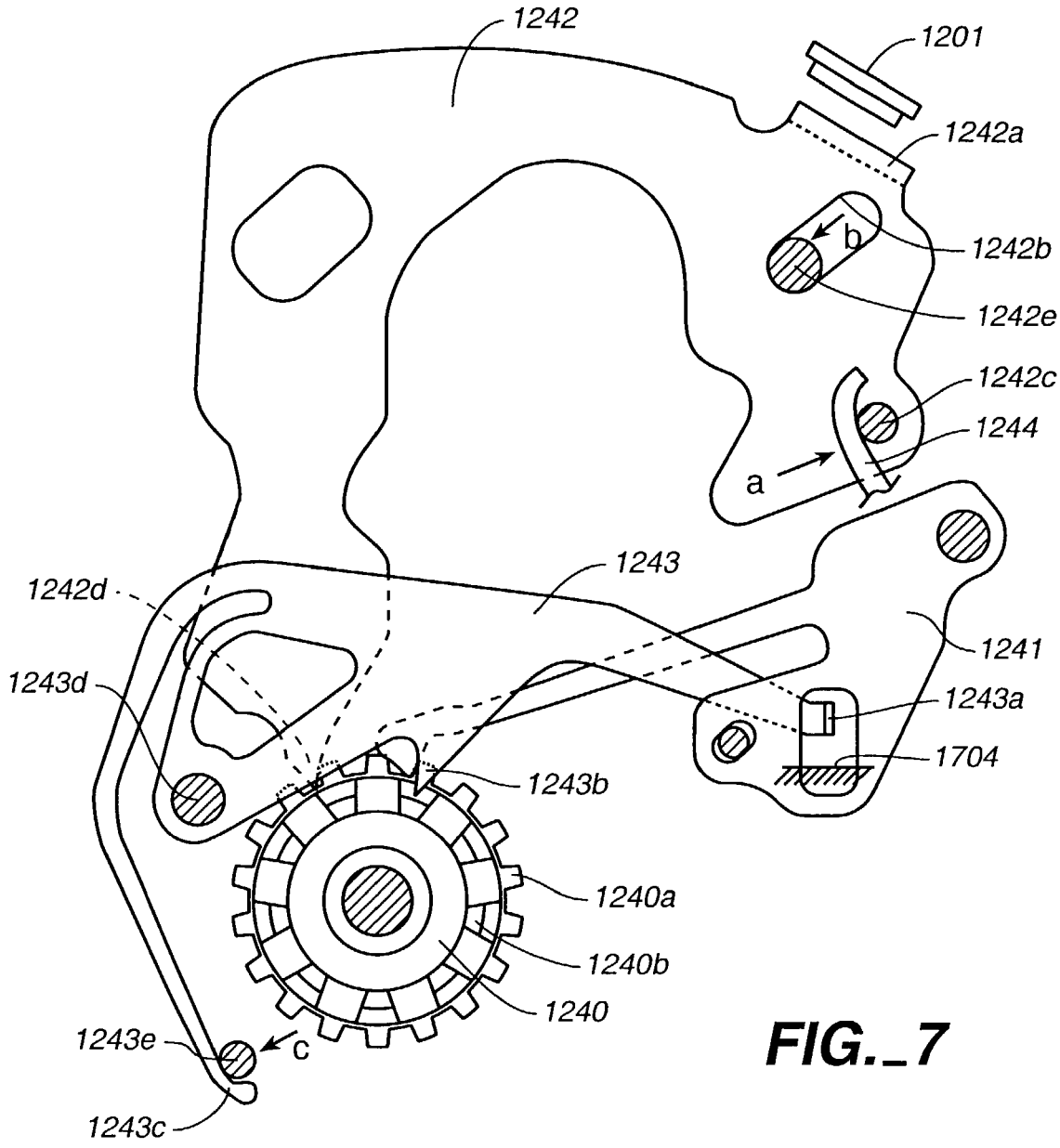
FIG. 7 is a first plan view showing an example of an operation of the start/stop operating mechanism in the chronograph section shown in FIG. 5.

The start/stop operating mechanism (first actuating section) is composed of the operating lever 1242, a switch lever A 1243, and an operating lever spring 1244, as shown in FIG. 7.

The operating lever 1242 is shaped like a substantially L-shaped flat plate. The operating lever 1242 has at one end a bent pressure portion 1242*a*, an elliptical through hole 1242*b*, and pin 1242*c*, and has at the other leading end an acute pressure portion 1242*d*. Such an operating lever 1242 is constructed as the start/stop operating mechanism by placing the pressure portion 1242*a* so as to face the start/stop button 1201, inserting a pin 1242*e* fixed to the movement into the through hole 1242*b*, retaining one end of the operating lever spring 1244 by the pin 1242*c*, and placing the pressure portion 1242*d* adjacent to the column wheel 1240.

The switch lever A 1243 is formed as a switch portion 1243*a* at one end, is provided with a planar projection 1243*b* at about the center thereof, and is formed as a retaining portion 1243*c* at the other end. Such a switch lever A 1243 is constructed as the start/stop operating mechanism by pivotally supporting about the center thereof by a pin 1243*d* fixed to the movement, placing the switch portion 1243*a* adjacent to a start circuit in a circuit board 1704, placing the projection 1243*b* into contact with the column 1240*b* provided in the axial direction of the cam wheel 1240, and retaining the retaining portion 1243*c* by a pin 1243*e* fixed to the movement. That is, the switch portion 1243*a* of the switch lever A 1243 makes contact with the start circuit of the circuit board 1704 so as to serve as a switch input. The switch lever A 1243 that is electrically connected to the secondary power source 1500 via the main plate 1701 and the like has the same potential as that of the positive pole of the secondary power source 1500.

An example of an operation of the start/stop operating mechanism having the above-described configuration when actuating the chronograph section 1200 will be described with reference to FIGS. 7 to 9.

While the chronograph section 1200 is in a stop state, as shown in FIG. 7, the operating lever 1242 is positioned in a state in which the pressure portion 1242*a* is separate from the start/stop button 1201, the pin 1242*c* is pressed by elastic force of the operating lever spring 1244 in the direction of the arrow "a" in the figure, and one end of the through hole 1242*b* is pressed by the pin 1242*e* in the direction of the arrow "b" in the figure. In this case, a leading end portion 1242*d* of the operating lever 1242 is positioned between the teeth 1240*a* of the cam wheel 1240.

The switch lever A 1243 is positioned while the projection 1243*b* is pushed up by the column 1240*b* of the cam wheel 1240 against the spring force of a spring portion 1243*c* formed at the end of the switch lever A 1243, and the retaining portion 1243*c* is pressed by the pin 1243*d* in the direction of the arrow "c" in the figure. At this time, the switch portion 1243*a* of the switch lever A 1243 is separate from the start circuit of the circuit board 1704, whereby the start circuit is electrically cut off.

Figure 8:
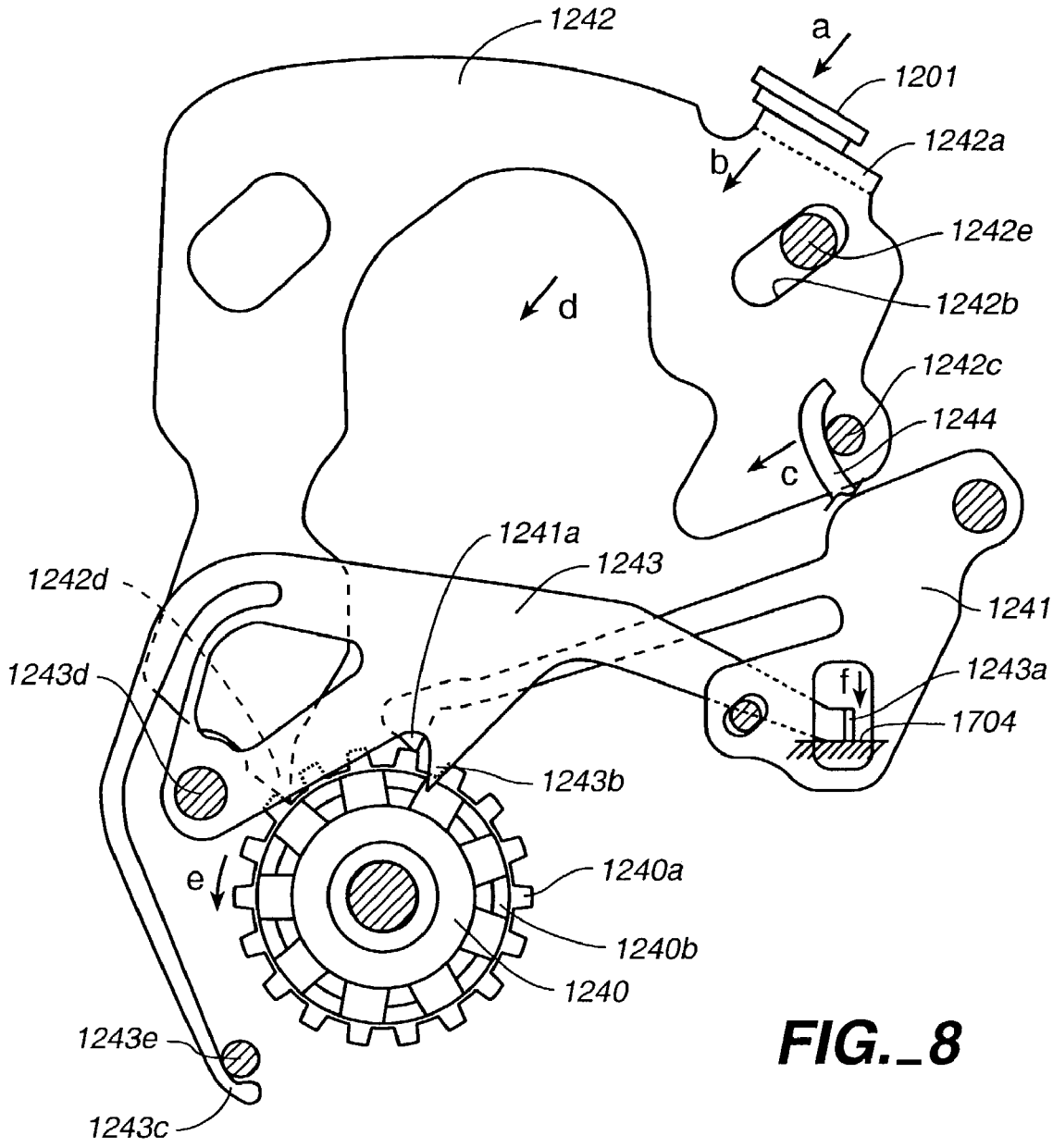
FIG. 8 is a second plan view showing an example of an operation of the start/stop operating mechanism in the chronograph section shown in FIG. 5.

As shown in FIG. 8, when the start/stop button 1201 is pushed in the direction of the arrow "a" in the figure in order to shift the chronograph section 1200 from this state to the start state, the pressure portion 1242*a* of the operating lever 1242 makes contact with the start/stop button 1201, and is pressed in the direction of the arrow "b" in the figure, and the pin 1242*c* presses and elastically deforms the operating lever spring 1244 in the direction of the arrow "c" in the figure. Therefore, the entire operating lever 1242 moves in the direction of the arrow "d" in the figure along the through hole 1242*b* and the pin 1242*e*. At this time, the leading end portion 1242*d* of the operating lever 1242 contacts and presses the side face of the tooth 1240*a* of the cam wheel 1240, thereby turning the cam wheel 1240 in the direction of the arrow "e" in the figure.

Simultaneously, when the side face of the column 1240*b* and the projection 1243*b* of the switch lever A 1243 are made out of phase by the turn of the cam wheel 1240, the projection 1243*b* reaches the gap between the columns 1240*b*, and is put into the gap by restoring force of the spring portion 1243*c*. Since the switch portion 1243*a* of the switch lever A 1243 turns in the direction of the arrow "f" in the figure and makes contact with the start circuit of the circuit board 1704, the start circuit is placed into an electrically conductive state.

In this case, the leading end portion 1241*a* of the cam wheel jumper 1241 is pushed up by the tooth 1240*a* of the cam wheel 1240.

The above operation is continued until the teeth 1240*a* of the cam wheel 1240 are fed by one pitch.

Figure 9:
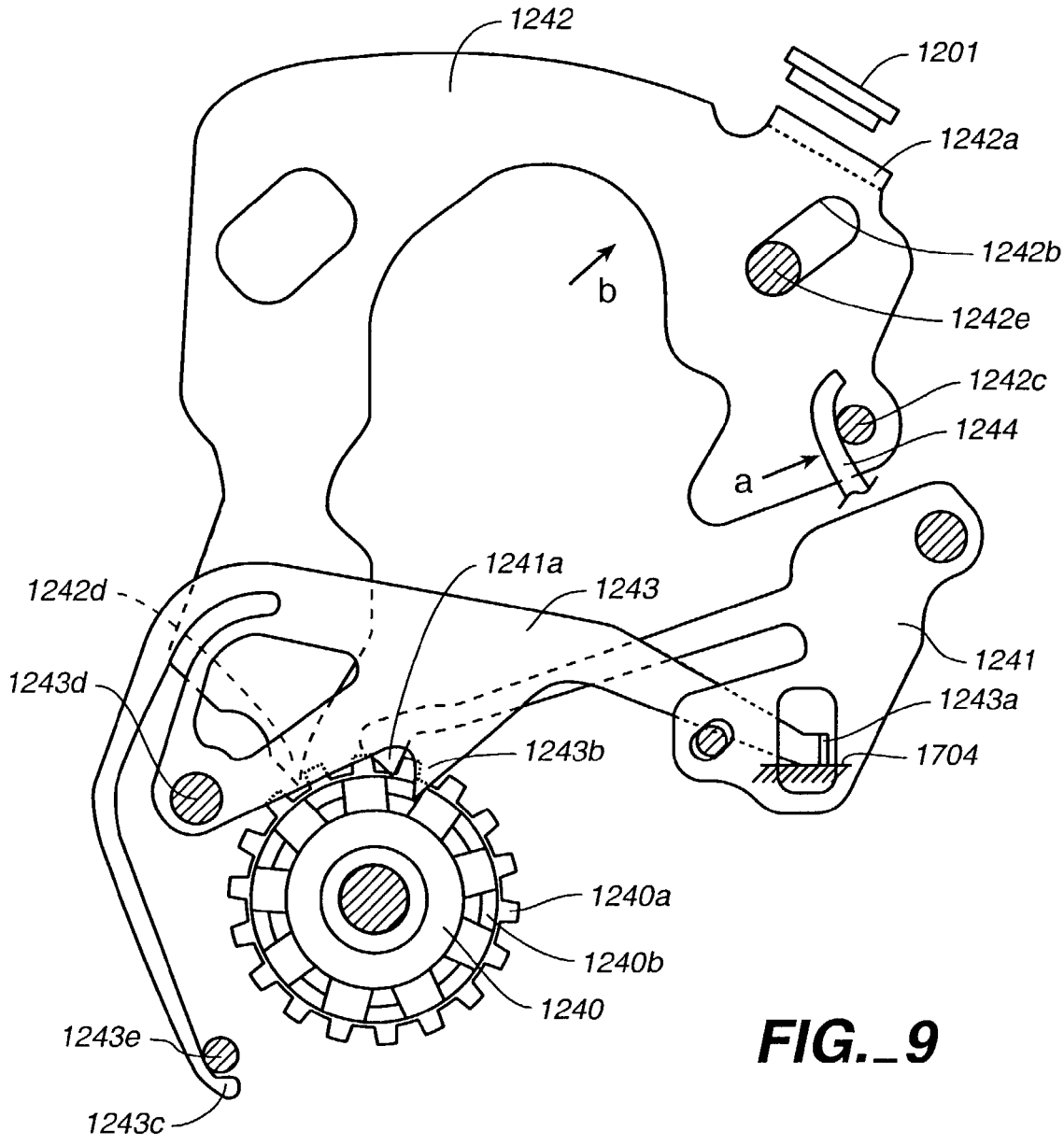
FIG. 9 is a third plan view showing an example of an operation of the start/stop operating mechanism in the chronograph section shown in FIG. 5.

Subsequently, when the hand is separated from the start/stop button 1201, the start/stop button 1201 automatically returns to its initial state by a spring built therein, as shown in FIG. 9. Then, the pin 1242*c* of the operating lever 1242 is pressed in the direction of the arrow "a" in the figure by restoring force of the operating lever spring 1244. Therefore, the entire operating lever 1242 moves along the through hole 1242*b* and the pin 1242*e* in the direction of the arrow "b" in the figure until one end of the through hole 1242*b* contacts the pin 1242*e*, and returns to the same position as shown in FIG. 7.

In this case, since the projection 1243*b* of the switch lever A 1243 remains inside the gap between the columns 1240*b* of the cam wheel 1240, the switch portion 1243*a* is in contact with the start circuit of the circuit board 1704, and the start circuit is held in the electrically conductive state. Therefore, the chronograph section 1200 is held in the start state.

At this time, the leading end portion 1241*a* of the cam wheel jumper 1241 is placed between the teeth 1240*a* of the cam wheel 1240, thereby regulating the phase of the cam wheel 1240 at rest in the turning direction.

In contrast, an operation similar to the above-described start operation is performed in order to stop the chronograph section 1200, and finally, the state shown in FIG. 7 is brought about again.

As described above, the start/stop of the chronograph section 1200 can be controlled by pivoting the operating lever 1242 by the operation of pushing the start/stop button 1201 so as to turn the cam wheel 1240 and to pivot the switch lever A 1243.

The reset operating mechanism (second actuating section) comprises, as shown in FIG. 5, the cam wheel 1240, an operating lever 1251, a hammer operating lever 1252, an intermediate hammer 1253, a hammer driving lever 1254, the operating lever spring 1244, an intermediate hammer spring 1255, a hammer jumper 1256, and a switch lever B

1257. The reset operating mechanism further comprises a heart cam A 1261, a zero return lever A 1262, a zero return lever A spring 1263, a heart cam B 1264, a zero return lever B 1265, a zero return lever B spring 1266, a heart cam C 1267, a zero return lever C 1268, a zero return lever C spring 1269, a heart cam D 1270, a zero return lever D 1271, and a zero return lever D spring 1272.

The reset operating mechanism in the chronograph section 1200 is structured so as not to operate while the chronograph section 1200 is in the start state, and so as to operate when the chronograph section 1200 is in the stop state. Such a mechanism is referred to as a "safety mechanism". First, the operating lever 1251, the hammer operating lever 1252, the intermediate hammer 1253, the operating lever spring 1244, the intermediate hammer spring 1255, and the hammer jumper 1256, which constitute the safety mechanism, will be described with reference to FIG. 10.

The operating lever 1251 is formed in the shape of a substantially Y-shaped flat plate. The operating lever 1251 has a pressure portion 1251*a* at one end, an elliptic through hole 1251*b* at one end of a fork, and a pin 1251*c* formed between the pressure portion 1251*a* and the through hole 1251*b*. Such an operating lever 1251 is constructed as the reset operating mechanism by placing the pressure portion 1251*a* to face the reset button 1202, inserting a pin 1252*c* of the hammer operating lever 1252 into the through hole 1251*b*, pivotally supporting the other fork by a pin 1251*d* fixed to the movement, and retaining the other end of the operating lever spring 1244 by the pin 1251*c*.

The hammer operating lever 1252 is composed of a first hammer operating lever 1252*a* and a second hammer operating lever 1252*b* shaped like a substantially rectangular flat plate, which overlap with each other and are pivotally supported by a shaft 1252*g* at about the center. The first hammer operating lever 1252*a* is provided with the pin 1252*c* at one end, and the second hammer operating lever 1252*b* is provided with pressure portions 1252*d* and 1252*e* at both ends. Such a hammer operating lever 1252 is constructed as the reset operating mechanism by inserting the pin 1252*c* in the through hole 1251*b* of the operating lever 1251, pivotally supporting the other end of the first hammer operating lever 1252*a* by a pin 1252*f* fixed to the movement, placing the pressure portion 1252*d* to face a pressure portion 1253*c* of the intermediate hammer 1253, and placing the pressure portion 1252*d* adjacent to the cam wheel 1240.

The intermediate hammer 1253 is shaped like a substantially rectangular flat plate. The intermediate hammer 1253 has pins 1253*a* and 1253*b* at one end and at the center, and one corner of the other end thereof is formed as a pressure portion 1253*c*. Such an intermediate hammer 1253 is constructed as the reset operating mechanism by retaining one end of the intermediate hammer spring 1255 by the pin 1253*a*, retaining one end of the hammer jumper 1256 by the pin 1253*b*, placing the pressure portion 1253*c* to face the pressure portion 1252*d* of the second hammer operating lever 1252*b*, and pivotally supporting the other corner at the other end by a pin 1253*d* fixed to the movement.

An example of an operation of the safety mechanism having the above-described configuration will be described with reference to FIGS. 10 to 13.

Figure 10:
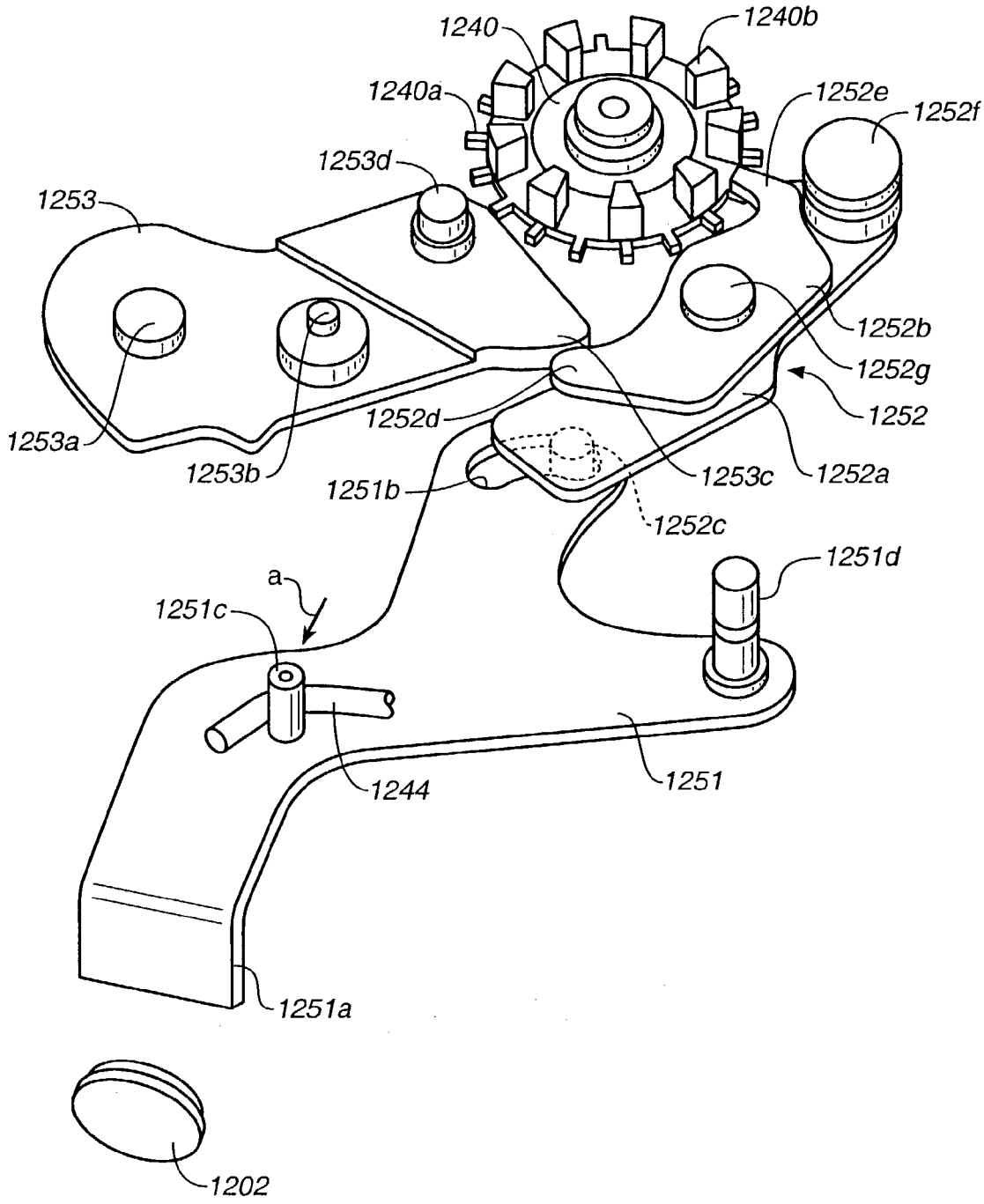
FIG. 10 is a first perspective view showing an example of an operation of a safety mechanism in the chronograph section shown in FIG. 5.
Figure 11:
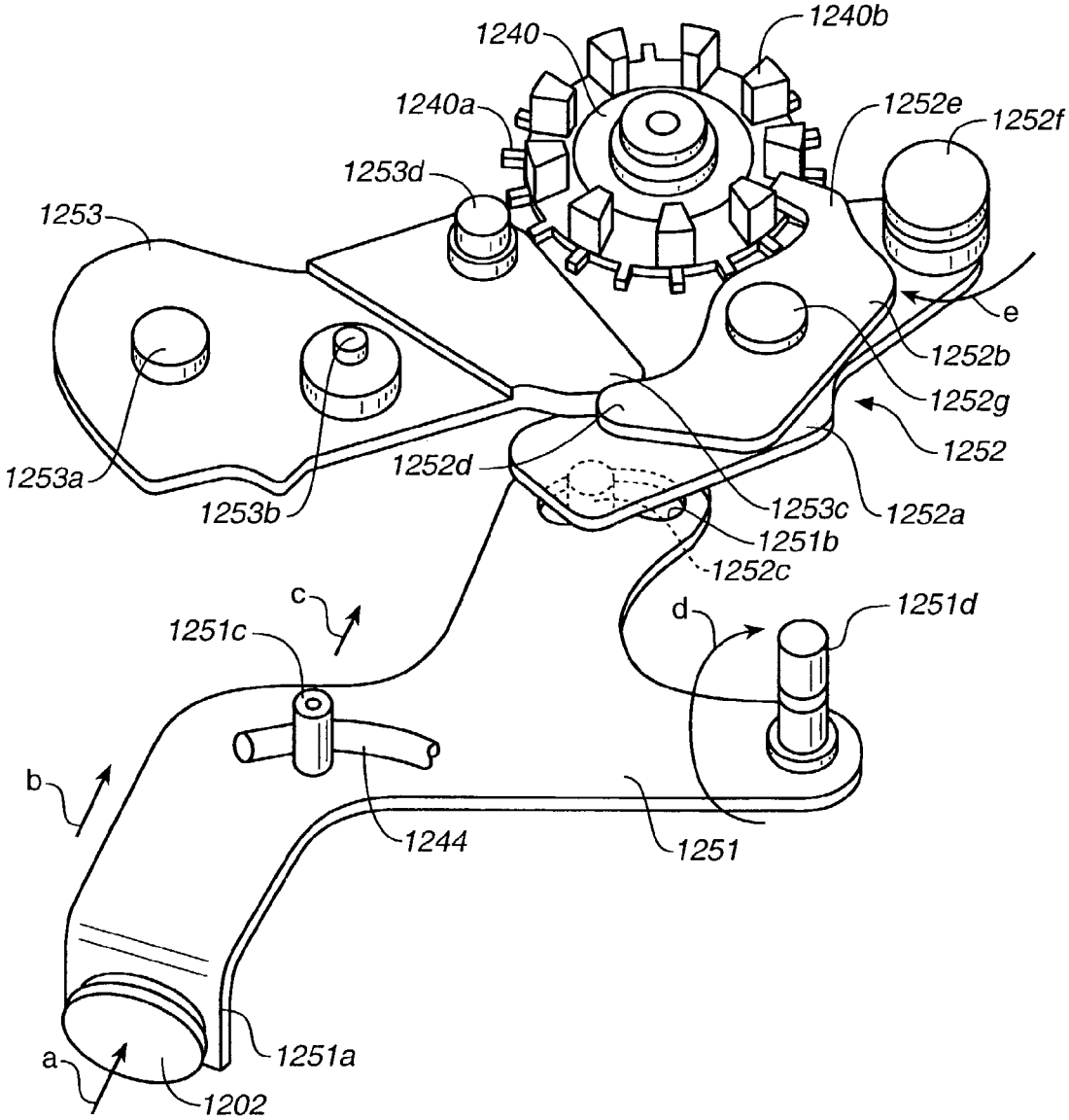
FIG. 11 is a second perspective view showing an example of an operation of the safety mechanism in the chronograph section shown in FIG. 5.

While the chronograph section 1200 is in the start state, the switch lever A 1243 that is electrically connected to the secondary power source in FIG. 10 has the same potential as that of the positive pole of the secondary power source 1500.

An example of an operation of the start/stop operating mechanism having the above-described configuration when actuating the chronograph section 1200 will be described with reference to FIGS. 7 to 9.

While the chronograph section 1200 is in a stop state, as shown in FIG. 7, the operating lever 1242 is positioned in a state in which the pressure portion 1242*a* is separate from the start/stop button 1201, the pin 1242*c* is pressed by elastic force of the operating lever spring 1244 in the direction of the arrow "a" in the figure, and one end of the through hole 1242*b* is pressed by the pin 1242*e* in the direction of the arrow "b" in the figure. In this case, a leading end portion 1242*d* of the operating lever 1242 is positioned between the teeth 1240*a* of the cam wheel 1240.

The switch lever A 1243 is positioned while the projection 1243*b* is pushed up by the column 1240*b* of the cam wheel 1240 against the spring force of a spring portion 1243*c* formed at the end of the switch lever A 1243, and the retaining portion 1243*c* is pressed by the pin 1243*d* in the direction of the arrow "c" in the figure. Even when the pressure portion 1252*d* makes contact with the pressure portion 1253*c* of the intermediate hammer 1253, since the second hammer operating lever 1252*b* turns on the shaft 1252*g* and the stroke is thereby absorbed, the pressure portion 1253*c* is not pressed by the pressure portion 1252*d*. Since operating force of the reset button 1202 is cut off at the hammer operating lever 1252 and is not transmitted to the intermediate hammer 1253 and the subsequent reset operating mechanism, which will be described later, even if the reset button 1202 is inadvertently pushed while the chronograph section 1200 is in the start state, the chronograph section 1200 is prevented from being reset.

Figure 12:
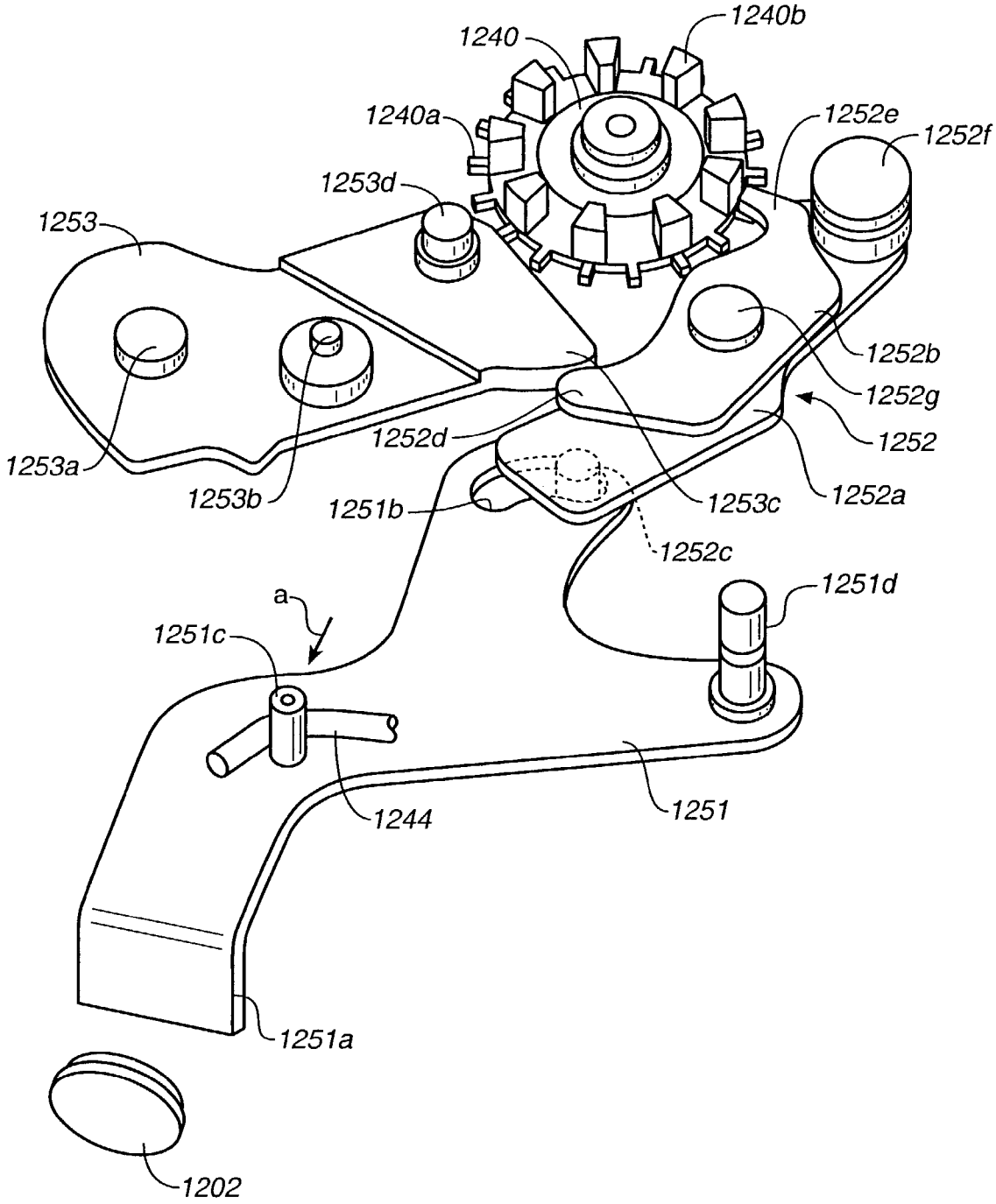
FIG. 12 is a third perspective view showing an example of an operation of the safety mechanism in the chronograph section shown in FIG. 5.

In contrast, while the chronograph section 1200 is in the stop state, as shown in FIG. 12, the operating lever 1251 is positioned in the state in which the pressure portion 1251*a* is separate from the reset button 1202, and the pin 1251*c* is pressed by the elastic force of the operating lever spring 1244 in the direction of the arrow a in the figure. At this time, the pressure portion 1252*e* of the second hammer operating lever 1252*b* is positioned outside the columns 1240*b* of the cam wheel. 1240.

Figure 13:
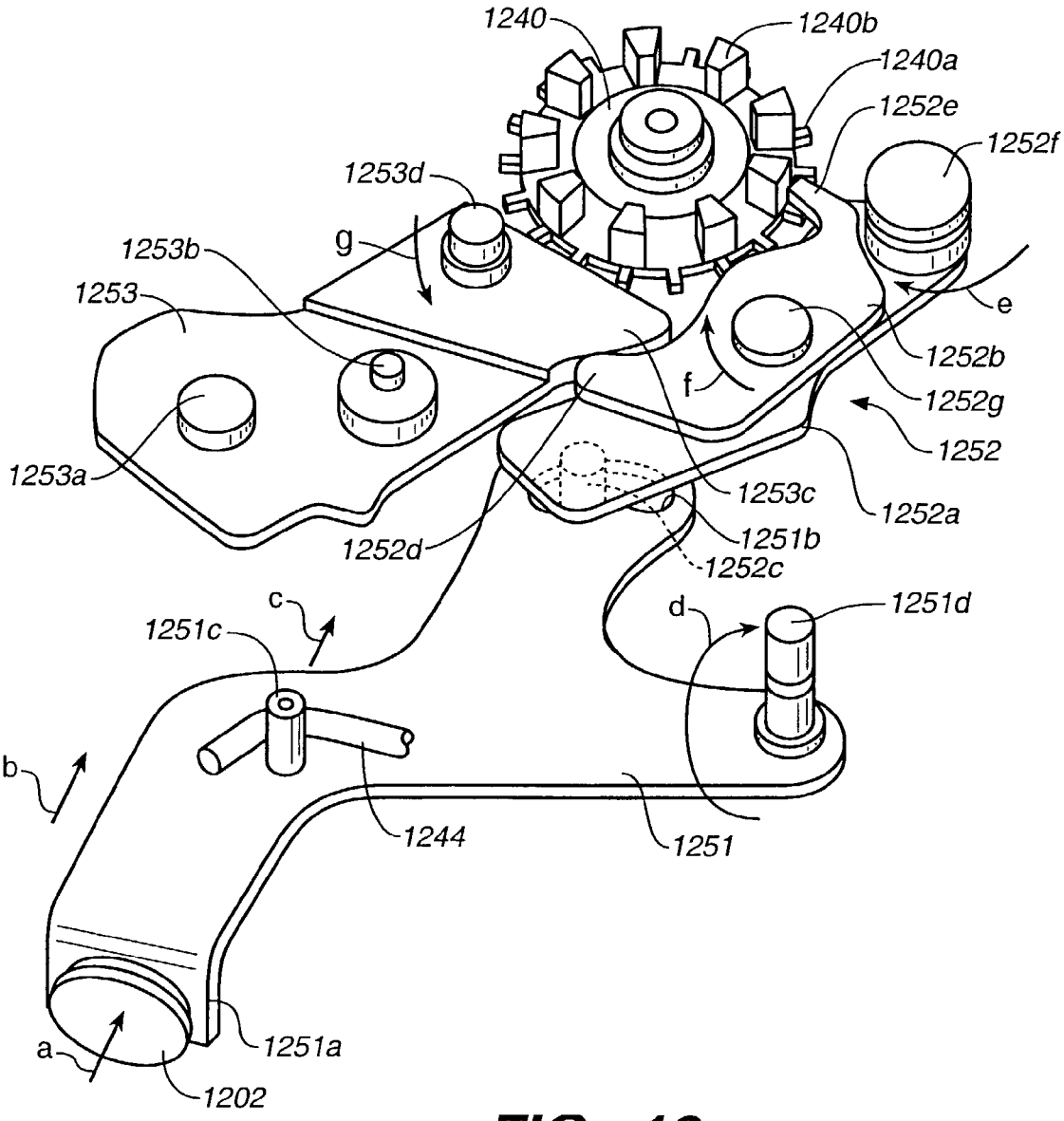
FIG. 13 is a fourth perspective view showing an example of an operation of the safety mechanism in the chronograph section shown in FIG. 5.

When the reset button 1202 is manually pushed in the direction of the arrow "a" in the figure, as shown in FIG. 13, the pressure portion 1251*a* of the operating lever 1251 contacts the reset button 1202 and is pressed in the direction of the arrow "b" in the figure, and the pin 1251*c* presses and elastically deforms the operating lever spring 1244 in the direction of the arrow "c" in the figure. Therefore, the entire operating lever 1251 turns on the pin 1251*d* in the direction of the arrow "d" in the figure. Since the pin 1252*c* of the first hammer operating lever 1252*a* is moved along the through hole 1251*b* with this turn, the first hammer operating lever 1252*a* turns on the pin 1252*f* in the direction of the arrow "e" in the figure.

In this case, since the pressure portion 1252*e* of the second hammer operating lever 1252*b* is stopped by the side face of the column 1240*b* of the cam wheel 1240, the second hammer operating lever 1252*b* turns on the shaft 1252*g* in the direction of the arrow "f" in the figure. Since the pressure portion 1252*d* of the second hammer operating lever 1252*b* contacts and presses the pressure portion 1253*c* of the intermediate hammer 1253 with this turn, the intermediate hammer 1253 turns on the pin 1253*d* in the direction of the arrow "g" in the figure. Since the operating force of the reset button 1202 is transmitted to the intermediate hammer 1253 and the reset operating mechanism, which will be described later, the chronograph section 1200 can be reset by pushing the reset button 1202 when it is in the stop state. When resetting is performed, a contact of the switch lever B 1257 makes contact with a reset circuit of the circuit board 1704, thereby electrically resetting the chronograph section 1200.

Next, description will be given of the hammer driving lever 1254, the heart cam A 1261, the zero return lever A 1262, the zero return lever A spring 1263, the heart cam B 1264, the zero return lever B 1265, the zero return lever B spring 1266, the heart cam C 1267, the zero return lever C 1268, the zero return lever C spring 1269, the heart cam D 1270, the zero return lever D 1271, and the zero return lever D spring 1272, which constitute the principal structure of the reset operating mechanism in the chronograph section 1200 shown in FIG. 5, with reference to FIG. 14.

The hammer driving lever 1254 is shaped like a substantially I-shaped flat plate. The hammer driving lever 1254 has an elliptic through hole 1254*a* at one end, a lever D restraining portion 1254*b* at the other end, and a lever B restraining portion 1254*c* and a lever C restraining portion 1254*d* at the center. Such a hammer driving lever 1254 is constructed as the reset operating mechanism by rotationally fixing the center thereof and inserting the pin 1253*b* of the intermediate hammer 1253 into the through hole 1254*a*. The heart cams A 1261, B 1264, C 1267, and D 1270 are fixed to the rotation shafts of the CG 1/10-second wheel 1232, the CG second wheel 1223, the CG minute wheel 1216, and the CG hour wheel 1217, respectively.

The zero return lever A 1262 is formed at one end as a hammer portion 1262*a* for hammering the heart cam A 1261, is provided with a turn regulating portion 1262*b* at the other end, and is provided with a pin 1262*c* at the center. Such a zero return lever A 1262 is constructed as the reset operating mechanism by pivotally supporting the other end by a pin 1253*d* fixed to the movement and retaining one end of the zero return lever A spring 1263 by the pin 1262*c*.

The zero return lever B 1265 is formed at one end as a hammer portion 1265*a* for hammering the heart cam B 1264, is provided at the other end with a turn regulating portion 1265*b* and a pressure portion 1265*c*, and is provided with a pin 1265*d* at the center. Such a zero return lever B 1265 is constructed as the reset operating mechanism by pivotally supporting the other end by the pin 1253*d* fixed to the movement and retaining one end of the zero return lever B spring 1266 by the pin 1265*d*.

The zero return lever C 1268 is formed at one end as a hammer portion 1268*a*for hammering the heart cam C 1267, is provided at the other end with a turn regulating portion 1268*b* and a pressure portion 1268*c*, and is provided with a pin 1268*d* at the center. Such a zero return lever C 1268 is constructed as the reset operating mechanism by pivotally supporting the other end by a pin 1268*e* fixed to the movement and retaining one end of the zero return lever C spring 1269 by the pin 1268*d*.

The zero return lever D 1271 is formed at one end as a hammer portion 1271*a* for hammering the heart cam D 1270, and is provided with a pin 1271*b* at the other end. Such a zero return lever D 1271 is constructed as the reset operating mechanism by pivotally supporting the other end by a pin 1271*c* fixed to the movement and retaining one end of the zero return lever D spring 1272 by the pin 1271*b*.

An example of an operation of the reset operating mechanism having the above-described configuration will be described with reference to FIGS. 14 and 15.

Figure 14:
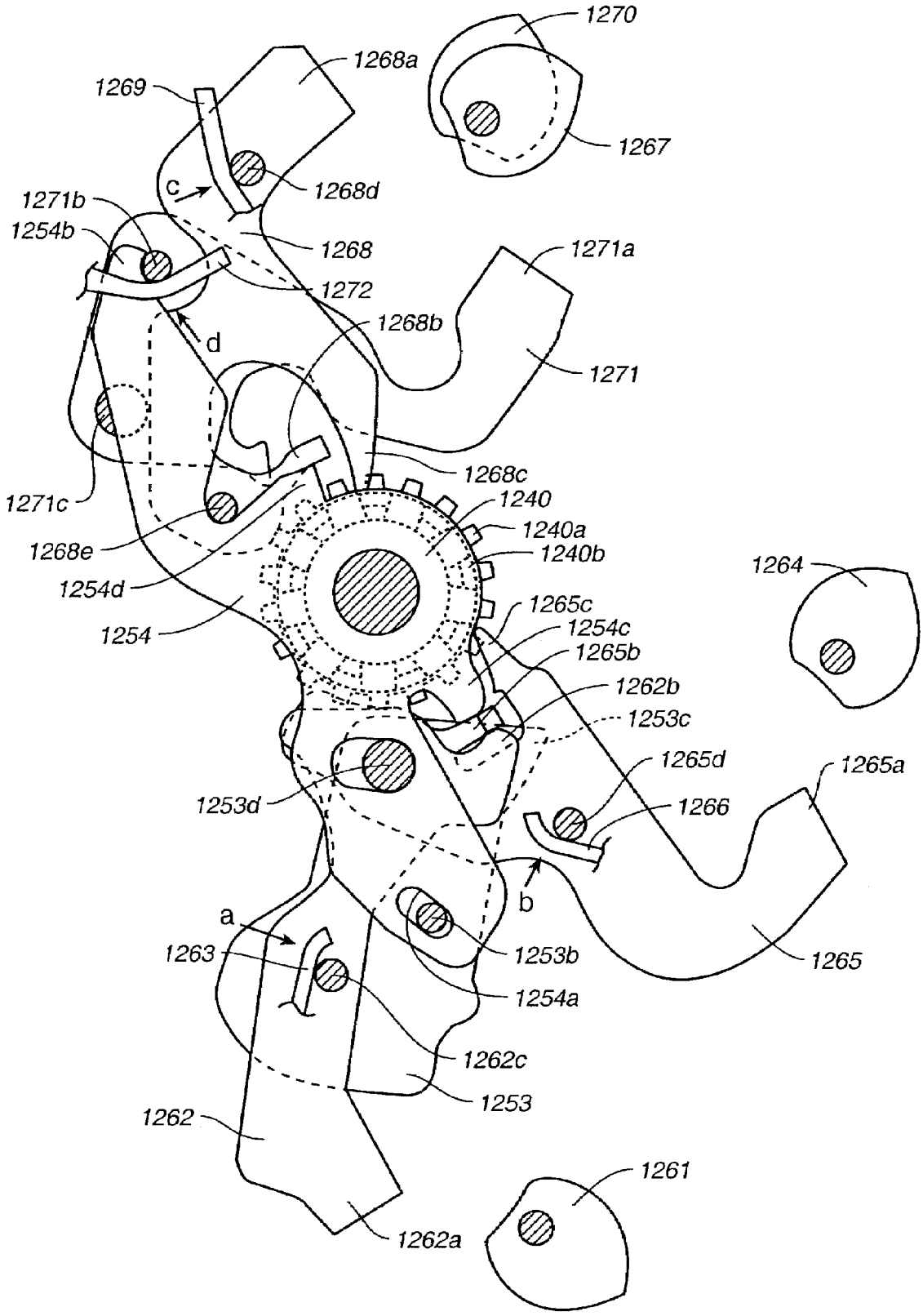
FIG. 14 is a first plan view showing an example of an operation of the principal mechanism of the reset operating mechanism in the chronograph section shown in FIG. 5.

When the chronograph section 1200 is in the stop state, as shown in FIG. 14, the zero return lever A 1262 is positioned while the turn regulating portion 1262*b* is retained by the turn regulating portion 1265*b* of the zero return lever B 1265, and the pin 1262*c* is pressed by the elastic force of the zero return lever A spring 1263 in the direction of the arrow "a" in the figure.

The zero return lever B 1265 is positioned while the turn regulating portion 1265*b* is retained by the lever B restraining portion 1254*c* of the hammer driving lever 1254, the pressure portion 1265*c* is pressed by the side face of the column 1240*b* of the cam wheel 1240, and the pin 1265*d* is pressed by the elastic force of the zero return lever B spring 1266 in the direction of the arrow "b" in the figure.

The zero return lever C 1268 is positioned while the turn regulating portion 1268*b* is retained by the lever C restraining portion 1254*d* of the hammer driving lever 1254, the pressure portion 1268*c* is pressed by the side face of the column 1240*b* of the cam wheel 1240, and the pin 1268*d* is pressed by the elastic force of the zero return lever C spring 1269 in the direction of the arrow "c" in the figure.

The zero return lever D 1271 is positioned while the pin 1271*b* is retained by the lever D restraining portion 1254*b* of the hammer driving lever 1254, and is pressed by the elastic force of the zero return lever D spring 1272 in the direction of the arrow "d" in the figure.

Therefore, the hammer portions 1262*a*, 1265*a*, 1268*a*, and 1271*a* of the zero return levers A1262, B 1265, C 1268, and D 1271 are respectively positioned at a predetermined distance from the heart cams A1261, B 1264, C 1267, and D 1270.

Figure 15:
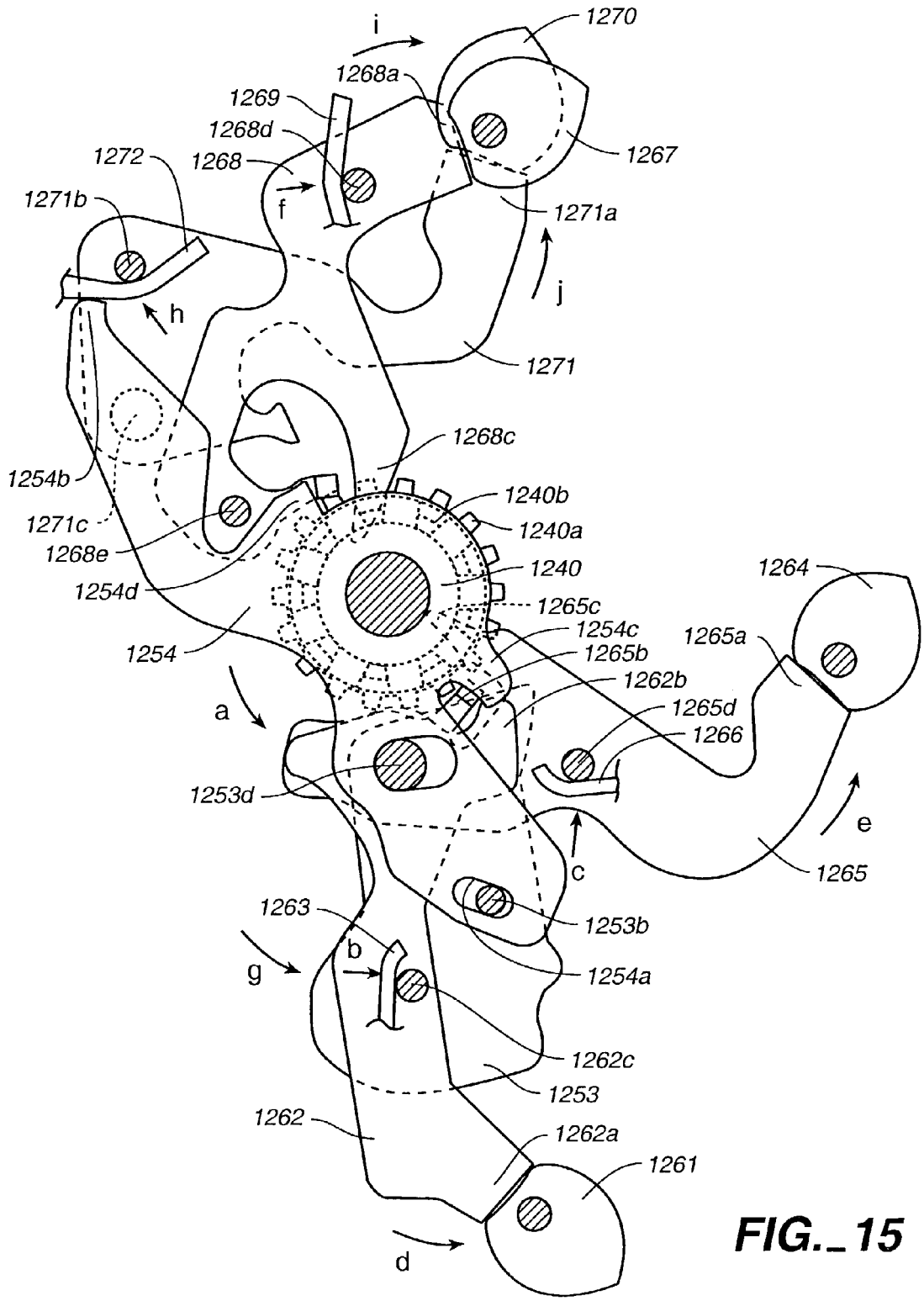
FIG. 15 is a second plan view showing an example of an operation of the principal mechanism of the reset operating mechanism in the chronograph section shown in FIG. 5.

When the intermediate hammer 1253 in this state turns on the pin 1253*d* in the direction of the arrow "g", as shown in FIG. 13, since the pin 1253*b* of the intermediate hammer 1253 moves inside the through hole 1254*a* of the hammer driving lever 1254 while pressing the through hole 1254*a*, as shown in FIG. 15, the hammer driving lever 1254 turns in the direction of the arrow "a" in the figure.

Then, the turn regulating portion 1265*b* of the zero return lever B 1265 is disengaged from the lever B restraining portion 1254*c* of the hammer driving lever 1254, and the pressure portion 1265*c* of the zero return lever B 1265 enters the gap between the columns 1240*b* of the cam wheel 1240. The pin 1265*d* of the zero return lever B 1265 is thereby pressed by the restoring force of the zero return lever B spring 1266 in the direction of the arrow "c" in the figure. Simultaneously, the regulation by the turn regulating portion 1262*b* is removed, and the pin 1262*c* of the zero return lever A 1262 is pressed by the restoring force of the zero return lever A spring 1263 in the direction of the arrow "b" in the figure. Therefore, the zero return lever A 1262 and the zero return lever B 1265 turn on the pin 1253*d* in the directions of the arrows "d" and "e" in the figure, and the hammer portions 1262*a* and 1265*a* hammer and turn the heart cams A1261 and B 1264, thereby returning the chronograph 1/10-second hand 1231 and the chronograph second hand 1221 to zero.

Simultaneously, the turn regulating portion 1268*b* of the zero return lever C 1268 is disengaged from the lever C restraining portion 1254*d* of the hammer driving lever 1254, the pressure portion 1268*c* of the zero return lever C 1268 enters the gap between the columns 1240*b* of the cam wheel 1240, and the pin 1268*d* of the zero return lever C 1268 is pressed by the restoring force of the zero return lever C spring 1269 in the direction of the arrow "f" in the figure. Furthermore, the pin 1271*b* of the zero return lever D 1271 disengages from the lever D restraining portion 1254*b* of the hammer driving lever 1254. Thereby, the pin 1271*b* of the zero return lever D 1271 is pressed by the restoring force of the zero return lever D spring 1272 in the direction of the arrow "h" in the figure. Therefore, the zero return lever C

1268 and the zero return lever D 1271 turn on the pins 1268*e* and 1271*c* in the directions of the arrows "i" and "j" in the figure, and the hammer portions 1268*a* and 1271*a* hammer and turn the heart cams C 1267 and D 1270, thereby returning the chronograph hour and minute hands 1211 and 1212 to zero.

According to a series of operations described above, while the chronograph section 1200 is in the stop state, it can be reset by pressing the reset button 1202.

Figure 16:
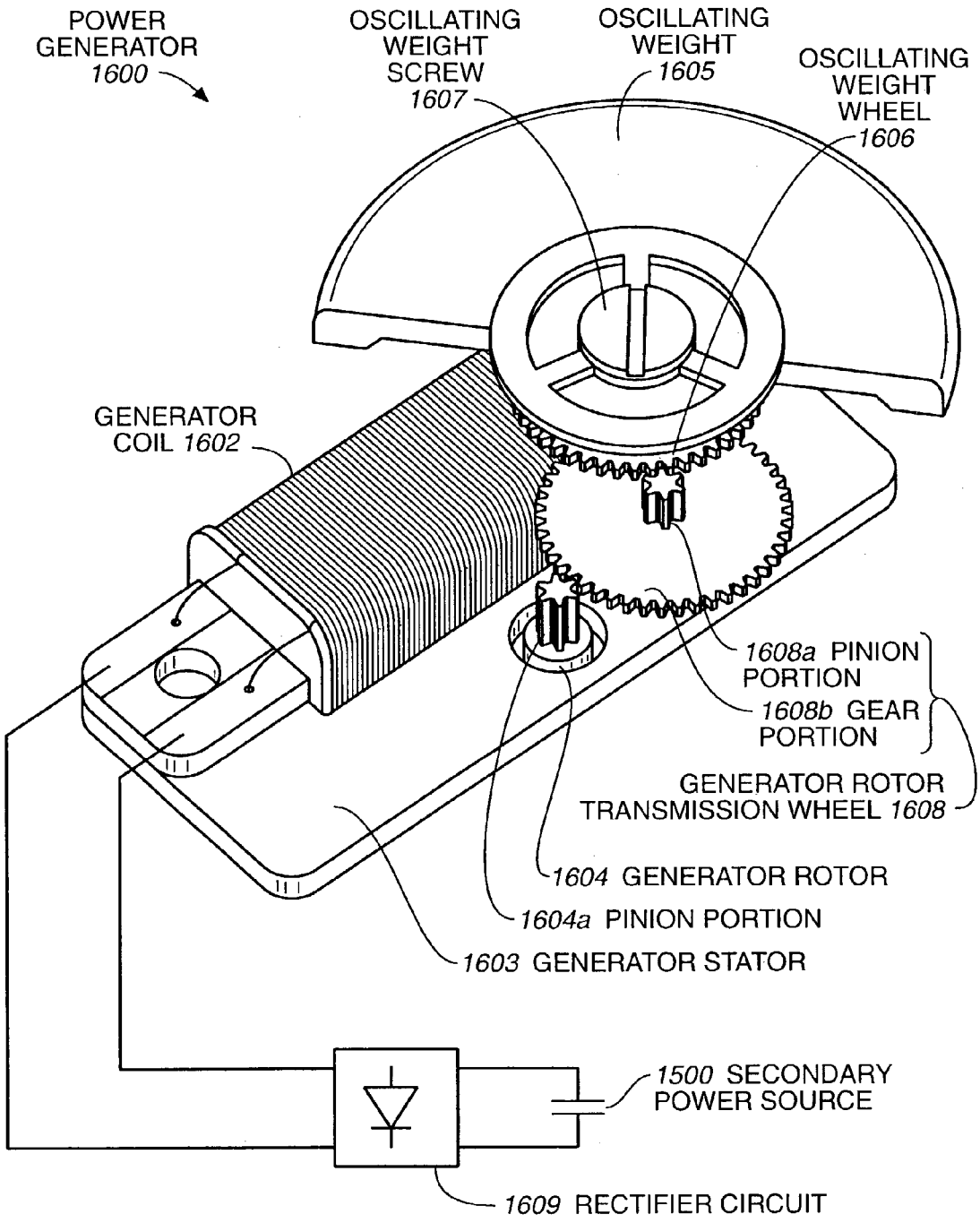
FIG. 16 is a schematic perspective view showing an example of a power generator used in the electronic timepiece shown in FIG. 1.

FIG. 16 is a schematic perspective view of an example of the power generator used in the electronic timepiece shown in FIG. 1.

The power generator 1600 comprises a generator coil 1602 formed on a high-permeability member, a generator stator 1603 made of a high-permeability material, a generator rotor 1604 composed of a permanent magnet and a pinion portion, a half-weight oscillating weight 1605, and the like.

The oscillating weight 1605 and an oscillating weight wheel 1606 disposed therebelow are rotationally supported by a shaft fixed to an oscillating weight support, and are prevented from falling off in the axial direction by an oscillating weight screw 1607. The oscillating weight wheel 1606 is meshed with a pinion portion 1608*a* of a generator rotor transmission wheel 1608, and a gear portion 1608*b* of the generator rotor transmission wheel 1608 is meshed with a pinion portion 1604*a* of the generator rotor 1604. The speed of this train of wheels is increased by approximately 30 times to 200 times. The speed increasing ratio may be freely set according to the performance of the power generator and the specifications of the watch.

In such a structure, when the oscillating weight 1605 is rotated by the action of the user's arm or by other means, the generator rotor 1604 rotates at high speed. Since the permanent magnet is fixed to the generator rotor 1604, the direction of a magnetic flux that interlinks the generator coil 1602 via the generator stator 1603 changes every time the generator rotor 1604 rotates, and alternating current is generated in the generator coil 1602 by electromagnetic induction. The alternating current is rectified by a rectifier circuit 1609, and is stored in the secondary power source 1500.

Figure 17:
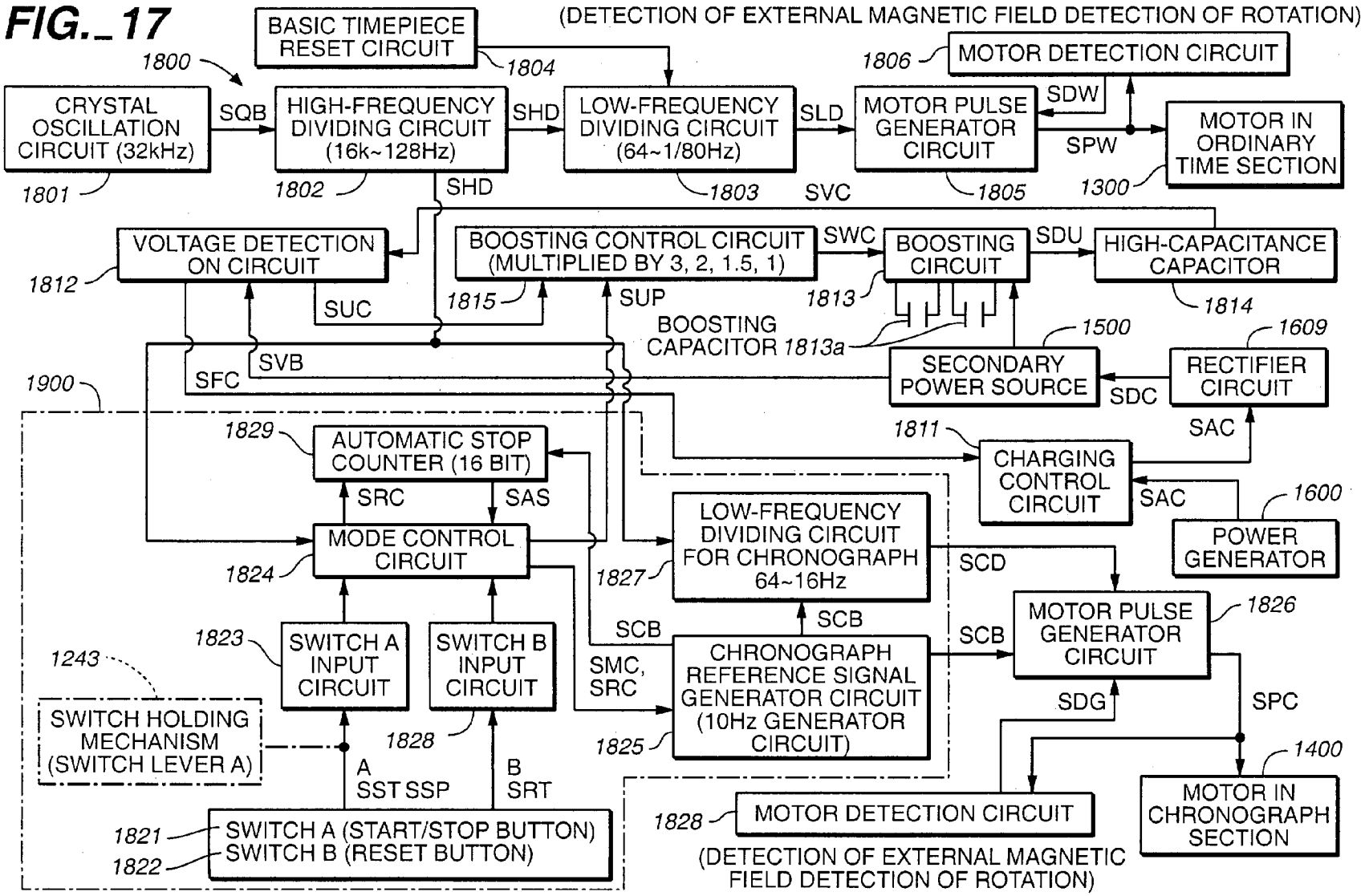
FIG. 17 is a schematic block diagram showing an example of a configuration of a control circuit used in the electronic timepiece shown in FIG. 1.
Figure 18:
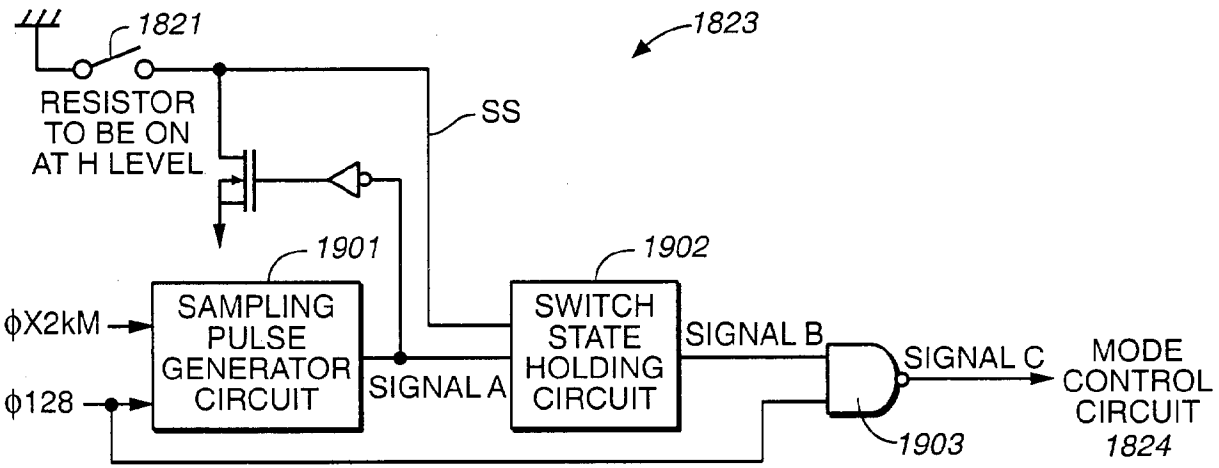
FIG. 18 is a block diagram showing an example of a configuration of the principal part of a control section in the control circuit shown in FIG. 17.

FIG. 17 is a schematic block diagram showing an example of the overall system configuration of the electronic timepiece shown in FIG. 1, excluding the mechanical section.

A signal SQB with, for example, an oscillation frequency of 32 kHz output from a crystal oscillating circuit 1801 including the tuning-fork crystal oscillator 1703 is input to a high-frequency dividing circuit 1802, where it is divided into frequencies of 16 kHz to 128 Hz. A signal SHD divided by the high-frequency dividing circuit 1802 is input to a low-frequency dividing circuit 1803, where it is divided into frequencies of 64 Hz to 1/80 Hz. The frequency generated by the low-frequency dividing circuit 1803 can be reset by a basic timepiece reset circuit 1804 connected to the low-frequency dividing circuit 1803.

A signal SLD divided by the low-frequency dividing circuit 1803 is input as a timing signal to a motor pulse generator circuit 1805. When the divided signal SLD becomes active, for example, every second or every 1/10 second, pulses SPW for motor driving and for detecting the motor rotation and the like are generated. The motor driving pulse SPW generated by the motor pulse generator circuit 1805 is supplied to the motor 1300 in the ordinary time section 1100, and the motor 1300 in the ordinary time section 1100 is thereby driven. With a timing different therefrom, the pulse SPW for detecting the motor rotation or the like is supplied to a motor detector circuit 1806, and the external magnetic field of the motor 1300 and the rotation of the rotor in the motor 1300 are detected. External magnetic field detection and rotation detection signals SDW detected by the motor detector circuit 1806 are fed back to the motor pulse generator circuit 1805.

An alternating voltage SAC generated by the power generator 1600 is input to the rectifier circuit 1609 via a charging control circuit 1811, is converted into a DC voltage SDC by, for example, full-wave rectification, and is stored in the secondary power source 1500. A voltage SVB between both ends of the secondary power source 1500 is detected by a voltage detection circuit 1812 continuously or on demand. According to the excessive or deficient state of the charge amount in the secondary power source 1500, a corresponding charging control command SFC is input to the charging control circuit 1811. Based on the charging control command SFC, the stop and start of supply of the AC voltage SAC generated by the power generator 1600 to the rectifier circuit 1609 are controlled.

On the other hand, the DC voltage SDC stored in the secondary power source 1500 is input to a boosting circuit 1813 including a boosting capacitor 1813*a*, where it is multiplied by a predetermined factor. A boosted DC voltage SDU is stored in the large-capacity capacitor 1814.

Boosting is performed so that the motors and the circuits reliably operate even when the voltage of the secondary power source 1500 falls below the operating voltage therefor. That is, both the motors and the circuits are driven by electric energy stored in the large-capacity capacitor 1814. When the voltage of the secondary power source 1500 increases to approximately 1.3 V, the large-capacity capacitor 1814 and the secondary power source 1500 are connected in parallel during use.

A voltage SVC between both ends of the large-capacity capacitor 1814 is detected by the voltage detection circuit 1812 continuously or on demand. According to the amount of electricity remaining in the large-capacity capacitor 1814, a corresponding boosting command SUC is input to a boosting control circuit 1815. The boosting factor SWC of the boosting circuit 1813 is controlled based on the boosting command SUC. The boosting factor is a multiple by which the voltage of the secondary power source 1500 is multiplied to be generated in the large-capacity capacitor 1814, and is controlled to be a multiple, such as 3, 2, 1.5, or 1, expressed by dividing the voltage of the large-capacity capacitor 1814 by the voltage of the secondary power source 1500.

A start signal SST, a stop signal SSP, or a reset signal SRT from a switch A 1821 accompanying the start/stop button 1201 and a switch B 1822 accompanying the reset button 1202 is input to a mode control circuit 1824 for controlling the modes in the chronograph section 1200 via a switch A input circuit 1823 for determining whether the start/stop button 1201 has been pressed, or a switch B input circuit 1828 for determining whether the reset button 1202 has been pressed. The switch A 1821 includes the switch lever A 1243 serving as a switch holding mechanism, and the switch B 1822 includes the switch lever B 1257.

A signal SHD divided by the high-frequency dividing circuit 1802 is also input to the mode control circuit 1824. In response to a start signal SST, a start/stop control signal SMC is output from the mode control circuit 1824. In response to the start/stop control signal SMC, a chronograph reference signal SCB generated by a chronograph reference signal generator circuit 1825 is input to a motor pulse generator circuit 1826.

On the other hand, a chronograph reference signal SCB generated by the chronograph reference signal generator circuit 1825 is also input to a chronograph low-frequency dividing circuit 1827, and a signal SHD divided by the high-frequency dividing circuit 1802 is divided into frequencies of 64 Hz to 16 Hz in synchronization with the chronograph reference signal SCB. A signal SCD divided by the chronograph low-frequency circuit 1827 is input to the motor pulse generator circuit 1826.

The chronograph reference signal SCB and the divided signal SCD are input as timing signals to the motor pulse generator circuit 1826. The divided signal SCD becomes active with an output timing of the chronograph reference signal SCB, for example, every 1/10 second or every second. In response to the divided signal SCD and the like, pulses SPC for motor driving and for detecting the motor rotation and the like are generated. The motor driving pulse SPC generated in the motor pulse generator circuit 1826 is supplied to the motor 1400 in the chronograph section 1200, and the motor 1400 in the chronograph section 1200 is thereby driven. The pulse SPC for detecting the motor rotation and the like is supplied to a motor detector circuit 1828 with a timing different therefrom, and the external magnetic field of the motor 1400 and the rotation of the rotor in the motor 1400 are detected. External magnetic field detection and rotation detection signals SDG detected by the motor detector circuit 1828 are fed back to the motor pulse generator circuit 1826.

A chronograph reference signal SCB generated by the chronograph reference signal generator circuit 1825 is also input to an automatic stop counter 1829 of, for example, 16 bits, and is counted. When the count reaches a predetermined value, that is, the measurement limit time, an automatic stop signal SAS is input to the mode control circuit 1824. In this case, a stop signal SSP is input to the chronograph reference signal generator circuit 1825, and the chronograph reference signal generator circuit 1825 is thereby stopped and reset.

When the stop signal SSP is input to the mode control circuit 1824, output of the start/stop control signal SMC is stopped, generation of the chronograph reference signal SCB is stopped, and driving of the motor 1400 in the chronograph section 1200 is stopped. After the generation of the chronograph reference signal SCB is stopped, that is, after the generation of a start/stop control signal SMC, which will be described later, is stopped, a reset signal SRT input to the mode control circuit 1824 is input as a reset control signal SRC to the chronograph reference signal generator circuit 1825 and the automatic stop counter 1829, the chronograph reference signal generator circuit 1825 and the automatic stop counter 1829 are reset, and the chronograph hands in the chronograph section 1200 are reset (returned to zero).

The control section 1900 in the control circuit 1800 shown in FIG. 1 comprises the switch A 1821, the switch B 1822, the switch A input circuit 1823, the switch B input circuit 1828, the mode control circuit 1824, the chronograph reference signal generator circuit 1825, and the automatic stop counter 1829. A detailed structure and an operation example of the switch A input circuit 1823 serving as the principal part of the present invention will be described with reference to FIGS. 18 to 21.

The switch A input circuit 1823 comprises a sampling pulse generating circuit (first circuit) 1901, a switch state holding circuit (second circuit) 1902, and a NAND circuit (third circuit) 1903.

Figure 19:
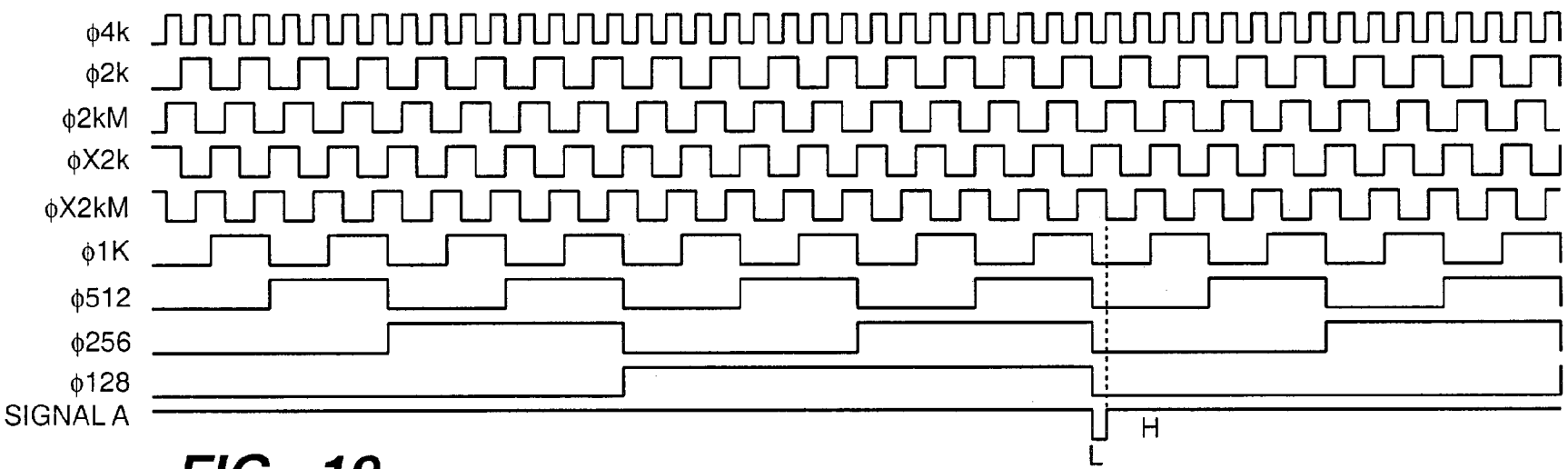
FIG. 19 is a circuit diagram of a switch input circuit in the control section shown in FIG. 17.

When signals (first and second pulse signals) SHD divided by the high-frequency dividing circuit 1802 and having different frequencies, for example, pulse signals of $\phi\times2$ kM and $\phi128$ divided as shown in FIG. 19, are input to the sampling pulse generating circuit 1901, the sampling pulse generating circuit 1901 outputs a signal (third pulse signal) as a sampling pulse that drops to the L level (first level) in response to the trailing edge of the pulse signal of $\phi128$ and that rises to the H level (second level) in response to the trailing edge of the pulse signal of $\phi\times2$ kM. Here, $\phi$ represents Hz, $\times$ represents inversion, and M represents half-wave shift.

The signal A from the sampling pulse generating circuit 1901 and a switch signal (actuation signal) SS from the switch A (first actuating section) 1821 are input to the switch state holding circuit 1902. The switch signal SS is pulled down while the signal A is high, is at the H level when the switch A 1821 is on, and is at the L level when the switch A 1821 is off. Therefore, the switch state holding circuit 1902 samples the switch signal SS based on the signal A, and outputs a signal B (fourth pulse signal) for holding the switch state, which rises to the H level on the rising edge of the signal A when the switch signal SS is high, and drops to the L level on the rising edge of the signal A when the switch signal SS is low, as shown in FIG. 20.

Figure 20:
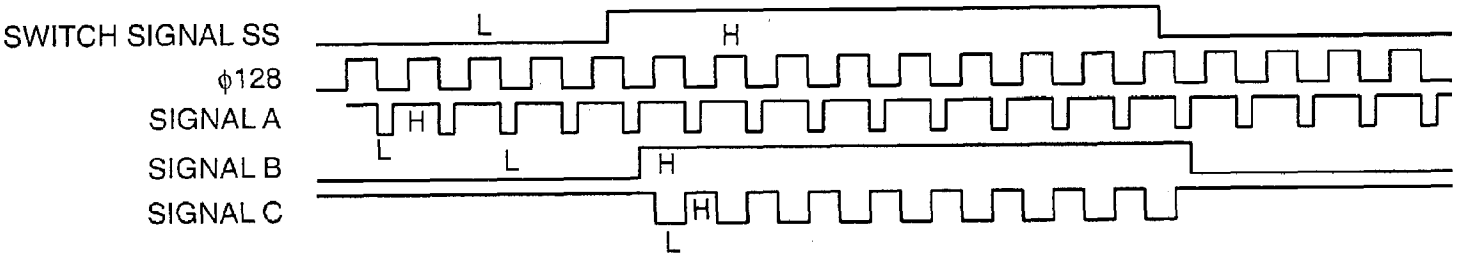
FIG. 20 is a timing chart showing signals in the portions of the switch input circuit shown in FIG. 19.

In response to the input of the signal B from the switch state holding circuit 1902 and a pulse signal of $\phi128$ from the high-frequency dividing circuit 1802 to the NAND circuit 1903, the NAND circuit 1903 outputs a signal C (fifth pulse signal) as a start signal SST/stop signal SSP, which is at the H level while the signal B is low, drops to the L level on the rising edge of the pulse signal of $\phi128$ and rises to the H level on the trailing edge of the pulse signal of $\phi128$ while the signal B is high, as shown in FIG. 20, and the NAND circuit 1903 inputs the signal C to the mode control circuit 1824.

Figure 21:
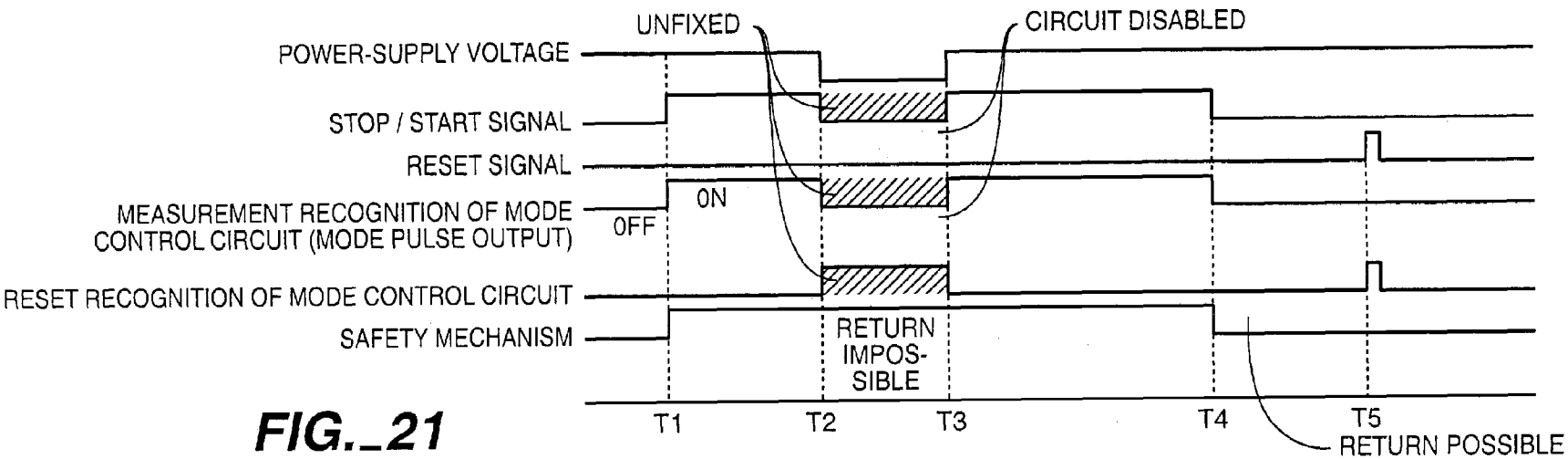
FIG. 21 is a timing chart showing examples of operations of the sections of the electronic timepiece shown in FIG. 1 according to the functions of the control section shown in FIG. 17.
Figure 22:
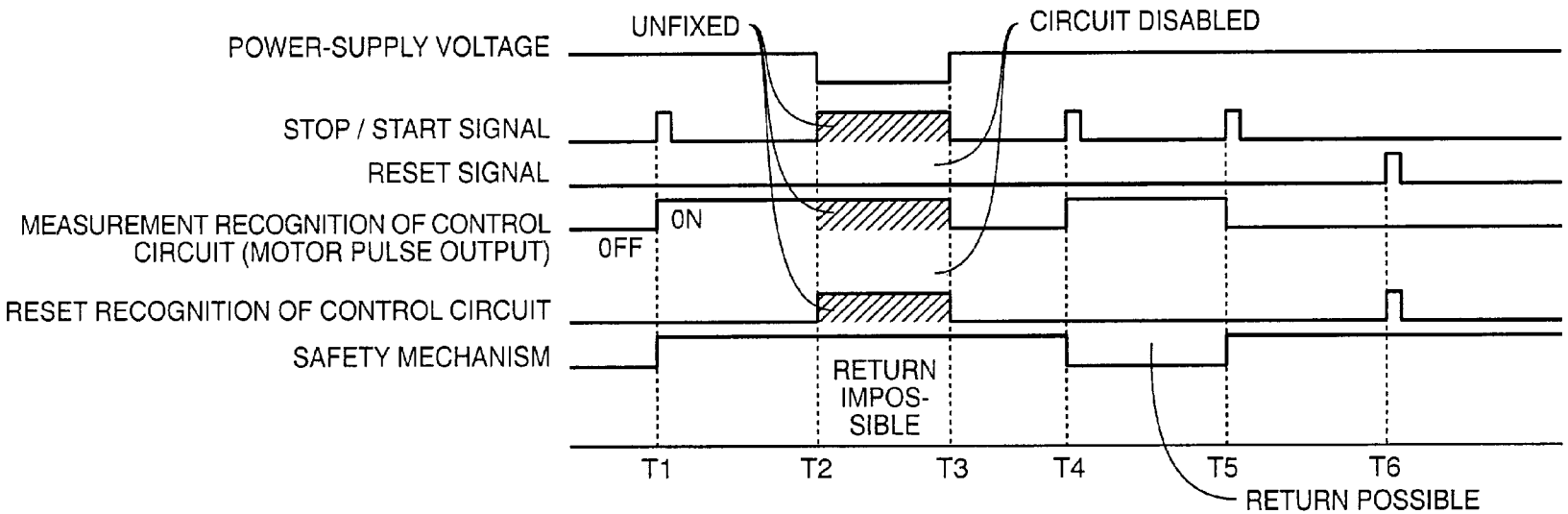
FIG. 22 is a timing chart showing examples of operations of the sections of an example of an electronic timepiece serving as a conventional time measurement device.

In such a structure, for example, as shown in FIG. 21, when the start/stop button 1201 is pushed and the switch A 1821 is turned on at a point T1, a H-level switch signal SS is input from the switch A 1821 to the switch state holding circuit 1902. Then, a signal B, which has risen to the H level on the rising edge of the signal A from the sampling pulse generating circuit 1901, is output from the switch state holding circuit 1902 to the NAND circuit 1903. Subsequently, a signal C, which drops to the L level on the rising edge of the pulse signal of $\phi128$ and rises to the H level on the trailing edge of the pulse signal of $\phi128$, is output from the NAND circuit 1903 to the mode control circuit 1824. Therefore, measurement recognition (motor pulse output) of the mode control circuit 1824 is put into an ON state, and the safety mechanism is put into a return impossible state.

After that, for example, when the power-supply voltage of the large-capacity capacitor 1814 falls at a point T2 below the operating voltage for the control circuit 1800 due to the voltage drop of the secondary power source 1500 depending on the power generating state of the power generator 1600, and the power-supply voltage of the secondary power source 1500 then recovers at a point T3 above the above operating voltage by being charged by the power generator 1600, the mode control circuit 1824 samples again the switch state of the start/stop button 1201, and thereby distinguishes between measurement and non-measurement, that is, a reset possible state and a reset impossible state. In this case, measurement recognition (motor pulse output) is held on, and the safety mechanism is also held in the return impossible state.

Accordingly, when the start/stop button 1201 is pushed and the switch A 1821 is turned off at a subsequent point T4, a switch signal SS at the L level is input from the switch A 1821 to the switch state holding circuit 1902. Then, a signal B, which has been lowered to the L level on the rising edge of the signal A from the sampling pulse generating circuit 1901, is output from the switch state holding circuit 1902 to the NAND circuit 1903. Furthermore, an H-level signal C is output from the NAND circuit 1903 to the mode control circuit 1824.

Therefore, measurement recognition (motor pulse output) by the mode control circuit 1824 is put into the OFF state, and the safety mechanism is put into the return possible state. Furthermore, when a reset signal is output by pushing the reset button at the subsequent point T5, reset recognition by the mode control circuit 1824 is turned on, and an return operation is performed.

In this way, even when the chronograph function abnormally stops, since the start/stop and reset operations of the chronograph allow recognition of the control circuit and the state of the safety mechanism to always coincide with each other, it is possible to prevent the returning operation from being performed during time measurement and from being disabled in a state in which time measurement is normally stopped.

The present invention is not limited to the above embodiment, and various modifications may be possible without departing from the scope of the claims.

For example, while the secondary power source 1500 to be charged by the power generator 1600 is used as a power source for the electronic timepiece 1000 in the above-described embodiment, a conventional power-supply battery, such as a button battery, may be used. Furthermore, a solar battery or a rechargeable battery may be used in addition to or instead of the power generator 1600.

While the power generator 1600 that generates power by the oscillating weight 1605 is used, for example, a power generator may be used that generates power by rotating a power generator using a torque produced by rewinding a spring by an external operating member, such as a crown.

Furthermore, while the single motor 1400 is provided in the chronograph section 1200, motors may be provided respectively for the hands in the chronograph section 1200.

While the electronic timepiece having the chronograph function of the analog display type has been described as a time measurement device, the present invention may be applied to any multifunctional clock of the analog display type, for example, a portable watch, a wristwatch, a table clock, or a wall clock.

As described above, according to the present invention, since the reset impossible state of the mechanical mechanism and the reset impossible state of the electrical function always coincide with each other, it is possible to prevent faulty operations, for example, of resetting during measurement of the elapsed time after the measurement of the elapsed time is abnormally stopped.

According to the present invention, even when the power-supply voltage recovers above the measurement operation voltage after measurement operation is stopped, it is possible to prevent faulty operation of return during subsequent measurement of elapsed time.

According to the present invention, it is possible to reset the mechanical mechanism after the electrical ON state of measurement of the elapsed time is switched to the OFF state by operating the actuating section for stopping the measurement of the elapsed time.

According to the present invention, it is possible to reset the mechanical mechanism after the electrical ON state of measurement of the elapsed time is switched to the OFF state by operating the actuating section for stopping the measurement of the elapsed time.

According to the present invention, since the return impossible state of the mechanical mechanism and the reset impossible state of the electrical function always coincide with each other, it is possible to prevent faulty operation of performing a return operation during driving of the hand after the driving of the hand is abnormally stopped.

According to the present invention, even when the power-supply voltage recovers above the hand driving voltage after hand driving is stopped, it is possible to prevent faulty operation of performing a return operation during subsequent hand driving.

According to the present invention, it is possible to return the hand to zero after switching a hand driving signal to a stop signal by the operation of the actuating section for stopping the hand driving in order to stop measurement of the elapsed time.

According to the present invention, it is possible to return the hand to zero after switching a hand driving signal to a stop signal by the operation of the actuating section for stopping the hand driving in order to stop measurement of the elapsed time.

According to the present invention, since the return impossible state of the mechanical mechanism and the reset impossible state of the electric control section always coincide with each other, it is possible to prevent faulty operation of returning the hand to zero by inadvertently pressing the second starting portion during driving of the hand after the driving of the hand abnormally stops.

According to the present invention, since the return impossible state of the mechanical mechanism and the reset impossible state of the electrical function always coincide with each other, it is possible to prevent faulty operation of returning the hand to zero by inadvertently pressing the second starting portion during driving of the hand after the driving of the hand abnormally stops.

According to the present invention, since the return impossible state of the mechanical mechanism and the reset impossible state of the electric control section always coincide with each other, it is possible to prevent faulty operation of returning the hand to zero by inadvertently pressing the second starting portion during driving of the hand after the driving of the hand abnormally stops.

According to the present invention, since the return impossible state of the mechanical mechanism and the reset impossible state of the electric control section always coincide with each other, even when the power-supply voltage recovers above the hand driving voltage after driving of the hand is stopped, it is possible to prevent faulty operation of returning the hand to zero during subsequent driving.

According to the present invention, it is possible to return the hand to zero after switching the hand driving signal to the stop signal by the operation of the first actuating section for stopping driving of the hand in order to stop measurement of the elapsed time.

According to the present invention, it is possible to return the hand to zero after switching the hand driving signal to the stop signal by the operation of the first actuating section for stopping driving of the hand in order to stop measurement of the elapsed time.

Since the present invention can be applied to, for example, a chronograph electronic timepiece so as to prevent faulty operation of returning the hand to zero during driving, it is possible to reliably prevent errors in collecting measurement data, and the like.

A preferred embodiment of the present invention will be described below with reference to the drawings.

Figure 23:
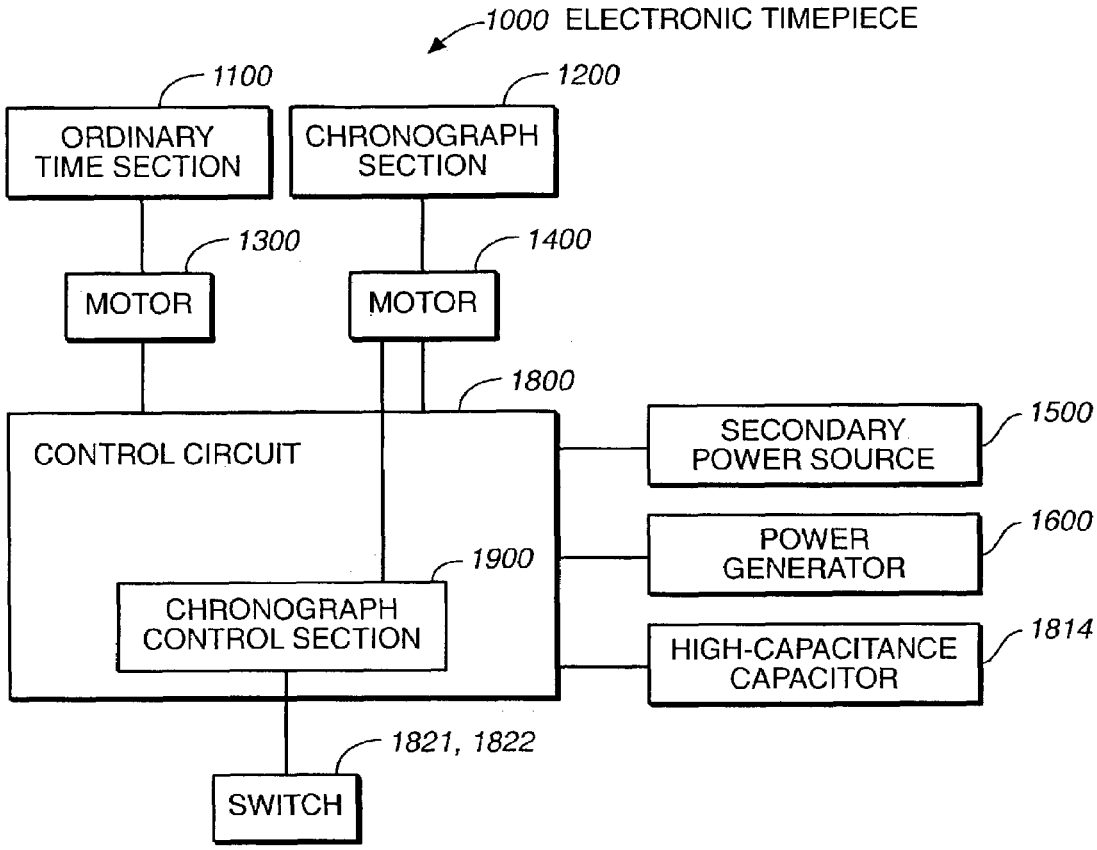
FIG. 23 is a schematic block diagram showing an electronic timepiece serving as a time measurement device according to an embodiment of the present invention.

FIG. 23 is a schematic block diagram showing an electronic timepiece serving as a time measurement device according to an embodiment of the present invention.

This electronic timepiece 1000 comprises two motors 1300 and 1400 for driving an ordinary time section 1100 and a chronograph section 1200, a large-capacity capacitor 1814 and a secondary power source 1500 for supplying electric power for driving the motors 1300 and 1400, a power generator 1600 for charging the secondary power source 1500, and a control circuit 1800 for controlling the overall watch. Furthermore, the control circuit 1800 includes a chronograph control section 1900 having switches 1821 and 1822 for controlling the chronograph section 1200 by a method that will be described later.

This electronic timepiece 1000 is an analog type of electronic timepiece having a chronograph function, in which the two motors 1300 and 1400 are separately driven by using electric power generated by the single power generator 1600 to move the hands in the ordinary time section 1100 and the chronograph section 1200. The chronograph section 1200 is not reset (returned to zero) by motor driving, but is mechanically reset, as will be described later.

Figure 24:
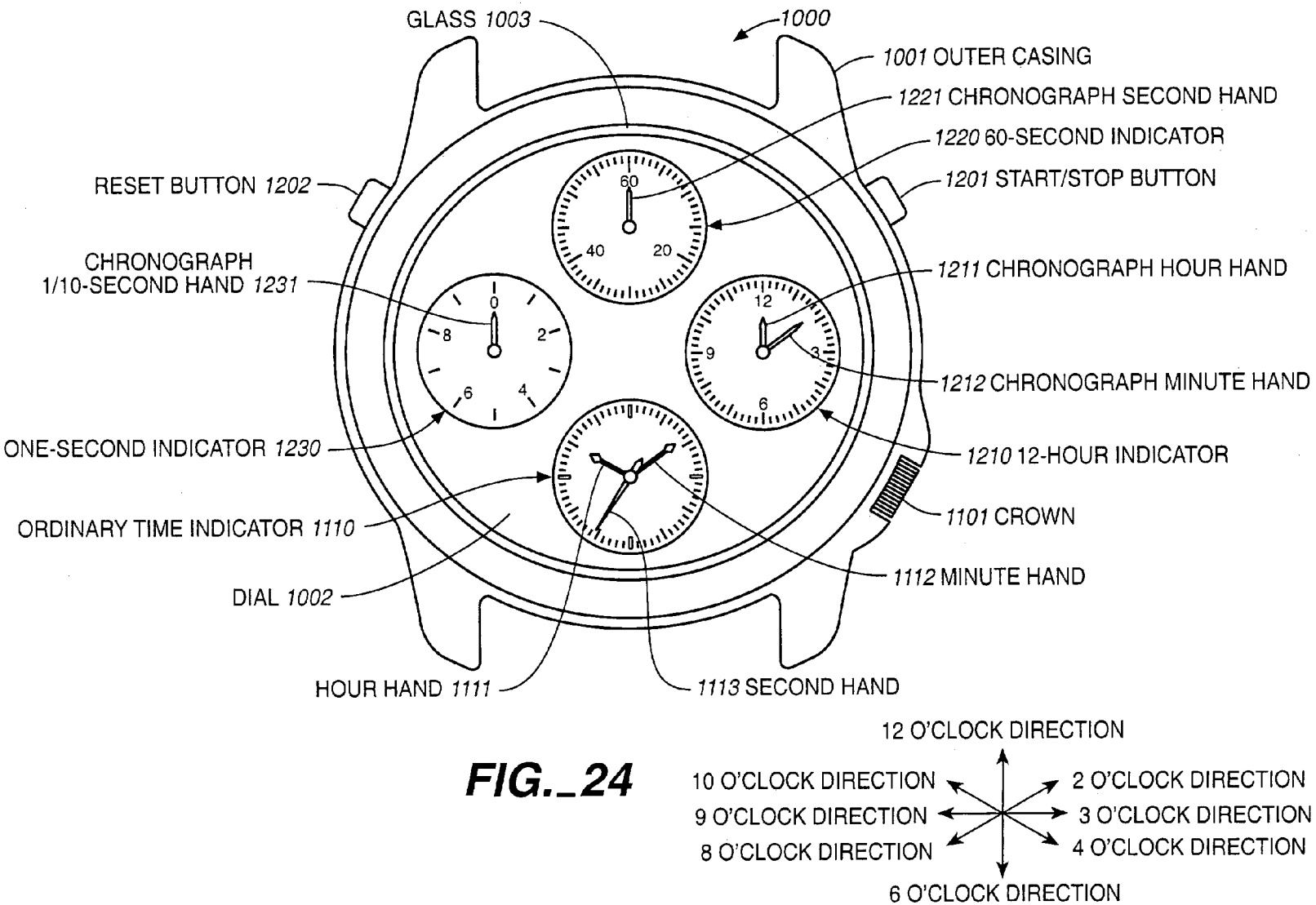
FIG. 24 is a plan view showing an example of the outward appearance of a finished article of the electronic timepiece shown in FIG. 23.

FIG. 24 is a plan view showing an example of the outward appearance of a completed article of the electronic timepiece shown in FIG. 23.

In this electronic timepiece 1000, a dial 1002 and a transparent glass 1003 are fitted inside an outer casing 1001. A crown 1101 serving as an external operating member is placed at 4 o'clock position of the outer casing 1001, and a start/stop button (first actuating section) 1201 and a reset button (second actuating section) 1202 for a chronograph are placed at 2 o'clock and 10 o'clock positions.

Furthermore, an ordinary time indicator 1110 having an hour hand 1111, a minute hand 1112, and a second hand 1113, which serve as ordinary time pointers, is placed at 6 o'clock position of the dial 1002, and indicators 1210, 1220, and 1230 having sub-hands for the chronograph are placed at 3 o'clock, 12 o'clock, and 9 o'clock positions. That is, the 12-hour indicator 1210 having chronograph hour and minute hands 1211 and 1212 is placed at 3 o'clock position, the 60-second indicator 1220 having a chronograph second hand 1221 is placed at 12 o'clock position, and a one-second indicator 1230 having a chronograph 1/10-second hand 1231 is placed at 9 o'clock position.

Figure 25:
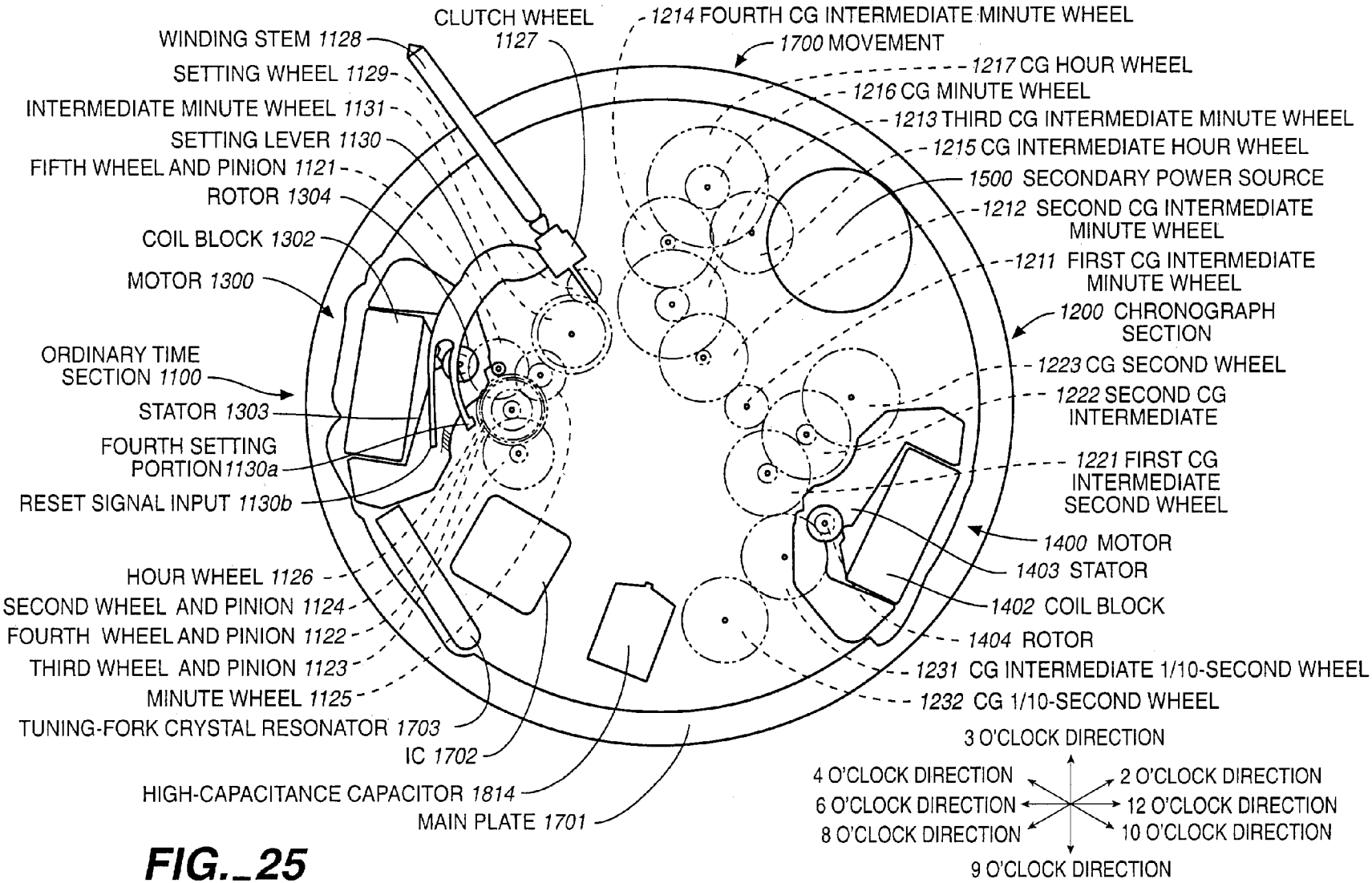
FIG. 25 is a plan view schematically showing an example of a structure of a movement in the electronic timepiece shown in FIG. 24, as viewed from the back side.

FIG. 25 is a plan view schematically showing an example of the structure of a movement in the electronic timepiece shown in FIG. 24.

In this movement 1700, the ordinary time section 1100, the motor 1300, and an IC 1702, a tuning-fork quartz resonator 1703, and the like are placed on 6 o'clock side of a main plate 1701, and the chronograph section 1200, the motor 1400, and the secondary power source 1500, such as a lithium-ion power source, are placed on 12 o'clock side.

The motors 1300 and 1400 are stepping motors, and include coil blocks 1302 and 1402 having magnetic cores made of a high-permeability material, stators 1303 and 1403 made of a high-permeability material, and rotors 1304 and 1404 composed of a rotor magnet and a rotor pinion.

The ordinary time section 1100 has a train of wheels, a fifth wheel and pinion 1121, a fourth wheel and pinion 1122, a third wheel and pinion 1123, a second wheel and pinion 1124, a minute wheel 1125, and an hour wheel 1126. The seconds, minutes, and hours in the ordinary time are indicated by these wheels.

Figure 26:
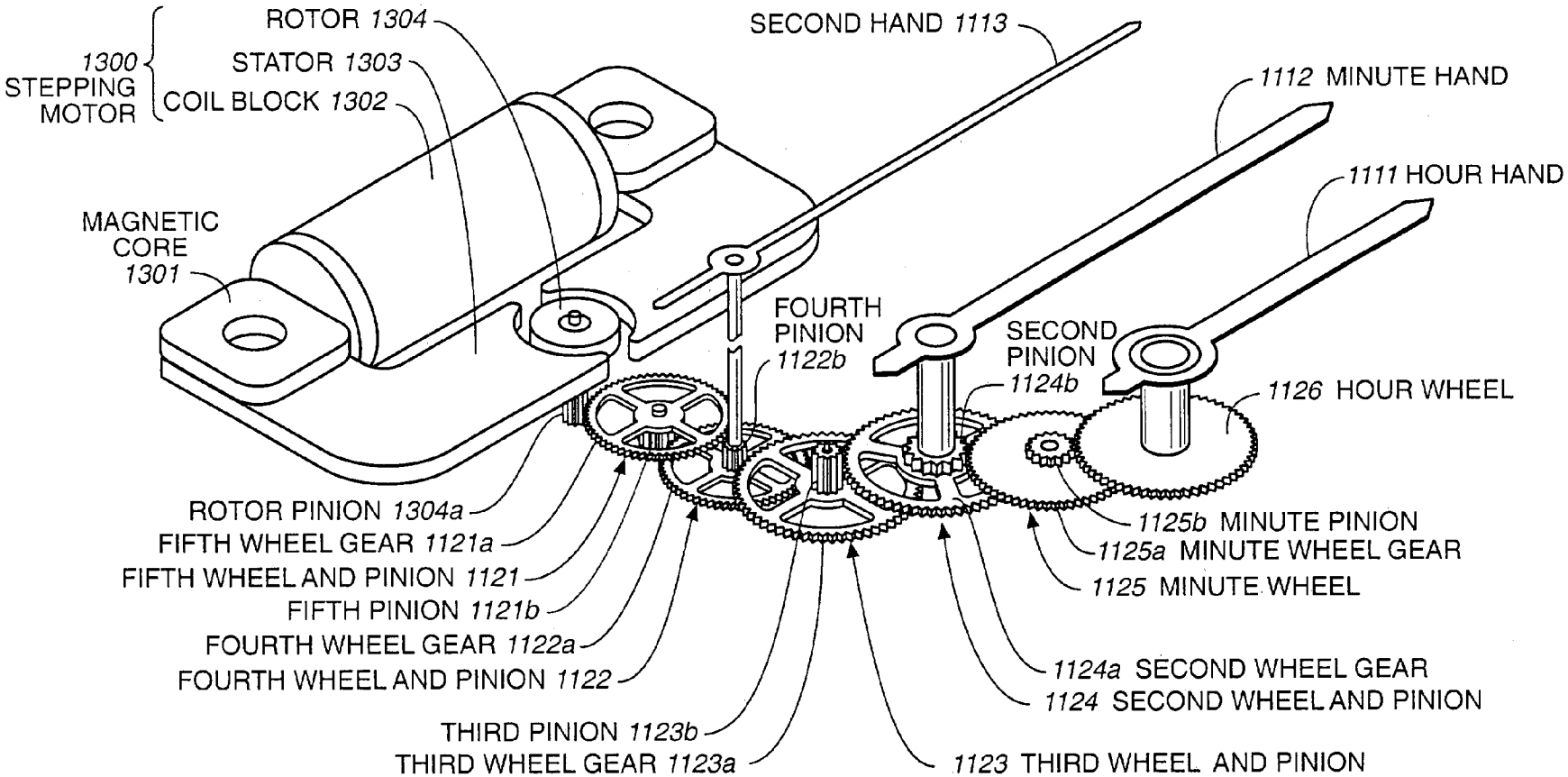
FIG. 26 is a perspective view showing the engagement state of a train of wheels in an ordinary time section in the movement of the electronic timepiece shown in FIG. 24.

FIG. 26 is a schematic perspective view showing the engagement state of the wheels in the ordinary time section 1100.

A rotor pinion 1304*a* is meshed with a fifth wheel gear 1121*a*, and a fifth pinion 1121*b* is meshed with a fourth wheel gear 1122*a*. The reduction ratio from the rotor pinion 1304*a* to the fourth wheel gear 1122*a* is set at 1/30. By outputting an electric signal from the IC 1702 so that the rotor 1304 rotates a half-turn per second, the fourth wheel and pinion 1122 makes one turn in sixty seconds, and the second hand 1113 fitted at the leading end thereof allows the second in ordinary time to be indicated.

A fourth pinion 1122*b* is meshed with a third wheel gear 1123*a*, and a third pinion 1123*b* is meshed with a second wheel gear 1124*a*. The reduction ratio from the fourth pinion 1122*b* to the second wheel gear 1124*a* is set at 1/60. The second wheel and pinion 1124 makes one turn in sixty minutes, and the minute hand 1112 fitted at the leading end thereof allows the minute in ordinary time to be indicated.

A second pinion 1124*b* is meshed with a minute wheel gear 1125*a*, and a minute pinion 1125*b* is meshed with the hour wheel 1126. The reduction ratio from the second pinion 1124*b* to the hour wheel 1126 is set at 1/12. The hour wheel 1126 makes one turn in twelve hours, and the hour hand 1111 fitted at the leading end thereof allows the hour in ordinary time to be indicated.

In FIGS. 24 and 25, the ordinary time section 1100 further comprises a winding stem 1128 that is fixed at one end to the crown 1101 and is fitted at the other end in a clutch wheel 1127, a setting wheel 1129, a winding stem positioning portion, and a setting lever 1130. The winding stem 1128 is structured to be drawn out stepwise by the crown 1101. A state in which the winding stem 1128 is not drawn out (zero stage) is an ordinary state. When the winding stem 1128 is drawn out to the first stage, the hour hand 1111 and the like are not stopped, and calendar correction is allowed. When the winding stem 1128 is drawn out to the second stage, the motion of the hands is stopped, and time correction is allowed.

When the winding stem 1128 is drawn out to the second stage by pulling the crown 1101, a reset signal input portion 1130*b* provided in the setting lever 1130 engaged with the winding stem positioning portion makes contact with a pattern formed on a circuit board having the IC 1702 mounted thereon, whereby the output of a motor pulse is stopped, and the motion of the hands is also stopped. In this case, the turn of the fourth wheel gear 1122*a* is regulated by a fourth setting portion 1130*a* provided in the setting lever 1130. When the winding stem 1128 is rotated together with the crown 1101 in this state, the rotation force is transmitted to the minute wheel 1125 via the sliding wheel 1127, the setting wheel 1129, and an intermediate minute wheel 1131. Since the second wheel gear 1124*a* is connected to the second pinion 1124*b* with a fixed sliding torque therebetween, even when the fourth wheel and pinion 1122 is regulated, the setting wheel 1129, the minute wheel 1125, the second pinion 1124*b*, and the hour wheel 1126 are allowed to turn. Since the minute hand 1112 and the hour hand 1111 are thereby turned, it is possible to set an arbitrary time.

In FIGS. 24 and 25, the chronograph section 1200 includes a train of wheels, a CG (chronograph) intermediate 1/10-second wheel 1231, and a CG 1/10-second wheel 1232. The CG 1/10-second wheel 1232 is placed at the center of the one-second indicator 1230. The structure of these train wheels allows 1/10-second indication in the chronograph at 9 o'clock position of the watch body.

In FIGS. 24 and 25, the chronograph section 1200 also includes a train of wheels, a CG first intermediate second wheel 1221, a CG second intermediate second wheel 1222, and a CG second wheel 1223. The CG second wheel 1223 is placed at the center of the sixty-minute indicator 1220. The structure of these train wheels allows second indication in the chronograph at 12 o'clock position of the watch body.

In FIGS. 24 and 25, the chronograph section 1200 also includes a train of wheels, a CG first intermediate minute wheel 1211, a CG second intermediate minute wheel 1212, a CG third intermediate minute wheel 1213, a CG fourth intermediate minute wheel 1214, a CG intermediate hour wheel 1215, a CG minute wheel 1216, and a CG hour wheel 1217. The CG minute wheel 1216 and the CG hour wheel 1217 are coaxially placed at the center of the 12-hour indicator 1220. The structure of the train wheels allows hour and minute indication in the chronograph at 3 o'clock position of the watch body.

Figure 27:
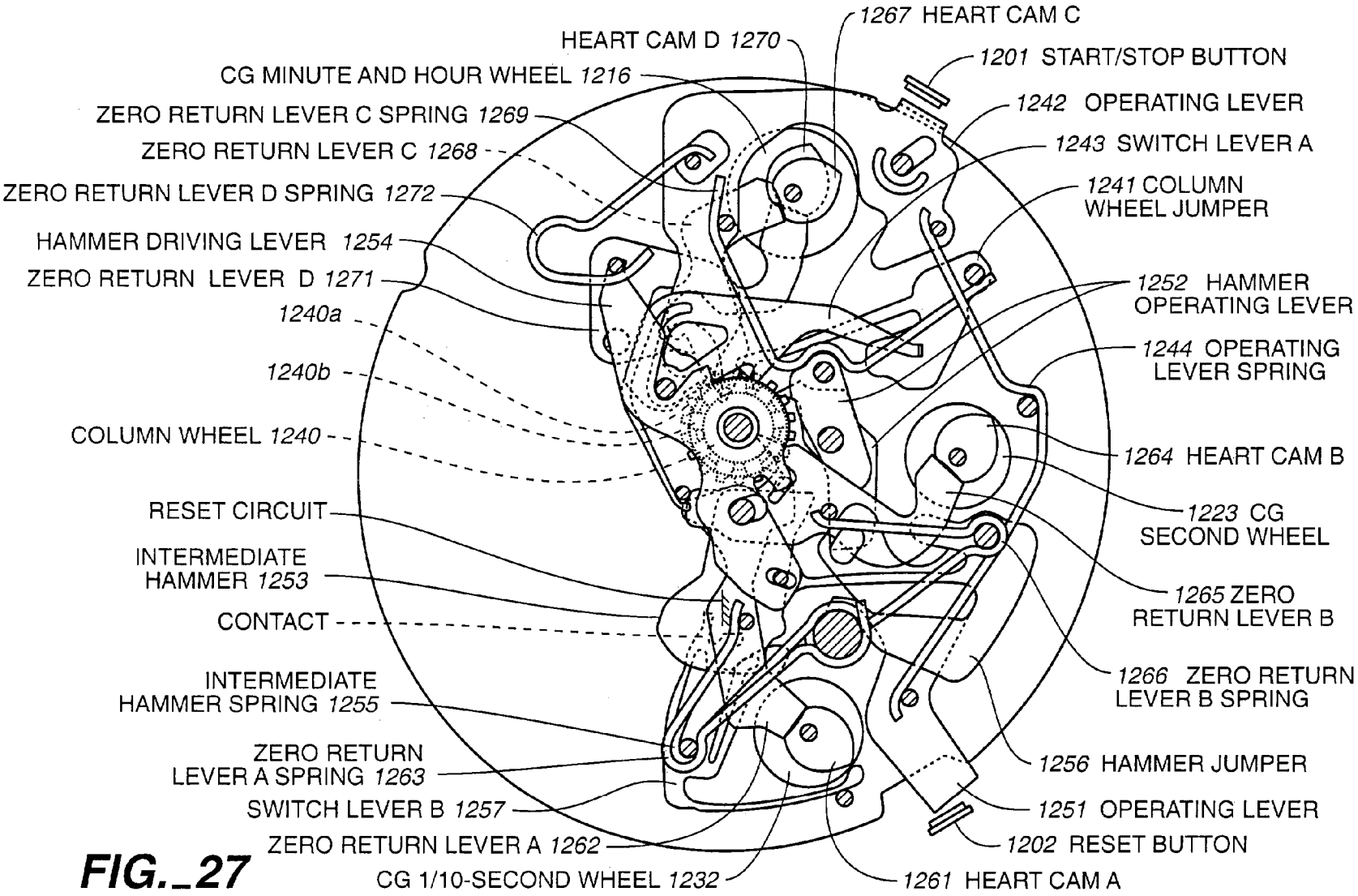
FIG. 27 is a plan view schematically showing an example of a configuration of start/stop and reset (return to zero) operating mechanisms in a chronograph section of the electronic timepiece shown in FIG. 24.
Figure 28:
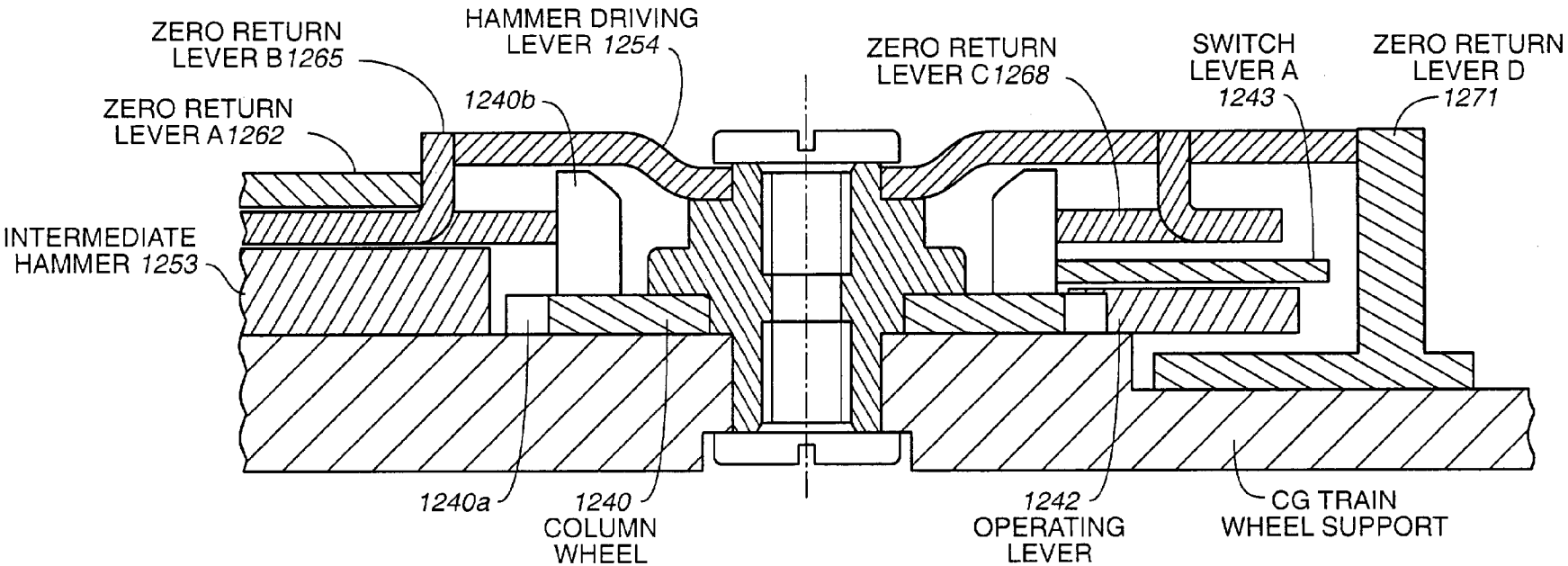
FIG. 28 is a sectional side view schematically showing am example of a configuration of the principal part of the start/stop and reset (return to zero) mechanisms in the chronograph section shown in FIG. 27.

FIG. 27 is a plan view schematically showing an example of the structure of start/stop and reset operating mechanisms in the chronograph section 1200, as viewed from the side of a rear cover of the watch. FIG. 28 is a sectional side view schematically showing an example of the structure of the principal part thereof. These figures show a reset state.

The start/stop and reset operating mechanisms in the chronograph section 1200 are placed on the movement shown in FIG. 25, in which start/stop and reset operations are mechanically performed by the rotation of a column wheel 1240 disposed at about the center of the movement. The column wheel 1240 is cylindrically formed. The column wheel 1240 has on its side face teeth 1240*a* arranged with a fixed pitch along the periphery, and has on one end face columns 1240*b* arranged with a fixed pitch along the periphery. The phase of the column wheel 1240 at rest is regulated by a column wheel jumper 1241 retained between the teeth 1240*a*, and the column wheel 1240 is turned counterclockwise by a column wheel turning portion 1242*d* disposed at the leading end of an operating lever 1242.

Figure 29:
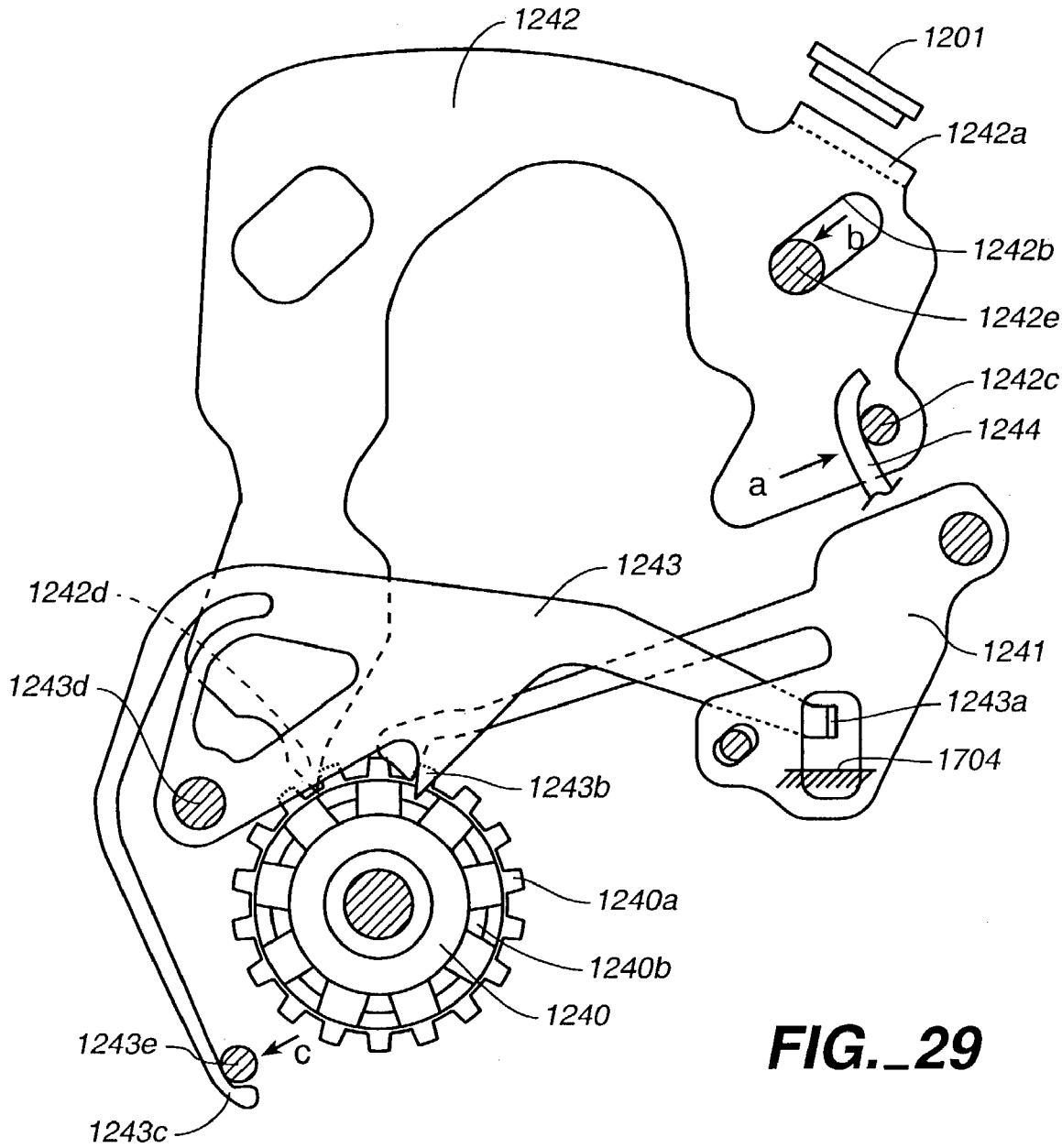
FIG. 29 is a first plan view showing an example of an operation of the start/stop operating mechanism in the chronograph section shown in FIG. 27.

The start/stop operating mechanism (first actuating section) is composed of the operating lever 1242, a switch lever A 1243, and an operating lever spring 1244, as shown in FIG. 29.

The operating lever 1242 is shaped like a substantially L-shaped flat plate. The operating lever 1242 has at one end a bent pressure portion 1242*a*, an elliptical through hole 1242*b*, and pin 1242*c*, and has at the other leading end an acute pressure portion 1242*d*. Such an operating lever 1242 is constructed as the start/stop operating mechanism by placing the pressure portion 1242*a* so as to face the start/stop button 1201, inserting a pin 1242*e* fixed to the movement into the through hole 1242*b*, retaining one end of the operating lever spring 1244 by the pin 1242*c*, and placing the pressure portion 1242*d* adjacent to the column wheel 1240.

The switch lever A 1243 is formed as a switch portion 1243*a* at one end, is provided with a planar projection 1243*b* at about the center thereof, and is formed as a retaining portion 1243*c* at the other end. Such a switch lever A 1243 is constructed as the start/stop operating mechanism by pivotally supporting about the center thereof by a pin 1243*d* fixed to the movement, placing the switch portion 1243*a* adjacent to a start circuit in a circuit board 1704, placing the projection 1243*b* into contact with the column 1240*b* provided in the axial direction of the cam wheel 1240, and retaining the retaining portion 1243*c* by a pin 1243*e* fixed to the movement. That is, the switch portion 1243*a* of the switch lever A 1243 makes contact with the start circuit of the circuit board 1704 so as to serve as a switch input. The switch lever A 1243 that is electrically connected to the secondary power source 1500 via the main plate 1701 and the like has the same potential as that of the positive pole of the secondary power source 1500.

An example of an operation of the start/stop operating mechanism having the above-described configuration when actuating the chronograph section 1200 will be described with reference to FIGS. 29 to 31.

While the chronograph section 1200 is in a stop state, as shown in FIG. 29, the operating lever 1242 is positioned in a state in which the pressure portion 1242*a* is separate from the start/stop button 1201, the pin 1242*c* is pressed by elastic force of the operating lever spring 1244 in the direction of the arrow "a" in the figure, and one end of the through hole 1242*b* is pressed by the pin 1242*e* in the direction of the arrow "b" in the figure. In this case, a leading end portion 1242*d* of the operating lever 1242 is positioned between the teeth 1240*a* of the cam wheel 1240.

The switch lever A 1243 is positioned while the projection 1243*b* is pushed up by the column 1240*b* of the cam wheel 1240 against the spring force of a spring portion 1243*c* formed at the end of the switch lever A 1243, and the retaining portion 1243*c* is pressed by the pin 1243*d* in the direction of the arrow "c" in the figure. At this time, the switch portion 1243*a* of the switch lever A 1243 is separate from the start circuit of the circuit board 1704, whereby the start circuit is electrically cut off.

Figure 30:
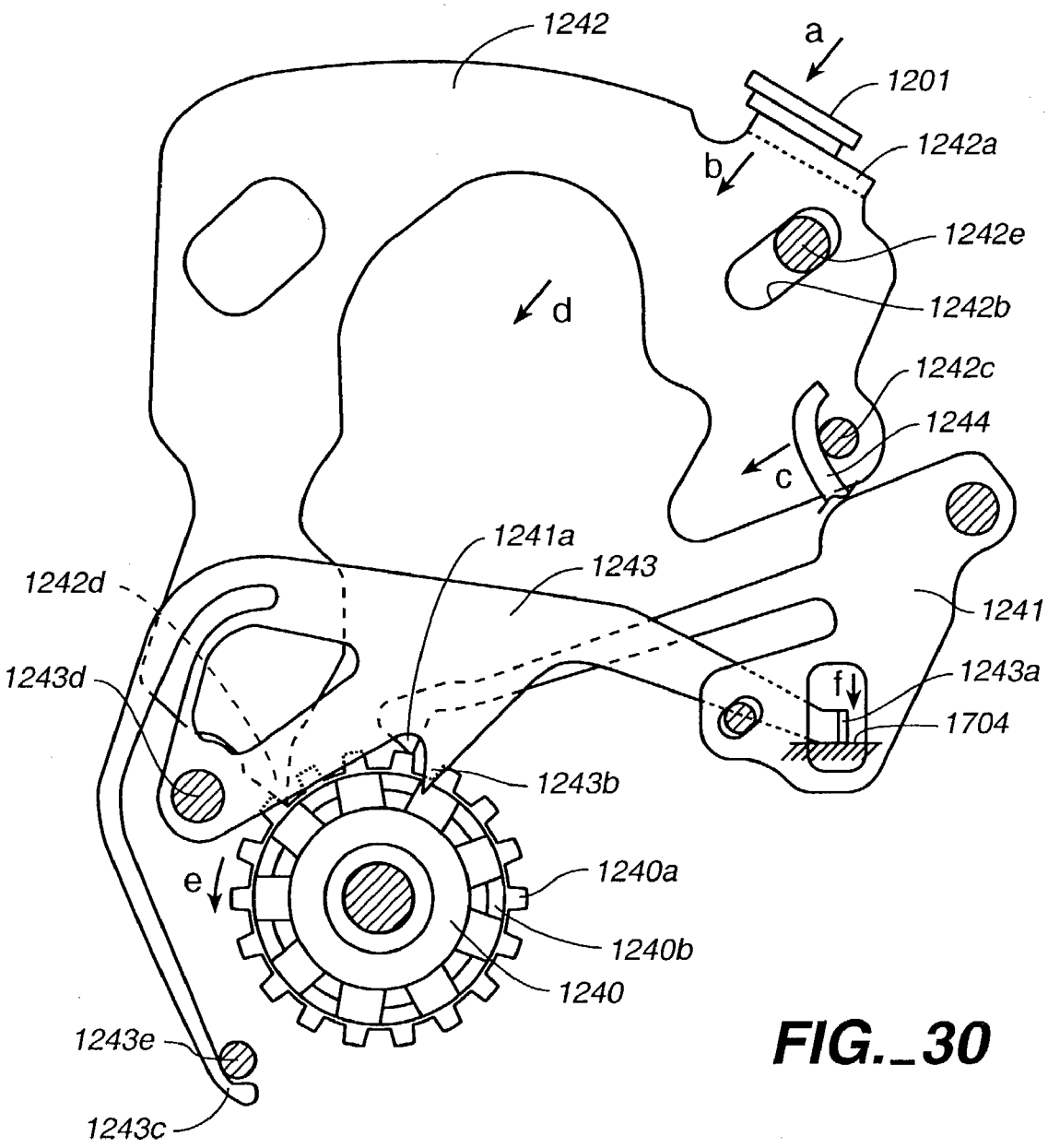
FIG. 30 is a second plan view showing an example of an operation of the start/stop operating mechanism in the chronograph section shown in FIG. 27.

As shown in FIG. 30, when the start/stop button 1201 is pushed in the direction of the arrow "a" in the figure in order to shift the chronograph section 1200 from this state to the start state, the pressure portion 1242*a* of the operating lever 1242 makes contact with the start/stop button 1201, and is pressed in the direction of the arrow "b" in the figure, and the pin 1242*c* presses and elastically deforms the operating lever spring 1244 in the direction of the arrow "c" in the figure. Therefore, the entire operating lever 1242 moves in the direction of the arrow "d" in the figure along the through hole 1242*b* and the pin 1242*e*. At this time, the leading end portion 1242*d* of the operating lever 1242 contacts and presses the side face of the tooth 1240*a* of the cam wheel 1240, thereby turning the cam wheel 1240 in the direction of the arrow "e" in the figure.

Simultaneously, when the side face of the column 1240*b* and the projection 1243*b* of the switch lever A 1243 are made out of phase by the turn of the cam wheel 1240, the projection 1243*b* reaches the gap between the columns 1240*b*, and is put into the gap by restoring force of the spring portion 1243*c*. Since the switch portion 1243*a* of the switch lever A 1243 turns in the direction of the arrow "f" in the figure and makes contact with the start circuit of the circuit board 1704, the start circuit is placed into an electrically conductive state.

In this case, the leading end portion 1241*a* of the cam wheel jumper 1241 is pushed up by the tooth 1240*a* of the cam wheel 1240.

The above operation is continued until the teeth 1240*a* of the cam wheel 1240 are fed by one pitch.

Figure 31:
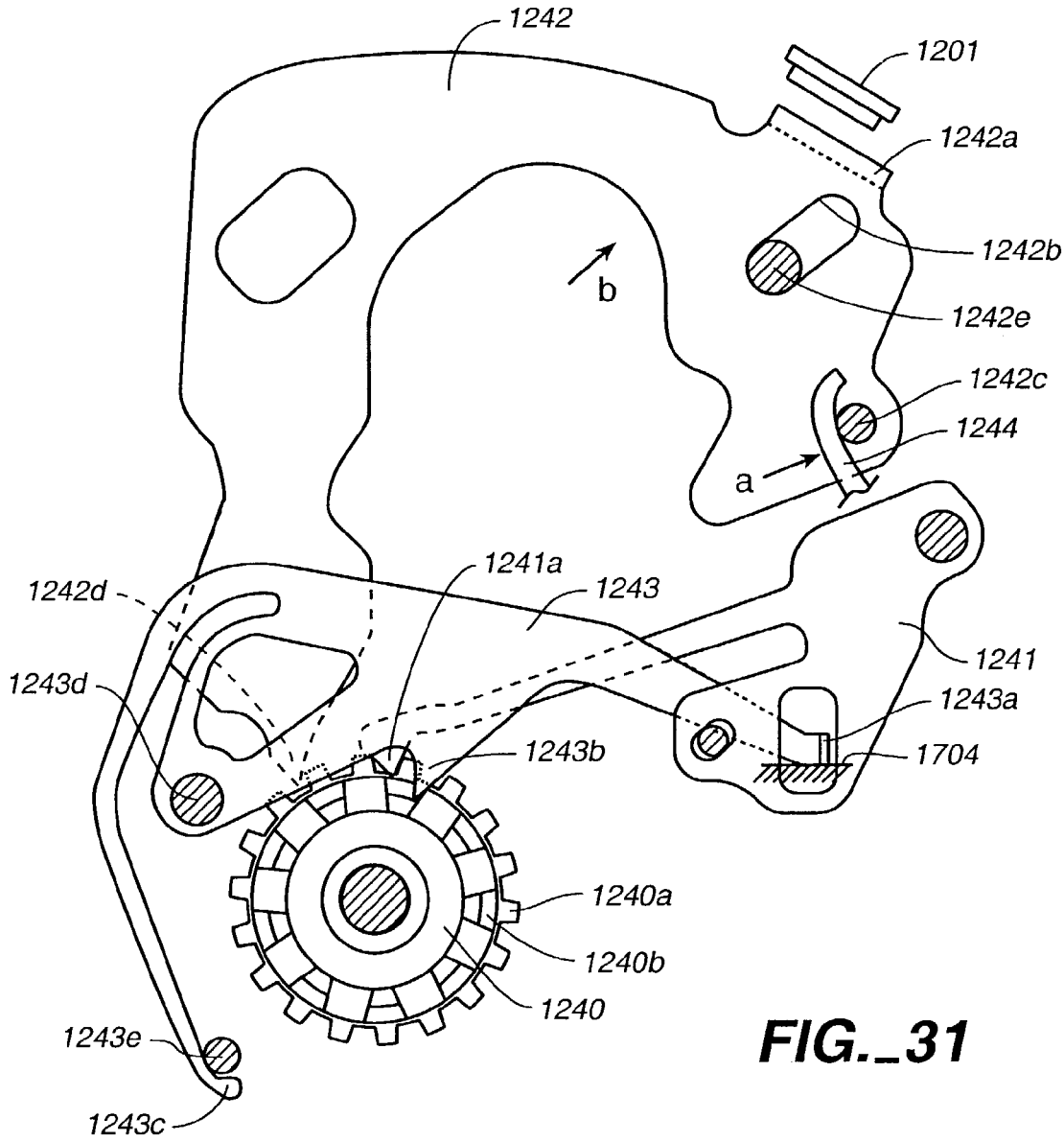
FIG. 31 is a third plan view showing an example of the operation of the starting/stopping mechanism in the chronograph section shown in FIG. 27.

Subsequently, when the hand is separated from the start/stop button 1201, the start/stop button 1201 automatically returns to its initial state by a spring built therein, as shown in FIG. 31. Then, the pin 1242*c* of the operating lever 1242 is pressed in the direction of the arrow "a" in the figure by restoring force of the operating lever spring 1244. Therefore, the entire operating lever 1242 moves along the through hole 1242*b* and the pin 1242*e* in the direction of the arrow "b" in the figure until one end of the through hole 1242*b* contacts the pin 1242*e*, and returns to the same position as shown in FIG. 29.

In this case, since the projection 1243*b* of the switch lever A 1243 remains inside the gap between the columns 1240*b* of the cam wheel 1240, the switch portion 1243*a* is in contact with the start circuit of the circuit board 1704, and the start circuit is held in the electrically conductive state. Therefore, the chronograph section 1200 is held in the start state.

At this time, the leading end portion 1241*a* of the cam wheel jumper 1241 is placed between the teeth 1240*a* of the cam wheel 1240, thereby regulating the phase of the cam wheel 1240 at rest in the turning direction.

In contrast, an operation similar to the above-described start operation is performed in order to stop the chronograph section 1200, and finally, the state shown in FIG. 29 is brought about again.

As described above, the start/stop of the chronograph section 1200 can be controlled by pivoting the operating lever 1242 by the operation of pushing the start/stop button 1201 so as to turn the cam wheel 1240 and to pivot the switch lever A 1243.

The reset operating mechanism (second actuating section) comprises, as shown in FIG. 27, the cam wheel 1240, an operating lever 1251, a hammer operating lever 1252, an intermediate hammer 1253, a hammer driving lever 1254, the operating lever spring 1244, an intermediate hammer spring 1255, a hammer jumper 1256, and a switch lever B 1257. The reset operating mechanism further comprises a heart cam A 1261, a zero return lever A 1262, a zero return lever A spring 1263, a heart cam B 1264, a zero return lever B 1265, a zero return lever B spring 1266, a heart cam C 1267, a zero return lever C 1268, a zero return lever C spring 1269, a heart cam D 1270, a zero return lever D 1271, and a zero return lever D spring 1272.

The reset operating mechanism in the chronograph section 1200 is structured so as not to operate while the chronograph section 1200 is in the start state, and so as to operate when the chronograph section 1200 is in the stop state. Such a mechanism is referred to as a "safety mechanism". First, the operating lever 1251, the hammer operating lever 1252, the intermediate hammer 1253, the operating lever spring 1244, the intermediate hammer spring 1255, and the hammer jumper 1256, which constitute the safety mechanism, will be described with reference to FIG. 32.

The operating lever 1251 is formed in the shape of a substantially Y-shaped flat plate. The operating lever 1251 has a pressure portion 1251*a* at one end, an elliptic through hole 1251*b* at one end of a fork, and a pin 1251*c* formed between the pressure portion 1251*a* and the through hole 1251*b*. Such an operating lever 1251 is constructed as the reset operating mechanism by placing the pressure portion 1251*a* to face the reset button 1202, inserting a pin 1252*c* of the hammer operating lever 1252 into the through hole 1251*b*, pivotally supporting the other fork by a pin 1251*d* fixed to the movement, and retaining the other end of the operating lever spring 1244 by the pin 1251*c*.

The hammer operating lever 1252 is composed of a first hammer operating lever 1252*a* and a second hammer operating lever 1252*b* shaped like a substantially rectangular flat plate, which overlap with each other and are pivotally supported by a shaft 1252*g* at about the center. The first hammer operating lever 1252*a* is provided with the pin 1252*c* at one end, and the second hammer operating lever 1252*b* is provided with pressure portions 1252*d* and 1252*e* at both ends. Such a hammer operating lever 1252 is constructed as the reset operating mechanism by inserting the pin 1252*c* in the through hole 1251*b* of the operating lever 1251, pivotally supporting the other end of the first hammer operating lever 1252*a* by a pin 1252*f* fixed to the movement, placing the pressure portion 1252*d* to face a pressure portion 1253*c* of the intermediate hammer 1253, and placing the pressure portion 1252*d* adjacent to the cam wheel 1240.

The intermediate hammer 1253 is shaped like a substantially rectangular flat plate. The intermediate hammer 1253 has pins 1253*a* and 1253*b* at one end and at the center, and one corner of the other end thereof is formed as a pressure portion 1253*c*. Such an intermediate hammer 1253 is constructed as the reset operating mechanism by retaining one end of the intermediate hammer spring 1255 by the pin 1253*a*, retaining one end of the hammer jumper 1256 by the pin 1253*b*, placing the pressure portion 1253*c* to face the pressure portion 1252*d* of the second hammer operating lever 1252*b*, and pivotally supporting the other corner at the other end by a pin 1253*d* fixed to the movement.

An example of an operation of the safety mechanism having the above-described configuration will be described with reference to FIGS. 32 to 35.

Figure 32:
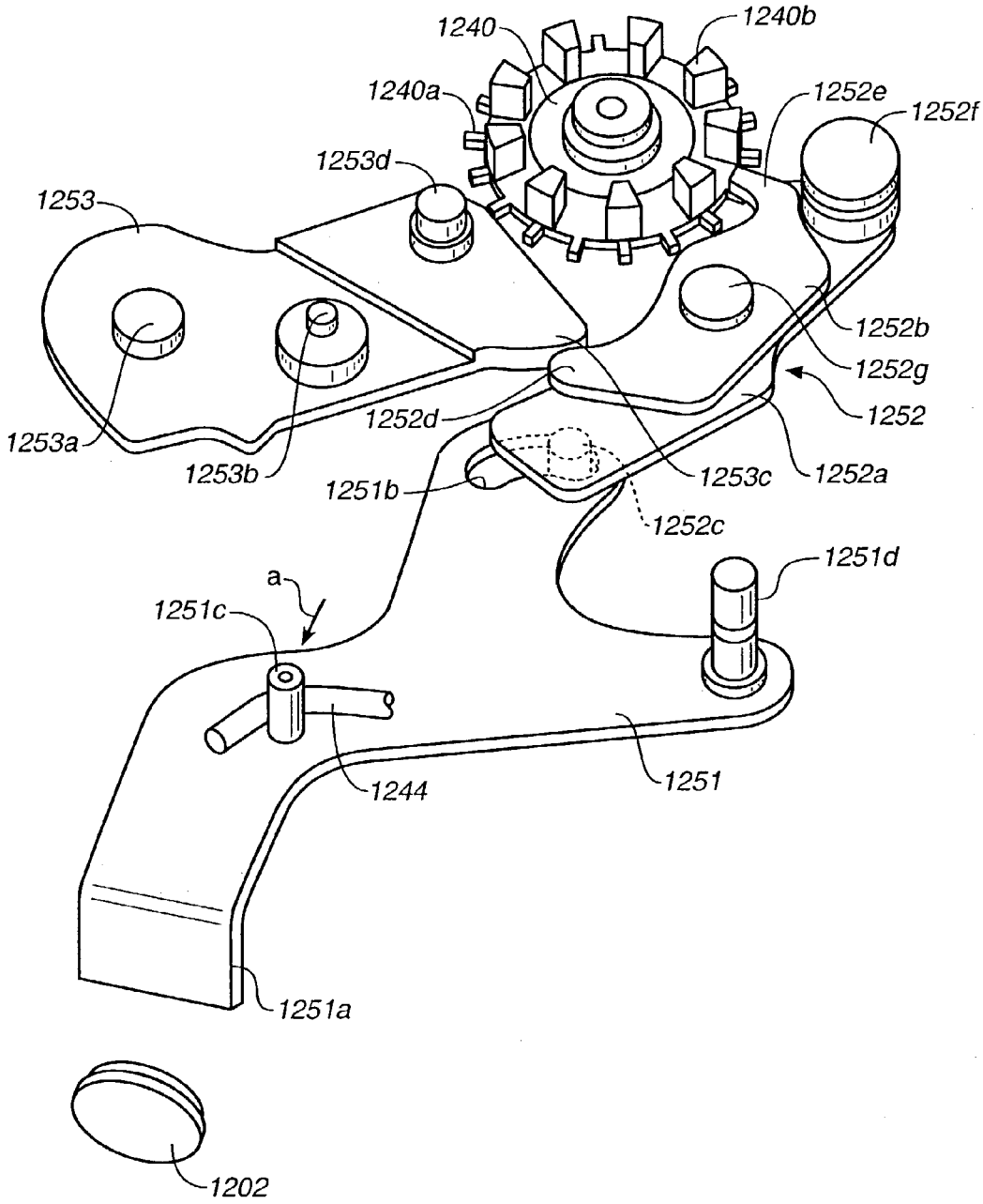
FIG. 32 is a first perspective view showing an example of an operation of a safety mechanism in the chronograph section shown in FIG. 27.

While the chronograph section 1200 is in the start state, the operating lever 1251 is positioned in a state in which the pressure portion 1251*a* is separate from the reset button 1202 and the pin 1251*c* is pressed by elastic force of the operating lever spring 1244 in the direction of the arrow "a" in the figure, as shown in FIG. 32. At this time, the pressure portion 1252*e* of the second hammer operating lever 1252*b* is positioned outside the gap between the teeth 1240*a* of the cam wheel 1240.

Figure 33:
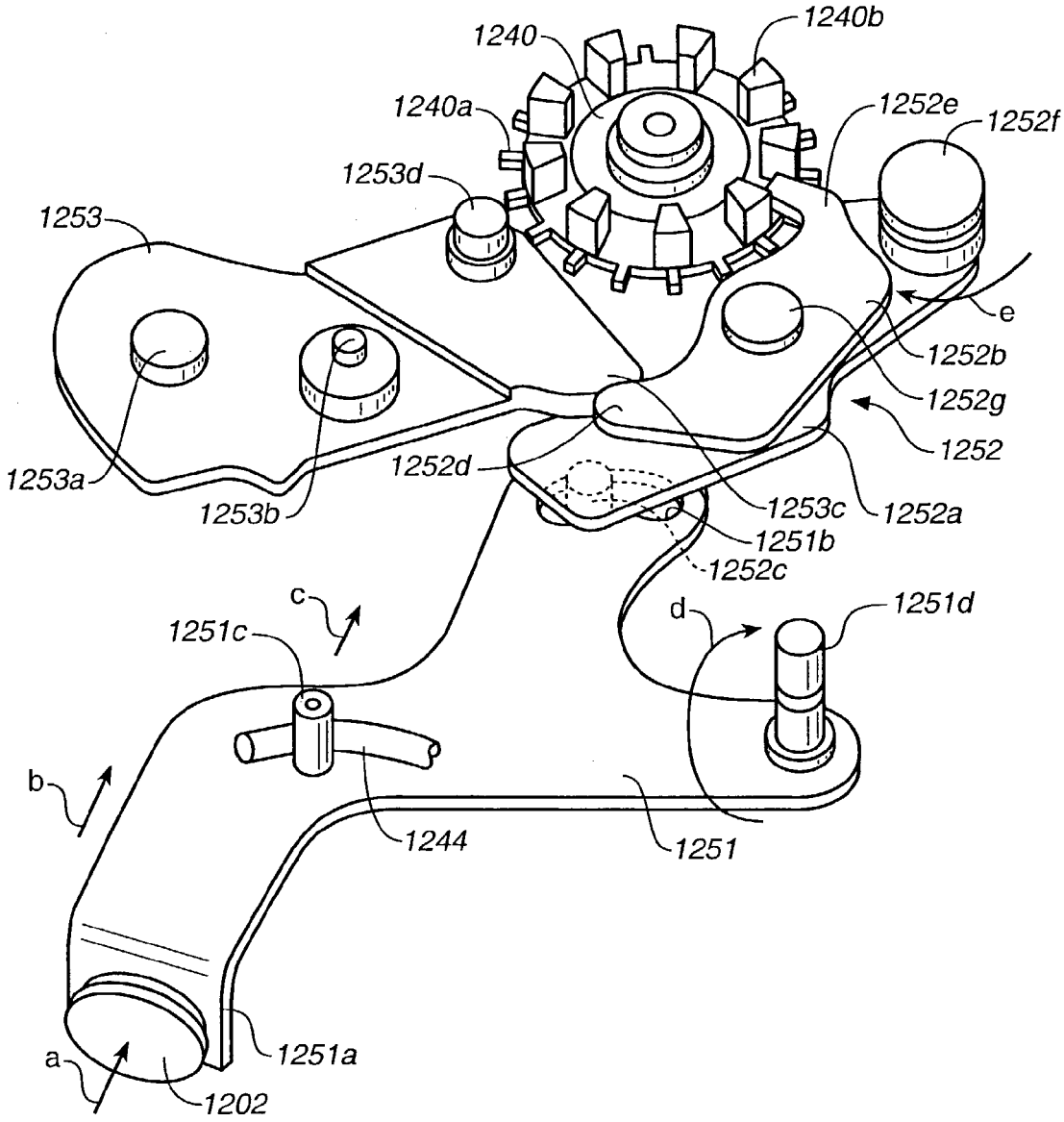
FIG. 33 is a second perspective view showing an example of an operation of the safety mechanism in the chronograph section shown in FIG. 27.

When the reset button 1202 in this state is pushed in the direction of the arrow a in the figure, as shown in FIG. 33, the pressure portion 1251*a* of the operating lever 1251 makes contact with the reset button 1202 and is pressed in the direction of the arrow "b" in the figure, and the pin 1251*c* presses and elastically deforms the operating lever spring 1244 in the direction of the arrow "c" in the figure. Therefore, the entire operating lever 1251 turns on the pin 1251*d* in the direction of the arrow "d" in the figure. Since the operating lever 1251 also moves, with this turn, the pin 1252*c* of the first hammer operating lever 1252*a* along the through hole 1251*b* of the operating lever 1251, the first hammer operating lever 1252*a* turns on the pin 1252*f* in the direction of the arrow "e" in the figure.

In this case, since the pressure portion 1252*e* of the second hammer operating lever 1252*b* enters the gap between the columns 1240*b* of the cam wheel 1240, even when the pressure portion 1252*d* makes contact with the pressure portion 1253*c* of the intermediate hammer 1253, the pressure portion 1253*c* is not pressed by the pressure portion 1252*d* because the second hammer operating lever 1252*b* turns on the shaft 1252*g* to absorb the stroke. Since operating force of the reset button 1202 is cut off at the hammer operating lever 1252 and is not transmitted to the intermediate hammer 1253 and the subsequent reset operating mechanism, which will be described later, even if the reset button 1202 is inadvertently pushed while the chronograph section 1200 is in the start state, the chronograph section 1200 is prevented from being reset.

Figure 34:
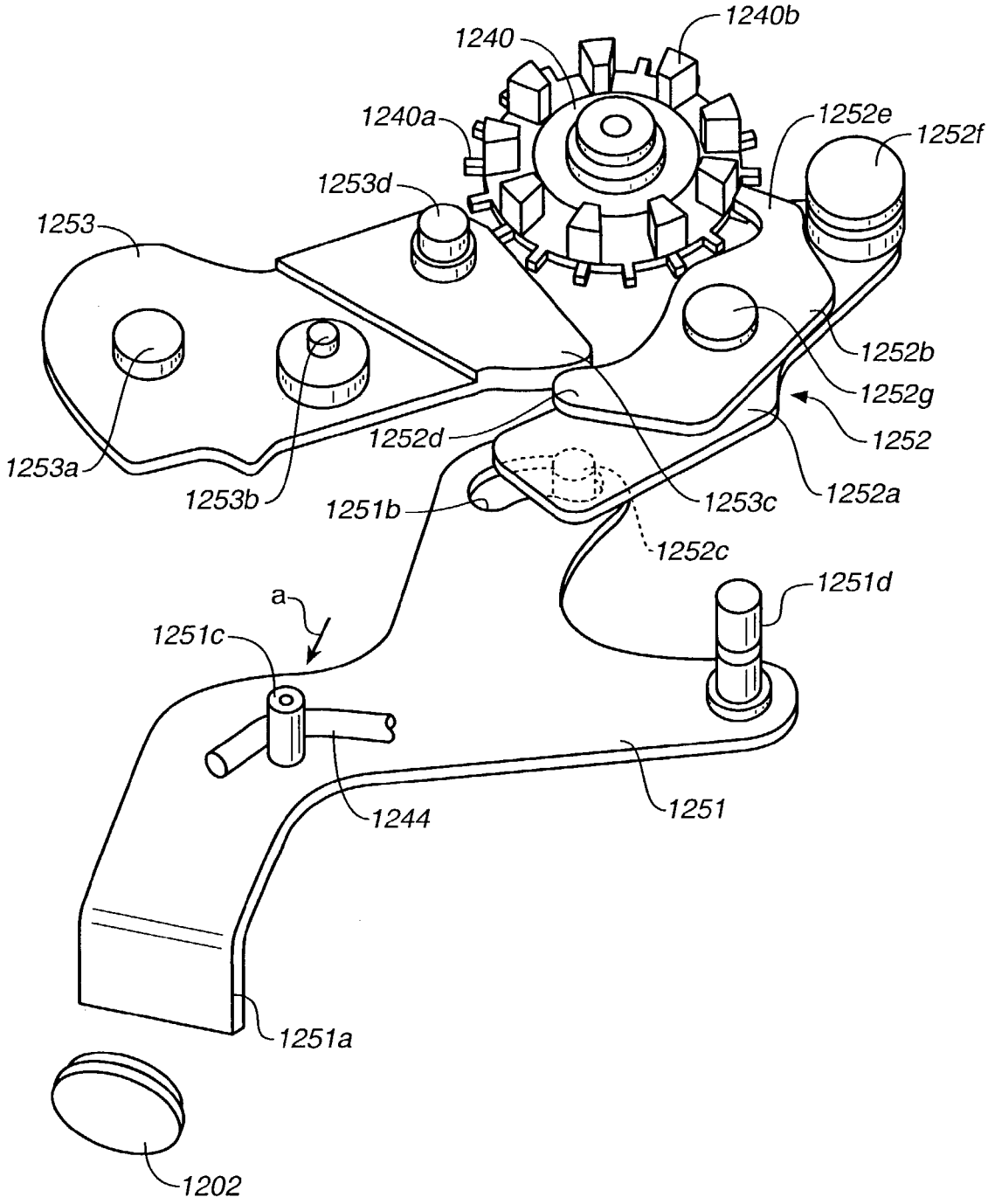
FIG. 34 is a third perspective view showing an example of an operation of the safety mechanism in the chronograph section shown in FIG. 27.

In contrast, while the chronograph section 1200 is in the stop state, as shown in FIG. 34, the operating lever 1251 is positioned in the state in which the pressure portion 1251*a* is separate from the reset button 1202, and the pin 1251*c* is pressed by elastic force of the operating lever spring 1244 in the direction of the arrow "a" in the figure. At this time, the pressure portion 1252*e* of the second hammer operating lever 1252*b* is positioned outside the columns 1240*b* of the cam wheel 1240.

Figure 35:
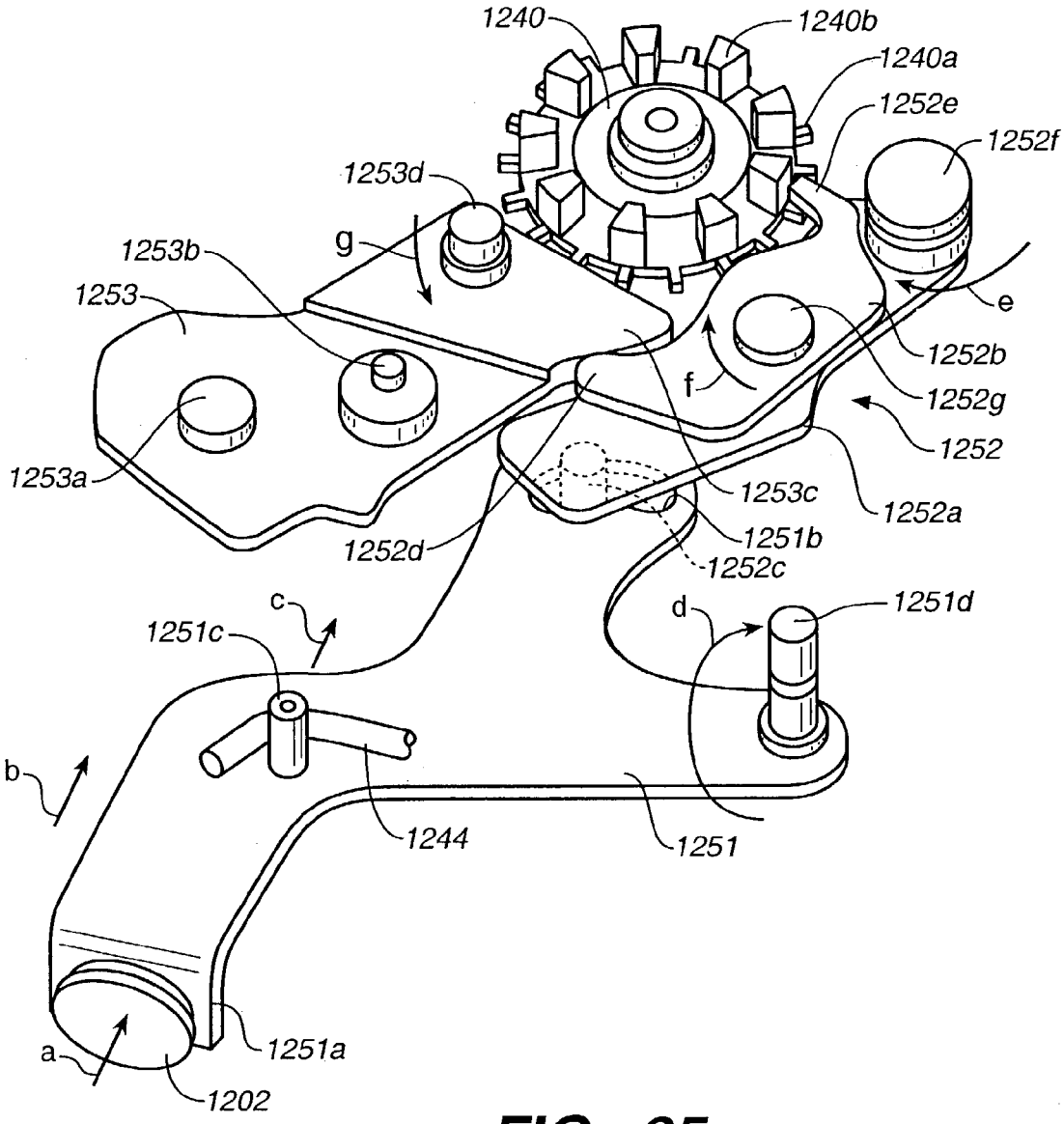
FIG. 35 is a fourth perspective view showing an example of an operation of the safety mechanism in the chronograph section shown in FIG. 27.

When the reset button 1202 is manually pushed in the direction of the arrow "a" in the figure, as shown in FIG. 35, the pressure portion 1251*a* of the operating lever 1251 contacts the reset button 1202 and is pressed in the direction of the arrow "b" in the figure, and the pin 1251*c* presses and elastically deforms the operating lever spring 1244 in the direction of the arrow "c" in the figure. Therefore, the entire operating lever 1251 turns on the pin 1251*d* in the direction of the arrow "d" in the figure. Since the pin 1252*c* of the first hammer operating lever 1252*a* is moved along the through hole 1251*b* with this turn, the first hammer operating lever 1252*a* turns on the pin 1252*f* in the direction of the arrow "e" in the figure.

In this case, since the pressure portion 1252*e* of the second hammer operating lever 1252*b* is stopped by the side face of the column 1240*b* of the cam wheel 1240, the second hammer operating lever 1252*b* turns on the shaft 1252*g* in the direction of the arrow "f" in the figure. Since the pressure portion 1252*d* of the second hammer operating lever 1252*b* contacts and presses the pressure portion 1253*c* of the intermediate hammer 1253 with this turn, the intermediate hammer 1253 turns on the pin 1253*d* in the direction of the arrow "g" in the figure. Since the operating force of the reset button 1202 is transmitted to the intermediate hammer 1253 and the subsequent reset operating mechanism, which will be described later, the chronograph section 1200 can be reset by pushing the reset button 1202 when it is in the stop state. When resetting is performed, a contact of the switch lever B 1257 makes contact with a reset circuit of the circuit board 1704, thereby electrically resetting the chronograph section 1200.

Next, description will be given of the hammer driving lever 1254, the heart cam A 1261, the zero return lever A 1262, the zero return lever A spring 1263, the heart cam B 1264, the zero return lever B 1265, the zero return lever B spring 1266, the heart cam C 1267, the zero return lever C 1268, the zero return lever C spring 1269, the heart cam D 1270, the zero return lever D 1271, and the zero return lever D spring 1272, which constitute the principal structure of the reset operating mechanism in the chronograph section 1200 shown in FIG. 27, with reference to FIG. 36.

The hammer driving lever 1254 is shaped like a substantially I-shaped flat plate. The hammer driving lever 1254 has an elliptic through hole 1254*a* at one end, a lever D restraining portion 1254*b* at the other end, and a lever B restraining portion 1254*c* and a lever C restraining portion 1254*d* at the center. Such a hammer driving lever 1254 is constructed as the reset operating mechanism by rotationally fixing the center thereof and inserting the pin 1253*b* of the intermediate hammer 1253 into the through hole 1254*a*. The heart cams A 1261, B 1264, C 1267, and D 1270 are fixed to the rotation shafts of the CG 1/10-second wheel 1232, the CG second wheel 1223, the CG minute wheel 1216, and the CG hour wheel 1217, respectively.

The zero return lever A 1262 is formed at one end as a hammer portion 1262*a* for hammering the heart cam A 1261, is provided with a turn regulating portion 1262*b* at the other end, and is provided with a pin 1262*c* at the center. Such a zero return lever A 1262 is constructed as the reset operating mechanism by pivotally supporting the other end by a pin 1253*d* fixed to the movement and retaining one end of the zero return lever A spring 1263 by the pin 1262*c*.

The zero return lever B 1265 is formed at one end a hammer portion 1265*a* for hammering the heart cam B 1264, is provided at the other end a turn regulating portion 1265*b* and a pressure portion 1265*c*, and is provided with a pin 1265*d* at the center. Such a zero return lever B 1265 is constructed as the reset operating mechanism by pivotally supporting the other end by the pin 1253*d* fixed to the movement and retaining one end of the zero return lever B spring 1266 by the pin 1265*d*.

The zero return lever C 1268 is formed at one end as a hammer portion 1268*a* for hammering the heart cam C 1267, is provided at the other end with a turn regulating portion 1268*b* and a pressure portion 1268*c*, and is provided with a pin 1268*d* at the center. Such a zero return lever C 1268 is constructed as the reset operating mechanism by pivotally supporting the other end by a pin 1268*e* fixed to the movement and retaining one end of the zero return lever C spring 1269 by the pin 1268*d*.

The zero return lever D 1271 is formed at one end as a hammer portion 1271*a* for hammering the heart cam D 1270, and is provided with a pin 1271*b* at the other end. Such a zero return lever D 1271 is constructed as the reset operating mechanism by pivotally supporting the other end by a pin 1271*c* fixed to the movement and retaining one end of the zero, return lever D spring 1272 by the pin 1271*b*.

An example of an operation of the reset operating mechanism having the above-described configuration will be described with reference to FIGS. 36 and 37.

Figure 36:
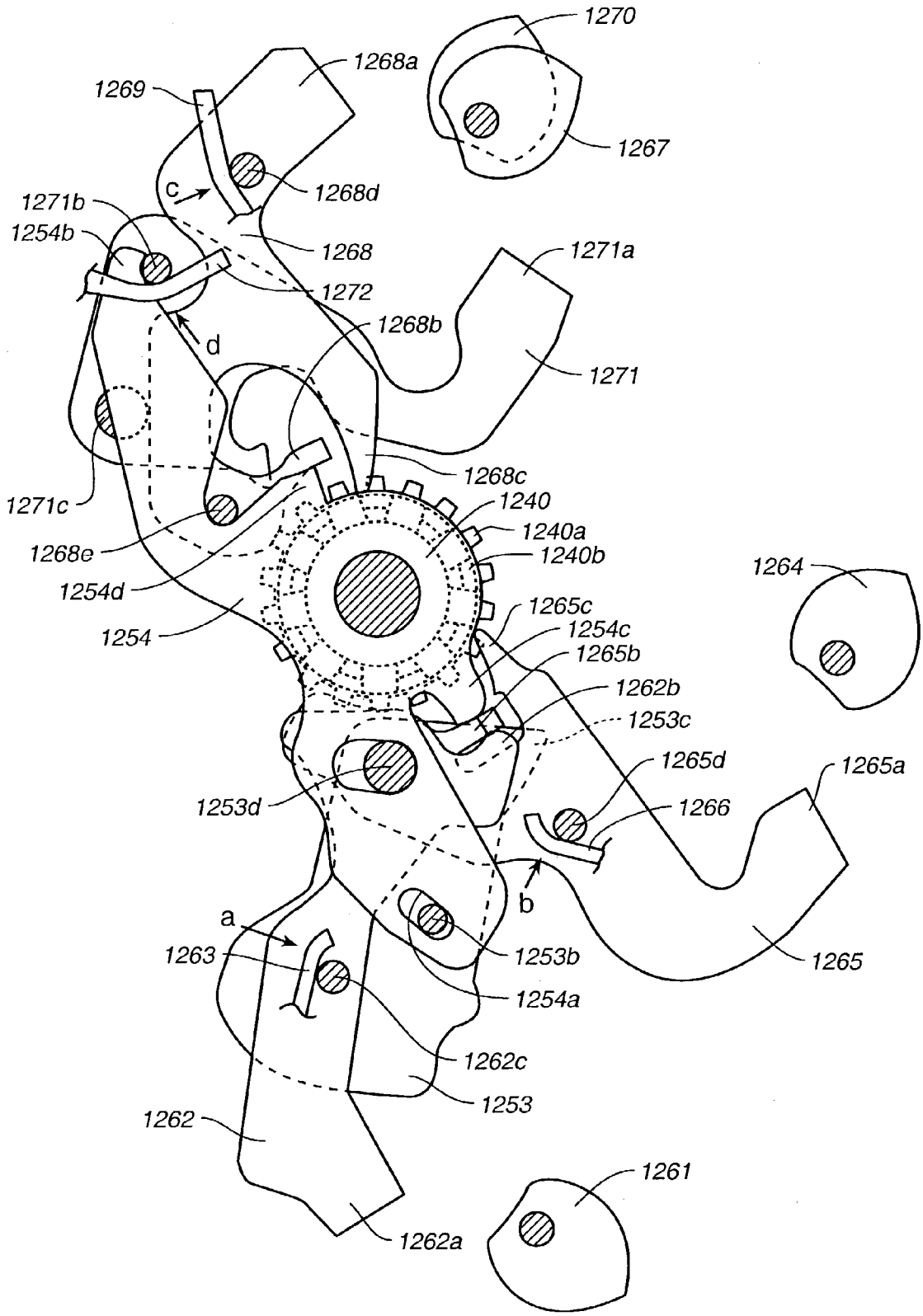
FIG. 36 is a first plan view showing an example of an operation of the principal mechanism of the reset operating mechanism in the chronograph section shown in FIG. 27.

When the chronograph section 1200 is in the stop state, as shown in FIG. 36, the zero return lever A 1262 is positioned while the turn regulating portion 1262*b* is retained by the turn regulating portion 1265*b* of the zero return lever B 1265, and the pin 1262*c* is pressed by the elastic force of the zero return lever A spring 1263 in the direction of the arrow "a" in the figure.

The zero return lever B 1265 is positioned while the turn regulating portion 1265*b* is retained by the lever B restraining portion 1254*c* of the hammer driving lever 1254, the pressure portion 1265*c* is pressed by the side face of the column 1240*b* of the cam wheel 1240, and the pin 1265*d* is pressed by elastic force of the zero return lever B spring 1266 in the direction of the arrow "b" in the figure.

The zero return lever C 1268 is positioned while the turn regulating portion 1268*b* is retained by the lever C restraining portion 1254*d* of the hammer driving lever 1254, the pressure portion 1268*c* is pressed by the side face of the column 1240*b* of the cam wheel 1240, and the pin 1268*d* is pressed by the elastic force of the zero return lever C spring 1269 in the direction of the arrow "c" in the figure.

The zero return lever D 1271 is positioned while the pin 1271*b* is retained by the lever D restraining portion 1254*b* of the hammer driving lever 1254, and is pressed by elastic force of the zero return lever D spring 1272 in the direction of the arrow "d" in the figure.

Therefore, the hammer portions 1262*a*, 1265*a*, 1268*a*, and 1271*a* of the zero return levers A1262, B 1265, C 1268, and D 1271 are respectively positioned at a predetermined distance from the heart cams A1261, B 1264, C 1267, and D 1270.

Figure 37:
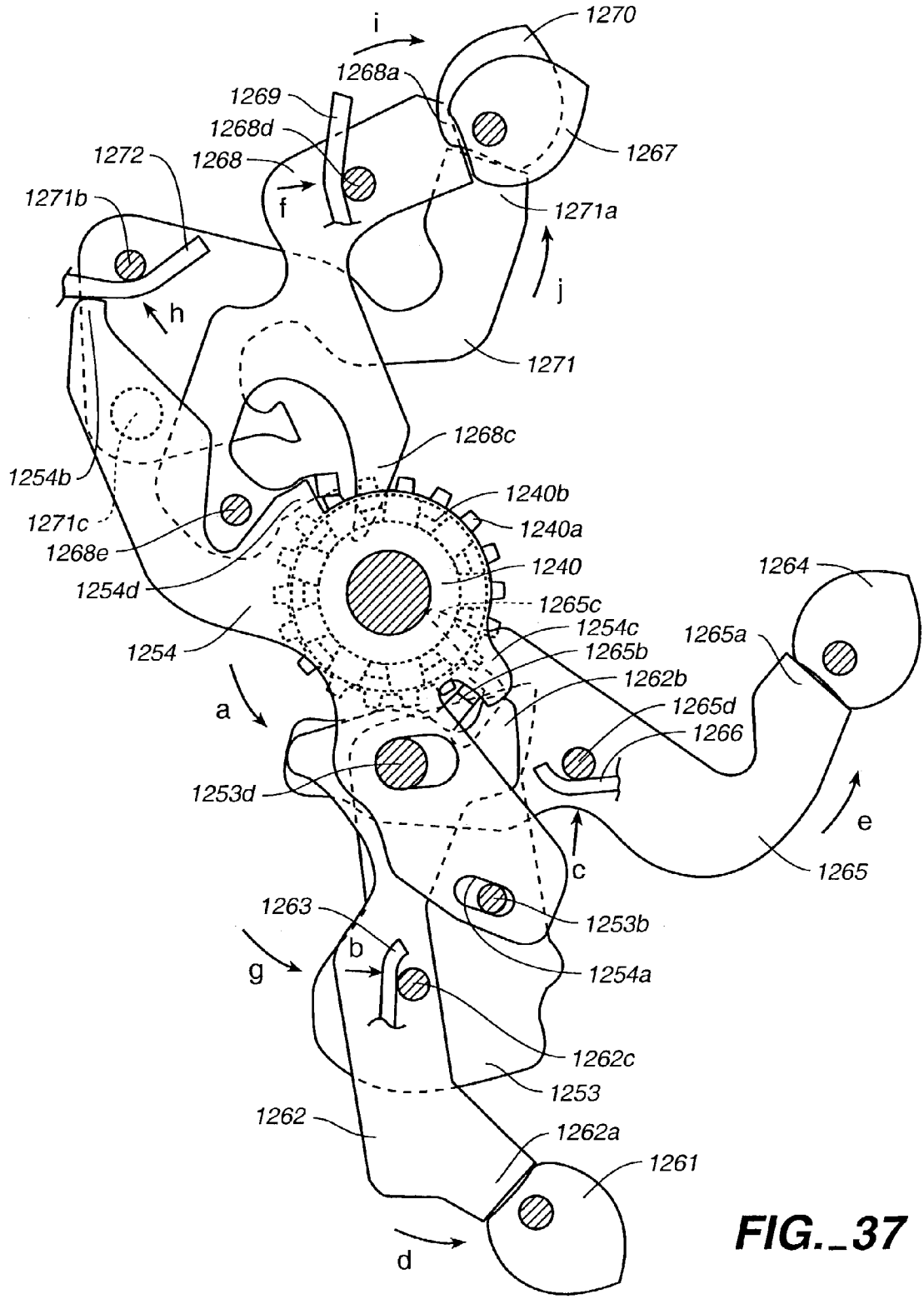
FIG. 37 is a second plan view showing an example of an operation of the principal mechanism of the reset operating mechanism in the chronograph section shown in FIG. 27.

When the intermediate hammer 1253 in this state turns on the pin 1253*d* in the direction of the arrow "g", as shown in FIG. 35, since the pin 1253*b* of the intermediate hammer 1253 moves inside the through hole 1254*a* of the hammer driving lever 1254 while pressing the through hole 1254*a*, as shown in FIG. 37, the hammer driving lever 1254 turns in the direction of the arrow "a" in the figure.

Then, the turn regulating portion 1265*b* of the zero return lever B 1265 is disengaged from the lever B restraining portion 1254*c* of the hammer driving lever 1254, and the pressure portion 1265*c* of the zero return lever B 1265 enters the gap between the columns 1240*b* of the cam wheel 1240. The pin 1265*d* of the zero return lever B 1265 is thereby pressed by the restoring force of the zero return lever B spring 1266 in the direction of the arrow "c" in the figure. Simultaneously, the regulation by the turn regulating portion 1262*b* is removed, and the pin 1262*c* of the zero return lever A 1262 is pressed by the restoring force of the zero return lever A spring 1263 in the direction of the arrow "b" in the figure. Therefore, the zero return lever A 1262 and the zero return lever B 1265 turn on the pin 1253*d* in the directions of the arrows "d" and "e" in the figure, and the hammer portions 1262*a* and 1265*a* hammer and turn the heart cams A1261 and B 1264, thereby resetting the chronograph 1/10-second hand 1231 and the chronograph second hand 1221.

Simultaneously, the turn regulating portion 1268*b* of the zero return lever C 1268 is disengaged from the lever C restraining portion 1254*d* of the hammer driving lever 1254, the pressure portion 1268*c* of the zero return lever C 1268 enters the gap between the columns 1240*b* of the cam wheel 1240, and the pin 1268*d* of the zero return lever C 1268 is pressed by the restoring force of the zero return lever C spring 1269 in the direction of the arrow "f" in the figure. Furthermore, the pin 1271*b* of the zero return lever D 1271 disengages from the lever D restraining portion 1254*b* of the hammer driving lever 1254. Thereby, the pin 1271*b* of the zero return lever D 1271 is pressed by the restoring force of the zero return lever D spring 1272 in the direction of the arrow "h" in the figure. Therefore, the zero return lever C 1268 and the zero return lever D 1271 turn on the pins 1268*e* and 1271*c* in the directions of the arrows "i" and "j" in the figure, and the hammer portions 1268*a* and 1271*a* hammer and turn the heart cams C 1267 and D 1270, thereby resetting the chronograph hour and minute hands 1211 and 1212.

According to a series of operations described above, while the chronograph section 1200 is in the stop state, it can be reset by pressing the reset button 1202.

Figure 38:
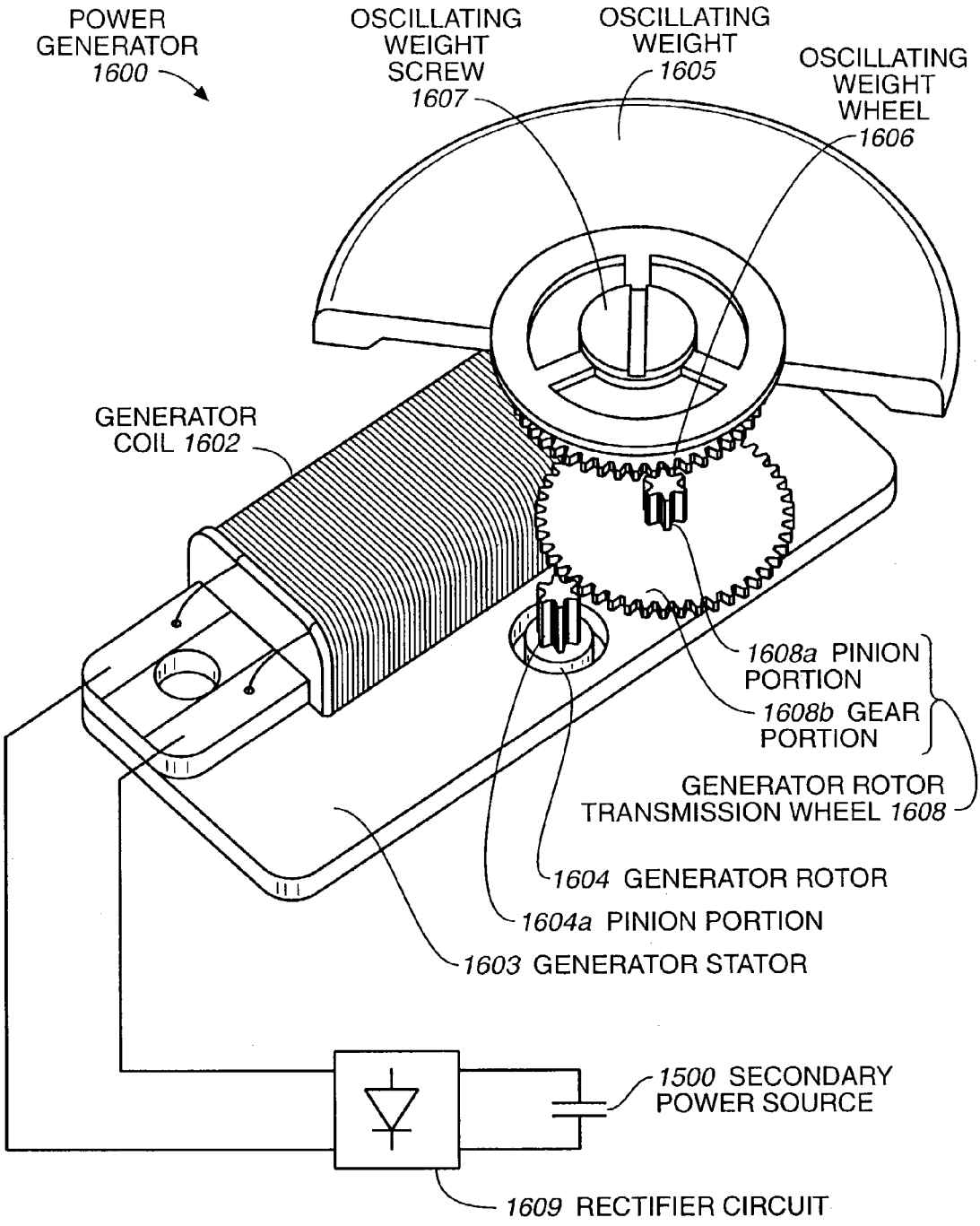
FIG. 38 is a schematic perspective view showing an example of a power generator used in the electronic timepiece shown in FIG. 23.

FIG. 38 is a schematic perspective view of an example of the power generator used in the electronic timepiece shown in FIG. 23.

The power generator 1600 comprises a generator coil 1602 formed on a high-permeability member, a generator stator 1603 made of a high-permeability material, a generator rotor 1604 composed of a permanent magnet and a pinion portion, a half-weight oscillating weight 1605, and the like.

The oscillating weight 1605 and an oscillating weight wheel 1606 disposed therebelow are rotationally supported by a shaft fixed to an oscillating weight support, and are prevented from falling off in the axial direction by an oscillating weight screw 1607. The oscillating weight wheel 1606 is meshed with a pinion portion 1608*a* of a generator rotor transmission wheel 1608, and a gear portion 1608*b* of the generator rotor transmission wheel 1608 is meshed with a pinion portion 1604*a* of the generator rotor 1604. The speed of this train of wheels is increased by approximately 30 times to 200 times. The speed increasing ratio may be freely set according to the performance of the power generator and the specifications of the watch.

In such a structure, when the oscillating weight 1605 is rotated by the action of the user's arm or by other means, the generator rotor 1604 rotates at high speed. Since the permanent magnet is fixed to the generator rotor 1604, the direction of a magnetic flux that interlinks the generator coil 1602 via the generator stator 1603 changes every time the generator rotor 1604 rotates, and alternating current is generated in the generator coil 1602 by electromagnetic induction. The alternating current is rectified by a rectifier circuit 1609, and is stored in the secondary power source 1500.

Figure 39:
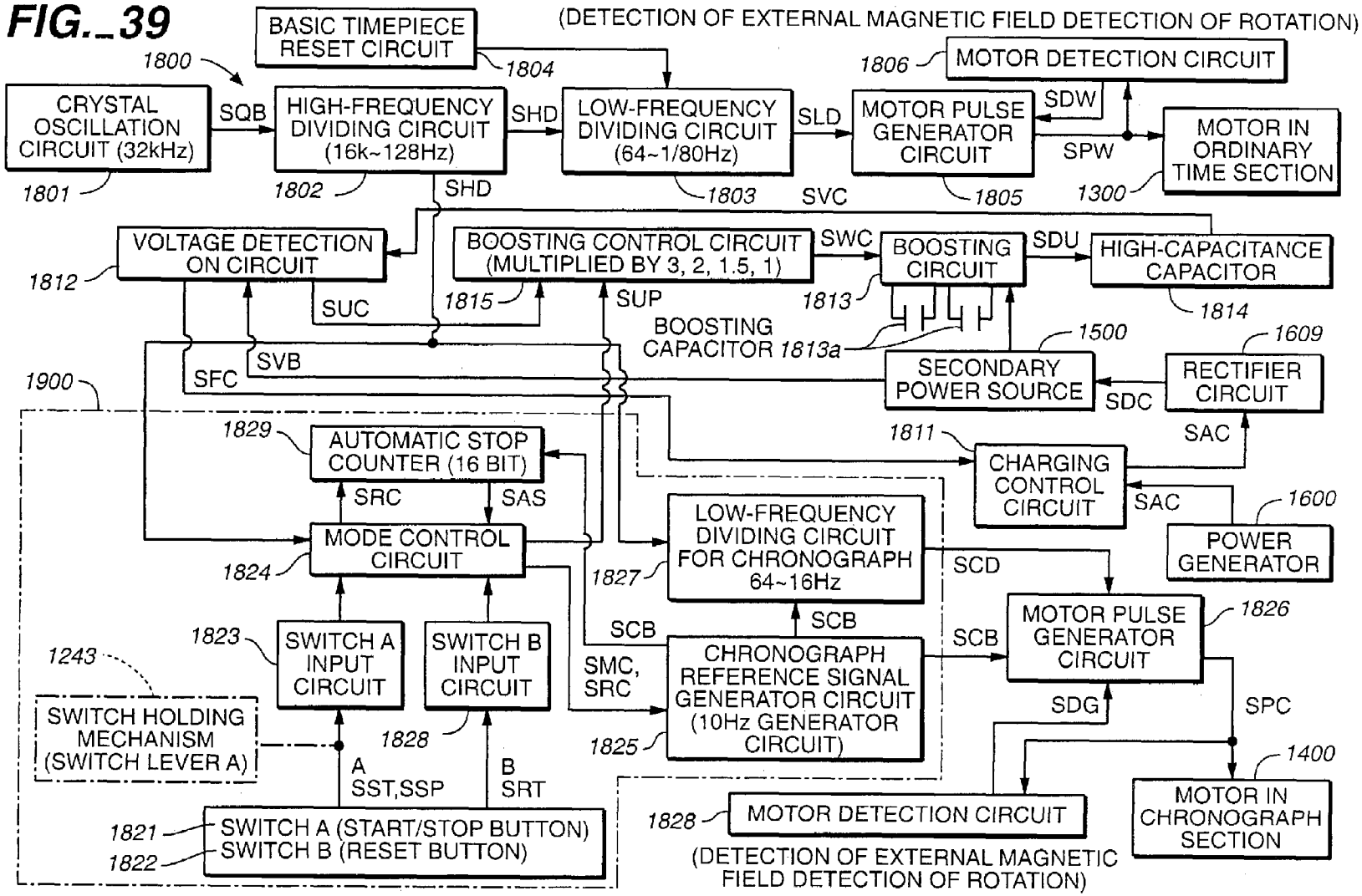
FIG. 39 is a schematic block diagram showing an example of a configuration of a control circuit used in the electronic timepiece shown in FIG. 23.

FIG. 39 is a schematic block diagram showing an example of the overall system configuration of the electronic timepiece shown in FIG. 23, excluding the mechanical section.

A signal SQB with, for example, an oscillation frequency of 32 kHz output from a crystal oscillating circuit 1801 including the tuning-fork crystal oscillator 1703 is input to a high-frequency dividing circuit 1802, where it is divided into frequencies of 16 kHz to 128 Hz. A signal SHD divided by the high-frequency dividing circuit 1802 is input to a low-frequency dividing circuit 1803, where it is divided into frequencies of 64 Hz to 1/80 Hz. The frequency generated by the low-frequency dividing circuit 1803 can be reset by a basic timepiece reset circuit 1804 connected to the low-frequency dividing circuit 1803.

A signal SLD divided by the low-frequency dividing circuit 1803 is input as a timing signal to a motor pulse generator circuit 1805. When the divided signal SLD becomes active, for example, every second or every 1/10 second, pulses SPW for motor driving and for detecting the motor rotation and the like are generated. The motor driving pulse SPW generated by the motor pulse generator circuit 1805 is supplied to the motor 1300 in the ordinary time section 1100, and the motor 1300 in the ordinary time section 1100 is thereby driven. With a timing different therefrom, the pulse SPW for detecting the motor rotation or the like is supplied to a motor detector circuit 1806, and the external magnetic field of the motor 1300 and the rotation of the rotor in the motor 1300 are detected. External magnetic field detection and rotation detection signals SDW detected by the motor detector circuit 1806 are fed back to the motor pulse generator circuit 1805.

An alternating voltage SAC generated by the power generator 1600 is input to the rectifier circuit 1609 via a charging control circuit 1811, is converted into a DC voltage SDC by, for example, full-wave rectification, and is stored in the secondary power source 1500. A voltage SVB between both ends of the secondary power source 1500 is detected by a voltage detection circuit 1812 continuously or on demand. According to the excessive or deficient state of the charge amount in the secondary power source 1500, a corresponding charging control command SFC is input to the charging control circuit 1811. Based on the charging control command SFC, the stop and start of supply of the AC voltage SAC generated by the power generator 1600 to the rectifier circuit 1609 are controlled.

On the other hand, the DC voltage SDC stored in the secondary power source 1500 is input to a boosting circuit 1813 including a boosting capacitor 1813*a*, where it is multiplied by a predetermined factor. A boosted DC voltage SDU is stored in the large-capacity capacitor 1814.

Boosting is performed so that the motors and the circuits reliably operate even when the voltage of the secondary power source 1500 falls below the operating voltage therefor. That is, both the motors and the circuits are driven by electric energy stored in the large-capacity capacitor 1814. When the voltage of the secondary power source 1500 increases to approximately 1.3 V, the large-capacity capacitor 1814 and the secondary power source 1500 are connected in parallel during use.

A voltage SVC between both ends of the large-capacity capacitor 1814 is detected by the voltage detection circuit 1812 continuously or on demand. According to the amount of electricity remaining in the large-capacity capacitor 1814, a corresponding boosting command SUC is input to a boosting control circuit 1815. Thee boosting factor SWC of the boosting circuit 1813 is controlled based on the boosting command SUC. The boosting factor is a multiple by which the voltage of the secondary power source 1500 is multiplied to be generated in the large-capacity capacitor 1814, and is controlled to be a multiple, such as 3, 2, 1.5, or 1, expressed by dividing the voltage of the large-capacity capacitor 1814 by the voltage of the secondary power source 1500.

A start signal SST, a stop signal SSP, or a reset signal SRT from a switch A 1821 accompanying the start/stop button 1201 and a switch B 1822 accompanying the reset button 1202 is input to a mode control circuit 1824 for controlling the modes in the chronograph section 1200. The switch A 1821 includes the switch lever A 1243 serving as a switch holding mechanism, and the switch B 1822 includes the switch lever B 1257.

A signal SHD divided by the high-frequency dividing circuit 1802 is also input to the mode control circuit 1824. In response to a start signal SST, a start/stop control signal SMC is output from the mode control circuit 1824. In response to the start/stop control signal SMC, a chronograph reference signal SCB generated by a chronograph reference signal generator circuit 1825 is input to a motor pulse generator circuit 1826.

On the other hand, a chronograph reference signal SCB generated by the chronograph reference signal generator circuit 1825 is also input to a chronograph low-frequency dividing circuit 1827, and a signal SHD divided by the high-frequency dividing circuit 1802 is divided into frequencies of 64 Hz to 16 Hz in synchronization with the chronograph reference signal SCB. A signal SCD divided by the chronograph low-frequency circuit 1827 is input to the motor pulse generator circuit 1826.

The chronograph reference signal SCB and the divided signal SCD are input as timing signals to the motor pulse generator circuit 1826. The divided signal SCD becomes active with an output timing of the chronograph reference signal SCB, for example, every 1/10 second or every second. In response to the divided signal SCD and the like, pulses SPC for motor driving and for detecting the motor rotation and the like are generated. The motor driving pulse SPC generated in the motor pulse generator circuit 1826 is supplied to the motor 1400 in the chronograph section 1200, and the motor 1400 in the chronograph section 1200 is thereby driven. The pulse SPC for detecting the motor rotation and the like is supplied to a motor detector circuit 1828 with a timing different therefrom, and the external magnetic field of the motor 1400 and the rotation of the rotor in the motor 1400 are detected. External magnetic field detection and rotation detection signals SDG detected by the motor detector circuit 1828 are fed back to the motor pulse generator circuit 1826.

A chronograph reference signal SCB generated by the chronograph reference signal generator circuit 1825 is also input to an automatic stop counter 1829 of, for example, 16 bits, and is counted. When the count reaches a predetermined value, that is, the measurement limit time, an automatic stop signal SAS is input to the mode control circuit 1824. In this case, a stop signal SSP is input to the chronograph reference signal generator circuit 1825, and the chronograph reference signal generator circuit 1825 is thereby stopped and reset.

When the stop signal SSP is input to the mode control circuit 1824, output of the start/stop control signal SMC is stopped, and generation of the chronograph reference signal SCB is stopped, thereby stopping driving of the motor 1400 in the chronograph section 1200. After the generation of the chronograph reference signal SCB is stopped, that is, after the generation of a start/stop control signal SMC, which will be described later, is stopped, a reset signal SRT input to the mode control circuit 1824 is input as a reset control signal SRC to the chronograph reference signal generator circuit 1825 and the automatic stop counter 1829, so that the chronograph reference signal generator circuit 1825 and the automatic stop counter 1829 are reset, and the chronograph hands in the chronograph section 1200 are reset.

Figure 40:
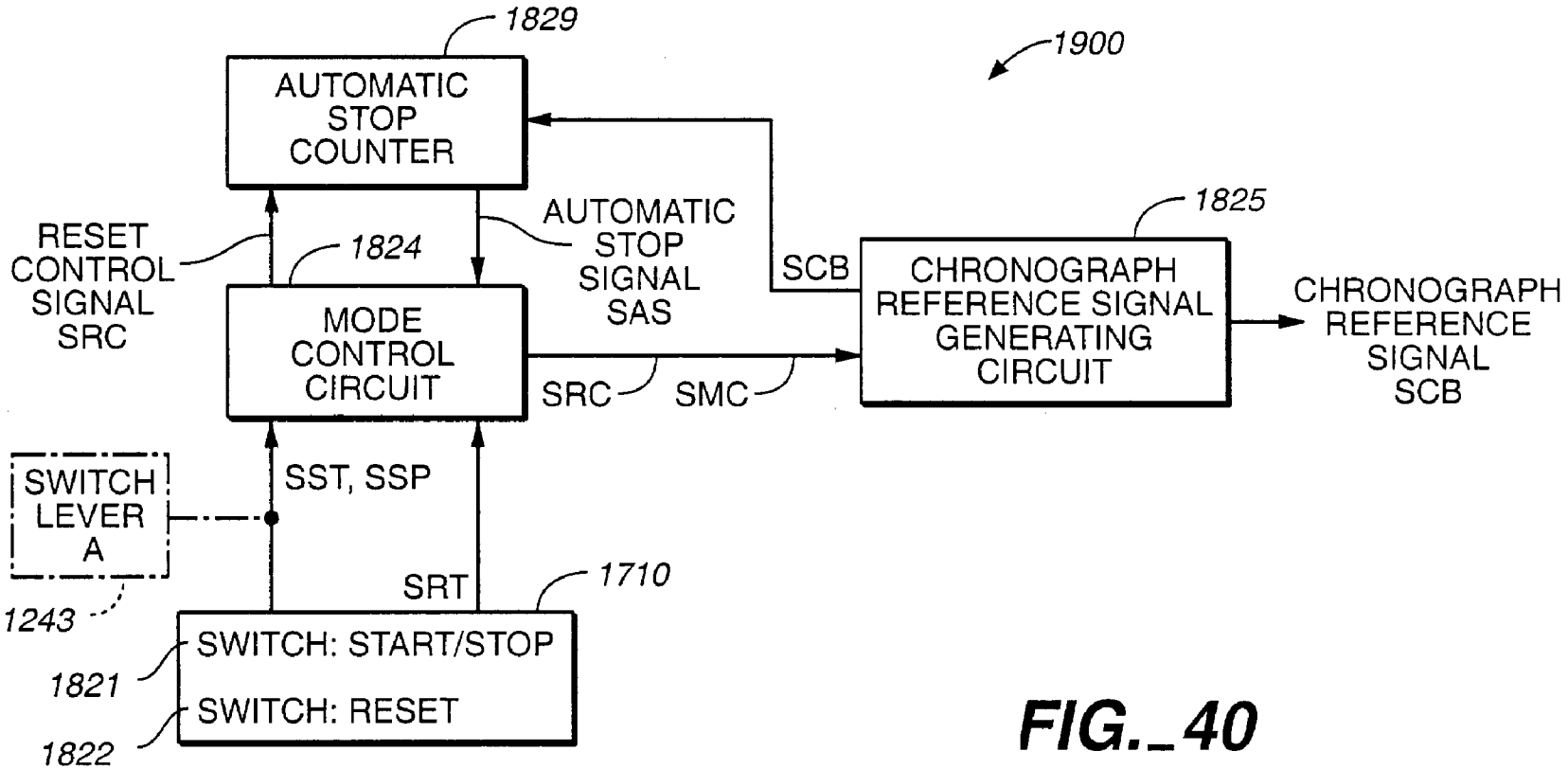
FIG. 40 is a circuit diagram showing an example of a configuration of a chronograph control section shown in FIG. 23 and the peripheral sections.

FIG. 40 is a block diagram showing the structure of the chronograph control section 1900 in the electronic timepiece 1000 having a chronograph shown in FIG. 23.

A "measurement mode" indicates a state in which time is being measured by the chronograph, and a "stop mode" indicates a state in which time measurement is stopped.

The chronograph control section 1900 comprises a switch 1710, the mode control circuit 1824, the chronograph reference signal generator circuit 1825, the automatic stop counter 1829, and the like, as shown in FIG. 40

The switch 1710 is a generic name of the start/stop switch 1821 and the reset switch 1822 to be operated by the start/stop button 1201 and the reset button 1202. The start/stop switch 1821 is turned on or off by operating the start/stop button 1201, and the reset switch 1822 is turned on or off by operating the reset button 1202.

The start/stop switch 1821 is mechanically held in the ON state by the switch lever A 1243. Thereby, for example, the start/stop switch 1821 is configured to be turned on by the first operation, and to be turned off by the second operation. Subsequently, this is repeated every time the start/stop switch 1821 is pushed. The reset switch 1822 is also subjected to almost the same operation, except that it is not held by the switch lever A 1243.

The mode control circuit 1824 outputs a start/stop control signal SMC or a reset control signal SRC to the chronograph reference signal generator circuit 1825 based on a start signal SST and a stop signal SSP, or a reset signal SRT from the switch 1710. The mode control circuit 1824 also outputs a reset control signal SRC to the automatic-stop counter 1829, the chronograph reference signal generator circuit 1825, and the like, thereby controlling the operation modes of the chronograph section 1200. The mode control circuit 1824 includes a circuit for preventing the reset switch 1822 from chattering. Details of the mode control circuit 1824 will be described later.

The chronograph reference signal generator circuit 1825 outputs a chronograph reference signal SCB to the motor pulse generator circuit 1826 based on the start/stop control signal SMC and the like from the mode control circuit 1824, thereby controlling the motor 1400. The chronograph reference signal generator circuit 1825 drives the motor 1400 when the start/stop control signal SMC is input thereto, and stops the motor 1400 when the signal is stopped.

The automatic stop counter 1829 starts measurement by the chronograph when a chronograph reference signal SCB is input from the chronograph reference signal generator circuit 1825 thereto, and counts chronograph reference signal SCB. The chronograph reference signal SCB serves as a synchronizing signal for timing the generation of motor pulses SPC, and the automatic stop counter 1829 counts the chronograph reference signals SCB. The automatic stop counter 1829 outputs an automatic stop signal SAS to the mode control circuit 1824 after the measured time has exceeded the maximum measurement time, for example, twelve hours, by a predetermined time.

Figure 41:
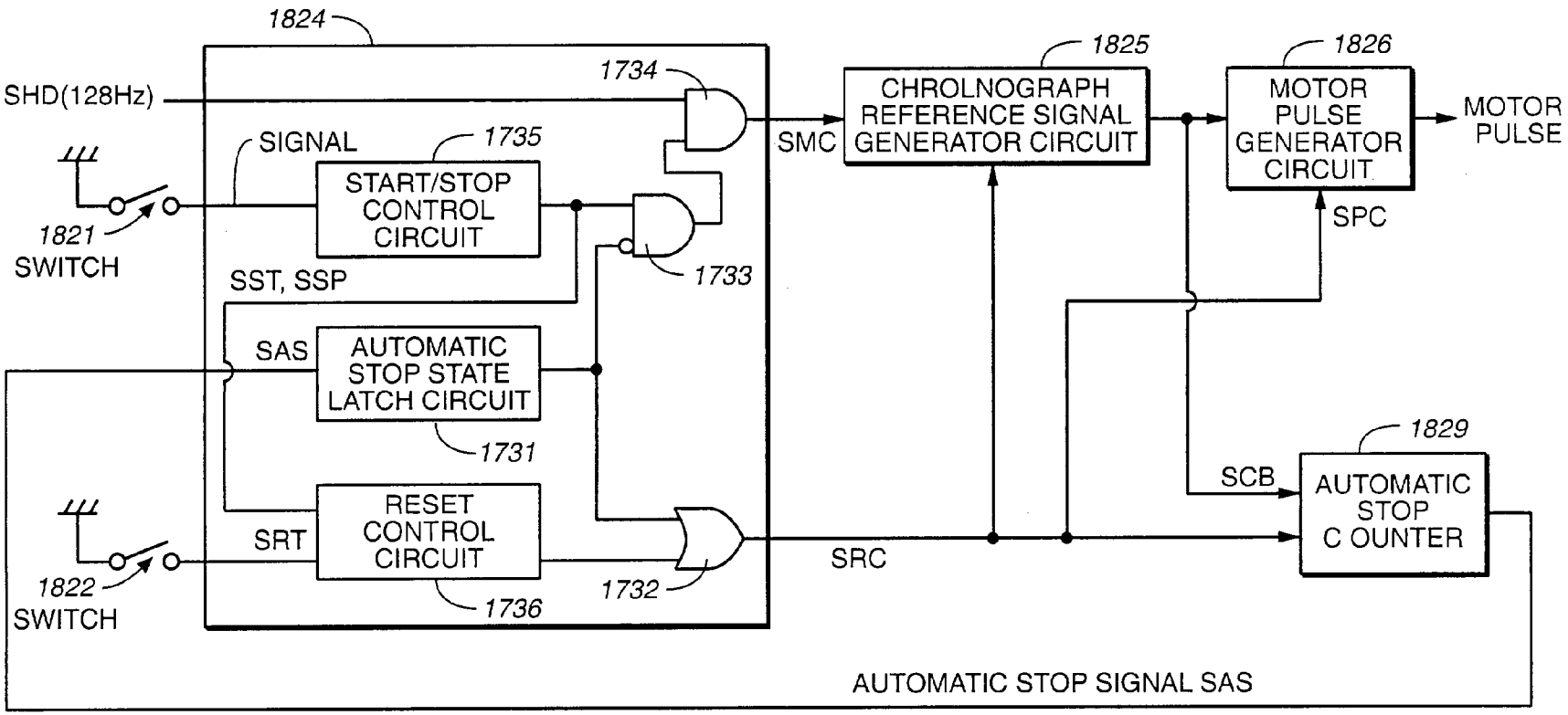
FIG. 41 is a circuit diagram showing an example of a configuration of a mode control circuit in the control section shown in FIG. 40.

FIG. 41 is a block diagram showing the configuration of the chronograph control section 1900 shown in FIG. 40 and the peripheral circuits.

The mode control circuit 1824 as a part of the chronograph control section 1900 comprises a start/stop control circuit 1735, a reset control circuit 1736, an automatic stop state latch circuit 1731, an OR circuit 1732, two AND circuits 1733 and 1734, and the like, as shown in FIG. 41.

The start/stop control circuit 1735 is a circuit for detecting the on/off state of the start/stop switch 1821. The start/stop control circuit 1735 outputs, to the AND circuit 1733 and the like, a signal indicating the measurement state or the non-measurement state in response to the operation of the start/stop switch 1821.

The reset control circuit 1736 is a circuit for detecting the on/off state of the reset switch 1822. The reset control circuit 1736 outputs, to the OR circuit 1732, a signal for resetting the chronograph control section 1900 or the like in response to the operation of the reset switch 1822.

In response to an automatic stop signal SAS from the automatic stop counter 1829, the automatic stop state latch circuit 1731 outputs, to the AND circuit 1733 and the OR circuit 1732, an L-level signal except in the automatic stop state, and outputs an H-level signal in the automatic stop state.

A signal from the automatic stop state latch circuit 1731 and a signal from the reset control circuit 1735 are input to the OR circuit 1732, and are output to the chronograph reference signal generator circuit 1825, the motor pulse generator circuit 1826, the automatic stop counter 1829, and the like. A signal formed by inverting a signal from the automatic stop state latch circuit 1731 and a signal output from the start/stop control circuit 1735 are input to the first AND circuit 1733. The first AND circuit 1733 produces output to the second AND circuit 1734. An output signal from the first AND circuit 1733 and a signal SHD (e.g., a pulse signal of 128 Hz) generated by the high-frequency dividing circuit 1802 shown in FIG. 39 are input to the second AND circuit 1734.

In such a configuration, the operation of the circuit shown in FIG. 41 will be described.

In the reset state, when the start/stop button 1201 is operated, the start/stop switch 1821 is turned on. Then, a start/stop signal SST is input to the mode control circuit 1824. The start/stop control circuit 1735 samples the ON state of the start/stop switch 1821. Therefore, in the mode control circuit 1824, the output from the AND circuit 1733 rises to the H level, a start/stop control signal SMC, which is a pulse signal of, for example, 128 Hz, is output from the AND circuit 1734 to the chronograph reference signal generating signal 1825, and the chronograph reference signal generator circuit 1825 outputs a chronograph reference signal SCB that is a pulse signal of, for example, 10 Hz. In this way, the motor pulse generator circuit 1826 outputs a motor pulse SPC for controlling the driving of the motor 1400 based on the chronograph reference signal SCB, thereby starting the hand movement in the chronograph section 1200 (time measuring section).

In this case, not only the chronograph hour hand 1211, the chronograph minute hand 1212, and chronograph second hand 1221 in the chronograph section 1200, but also the chronograph 1/10-second hand 1221 is always turning. Therefore, the user can read the elapsed time in the minimum measurement unit at any time during time measurement. In this way, since the hand movement in the electronic timepiece 1000 does not stop halfway, the user will not falsely recognize that trouble has occurred. Furthermore, the minimum unit time is always clearly indicated during time measurement in the electronic timepiece 1000, and this can delight the eyes of the user. The electronic timepiece 1000 has the power-generating section, and there is no fear that time measurement will be stopped halfway due to a shortage of capacitance in the battery. Therefore, time is allowed to be continuously indicated in the minimum measurement unit (e.g., indication by the chronograph 1/10-second hand 1231) that requires large electric power.

The automatic stop counter 1829 counts chronograph reference signals SCB from the chronograph reference signal generator circuit 1825. When the count reaches a value corresponding to the automatic stop position, the automatic stop counter 1829 outputs an automatic stop signal SAS to the automatic stop latch circuit 1731 in the mode control circuit 1824.

Since the automatic stop latch circuit 1731 outputs, for example, an H-level signal to the OR circuit 1732 and the AND circuit 1733, the OR circuit 1732 outputs an H-level signal, the chronograph reference signal generator circuit 1825, the motor pulse generator circuit 1826, and the automatic stop counter 1829 are reset, and hand movement in the chronograph section 1200 is stopped. Since the output signal from the AND circuit 1733 drops to the L level, the output from the AND circuit 1734 also drops to the L level, and the output of the start/stop control signal SMC from the mode control circuit 1824 to the chronograph reference signal generator circuit 1825 is stopped.

Figure 42:
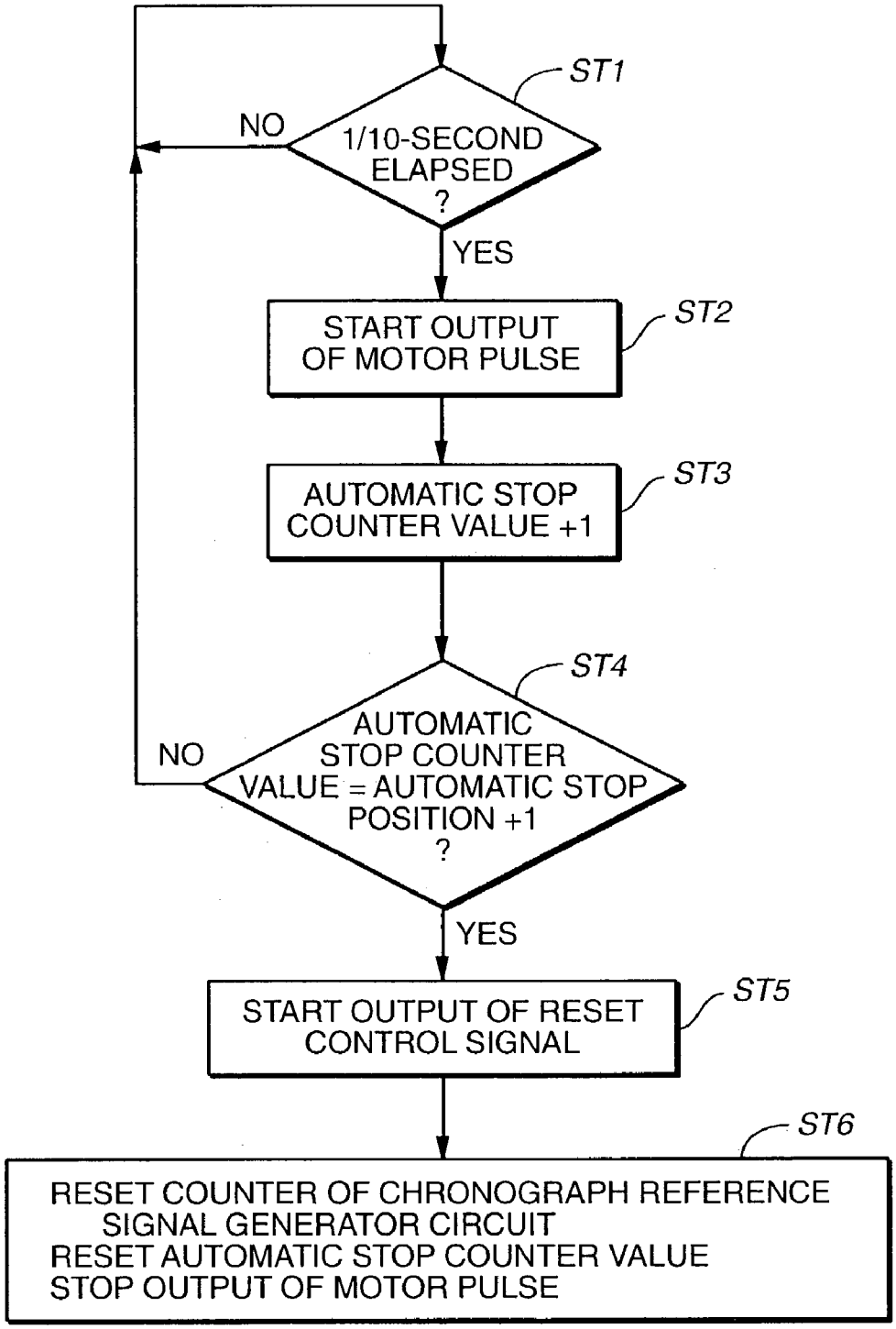
FIG. 42 is a flowchart showing an example of an operation of the chronograph control section shown in FIG. 40.

FIG. 42 is a flowchart showing the automatic stop process in the chronograph of the electronic timepiece 1000. The automatic stop process will be described below with reference to FIGS. 40 and 41.

Process Until Hand Reaches Automatic Stop Position

When the start/stop button 1201 is operated, a start/stop signal SST is input to the mode control circuit 1824. In response to this, the mode control circuit 1824 outputs a start/stop control signal SMC to the chronograph reference signal generator circuit 1825.

The chronograph reference signal generator circuit 1825 divides the start/stop control signal SMC of, for example, 128 Hz by 12 or 13, thereby generating a chronograph reference signal SCB of, for example, 10 Hz. Since the motor pulse SPC is output and counting is performed by the automatic stop counter 1829 in response to the trailing edge or the rising edge of the chronograph reference signal SCB, a standby state is maintained when the chronograph reference signal SCB does not change (Step ST1). When the chronograph reference signal SCB is output, the motor pulse generator circuit 1826 generates a motor pulse SPC in synchronization with the rising edge thereof, and starts output. In this way, hand movement is performed in the chronograph section 1200 (Step ST2).

The automatic stop counter 1829 increments the automatic stop count value by one on the rising edge of a chronograph reference signal SCB, for example, 1/128 seconds after the trailing edge of a chronograph reference signal SCB (Step ST3). In a case in which the incremented automatic stop count value is not equal to the sum of one and the count value corresponding to the automatic stop position of the hands in the chronograph section 1200, the above operation is performed again in Step ST1 (Step ST4). Thereby, hand movement in the chronograph section 1200 is performed, and time measurement is continued.

Process When Hand Reaches Automatic Stop Position

In a case in which the automatic stop count value is equal to the sum of one and the count value corresponding to the automatic stop position (Step ST4), the automatic stop counter 1829 outputs an automatic stop signal SAS to the mode control circuit 1824. In the mode control circuit 1824, the output signal from the automatic stop state latch circuit 1731 rises to the H level, and H-level reset control signals SRC are output from the OR circuit 1732 to the chronograph reference signal generator circuit 1825, the motor pulse generator circuit 1826, and the automatic stop counter 1829 (Step ST5). The chronograph reference signal generator circuit 1825, the motor pulse generator circuit 1826, and the automatic stop counter 1829 are thereby reset, the output of motor pulses SPC from the motor pulse generator circuit 1826 to the motor 1400 is stopped, as shown in FIG. 43, and the count value of the automatic stop counter 1829 becomes zero (Step ST6).

Figure 43:
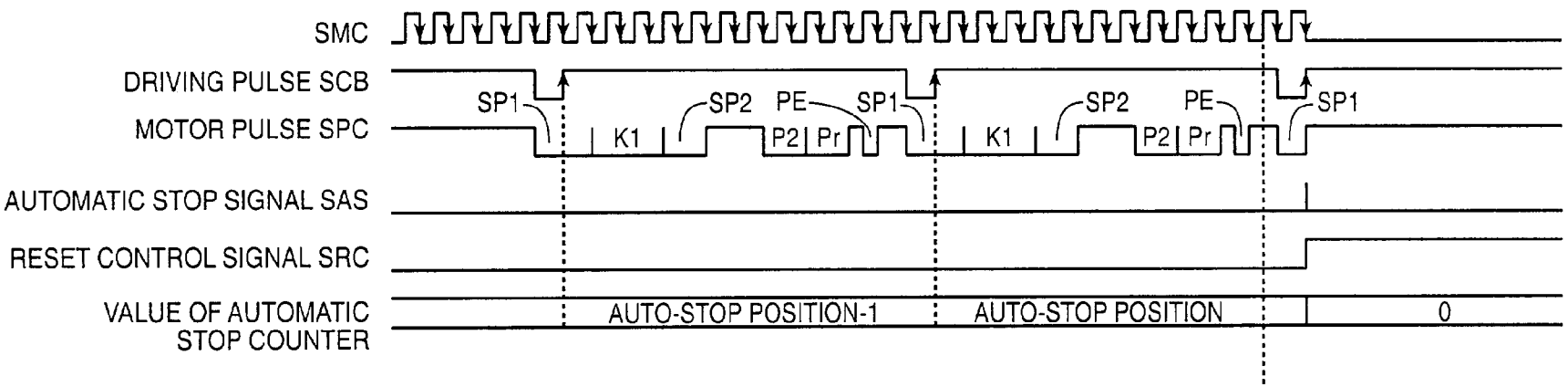
FIG. 43 is a timing chart showing signals in the portions of the chronograph control section shown in FIG. 40.

As is apparent from FIG. 43, since the automatic stop process is performed after the output of the motor pulses SPC is started, the motor pulses SPC are partly output. However, a pulse SP1 as a part of the motor pulse SPC serves as a pulse for detecting the external magnetic field, and is not a pulse for driving the motor 1400. Therefore, the hands are not moved and automatically stop at the preset automatic stop positions.

Figure 44:
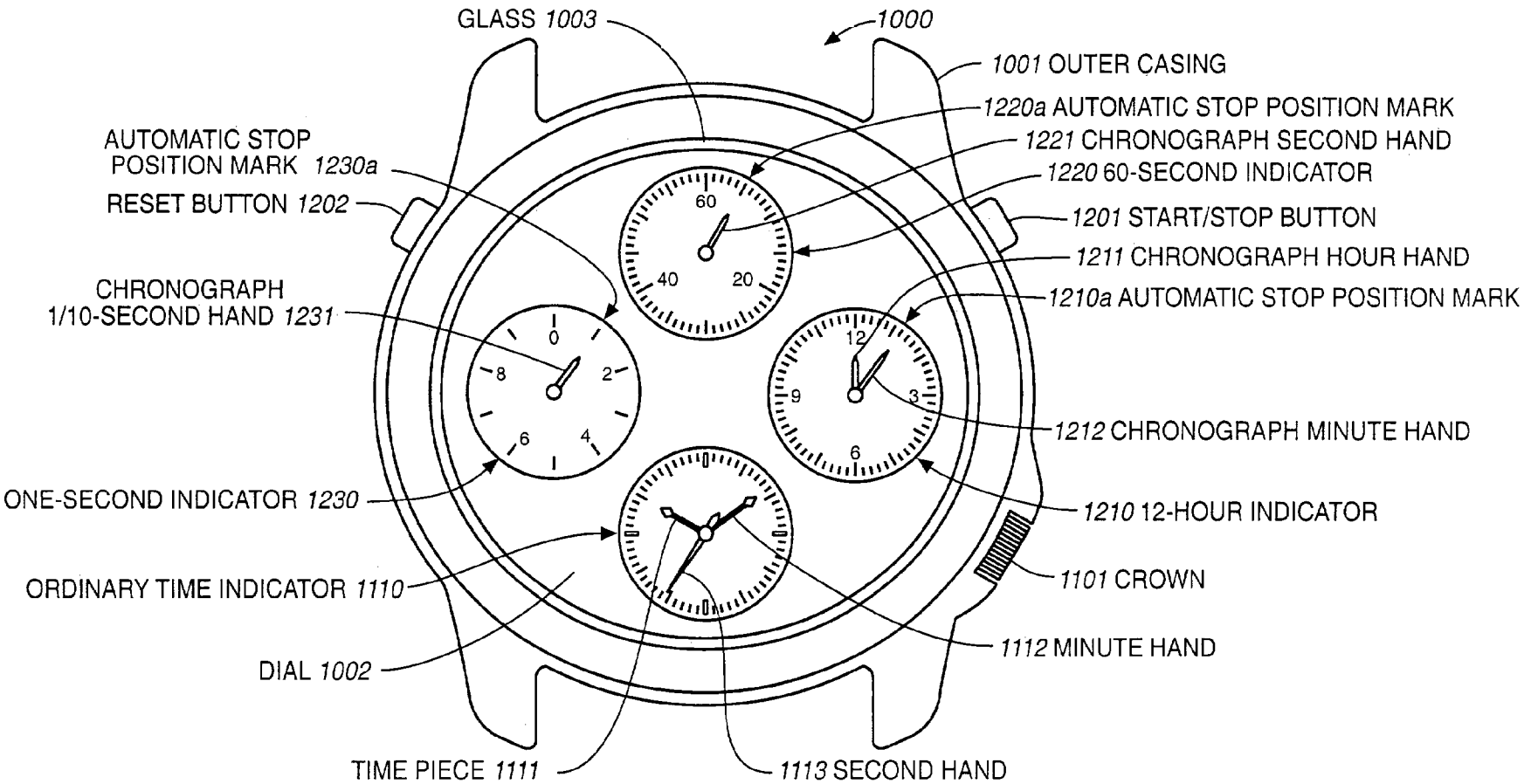
FIG. 44 is a schematic front view showing an example of an automatic stop state of the electronic timepiece shown in FIG. 23.

Thus, the hand movement in the chronograph section 1200 is stopped. In this case, the hands in the chronograph section 1200 are, as shown in FIG. 44, stopped at the hand positions exceeding the maximum measurement time, e.g., twelve hours, by a predetermined time. As the examples of the hand positions, when it is assumed that the maximum measurement time is set at, e.g., twelve hours, all the chronograph hour hand 1211, the chronograph minute hand 1212, the chronograph second hand 1221, and the chronograph 1/10-second hand 1231 may be at almost the same angle (e.g., 13 hours, 6 minutes, and 6.1 seconds), the hands other than the chronograph minute hand 1212 may be at almost the same angle (e.g., 12 hours, 6 minutes, and 6.1 seconds as shown in FIG. 44, 12 hours, 30 minutes, and 30.5 seconds, or 12 hours, 6 minutes, and 12.2 seconds), or only the chronograph second hand may be placed at a position different from the start position (e.g., 12 hours and 20 seconds).

In this state, the stop positions (orientations) of the chronograph minute hand 1212, the chronograph second hand 1221, the chronograph 1/10-second hand 1231 are unified in almost the same direction, as shown in FIG. 44. For this reason, the user can easily recognize that time measurement has automatically stopped. Therefore, the electronic timepiece 1000 can reliably urge the user to perform the stop operation and the reset operation in the next use.

While the automatic stop process is performed according to the flowchart shown in FIG. 42 in this embodiment, it may be performed by other methods.

Figure 45:
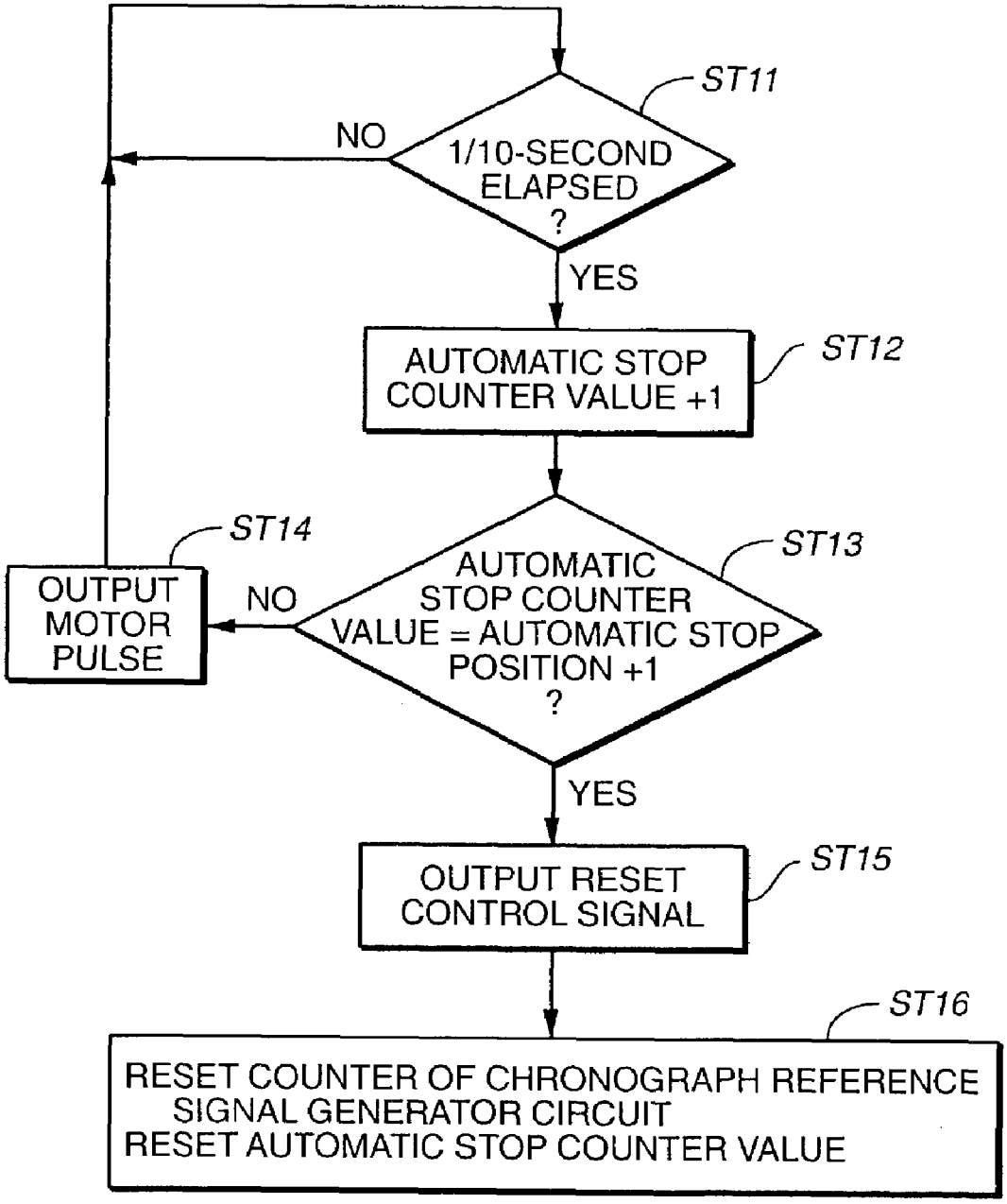
FIG. 45 is a flowchart showing another example of an operation of the chronograph control section shown in FIG. 40.

FIG. 45 is a flowchart showing another automatic stop process in the chronograph of the electronic timepiece 1000.

When the start/stop button 1201 is operated in the stop mode, a start signal SST is input to the mode control circuit 1824, and the mode control circuit 1824 outputs a start/stop control signal SMC to the chronograph reference signal generator circuit 1825, whereby measurement is started as follows.

The chronograph reference signal generator circuit 1825 creates a chronograph reference signal SCB of, for example, 10 Hz by dividing the start/stop control signal SMC of, for example, 128 Hz by 12 or 13. The operations of the motor pulse generator circuit 1826 and the automatic stop counter 1829 are on standby during the period other than creation (Step ST11). The automatic stop counter 1829 increments the automatic stop count value by one, for example, on the trailing edge of the chronograph reference signal SCB (Step ST12).

When it is determined in Step ST13 that the incremented automatic stop count value is not equal to the sum of one and the count value corresponding to the automatic stop position of the hands in the chronograph section 1200, a motor pulse SPC is generated on the trailing edge of the chronograph reference signal SCB, and is output to the motor 1400, thereby driving the motor 1400. The movement of the hands in the chronograph section 1200 is thereby performed. Subsequently, the above operation is performed again in Step ST11 (Step ST14).

In contrast, when the automatic stop count value is equal to the sum of one and the count value corresponding to the automatic stop position, the automatic stop counter 1829 outputs an automatic stop signal SAS to the mode control circuit 1824 (Step ST13). In the mode control circuit 1824, an output signal from the automatic stop state latch circuit 1731 rises to the H level, and an H-level reset control signal SRC is output from the OR circuit 1732 to the chronograph reference signal generator circuit 1825, the motor pulse generator circuit 1826, and the automatic stop counter 1829 (Step ST15).

In this way, the chronograph reference signal generator circuit 1825, the motor pulse generator circuit 1826, and the automatic stop counter 1829 are reset, and the count value of the automatic stop counter 1829 is made zero (Step ST16). In this case, the stop of the output of the motor pulse SPC may be omitted in Step ST16.

As described above, according to the present invention, in the electronic timepiece having a analog-display time measurement function, such as a chronograph, it is possible to stop the hand at a position differing from the measurement start hand position when the measured time exceeds the maximum measurement time during time measurement.

As an example of a position of the hand which is different from the measurement start position, when the maximum measurement time is twelve hours as in this embodiment, the hand positions indicating the time, e.g., 13 hours, 6 minutes, and 6.1 seconds, may be adopted, in which all the hands (the chronograph hour hand 1211, the chronograph minute hand 1212, the chronograph second hand 1221, the chronograph 1/10-second hand 1221) are oriented in almost the same direction. Furthermore, the hand positions showing the time, e.g., 12 hours, 6 minutes, and 6.1 seconds shown in FIG. 44, may be adopted, in which the hand other than the chronograph hour hand 1211 are substantially aligned. The hand positions indicating 12 hours, 30 minutes and 30.5 seconds, and 12 hours, 6 minutes, and 12.2 seconds, may be adopted. The hand positions indicating the time, e.g., 12 hours and 20 seconds, may be adopted, in which the hands other than the chronograph second hand 1221 are aligned.

The present invention is not limited to the above-described embodiment, and various modifications are possible without departing from the scope of the claims.

For example, while the chronograph hands stop oriented in almost the same direction when time measurement is automatically stopped because the maximum measurement time is over during the measurement, the hands may be stopped at the positions that the user can recognize at a glance. As an example of such positions that the user can recognize at a glance, the positions can be recognized at a glance, for example, by placing predetermined marks at the automatic stop position 1230*a* of the chronograph 1/10-second hand 1221, the automatic stop position 1220*a* of the chronograph second hand 1221, the automatic stop position 1210*a* of the chronograph minute hand 1212, and the like, as shown in FIG. 44. Furthermore, visual recognition is made easier by providing an indication, such as "AUTO STOP" at the positions on the dial 1002 corresponding to the automatic stop positions 1230*a*, 1220*a*, and 1210*a*.

While the electronic timepiece has been described as an example of the time measurement device in the above embodiment, the present invention may be applied to a portable watch, a table clock, a wristwatch, a wall clock, and the like.

In addition, while the secondary battery to be charged by the power generator has been described as an example of the power-supply battery for the electronic timepiece in the above embodiment, a conventional power-supply battery, such as a button battery, a solar battery, or the like may be adopted instead of or in addition to the secondary battery.

As described above, according to the present invention, even when time measurement is automatically stopped after the maximum measurement time has elapsed from the beginning of the time measurement, it is possible to inform the user of the automatic stop, and to urge the user to perform a stop operation and a reset operation in the next use, which prevents the measurement timing from being lost.

According to the present invention, the safety mechanism prevents the measured time from being initialized during time measurement. Therefore, time measurement is not made inaccurate due to a misoperation by the user with the time measurement function during time measurement.

According to the present invention, the user is allowed to visually recognize with use that time measurement is automatically stopped after the maximum measurement time has elapsed from the beginning of the time measurement.

According to the present invention, -when the predetermined maximum measurement time has elapsed since the time measurement by the chronograph is started, the hands automatically stop at preset hand positions. For this reason, the user can visually recognize with ease that time measurement has been automatically stopped.

According to the present invention, since the power generator is provided, there is no fear that time measurement will be stopped halfway due to a shortage of capacitance in the battery, which makes it possible to continuously indicate time in the minimum measurement unit that requires large electric power.

According to the present invention, since the hand for measuring the minimum unit time is constantly turning during time measurement, the elapsed time can be read in the minimum measurement unit at any time during time measurement. Since the time measurement device does not stop the movement of the hand halfway in this way, the user will not falsely recognize that trouble has occurred. Furthermore, time is clearly shown in the minimum unit during time measurement in the time measurement device, and this can delight the eyes of the user.

A preferred embodiment of the present invention will be described below with reference to the drawings.

Figure 46:
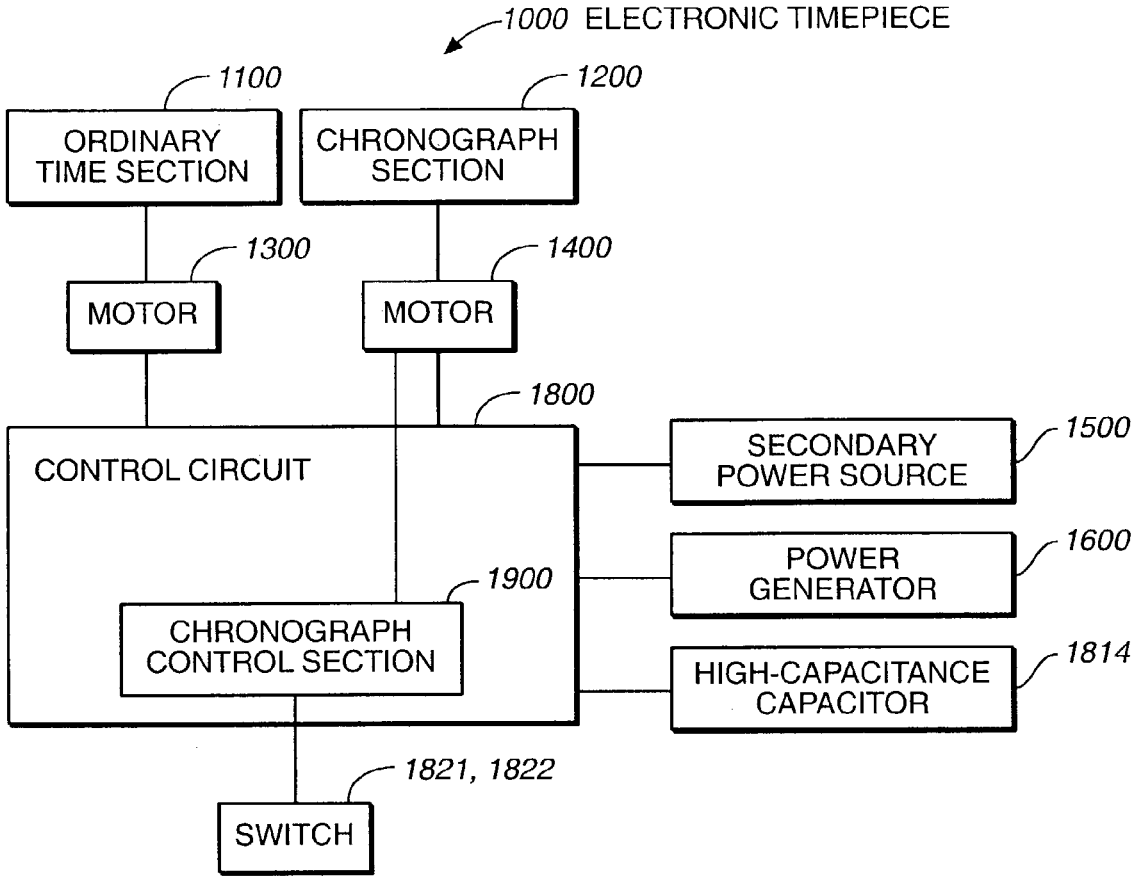
FIG. 46 is a schematic block diagram of an electronic timepiece serving as a time measurement device according to an embodiment of the present invention.

FIG. 46 is a schematic block diagram showing an electronic timepiece serving as a time measurement device according to an embodiment of the present invention.

This electronic timepiece 1000 comprises two motors 1300 and 1400 for driving an ordinary time section 1100 and a chronograph section 1200, a large-capacity capacitor 1814 and a secondary power source 1500 for supplying electric power for driving the motors 1300 and 1400, a power generator 1600 for charging the secondary power source 1500, and a control circuit 1800 for controlling the overall watch. Furthermore, the control circuit 1800 includes a chronograph control section 1900 having switches 1821 and 1822 for controlling the chronograph section 1200 by a method that will be described later.

This electronic timepiece 1000 is an analog type of electronic timepiece having a chronograph function, in which the two motors 1300 and 1400 are separately driven by using electric power generated by the single power generator 1600 to move the hands in the ordinary time section 1100 and the chronograph section 1200. The chronograph section 1200 is not reset by motor driving, but is mechanically reset, as will be described later.

Figure 47:
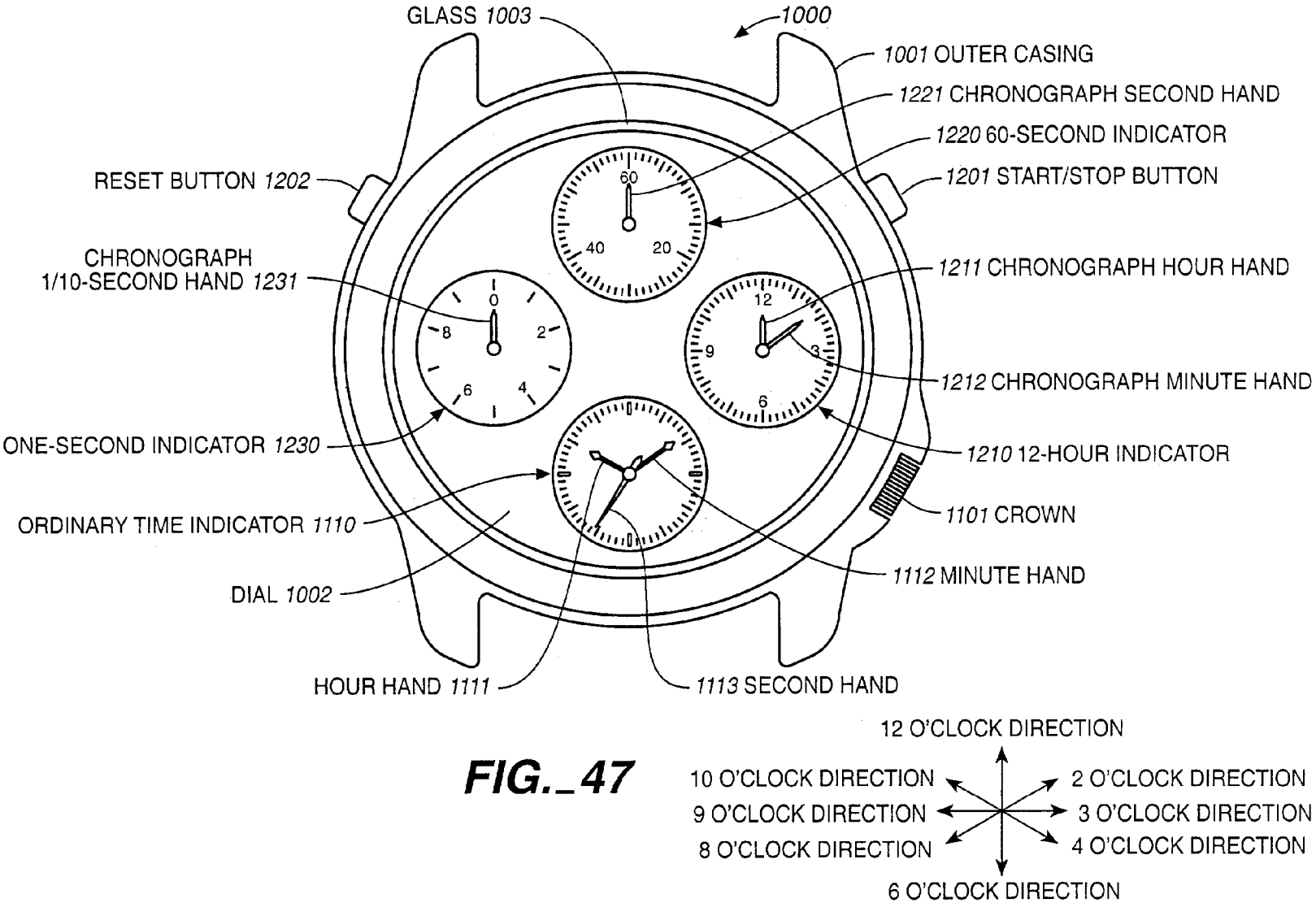
FIG. 47 is a plan view showing an example of the outward appearance of a finished article of the electronic timepiece shown in FIG. 46.

FIG. 47 is a plan view showing an example of the outward appearance of a completed article of the electronic timepiece shown in FIG. 46.

In this electronic timepiece 1000, a dial 1002 and a transparent glass 1003 are fitted inside an outer casing 1001. A crown 1101 serving as an external operating member is placed at 4 o'clock position of the outer casing 1001, and a start/stop button (first actuating section) 1201 and a reset button (second actuating section) 1202 for a chronograph are placed at 2 o'clock and 10 o'clock positions.

Furthermore, an ordinary time indicator 1110 having an hour hand 1111, a minute hand 1112, and a second hand 1113, which serve as ordinary time pointers, is placed at 6 o'clock position of the dial 1002, and indicators 1210, 1220, and 1230 having sub-hands for the chronograph are placed at 3 o'clock, 12 o'clock, and 9 o'clock positions. That is, the 12-hour indicator 1210 having chronograph hour and minute hands 1211 and 1212 is placed at 3 o'clock position, the 60-second indicator 1220 having a chronograph second hand 1221 is placed at 12 o'clock position, and a one-second indicator 1230 having a chronograph 1/10-second hand 1231 is placed at 9 o'clock position.

Figure 48:
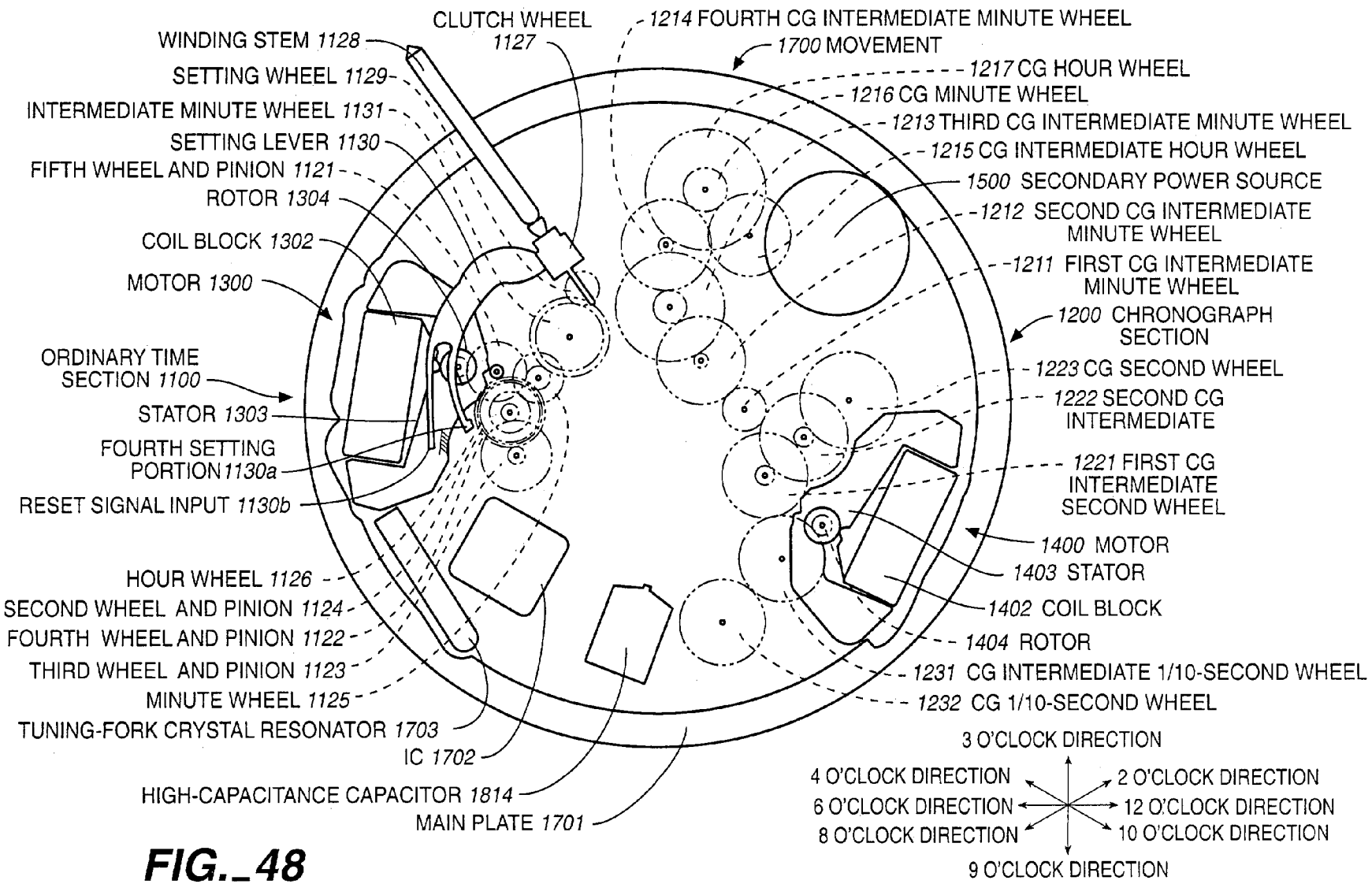
FIG. 48 is a plan view schematically showing an example of a structure of a movement in the electronic timepiece shown in FIG. 47, as viewed from the back side.

FIG. 48 is a plan view schematically showing an example of the structure of a movement in the electronic timepiece shown in FIG. 47.

In this movement 1700, the ordinary time section 1100, the motor 1300, and an IC 1702, a tuning-fork quartz resonator 1703, and the like are placed on 6 o'clock side of a main plate 1701, and the chronograph section 1200, the motor 1400, and the secondary power source 1500, such as a lithium-ion power source, are placed on 12 o'clock side.

The motors 1300 and 1400 are stepping motors, and include coil blocks 1302 and 1402 having magnetic cores made of a high-permeability material, stators 1303 and 1403 made of a high-permeability material, and rotors 1304 and 1404 composed of a rotor magnet and a rotor pinion.

The ordinary time section 1100 has a train of wheels, a fifth wheel and pinion 1121, a fourth wheel and pinion 1122, a third wheel and pinion 1123, a second wheel and pinion 1124, a minute wheel 1125, and an hour wheel 1126. The seconds, minutes, and hours in the ordinary time are indicated by these wheels.

Figure 49:
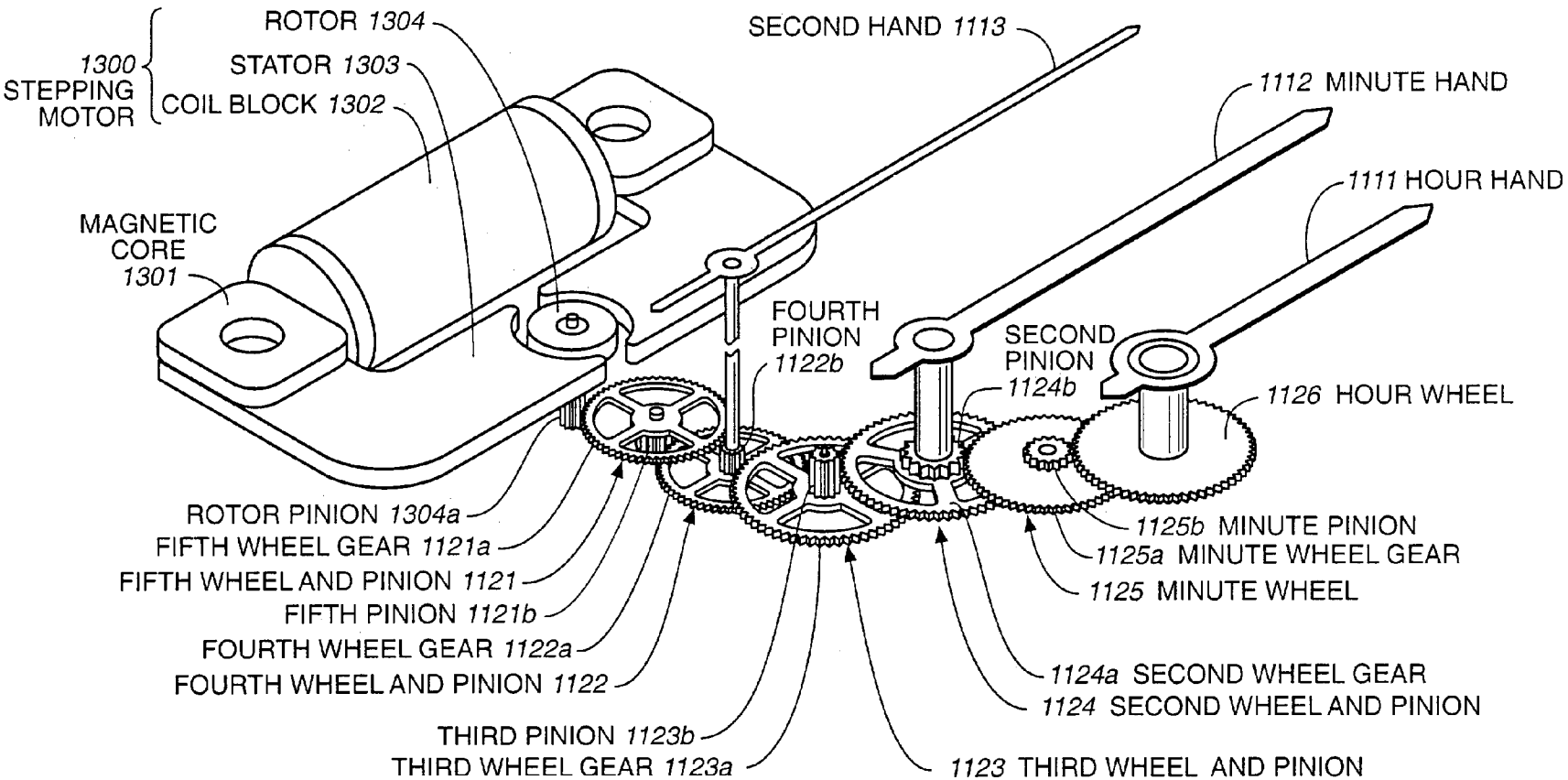
FIG. 49 is a perspective view showing an engagement state of a train of wheels in an ordinary time section in the movement of the electronic timepiece shown in FIG. 47.

FIG. 49 is a schematic perspective view showing the engagement state of the wheels in the ordinary time section 1100.

A rotor pinion 1304*a* is meshed with a fifth wheel gear 1121*a*, and a fifth pinion 1121*b* is meshed with a fourth wheel gear 1122*a*. The reduction ratio from the rotor pinion 1304*a* to the fourth wheel gear 1122*a* is set at 1/30. By outputting an electric signal from the IC 1702 so that the rotor 1304 rotates a half-turn per second, the fourth wheel and pinion 1122 makes one turn in sixty seconds, and the second hand 1113 fitted at the leading end thereof allows the second in ordinary time to be indicated.

A fourth pinion 1122*b* is meshed with a third wheel gear 1123*a*, and a third pinion 1123*b* is meshed with a second wheel gear 1124*a*. The reduction ratio from the fourth pinion 1122*b* to the second wheel gear 1124*a* is set at 1/60. The second wheel and pinion 1124 makes one turn in sixty minutes, and the minute hand 1112 fitted at the leading end thereof allows the minute in ordinary time to be indicated.

A second pinion 1124*b* is meshed with a minute wheel gear 1125*a*, and a minute pinion 1125*b* is meshed with the hour wheel 1126. The reduction ratio from the second pinion 1124*b* to the hour wheel 1126 is set at 1/12. The hour wheel 1126 makes one turn in twelve hours, and the hour hand 1111 fitted at the leading end thereof allows the hour in ordinary time to be indicated.

In FIGS. 47 and 48, the ordinary time section 1100 further comprises a winding stem 1128 that is fixed at one end to the crown 1101 and is fitted at the other end in a clutch wheel 1127, a setting wheel 1129, a winding stem positioning portion, and a setting lever 1130. The winding stem 1128 is structured to be drawn out stepwise by the crown 1101. A state in which the winding stem 1128 is not drawn out (zero stage) is an ordinary state. When the winding stem 1128 is drawn out to the first stage, the hour hand 1111 and the like are not stopped, and calendar correction is allowed. When the winding stem 1128 is drawn out to the second stage, the motion of the hands is stopped, and time correction is allowed.

When the winding stem 1128 is drawn out to the second stage by pulling the crown 1101, a reset signal input portion 1130*b* provided in the setting lever 1130 engaged with the winding stem positioning portion makes contact with a pattern formed on a circuit board having the IC 1702 mounted thereon, whereby the output of a motor pulse is stopped, and the motion of the hands is also stopped. In this case, the turn of the fourth wheel gear 1122*a* is regulated by a fourth setting portion 1130*a* provided in the setting lever 1130. When the winding stem 1128 is rotated together with the crown 1101 in this state, the rotation force is transmitted to the minute wheel 1125 via the sliding wheel 1127, the setting wheel 1129, and an intermediate minute wheel 1131. Since the second wheel gear 1124*a* is connected to the second pinion 1124*b* with a fixed sliding torque therebetween, even when the fourth wheel and pinion 1122 is regulated, the setting wheel 1129, the minute wheel 1125, the second pinion 1124*b*, and the hour wheel 1126 are allowed to turn. Since the minute hand 1112 and the hour hand 1111 are thereby turned, it is possible to set an arbitrary time.

In FIGS. 47 and 48, the chronograph section 1200 includes a train of wheels, a CG (chronograph) intermediate 1/10-second wheel 1231 and a CG 1/10-second wheel 1232. The CG 1/10-second wheel 1232 is placed at the center of the one-second indicator 1230. The structure of these train wheels allows 1/10-second indication in the chronograph at 9 o'clock position of the watch body.

In FIGS. 47 and 48, the chronograph section 1200 also includes a train of wheels, a CG first intermediate second wheel 1221, a CG second intermediate second wheel 1222, and a CG second wheel 1223. The CG second wheel 1223 is placed at the center of the sixty-minute indicator 1220. The structure of these train wheels allows second indication in the chronograph at 12 o'clock position of the watch body.

In FIGS. 47 and 48, the chronograph section 1200 also includes a train of wheels, a CG first intermediate minute wheel 1211, a CG second intermediate minute wheel 1212, a CG third intermediate minute wheel 1213, a CG fourth intermediate minute wheel 1214, a CG intermediate hour wheel 1215, a CG minute wheel 1216, and a CG hour wheel 1217. The CG minute wheel 1216 and the CG hour wheel 1217 are coaxially placed at the center of the 12-hour indicator 1220. The structure of the train wheels allows hour and minute indication in the chronograph at 3 o'clock position of the watch body.

Figure 50:
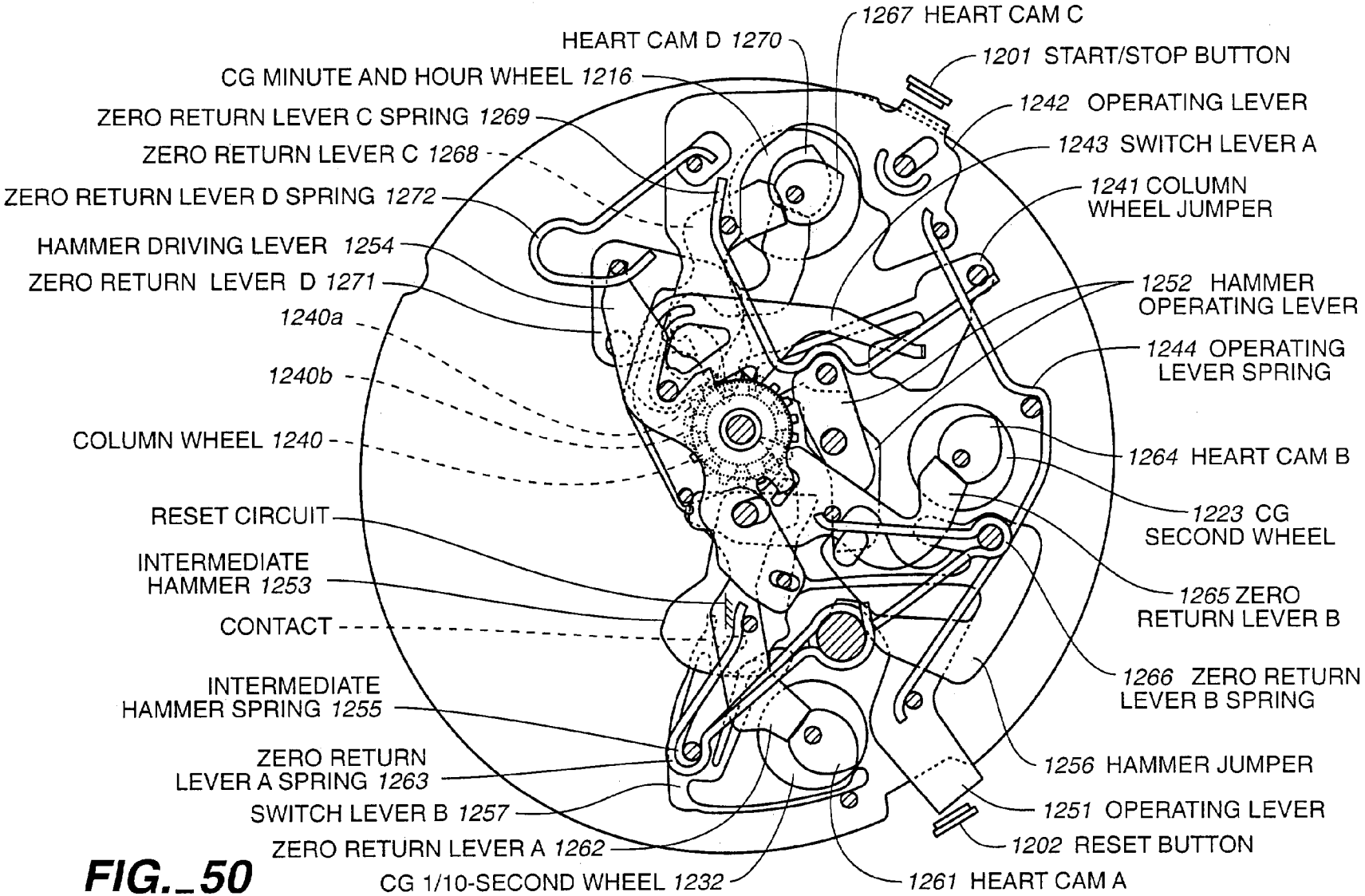
FIG. 50 is a plan view schematically showing an example of a configuration of a start/stop and reset (return to zero) operating mechanisms in a chronograph section of the electronic timepiece shown in FIG. 47.

FIG. 50 is a plan view schematically showing an example of the structure of start/stop and reset operating mechanisms in the chronograph section 1200, as viewed from the side of a rear cover of the watch.

Figure 51:
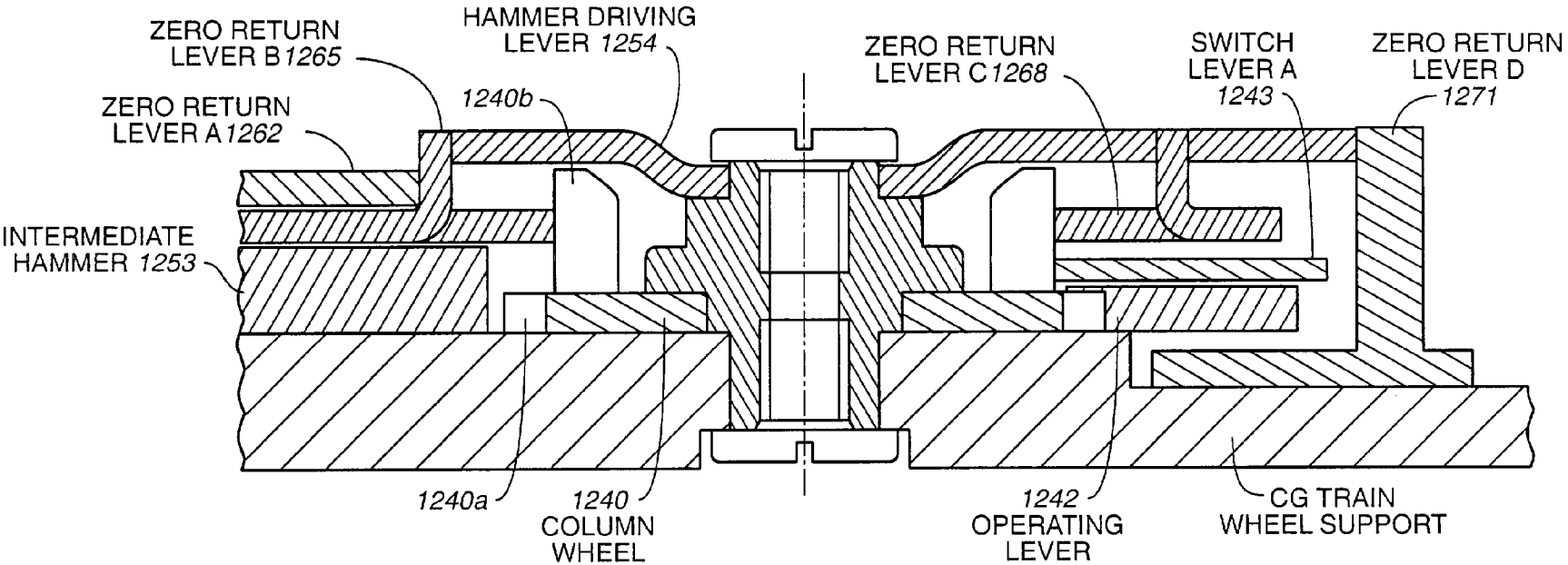
FIG. 51 is a sectional side view schematically showing an example of a configuration of the principal part of the start/stop and reset (return to a predetermined time) mechanisms in the chronograph section shown in FIG. 50.

FIG. 51 is a sectional side view schematically showing an example of the structure of the principal part thereof. These figures show a reset state.

The start/stop and reset operating mechanisms in the chronograph section 1200 are placed on the movement shown in FIG. 48, in which start/stop and reset operations are mechanically performed by the rotation of a column wheel 1240 disposed at about the center of the movement. The column wheel 1240 is cylindrically formed. The column wheel 1240 has on its side face teeth 1240*a* arranged with a fixed pitch along the periphery, and has on one end face columns 1240*b* arranged with a fixed pitch along the periphery. The phase of the column wheel 1240 at rest is regulated by a column wheel jumper 1241 retained between the teeth 1240*a*, and the column wheel 1240 is turned counterclockwise by a column wheel turning portion 1242*d* disposed at the leading end of an operating lever 1242.

Figure 52:
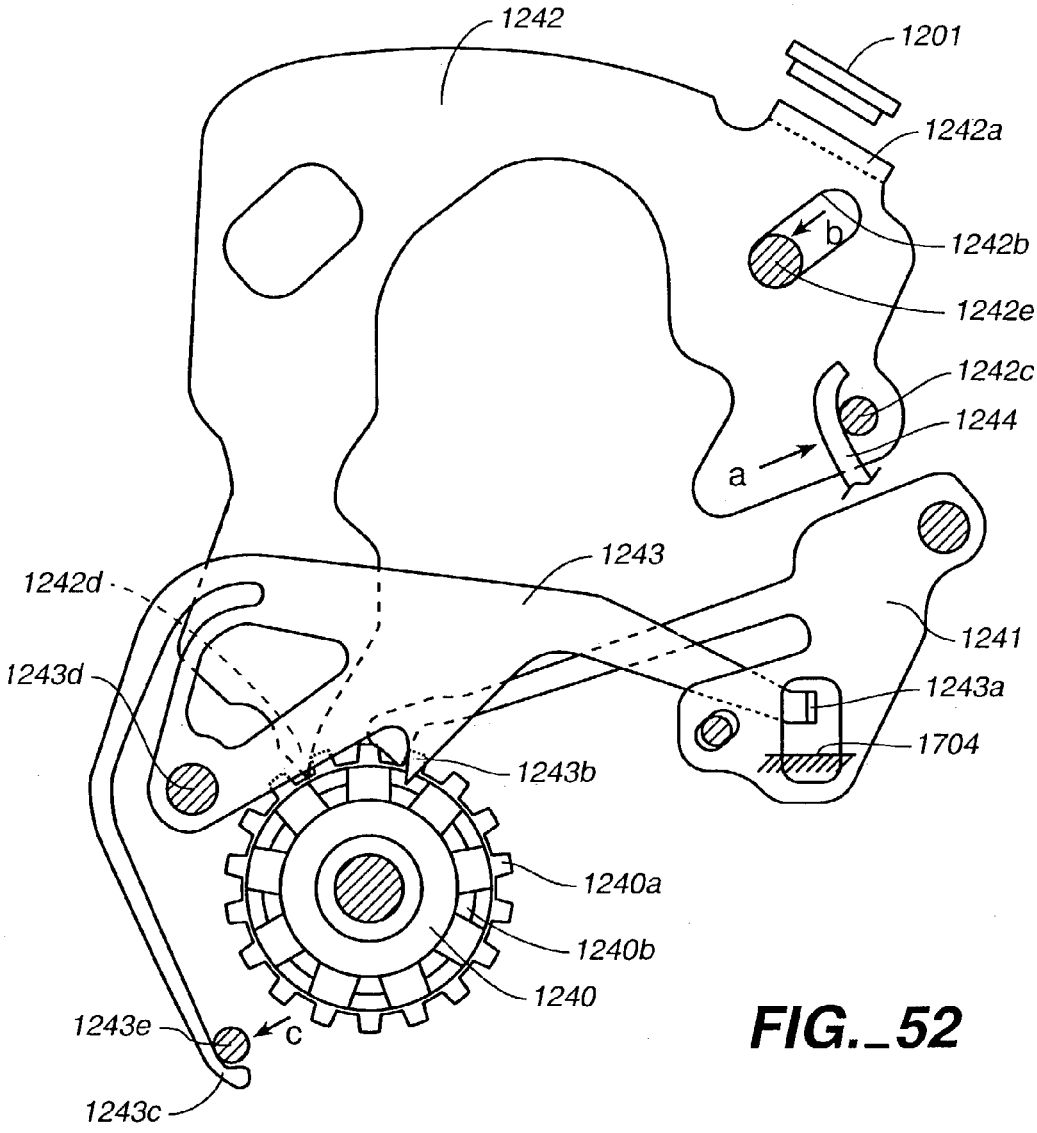
FIG. 52 is a plan view showing an example of an operation of the start/stop operating mechanism in the chronograph section shown in FIG. 50.

The start/stop operating mechanism (first actuating section) is composed of the operating lever 1242, a switch lever A 1243, and an operating lever spring 1244, as shown in FIG. 52.

The operating lever 1242 is shaped like a substantially L-shaped flat plate. The operating lever 1242 has at one end a bent pressure portion 1242*a*, an elliptical through hole 1242*b*, and pin 1242*c*, and has at the other leading end an acute pressure portion 1242*d*. Such an operating lever 1242 is constructed as the start/stop operating mechanism by placing the pressure portion 1242*a* so as to face the start/stop button 1201, inserting a pin 1242*e* fixed to the movement into the through hole 1242*b*, retaining one end of the operating lever spring 1244 by the pin 1242*c*, and placing the pressure portion 1242*d* adjacent to the column wheel 1240.

The switch lever A 1243 is formed as a switch portion 1243*a* at one end, is provided with a planar projection 1243*b* at about the center thereof, and is formed as a retaining portion 1243*c* at the other end. Such a switch lever A 1243 is constructed as the start/stop operating mechanism by pivotally supporting about the center thereof by a pin 1243*d* fixed to the movement, placing the switch portion 1243*a* adjacent to a start circuit in a circuit board 1704, placing the projection 1243*b* into contact with the column 1240*b* provided in the axial direction of the cam wheel 1240, and retaining the retaining portion 1243*c* by a pin 1243*e* fixed to the movement. That is, the switch portion 1243*a* of the switch lever A 1243 makes contact with the start circuit of the circuit board 1704 so as to serve as a switch input. The switch lever A 1243 that is electrically connected to the secondary power source 1500 via the main plate 1701 and the like has the same potential as that of the positive pole of the secondary power source 1500.

An example of an operation of the start/stop operating mechanism having the above-described configuration when actuating the chronograph section 1200 will be described with reference to FIGS. 52 to 54.

While the chronograph section 1200 is in a stop state, as shown in FIG. 52, the operating lever 1242 is positioned in a state in which the pressure portion 1242*a* is separate from the start/stop button 1201, the pin 1242*c* is pressed by elastic force of the operating lever spring 1244 in the direction of the arrow "a" in the figure, and one end of the through hole 1242*b* is pressed by the pin 1242*e* in the direction of the arrow "b" in the figure. In this case, a leading end portion 1242*d* of the operating lever 1242 is positioned between the teeth 1240*a* of the cam wheel 1240.

The switch lever A 1243 is positioned while the projection 1243*b* is pushed up by the column 1240*b* of the cam wheel 1240 against the spring force of a spring portion 1243*c* formed at the end of the switch lever A 1243, and the retaining portion 1243*c* is pressed by the pin 1243*d* in the direction of the arrow "c" in the figure. At this time, the switch portion 1243*a* of the switch lever A 1243 is separate from the start circuit of the circuit board 1704, whereby the start circuit is electrically cut off.

Figure 53:
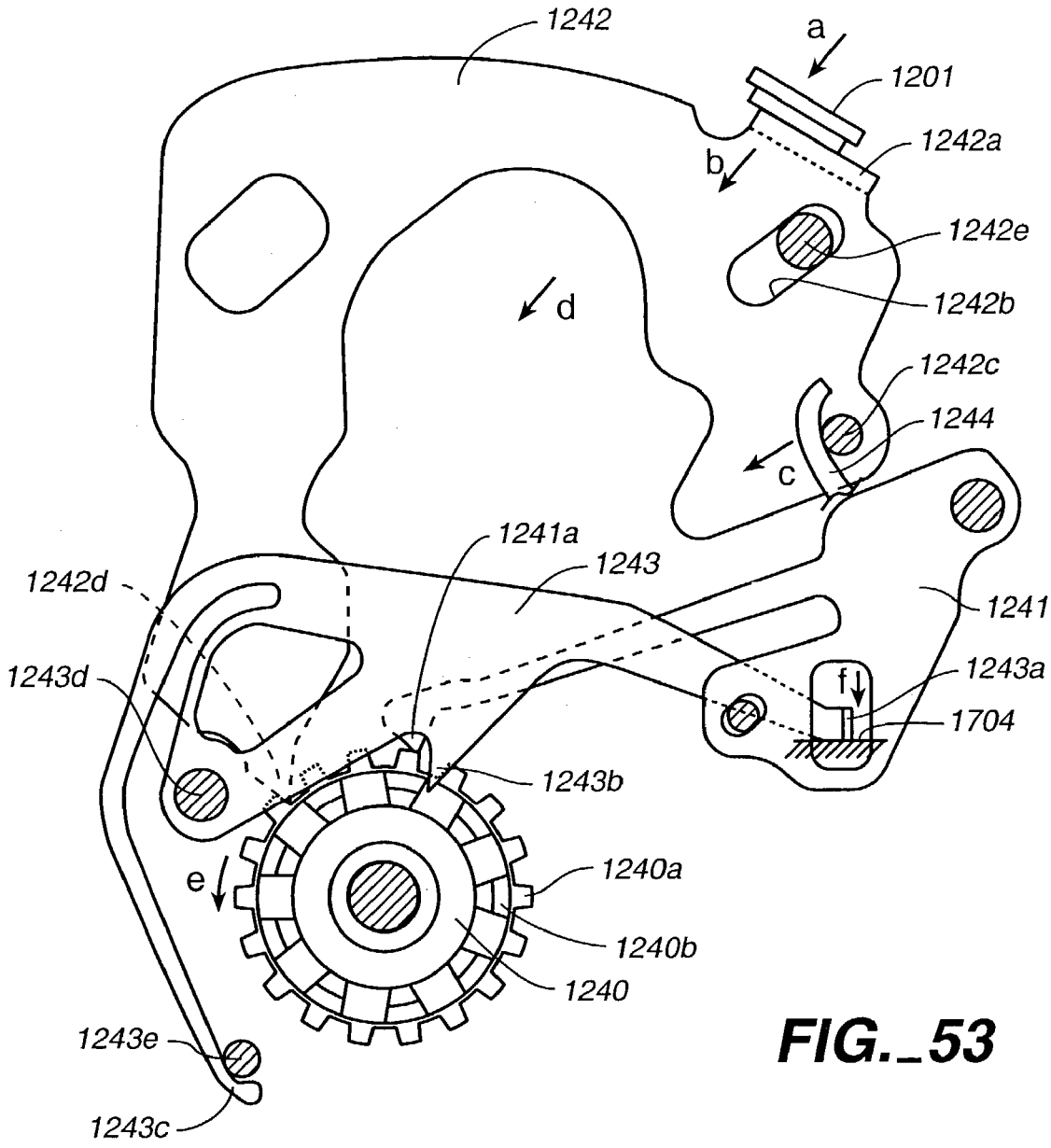
FIG. 53 is a second plan view showing an example of an operation of the start/stop operating mechanism in the chronograph section shown in FIG. 50.

As shown in FIG. 53, when the start/stop button 1201 is pushed in the direction of the arrow "a" in the figure in order to shift the chronograph section 1200 from this state to the start state, the pressure portion 1242*a* of the operating lever 1242 makes contact with the start/stop button 1201, and is pressed in the direction of the arrow "b" in the figure, and the pin 1242*c* presses and elastically deforms the operating lever spring 1244 in the direction of the arrow "c" in the figure. Therefore, the entire operating lever 1242 moves in the direction of the arrow "d" in the figure along the through hole 1242*b* and the pin 1242*e*. At this time, the leading end portion 1242*d* of the operating lever 1242 contacts and presses the side face of the tooth 1240*a* of the cam wheel 1240, thereby turning the cam wheel 1240 in the direction of the arrow "e" in the figure.

Simultaneously, when the side face of the column 1240*b* and the projection 1243*b* of the switch lever A 1243 are made out of phase by the turn of the cam wheel 1240, the projection 1243*b* reaches the gap between the columns 1240*b*, and is put into the gap by restoring force of the spring portion 1243*c*. Since the switch portion 1243*a* of the switch lever A 1243 turns in the direction of the arrow "f" in the figure and makes contact with the start circuit of the circuit board 1704, the start circuit is placed into an electrically conductive state.

In this case, the leading end portion 1241*a* of the cam wheel jumper 1241 is pushed up by the tooth 1240*a* of the cam wheel 1240.

The above operation is continued until the teeth 1240*a* of the cam wheel 1240 are fed by one pitch.

Figure 54:
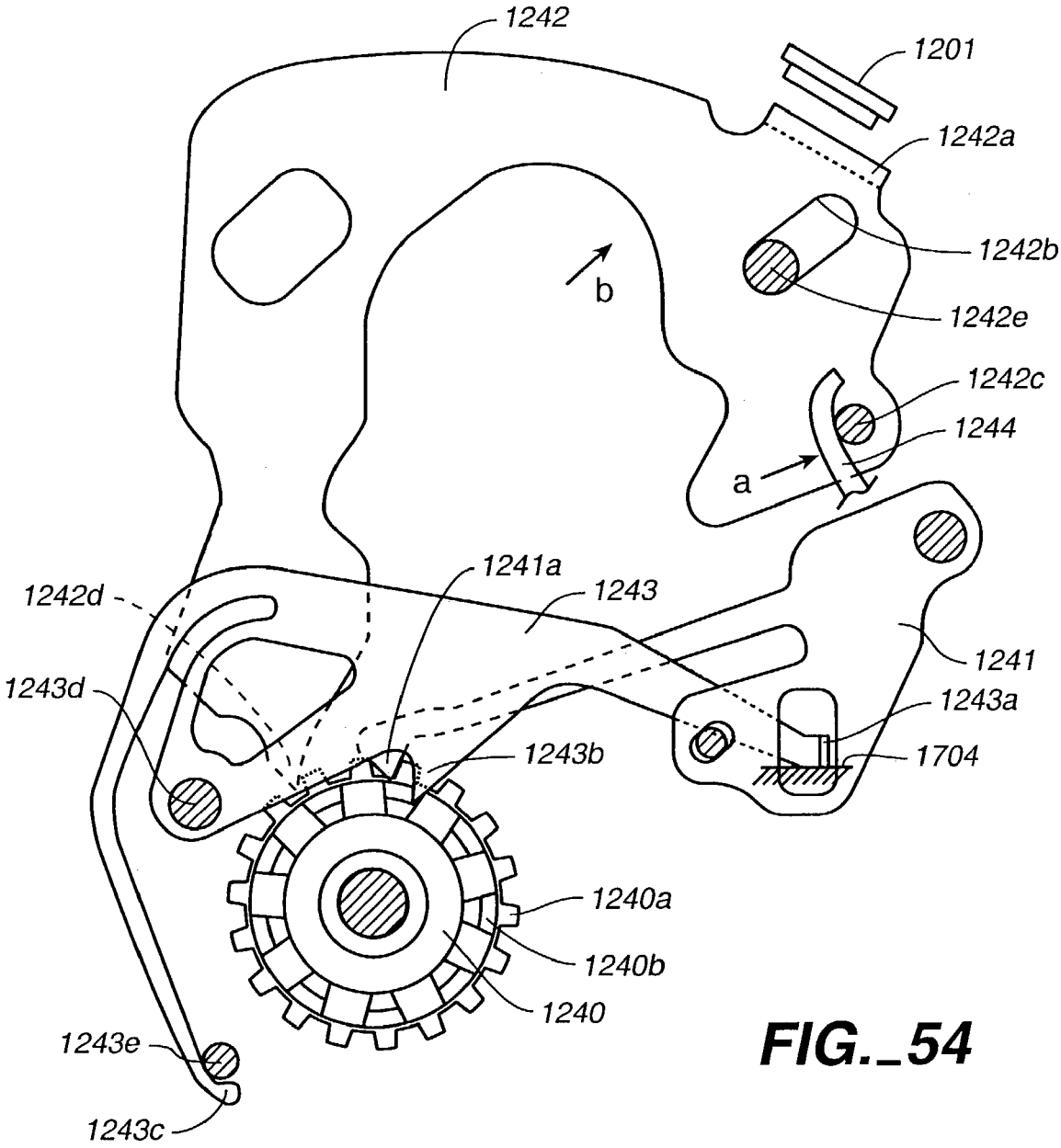
FIG. 54 is a third plan view showing an example of an operation of the start/stop operating mechanism in the chronograph section shown in FIG. 50.

Subsequently, when the hand is separated from the start/stop button 1201, the start/stop button 1201 automatically returns to its initial state by a spring built therein, as shown in FIG. 54. Then, the pin 1242*c* of the operating lever 1242 is pressed in the direction of the arrow "a" in the figure by restoring force of the operating lever spring 1244. Therefore, the entire operating lever 1242 moves along the through hole 1242*b* and the pin 1242*e* in the direction of the arrow "b" in the figure until one end of the through hole 1242*b* contacts the pin 1242*e*, and returns to the same position as shown in FIG. 52.

In this case, since the projection 1243*b* of the switch lever A 1243 remains inside the gap between the columns 1240*b* of the cam wheel 1240, the switch portion 1243*a* is in contact with the start circuit of the circuit board 1704, and the start circuit is held in the electrically conductive state. Therefore, the chronograph section 1200 is held in the start state.

At this time, the leading end portion 1241*a* of the cam wheel jumper 1241 is placed between the teeth 1240*a* of the cam wheel 1240, thereby regulating the phase of the cam wheel 1240 at rest in the turning direction.

In contrast, an operation similar to the above-described start operation is performed in order to stop the chronograph section 1200, and finally, the state shown in FIG. 52 is brought about again.

As described above, the start/stop of the chronograph section 1200 can be controlled by pivoting the operating lever 1242 by the operation of pushing the start/stop button 1201 so as to turn the cam wheel 1240 and to pivot the switch lever A 1243.

The reset operating mechanism (second actuating section) comprises, as shown in FIG. 50, the cam wheel 1240, an operating lever 1251, a hammer operating lever 1252, an intermediate hammer 1253, a hammer driving lever 1254, the operating lever spring 1244, an intermediate hammer spring 1255, a hammer jumper 1256, and a switch lever B 1257. The reset operating mechanism further comprises a heart cam A 1261, a zero return lever A 1262, a zero return lever A spring 1263, a heart cam B 1264, a zero return lever B 1265, a zero return lever B spring 1266, a heart cam C 1267, a zero return lever C 1268, a zero return lever C spring 1269, a heart cam D 1270, a zero return lever D 1271, and a zero return lever D spring 1272.

The reset operating mechanism in the chronograph section 1200 is structured so as not to operate while the chronograph section 1200 is in the start state, and so as to operate while the chronograph section 1200 is in the stop state. Such a mechanism is referred to as a "safety mechanism". First, the operating lever 1251, the hammer operating lever 1252, the intermediate hammer 1253, the operating lever spring 1244, the intermediate hammer spring 1255, and the hammer jumper 1256, which constitute the safety mechanism, will be described with reference to FIG. 55.

The operating lever 1251 is formed in the shape of a substantially Y-shaped flat plate. The operating lever 1251 has a pressure portion 1251*a* at one end, an elliptic through hole 1251*b* at one end of a fork, and a pin 1251*c* formed between the pressure portion 1251*a* and the through hole 1251*b*. Such an operating lever 1251 is constructed as the reset operating mechanism by placing the pressure portion 1251*a* to face the reset button 1202, inserting a pin 1252*c* of the hammer operating lever 1252 into the through hole 1251*b*, pivotally supporting the other fork by a pin 1251*d* fixed to the movement, and retaining the other end of the operating lever spring 1244 by the pin 1251*c*.

The hammer operating lever 1252 is composed of a first hammer operating lever 1252*a* and a second hammer operating lever 1252*b* shaped like a substantially rectangular flat plate, which overlap with each other and are pivotally supported by a shaft 1252*g* at about the center. The first hammer operating lever 1252*a* is provided with the pin 1252*c* at one end, and the second hammer operating lever 1252*b* is provided with pressure portions 1252*d* and 1252*e* at both ends. Such a hammer operating lever 1252 is constructed as the reset operating mechanism by inserting the pin 1252*c* in the through hole 1251*b* of the operating lever 1251, pivotally supporting the other end of the first hammer operating lever 1252*a* by a pin 1252*f* fixed to the movement, placing the pressure portion 1252*d* to face a pressure portion 1253*c* of the intermediate hammer 1253, and placing the pressure portion 1252*d* adjacent to the cam wheel 1240.

The intermediate hammer 1253 is shaped like a substantially rectangular flat plate. The intermediate hammer 1253 has pins 1253*a* and 1253*b* at one end and at the center, and one corner of the other end thereof is formed as a pressure portion 1253*c*. Such an intermediate hammer 1253 is constructed as the reset operating mechanism by retaining one end of the intermediate hammer spring 1255 by the pin 1253*a*, retaining one end of the hammer jumper 1256 by the pin 1253*b*, placing the pressure portion 1253*c* to face the pressure portion 1252*d* of the second hammer operating lever 1252*b*, and pivotally supporting the other corner at the other end by a pin 1253*d* fixed to the movement.

An example of an operation of the safety mechanism having the above-described configuration will be described with reference to FIGS. 55 to 58.

Figure 55:
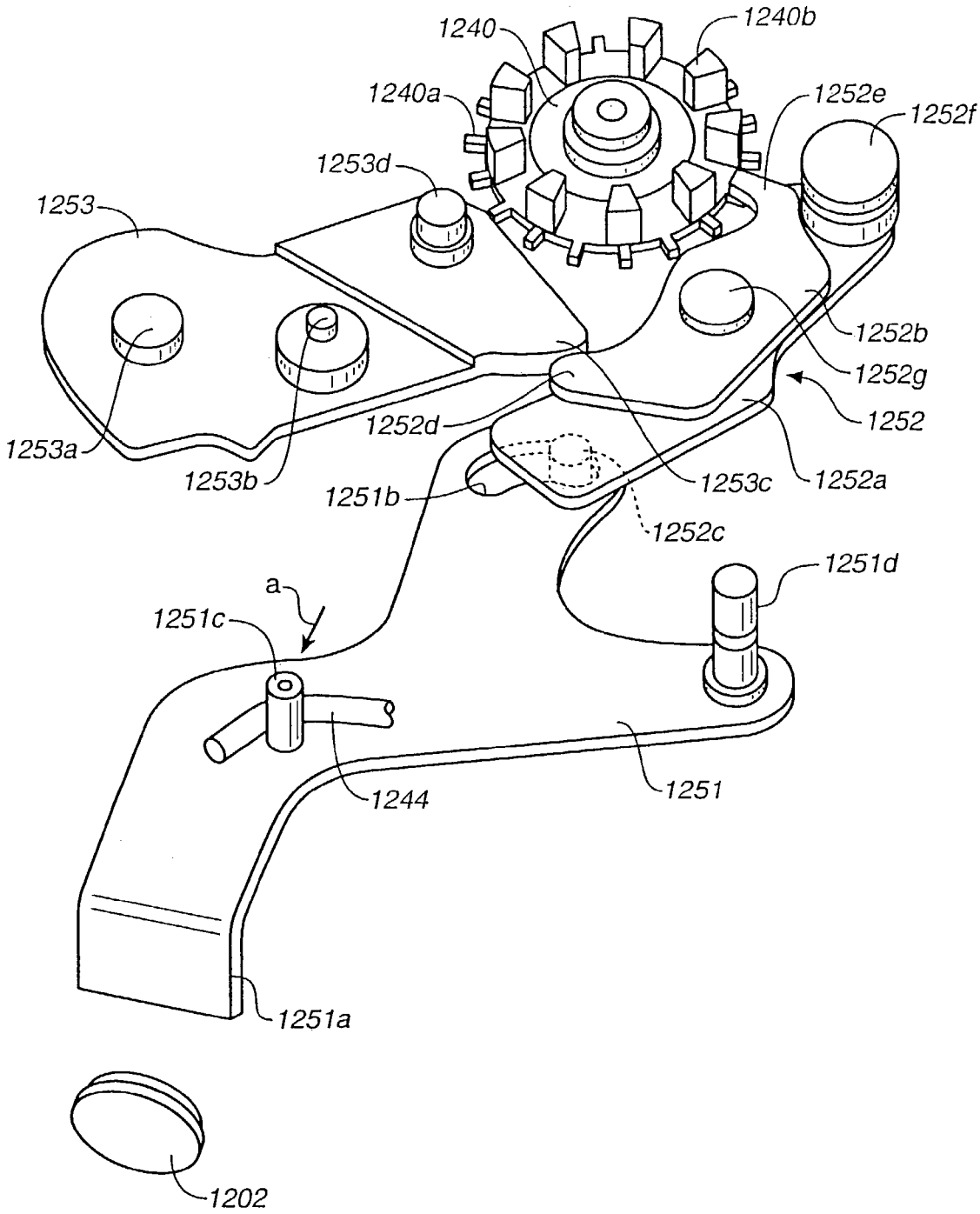
FIG. 55 is a first perspective view showing an example of an operation of a safety mechanism in the chronograph section shown in FIG. 50.

When the chronograph section 1200 is in the start state, the operating lever 1251 is positioned in a state in which the pressure portion 1251*a* is separate from the reset button 1202 and the pin 1251*c* is pressed by elastic force of the operating lever spring 1244 in the direction of the arrow "a" in the figure, as shown in FIG. 55. At this time, the pressure portion 1252*e* of the second hammer operating lever 1252*b* is positioned outside the gap between the teeth 1240*a* of the cam wheel 1240.

Figure 56:
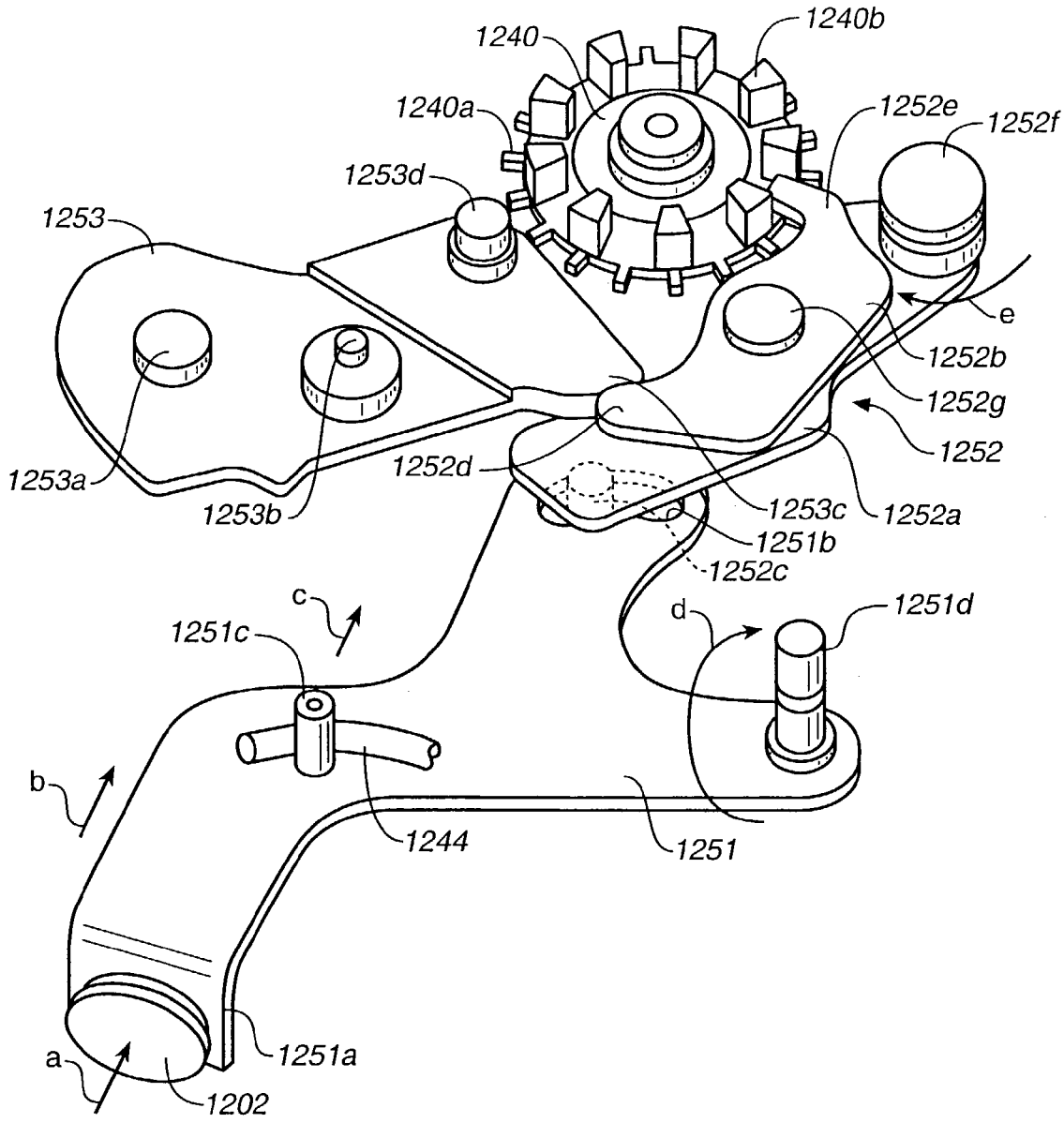
FIG. 56 is a second perspective view showing an example of an operation of the safety mechanism in the chronograph section shown in FIG. 50.

When the reset button 1202 in this state is pushed in the direction of the arrow "a", as shown in FIG. 56, the pressure portion 1251*a* of the operating lever 1251 makes contact with the reset button 1202 and is pressed in the direction of the arrow "b" in the figure, and the pin 1251*c* presses and elastically deforms the operating lever spring 1244 in the direction of the arrow "c" in the figure. Therefore, the entire operating lever 1251 turns on the pin 1251*d* in the direction of the arrow "d" in the figure. Since the operating lever 1251 also moves, with this turn, the pin 1252*c* of the first hammer operating lever 1252*a* along the through hole 1251*b* of the operating lever 1251, the first hammer operating lever 1252*a* turns on the pin 1252*f* in the direction of the arrow "e" in the figure.

In this case, since the pressure portion 1252*e* of the second hammer operating lever 1252*b* enters the gap between the columns 1240*b* of the cam wheel 1240, even when the pressure portion 1252*d* makes contact with the pressure portion 1253*c* of the intermediate hammer 1253, the pressure portion 1253*c* is not pressed by the pressure portion 1252*d* because the second hammer operating lever 1252*b* turns on the shaft 1252*g* to absorb the stroke. Since operating force of the reset button 1202 is cut off at the hammer operating lever 1252 and is not transmitted to the intermediate hammer 1253 and the subsequent reset operating mechanism, which will be described later, even if the reset button 1202 is inadvertently pushed while the chronograph section 1200 is in the start state, the chronograph section 1200 is prevented from being reset.

Figure 57:
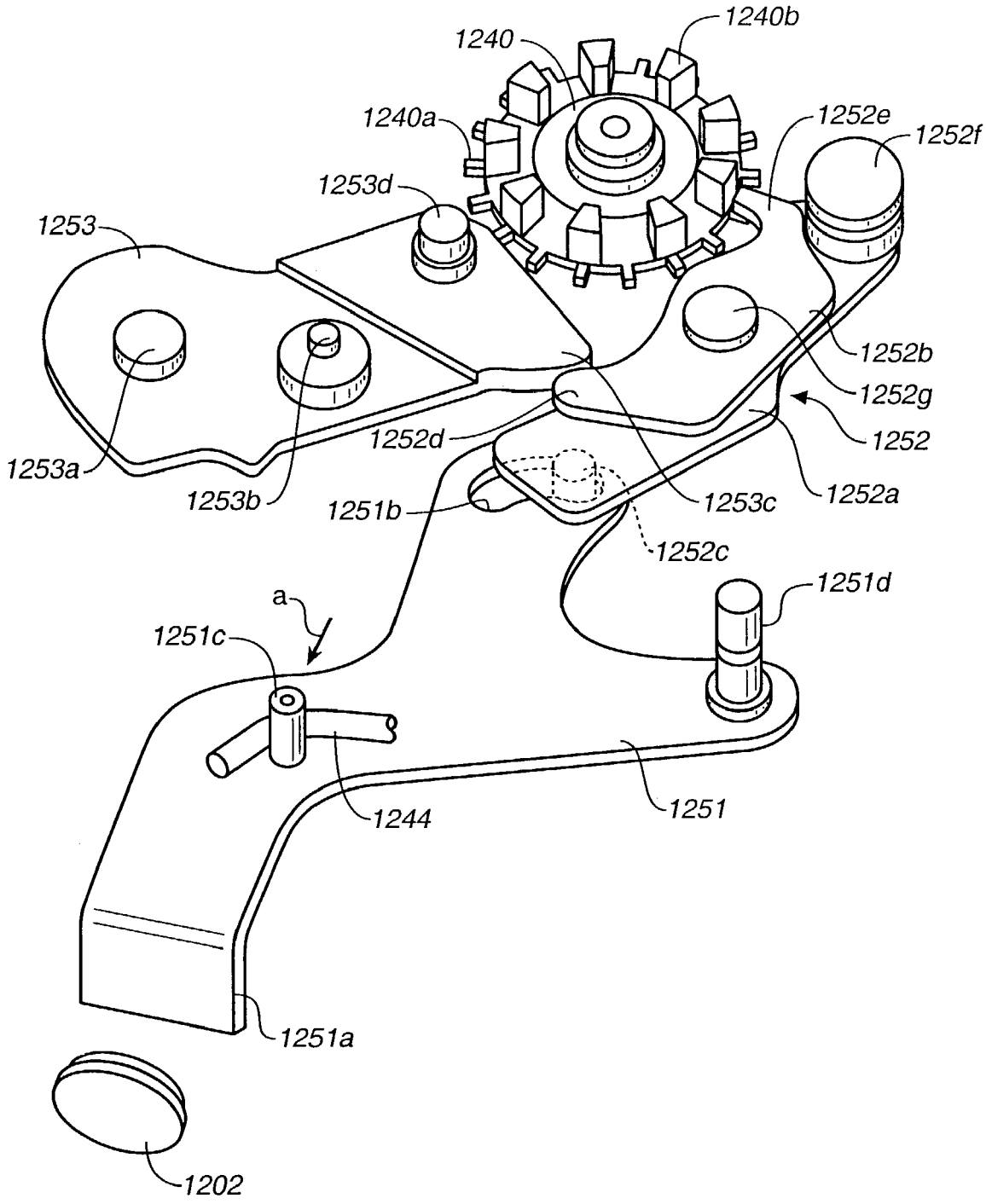
FIG. 57 is a third perspective view showing an example of the operation of the safety mechanism in the chronograph section shown in FIG. 50.

In contrast, while the chronograph section 1200 is in the stop state, as shown in FIG. 57, the operating lever 1251 is positioned in the state in which the pressure portion 1251*a* is separate from the reset button 1202, and the pin 1251*c* is pressed by the elastic force of the operating lever spring 1244 in the direction of the arrow "a" in the figure. At this time, the pressure portion 1252*e* of the second hammer operating lever 1252*b* is positioned outside the columns 1240*b* of the cam wheel 1240.

Figure 58:
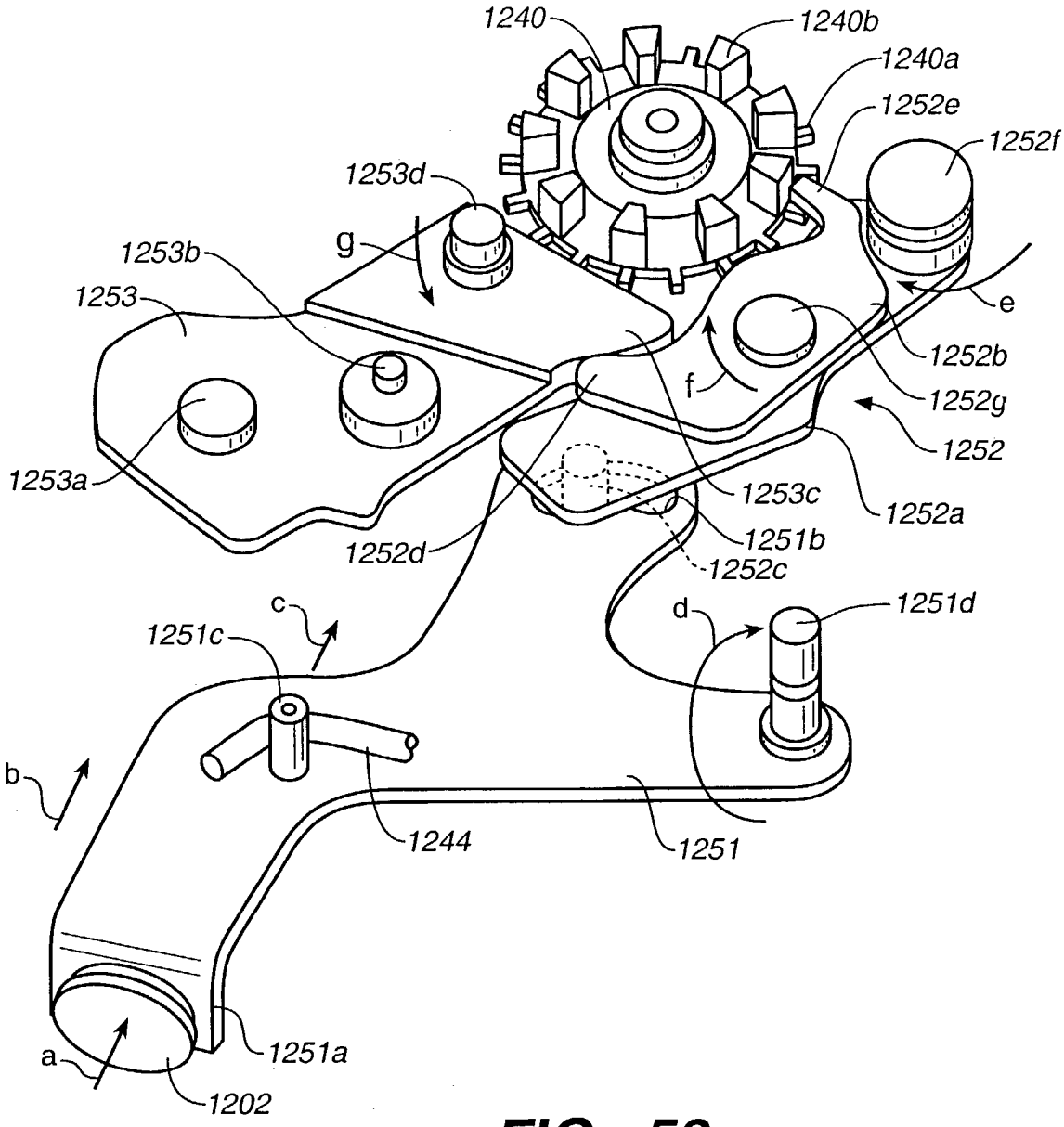
FIG. 58 is a fourth perspective view showing an example of an operation of the safety mechanism in the chronograph section shown in FIG. 50.

When the reset button 1202 is manually pushed in the direction of the arrow "a" in this state, as shown in FIG. 58, the pressure portion 1251*a* of the operating lever 1251 contacts the reset button 1202 and is pressed in the direction of the arrow "b" in the figure, and the pin 1251*c* presses and elastically deforms the operating lever spring 1244 in the direction of the arrow "c" in the figure. Therefore, the entire operating lever 1251 turns on the pin 1251*d* in the direction of the arrow "d" in the figure. Since the pin 1252*c* of the first hammer operating lever 1252*a* is moved along the through hole 1251*b* with this turn, the first hammer operating lever 1252*a* turns on the pin 1252*f* in the direction of the arrow "e" in the figure.

In this case, since the pressure portion 1252*e* of the second hammer operating lever 1252*b* is stopped by the side face of the column 1240*b* of the cam wheel 1240, the second hammer operating lever 1252*b* turns on the shaft 1252*g* in the direction of the arrow "f" in the figure. Since the pressure portion 1252*d* of the second hammer operating lever 1252*b* contacts and presses the pressure portion 1253*c* of the intermediate hammer 1253 with this turn, the intermediate hammer 1253 turns on the pin 1253*d* in the direction of the arrow "g" in the figure. Since the operating force of the reset button 1202 is transmitted to the intermediate hammer 1253 and the subsequent reset operating mechanism, which will be described later, the chronograph section 1200 can be reset by pushing the reset button 1202 when it is in the stop state. When resetting is performed, a contact of the switch lever B 1257 makes contact with a reset circuit of the circuit board 1704, thereby electrically resetting the chronograph section 1200.

Next, description will be given of the hammer driving lever 1254, the heart cam A 1261, the zero return lever A 1262, the zero return lever A spring 1263, the heart cam B 1264, the zero return lever B 1265, the zero return lever B spring 1266, the heart cam C 1267, the zero return lever C 1268, the zero return lever C spring 1269, the heart cam D 1270, the zero return lever D 1271, and the zero return lever D spring 1272, which constitute the principal structure of the reset operating mechanism in the chronograph section 1200 shown in FIG. 50, with reference to FIG. 59.

The hammer driving lever 1254 is shaped like a substantially I-shaped flat plate. The hammer driving lever 1254 has an elliptic through hole 1254*a* at one end, a lever D restraining portion 1254*b* at the other end, and a lever B restraining portion 1254*c* and a lever C restraining portion 1254*d* at the center. Such a hammer driving lever 1254 is constructed as the reset operating mechanism by rotationally fixing the center thereof and inserting the pin 1253*b* of the intermediate hammer 1253 into the through hole 1254*a*. The heart cams A 1261, B 1264, C 1267, and D 1270 are fixed to the rotation shafts of the CG 1/10-second wheel 1232, the CG second wheel 1223, the CG minute wheel 1216, and the CG hour wheel 1217, respectively.

The zero return lever A 1262 is formed at one end as a hammer portion 1262*a* for hammering the heart cam A 1261, is provided with a turn regulating portion 1262*b* at the other end, and is provided with a pin 1262*c* at the center. Such a zero return lever A 1262 is constructed as the reset operating mechanism by pivotally supporting the other end by a pin 1253*d* fixed to the movement and retaining one end of the zero return lever A spring 1263 by the pin 1262*c*.

The zero return lever B 1265 is formed at one end as a hammer portion 1265*a* for hammering the heart cam B 1264, is provided at the other end with a turn regulating portion 1265*b* and a pressure portion 1265*c*, and is provided with a pin 1265*d* at the center. Such a zero return lever B 1265 is constructed as the reset operating mechanism by pivotally supporting the other end by the pin 1253*d* fixed to the movement and retaining one end of the zero return lever B spring 1266 by the pin 1265*d*.

The zero return lever C 1268 is formed at one end as a hammer portion 1268*a* for hammering the heart cam C 1267, is provided at the other end with a turn regulating portion 1268*b* and a pressure portion 1268*c*, and is provided with a pin 1268*d* at the center. Such a zero return lever C 1268 is constructed as the reset operating mechanism by pivotally supporting the other end by a pin 1268*e* fixed to the movement and retaining one end of the zero return lever C spring 1269 by the pin 1268*d*.

The zero return lever D 1271 is formed at one end as a hammer portion 1271*a* for hammering the heart cam D 1270, and is provided with a pin 1271*b* at the other end. Such a zero return lever D 1271 is constructed as the reset operating mechanism by pivotally supporting the other end by a pin 1271*c* fixed to the movement and retaining one end of the zero return lever D spring 1272 by the pin 1271*b*.

An example of an operation of the reset operating mechanism having the above-described configuration will be described with reference to FIGS. 59 and 60.

Figure 59:
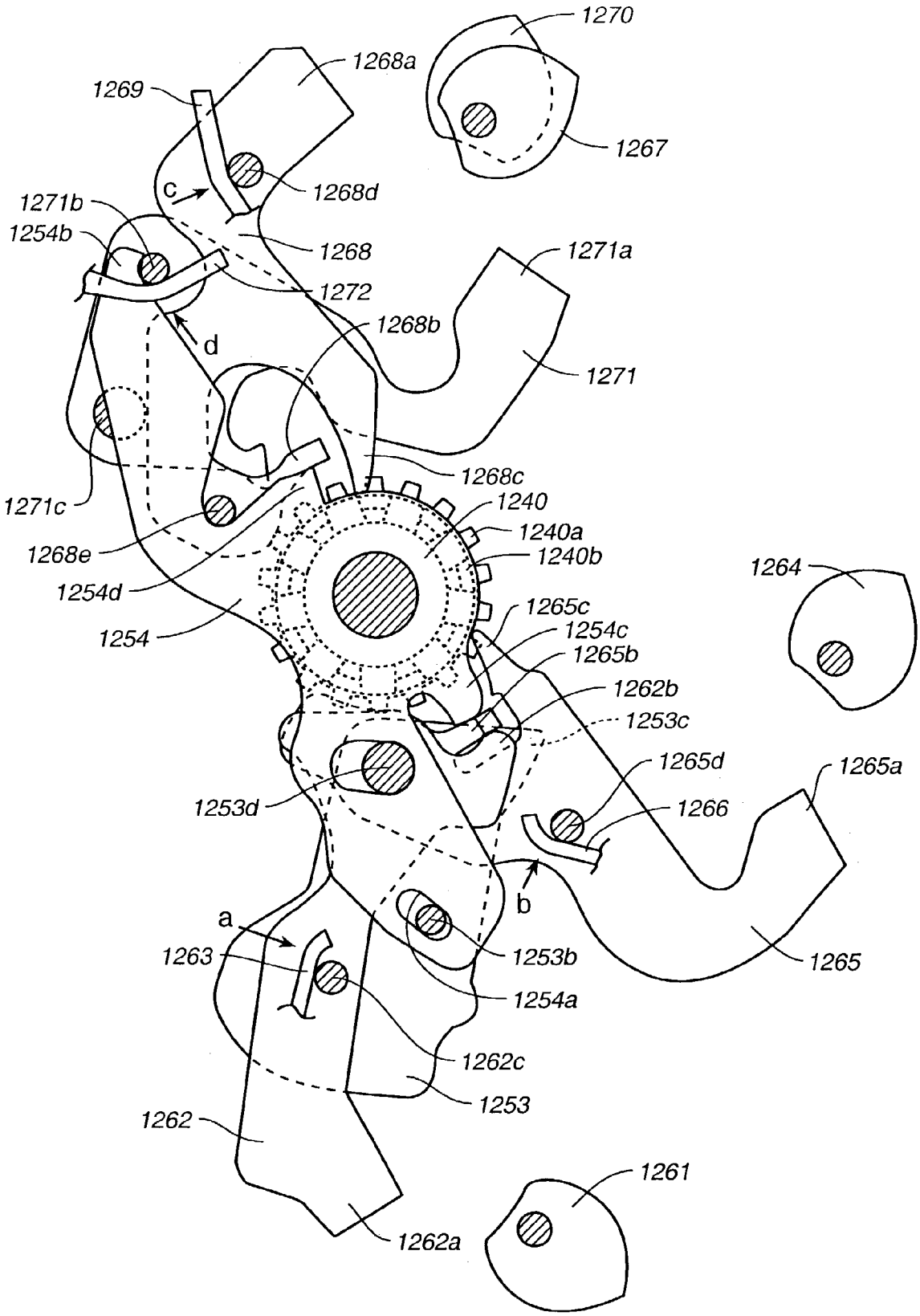
FIG. 59 is a first plan view showing an example of an operation of the principal mechanism of the reset operating mechanism in the chronograph section shown in FIG. 50.

When the chronograph section 1200 is in the stop state, as shown in FIG. 59, the zero return lever A 1262 is positioned while the turn regulating portion 1262*b* is retained by the turn regulating portion 1265*b* of the zero return lever B 1265, and the pin 1262*c* is pressed by the elastic force of the zero return lever A spring 1263 in the direction of the arrow "a" in the figure.

The zero return lever B 1265 is positioned while the turn regulating portion 1265*b* is retained by the lever B restraining portion 1254*c* of the hammer driving lever 1254, the pressure portion 1265*c* is pressed by the side face of the column 1240*b* of the cam wheel 1240, and the pin 1265*d* is pressed by the elastic force of the zero return lever B spring 1266 in the direction of the arrow "b" in the figure.

The zero return lever C 1268 is positioned while the turn regulating portion 1268*b* is retained by the lever C restraining portion 1254*d* of the hammer driving lever 1254, the pressure portion 1268*c* is pressed by the side face of the column 1240*b* of the cam wheel 1240, and the pin 1268*d* is pressed by the elastic force of the zero return lever C spring 1269 in the direction of the arrow "c" in the figure.

The zero return lever D 1271 is positioned while the pin 1271*b* is retained by the lever D restraining portion 1254*b* of the hammer driving lever 1254, and is pressed by the elastic force of the zero return lever D spring 1272 in the direction of the arrow "d" in the figure.

Therefore, the hammer portions 1262*a*, 1265*a*, 1268*a*, and 1271*a* of the zero return levers A1262, B 1265, C 1268, and D 1271 are respectively positioned at a predetermined distance from the heart cams A1261, B 1264, C 1267, and D 1270.

Figure 60:
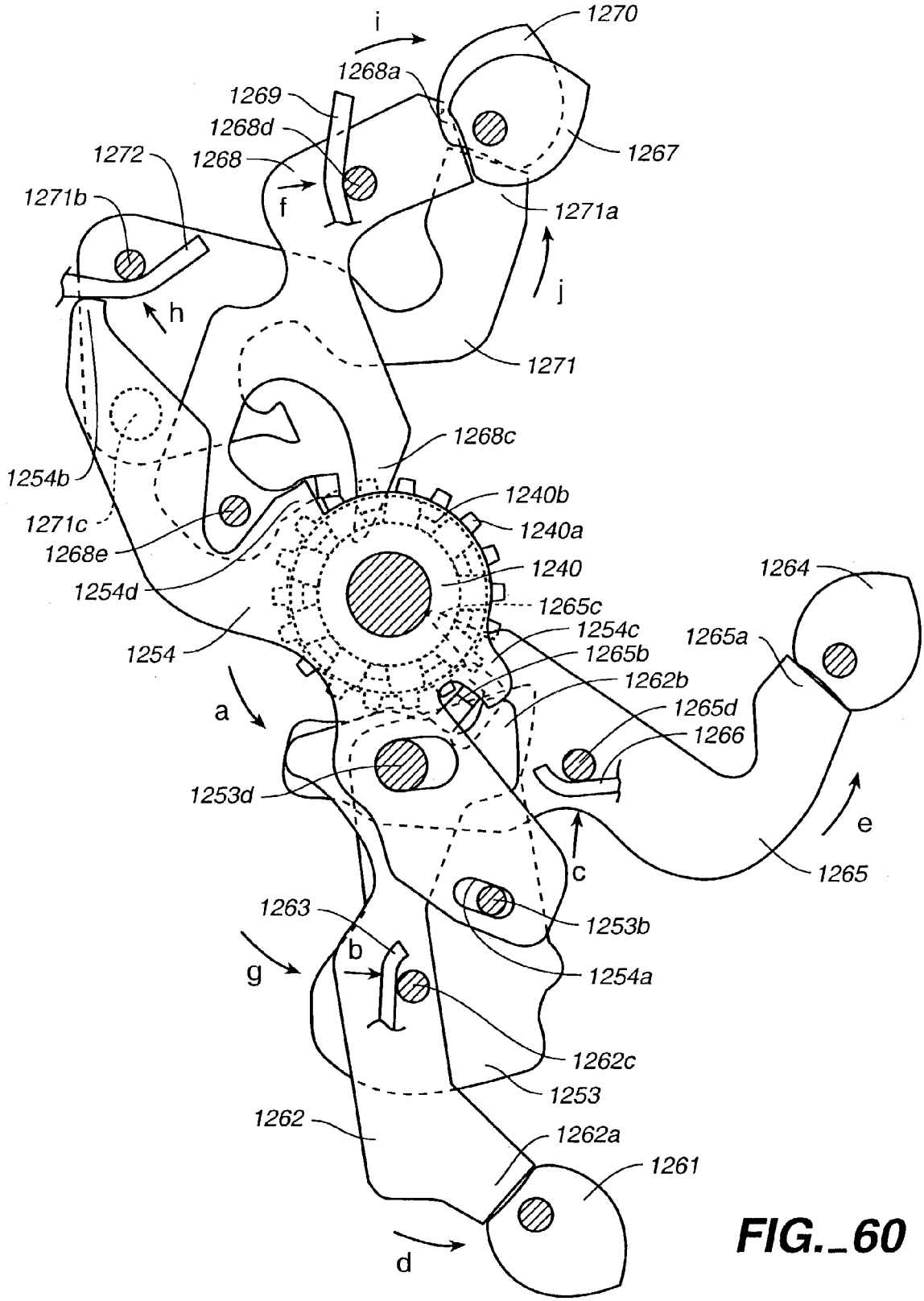
FIG. 60 is a second plan view showing an example of an operation of the principal mechanism of the reset operating mechanism in the chronograph section shown in FIG. 50.

When the intermediate hammer 1253 in this state turns on the pin 1253*d* in the direction of the arrow "g", as shown in FIG. 58, since the pin 1253*b* of the intermediate hammer 1253 moves inside the through hole 1254*a* of the hammer driving lever 1254 while pressing the through hole 1254*a*, as shown in FIG. 60, the hammer driving lever 1254 turns in the direction of the arrow "a" in the figure.

Then, the turn regulating portion 1265*b* of the zero return lever B 1265 is disengaged from the lever B restraining portion 1254*c* of the hammer driving lever 1254, and the pressure portion 1265*c* of the zero return lever B 1265 enters the gap between the columns 1240*b* of the cam wheel 1240. The pin 1265*d* of the zero return lever B 1265 is thereby pressed by the restoring force of the zero return lever B spring 1266 in the direction of the arrow "c" in the figure. Simultaneously, the regulation by the turn regulating portion 1262*b* is removed, and the pin 1262*c* of the zero return lever A 1262 is pressed by the restoring force of the zero return lever A spring 1263 in the direction of the arrow "b" in the figure. Therefore, the zero return lever A 1262 and the zero return lever B 1265 turn on the pin 1253*d* in the directions of the arrows "d" and "e" in the figure, and the hammer portions 1262*a* and 1265*a* hammer and turn the heart cams A1261 and B 1264, thereby resetting the chronograph 1/10-second hand 1231 and the chronograph second hand 1221.

Simultaneously, the turn regulating portion 1268*b* of the zero return lever C 1268 is disengaged from the lever C restraining portion 1254*d* of the hammer driving lever 1254, the pressure portion 1268*c* of the zero return lever C 1268 enters the gap between the columns 1240*b* of the cam wheel 1240, and the pin 1268*d* of the zero return lever C 1268 is pressed by the restoring force of the zero return lever C spring 1269 in the direction of the arrow "f" in the figure. Furthermore, the pin 1271*b* of the zero return lever D 1271 disengages from the lever D restraining portion 1254*b* of the hammer driving lever 1254. Thereby, the pin 1271*b* of the zero return lever D 1271 is pressed by the restoring force of the zero return lever D spring 1272 in the direction of the arrow "h" in the figure. Therefore, the zero return lever C 1268 and the zero return lever D 1271 turn on the pins 1268*e* and 1271*c* in the directions of the arrows "i" and "j" in the figure, and the hammer portions 1268*a* and 1271*a* hammer and turn the heart cams C 1267 and D 1270, thereby resetting the chronograph hour and minute hands 1211 and 1212.

According to a series of operations described above, while the chronograph section 1200 is in the stop state, it can be reset by pressing the reset button 1202.

Figure 61:
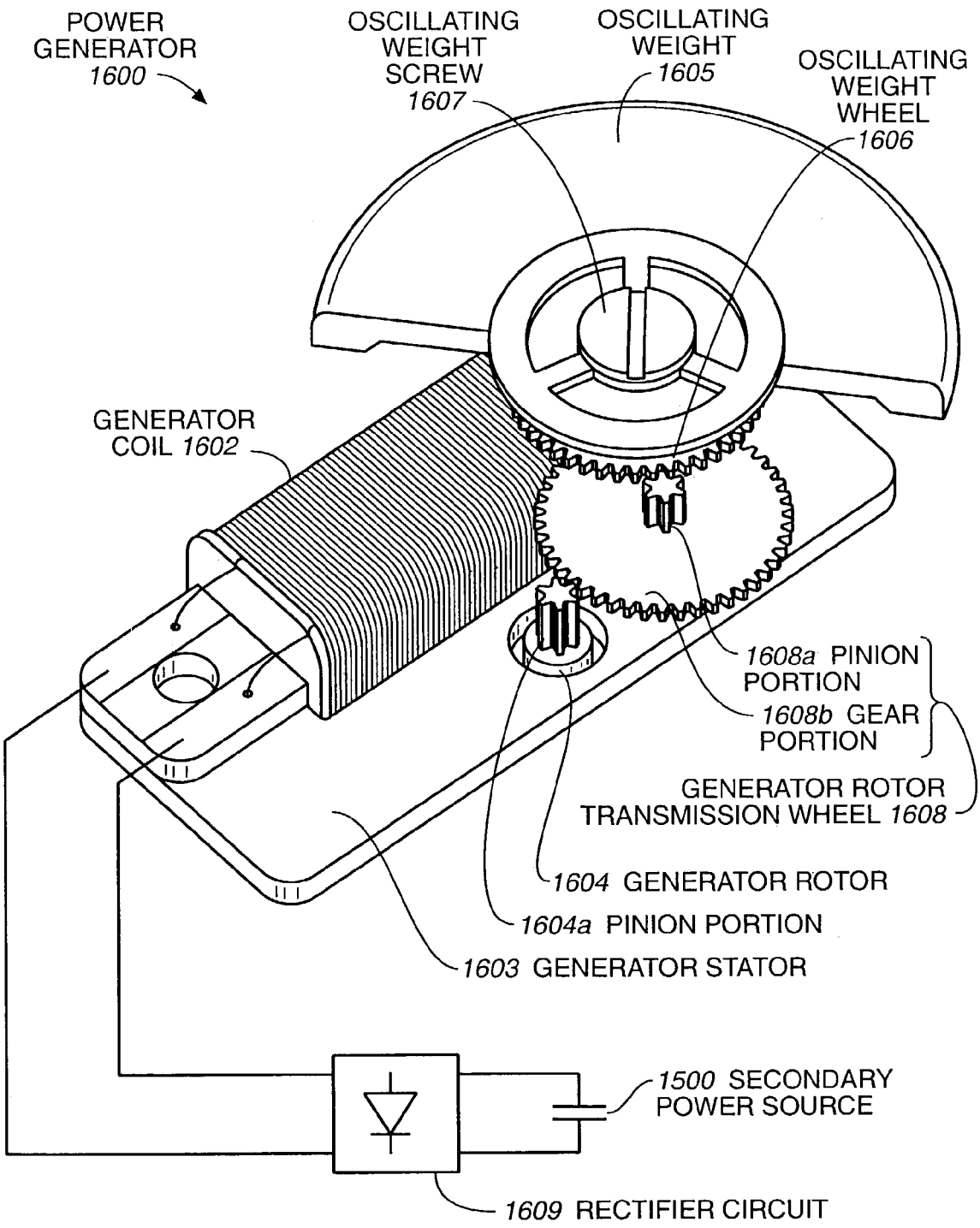
FIG. 61 is a schematic perspective view showing an example of a power generator used in the electronic timepiece shown in FIG. 46.

FIG. 61 is a schematic perspective view of an example of the power generator used in the electronic timepiece shown in FIG. 46.

The power generator 1600 comprises a generator coil 1602 formed on a high-permeability member, a generator stator 1603 made of a high-permeability material, a generator rotor 1604 composed of a permanent magnet and a pinion portion, an oscillating weight 1605 having a one-sided weight, and the like.

The oscillating weight 1605 and an oscillating weight wheel 1606 disposed therebelow are rotationally supported by a shaft fixed to an oscillating weight support, and are prevented from falling off in the axial direction by an oscillating weight screw 1607. The oscillating weight wheel 1606 is meshed with a pinion portion 1608*a* of a generator rotor transmission wheel 1608, and a gear portion 1608*b* of the generator rotor transmission wheel 1608 is meshed with a pinion portion 1604*a* of the generator rotor 1604. These train wheels increase the input speed by approximately 30 times to 200 times. The speed increasing ratio may be optionally set according to the performance of the power generator and the specifications of the watch.

In such a structure, when the oscillating weight 1605 is rotated by the action of the user's arm or by other means, the generator rotor 1604 rotates at high speed. Since the permanent magnet is fixed to the generator rotor 1604, the direction of a magnetic flux that interlinks the generator coil 1602 via the generator stator 1603 changes every time the generator rotor 1604 rotates, and alternating current is generated in the generator coil 1602 by electromagnetic induction. The alternating current is rectified by a rectifier circuit 1609, and is stored in the secondary power source 1500.

Figure 62:
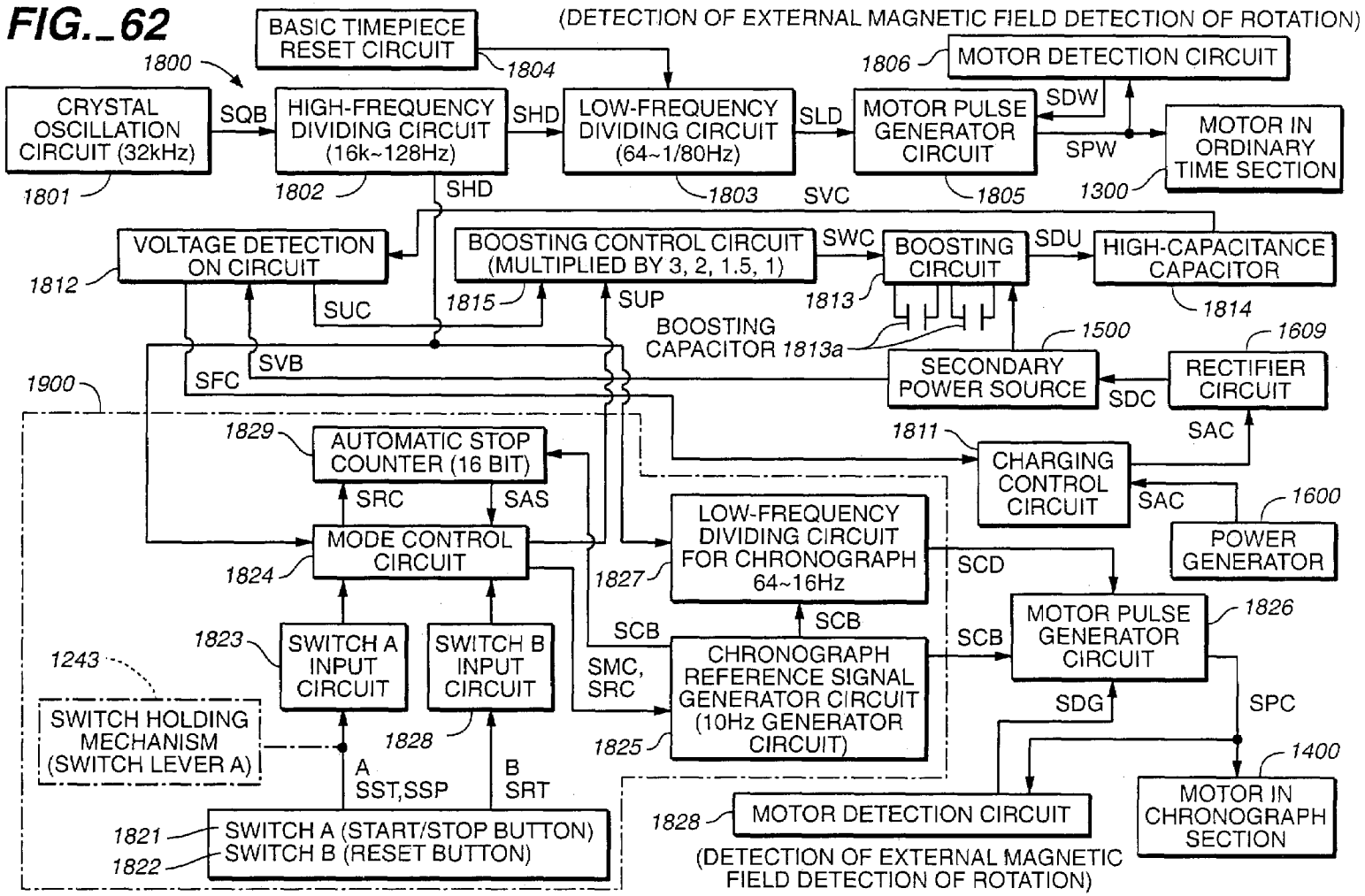
FIG. 62 is a schematic block diagram showing an example of a configuration of a control circuit used in the electronic timepiece shown in FIG. 46.

FIG. 62 is a schematic block diagram showing an example of the overall system configuration of the electronic timepiece shown in FIG. 46, excluding the mechanical section.

A signal SQB with, for example, an oscillation frequency of 32 kHz output from a crystal oscillating circuit 1801 including the tuning-fork crystal oscillator 1703 is input to a high-frequency dividing circuit 1802, where it is divided into frequencies of 16 kHz to 128 Hz. A signal SHD divided by the high-frequency dividing circuit 1802 is input to a low-frequency dividing circuit 1803, where it is divided into frequencies of 64 Hz to 1/80 Hz. The frequency generated by the low-frequency dividing circuit 1803 can be reset by a basic timepiece reset circuit 1804 connected to the low-frequency dividing circuit 1803.

A signal SLD divided by the low-frequency dividing circuit 1803 is input as a timing signal to a motor pulse generator circuit 1805. When the divided signal SLD becomes active, for example, every second or every 1/10 second, pulses SPW for motor driving and for detecting the motor rotation and the like are generated. The motor driving pulse SPW generated by the motor pulse generator circuit 1805 is supplied to the motor 1300 in the ordinary time section 1100, and the motor 1300 in the ordinary time section 1100 is thereby driven. With a timing different therefrom, the pulse SPW for detecting the motor rotation or the like is supplied to a motor detector circuit 1806, and the external magnetic field of the motor 1300 and the rotation of the rotor in the motor 1300 are detected. External magnetic field detection and rotation detection signals SDW detected by the motor detector circuit 1806 are fed back to the motor pulse generator circuit 1805.

An alternating voltage SAC generated by the power generator 1600 is input to the rectifier circuit 1609 via a charging control circuit 1811, is converted into a DC voltage SDC by, for example, full-wave rectification, and is stored in the secondary power source 1500. A voltage SVB between both ends of the secondary power source 1500 is detected by a voltage detection circuit 1812 continuously or on demand. According to the excessive or deficient state of the charge amount in the secondary power source 1500, a corresponding charging control command SFC is input to the charging control circuit 1811. Based on the charging control command SFC, the stop and start of supply of the AC voltage SAC generated by the power generator 1600 to the rectifier circuit 1609 are controlled.

On the other hand, the DC voltage SDC stored in the secondary power source 1500 is input to a boosting circuit 1813 including a boosting capacitor 1813*a*, where it is multiplied by a predetermined factor. A boosted DC voltage SDU is stored in the large-capacity capacitor 1814.

Boosting is performed so that the motors and the circuits reliably operate even when the voltage of the secondary power source 1500 falls below the operating voltage therefor. That is, both the motors and the circuits are driven by electric energy stored in the large-capacity capacitor 1814. When the voltage of the secondary power source 1500 increases to approximately 1.3 V, the large-capacity capacitor 1814 and the secondary power source 1500 are connected in parallel during use.

A voltage SVC between both ends of the large-capacity capacitor 1814 is detected by the voltage detection circuit 1812 continuously or on demand. According to the amount of electricity remaining in the large-capacity capacitor 1814, a corresponding boosting command SUC is input to a boosting control circuit 1815. The boosting factor SWC of the boosting circuit 1813 is controlled based on the boosting command SUC. The boosting factor is a multiple by which the voltage of the secondary power source 1500 is multiplied to be generated in the large-capacity capacitor 1814, and is controlled to be a multiple, such as 3, 2, 1.5, or 1, expressed by dividing the voltage of the large-capacity capacitor 1814 by the voltage of the secondary power source 1500.

A start signal SST, a stop signal SSP, or a reset signal SRT from a switch A 1821 accompanying the start/stop button 1201 and a switch B 1822 accompanying the reset button 1202 is input to a mode control circuit 1824 for controlling the modes in the chronograph section 1200. The switch A 1821 includes the switch lever A 1243 serving as a switch holding mechanism, and the switch B 1822 includes the switch lever B 1257.

A signal SHD divided by the high-frequency dividing circuit 1802 is also input to the mode control circuit 1824. In response to a start signal SST, a start/stop control signal SMC is output from the mode control circuit 1824. In response to the start/stop control signal SMC, a chronograph reference signal SCB generated by a chronograph reference signal generator circuit 1825 is input to a motor pulse generator circuit 1826.

On the other hand, a chronograph reference signal SCB generated by the chronograph reference signal generator circuit 1825 is also input to a chronograph low-frequency dividing circuit 1827, and a signal SHD divided by the high-frequency dividing circuit 1802 is divided into frequencies of 64 Hz to 16 Hz in synchronization with the chronograph reference signal SCB. A signal SCD divided by the chronograph low-frequency circuit 1827 is input to the motor pulse generator circuit 1826.

The chronograph reference signal SCB and the divided signal SCD are input as timing signals to the motor pulse generator circuit 1826. The divided signal SCD becomes active with an output timing of the chronograph reference signal SCB, for example, every 1/10 second or every second. In response to the divided signal SCD and the like, pulses SPC for motor driving and for detecting the motor rotation and the like are generated. The motor driving pulse SPC generated in the motor pulse generator circuit 1826 is supplied to the motor 1400 in the chronograph section 1200, and the motor 1400 in the chronograph section 1200 is thereby driven. The pulse SPC for detecting the motor rotation and the like is supplied to a motor detector circuit 1828 with a timing different therefrom, and the external magnetic field of the motor 1400 and the rotation of the rotor in the motor 1400 are detected. External magnetic field detection and rotation detection signals SDG detected by the motor detector circuit 1828 are fed back to the motor pulse generator circuit 1826.

A chronograph reference signal SCB generated by the chronograph reference signal generator circuit 1825 is also input to an automatic stop counter 1829 of, for example, 16 bits, and is counted. When the count reaches a predetermined value, that is, the measurement limit time, an automatic stop signal SAS is input to the mode control circuit 1824. In this case, a stop signal SSP is input to the chronograph reference signal generator circuit 1825, and the chronograph reference signal generator circuit 1825 is thereby stopped and reset.

When the stop signal SSP is input to the mode control circuit 1824, output of the start/stop control signal SMC is stopped, generation of the chronograph reference signal SCB is stopped, and driving of the motor 1400 in the chronograph section 1200 is stopped. After the generation of the chronograph reference signal SCB is stopped, that is, after the generation of a start/stop control signal SMC, which will be described later, is stopped, a reset signal SRT input to the mode control circuit 1824 is input as a reset control signal SRC to the chronograph reference signal generator circuit 1825 and the automatic stop counter 1829, the chronograph reference signal generator circuit 1825 and the automatic stop counter 1829 are reset, and the chronograph hands in the chronograph section 1200 are reset.

Figure 63:
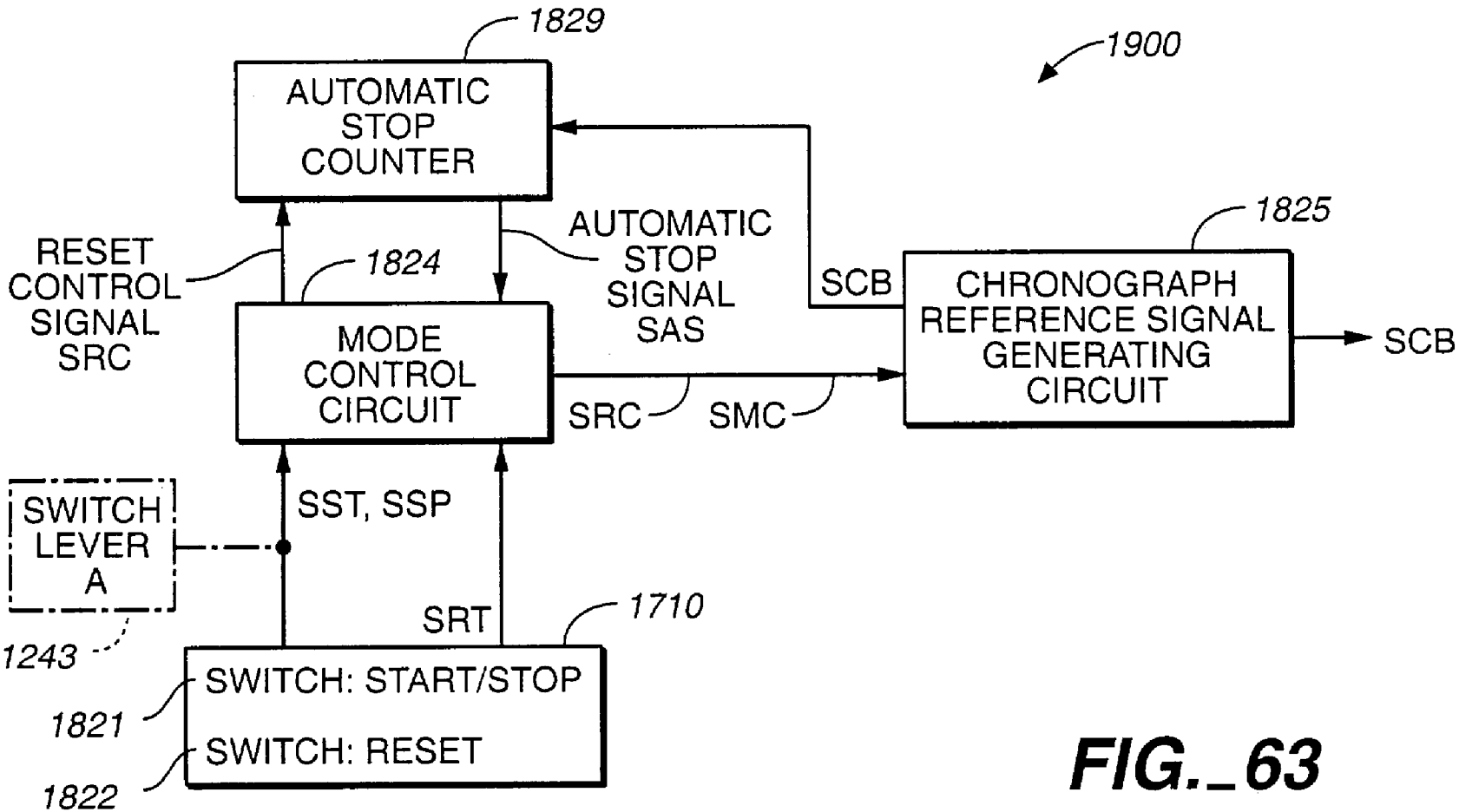
FIG. 63 is a circuit diagram showing an example of a configuration of a chronograph control section shown in FIG. 46 and the peripheral sections.

FIG. 63 is a block diagram showing the configuration of the chronograph control section 1900 shown in FIG. 46 and the peripheral circuits.

In the following description, a "time measurement mode" indicates, for example, a state in which time is being measured by the chronograph, and a "stop mode" indicates a state in which time measurement is stopped.

The chronograph control section 1900 comprises a switch 1710, the mode control circuit 1824, the chronograph reference signal generator circuit 1825, the automatic stop counter 1829, and the like, as shown in FIG. 63 The switch 1710 is a generic name of the start/stop switch 1821 (switch A), the reset switch 1822 (switch B) and the like to be operated by the start/stop button 1201 (external input portion) and the reset button 1202. The start/stop switch 1821 is turned on or off by operating the start/stop button 1201, and the reset switch 1822 is turned on or off by operating the reset button 1202.

The start/stop switch 1821 is mechanically held in the ON state by the switch lever A 1243 (holding portion). For example, the start/stop switch 1821 is configured to be turned on by the first operation, and to be turned off by the second operation. Subsequently, this is repeated every time the start/stop button 1201 is pushed. The reset switch 1822 is also subjected to almost the same operation, except that it is not held by the switch holding mechanism 1243.

The mode control circuit 1824 outputs a start/stop control signal SMC or a reset control signal SRC to the chronograph reference signal generator circuit 1825 based on a start signal SST and a stop signal SSP, or a reset signal SRT from the switch 1710. The mode control circuit 1824 also outputs a reset control signal SRC to the automatic-stop counter 1829, as shown in FIG. 63, thereby resetting the value of the automatic stop counter 1829. The mode control circuit 1824 includes a circuit for preventing the reset switch 1822 from chattering. Details of the mode control circuit 1824 will be described later.

A start/stop control signal SMC is input from the mode control circuit 1829 to the chronograph reference signal generator circuit 1825 when the start/stop switch 1821 is turned on. The chronograph reference signal generator circuit 1825 is a circuit for dividing the start/stop control signal SMC, generating a chronograph reference signal SCB, of, for example, approximately 10 Hz, and outputting the signal SCB to the motor pulse generator circuit 1826 shown in FIG. 62. The chronograph reference signal SCB is a reference clock for timing the generation of motor pulses SPC output from the motor pulse generator circuit 1826 in order to drive the motor 1400.

The automatic stop counter 1829 starts measurement by the chronograph when a chronograph reference signal SCB is input from the chronograph reference signal generator circuit 1825 thereto, and counts chronograph reference signals SCB. The automatic stop counter 1829 outputs an automatic stop signal SAS to the mode control circuit 1824 after the measured time has exceeded the maximum measurement time, e.g., 12 hours, by a predetermined time.

Figure 64:
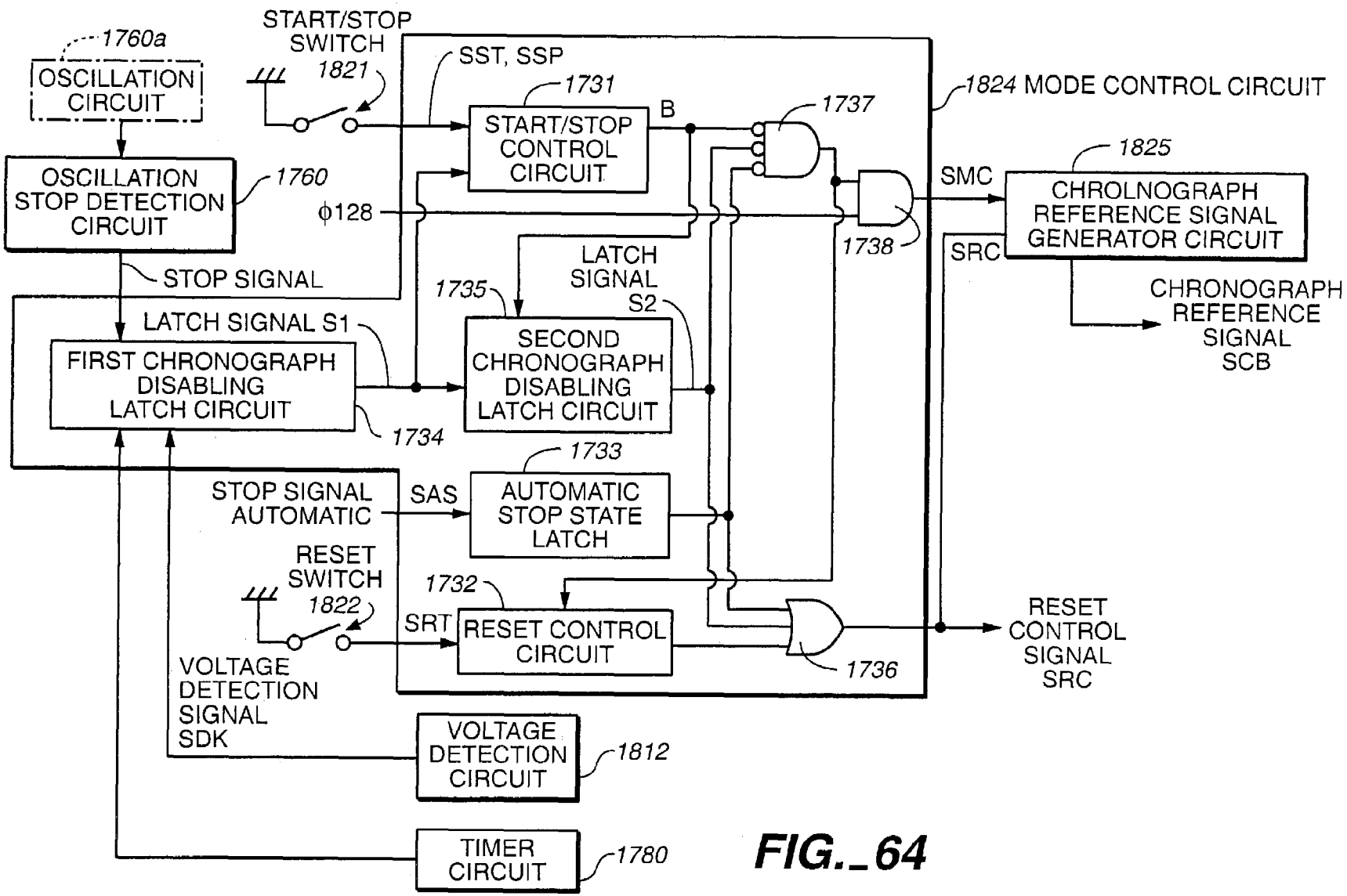
FIG. 64 is a circuit diagram showing an example of a configuration of a mode control section in the chronograph control section shown in FIG. 63.

FIG. 64 is a block diagram showing the mode control circuit 1824 as a part of the chronograph control section 1900 shown in FIG. 46 and the peripheral circuits.

The mode control circuit 1824 as a part of the chronograph control section 1900 comprises a start/stop control circuit 1731, a reset control circuit 1732, an automatic stop state latch circuit 1733, a first chronograph disabling latch circuit 1734, a second chronograph disabling latch circuit 1735, an OR circuit 1736, two AND circuits 1733 and 1734, and the like.

The mode control circuit 1824 is connected to an oscillation stop detection circuit 1760, a voltage detection circuit 1812 for detecting the power-supply voltage of the secondary battery 1500 and the like (power source), a timer circuit 1780 (second time measuring section), and the like.

Figure 65:
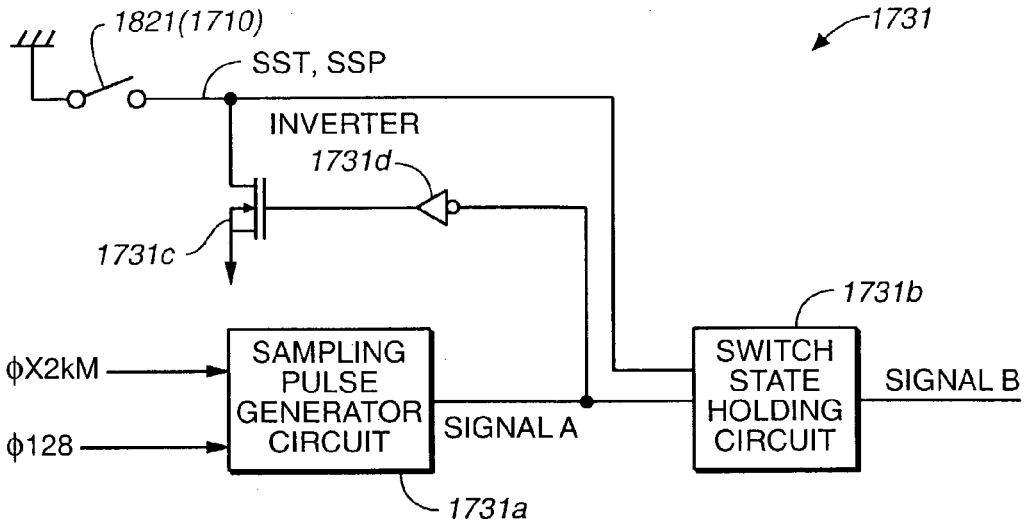
FIG. 65 is a circuit diagram showing an example of a configuration in proximity to a start/stop control circuit in the mode control section shown in FIG. 64.

The start/stop control circuit 1731 includes a sampling pulse generating circuit 1731*a*, a switch state holding circuit 1732*b*, and the like as shown in FIG. 65.

When signals of, for example, ϕ×2 kM and 128 Hz, which are generated by dividing a clock signal from an oscillation circuit 1760*a* in FIG. 64, are input to the sampling pulse generating circuit 1731*a*, the sampling pulse generating circuit 1731*a* outputs a signal A serving as a sampling pulse that drops to the L level, for example, on the trailing edge of the pulse signal of 128 Hz and that rises to the H level, for example, on the trailing edge of the pulse signal of ϕ×2 kM. ϕ represents Hz, × represents inversion, and M represents half-wave shift.

The signal A from the sampling pulse generating circuit 1731*a* is input to one input terminal of the switch state holding circuit 1731, and switch input signals SST and SSP from the start/stop switch 1821 are input to the other input terminal, as shown in FIG. 65.

A resistor 1731*c* is a resistor to be pulled down only while the input is at the H level. The resistor 1731*c* is pulled down because the input rises to the H level via an inverter 1731*c* while the signal A is high. Therefore, the switch input signal SST and the like are at the H level when the start/stop switch 1821 is on, and are at the L level only while the signal A is low when the start/stop switch 1821 is off.

The switch state holding circuit 1731*b* samples the signals SST and the like in response to the signal A, fetches an H-level signal, for example, on the rising edge of the signal A while the start/stop switch 1821 is on, fetches in an L-level signal, for example, on the rising edge of the signal A when the start/stop switch 1821 is off, outputs as a signal B a signal formed by inverting the fetched signal, and holds the state of the signal B until the rising edge of the next signal A.

The reset control circuit 1732 outputs a reset control signal SRC to the OR circuit 1736 when a reset signal SRT, which is a pulse signal to be output when the reset switch 1822 is turned on, is input thereto.

The automatic stop state latch circuit 1733 outputs, for example, an L-level signal except in the automatic stop state, and outputs an H-level signal in the automatic stop state.

The first chronograph disabling latch circuit 1734 outputs a latch signal S1 to the start/stop control circuit 1731 and the second chronograph disabling latch circuit 1735 when a stop signal SHT and the like are input from an oscillation circuit 1760*a* to the oscillation stop detection circuit 1760.

The second chronograph disabling latch circuit 1735 outputs a latch signal S2 to the OR circuit 1736 and the AND circuit 1737 based on the latch signal S1 or the like from the first chronograph disabling latch circuit 1735.

The OR circuit 1736 outputs a reset control signal SRC to the chronograph reference signal generator circuit 1825 based on the signals from the reset control circuit 1732, the automatic stop state latch circuit 1733, the second chronograph disabling latch circuit 1733, and the like.

A signal B from the start/stop control circuit 1731 is input to the AND circuit 1737, the signals from the automatic stop state latch circuit 1733 and the second chronograph disabling latch circuit 1735 are inverted and input thereto, and the AND circuit 1737 outputs these signals to the second AND circuit 1738 and the reset control circuit 1732.

The output signal from the first AND circuit 1737 and a pulse signal of, for example, 128 Hz, which is generated by division by the high-frequency dividing circuit 1802 in FIG. 62, are input to the second AND circuit 1738, and the second AND circuit 1738 outputs the signals to the chronograph reference signal generator circuit 1825 and the like.

The electronic timepiece 1000 has the configuration described above. Next, the operations thereof will be described with reference to FIGS. 64 and 65, and so on.

Figure 66:
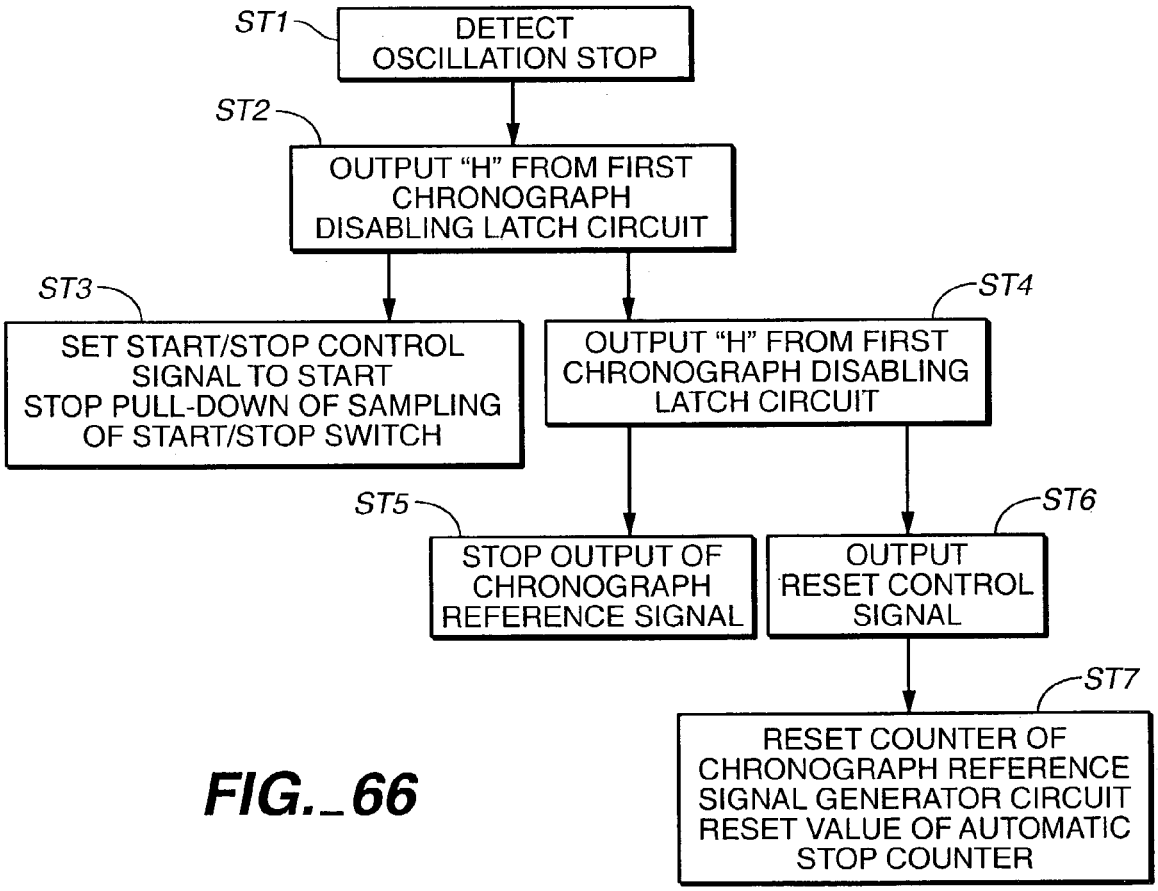
FIG. 66 is a flowchart showing chronograph disabling at the time of restart in the electronic timepiece shown in FIG. 46.

FIG. 66 is a flowchart showing a chronograph disabling process in the electronic timepiece 1000.

In the electronic timepiece 1000, the chronograph disabling process is performed as follows when the power-supply voltage of the secondary battery 1500 recovers and the chronograph control section 1900 is then restarted after the power-supply voltage of the secondary battery 1500 falls below a predetermined operating voltage (e.g., 0.4 V) and the chronograph control section 1900 is thereby disabled.

Immediately after the electronic timepiece 1000 is restarted, the oscillation circuit 1760*a* shown in FIG. 64 does not oscillate. For this reason, the oscillation stop detection circuit 1760 detects the oscillation stop, and outputs a stop signal SHT to the first chronograph disabling latch circuit 1734 (Step ST1).

The first chronograph disabling latch circuit 1734 outputs an H-level latch signal S1 to the start/stop control circuit 1731 and the second chronograph disabling latch circuit 1735 (Step ST2).

While the output signal S1 from the first chronograph disabling latch circuit 1734 is high, the sampling pulse generating circuit 1731*a* and the switch state holding circuit 1731*b* are maintained as follows by using the output signal S1, as shown in FIG. 65. The sampling pulse generating circuit 1731 fixes the signals A at the H level without outputting a sampling pulse. The switch state holding circuit 1731*b* fixes the signals B at the L level (in the start state), regardless of the on/off state of the start/stop switch 1821 (Step ST3).

Such fixing of the signals in the above states are performed for the following reason. The sampling pulse generating circuit 1731*a* fixes the signal A at the H level, and thereby does not pull down the sampling of the resistor 1731*c*. For this reason, even when the start/switch switch 1821 is on, current does not flow through the resistor 1731, which can limit the current to be consumed. In this case, the signal B may be fixed at either the H level or the L level, whereas the L level is more suited to cancel disabling in this embodiment.

The second chronograph disabling latch circuit 1735 receives an H-level latch signal S1 from the first chronograph disabling latch circuit 1734, and outputs a latch signal S2 (Step ST4).

The latch signal S2 is output to the AND circuit 1737 shown in FIG. 64, and the chronograph reference signal generator circuit 1825 stops outputting the chronograph reference signals SCB. That is, the motor 1400 is stopped (Step ST5). Simultaneously, the latch signal S2 is output as a reset control signal SRC via the OR circuit 1736 (Step ST6), thereby resetting the count values of the chronograph reference signal generator circuit 1825 and the automatic stop counter 1829 (Step ST7).

Figure 67:
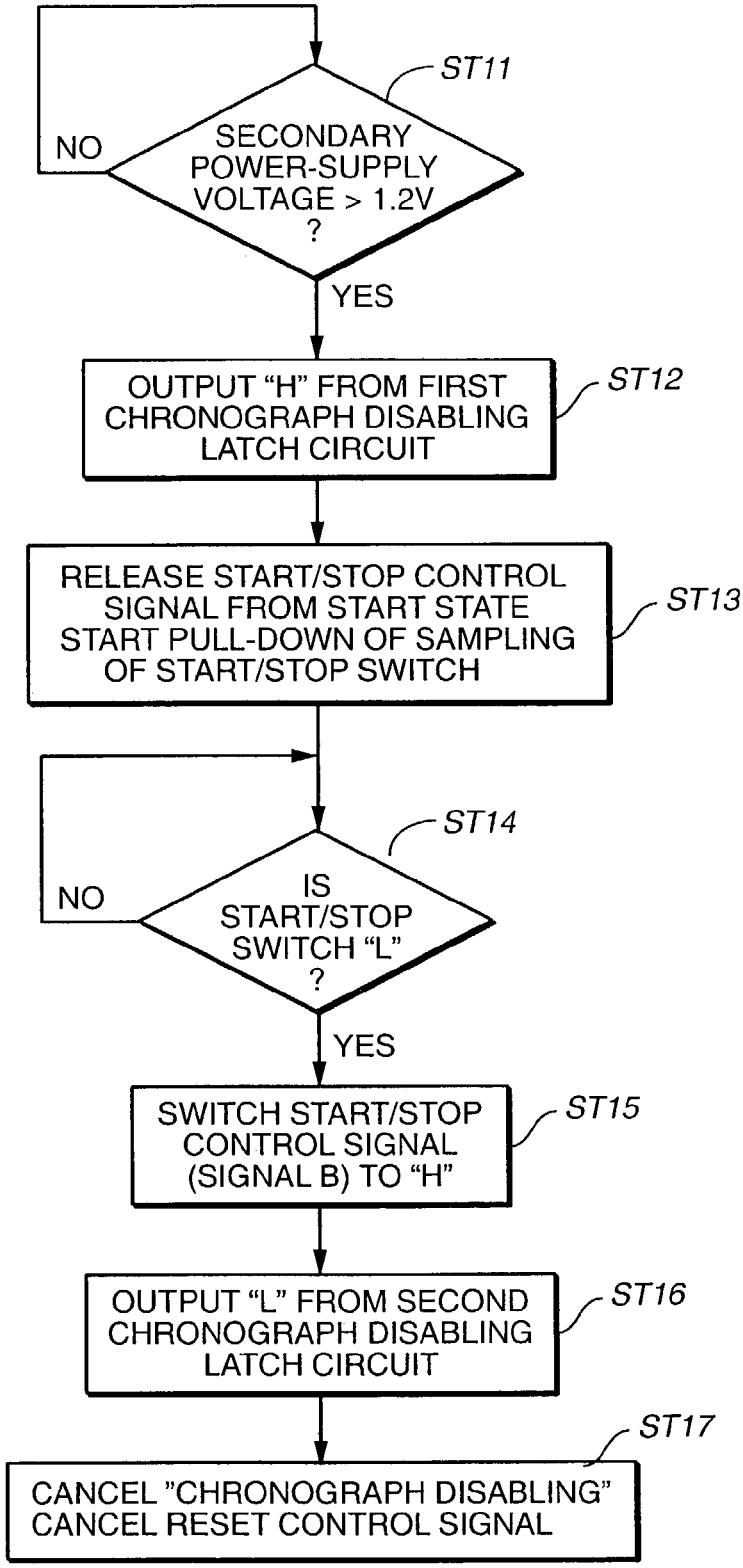
FIG. 67 is a flowchart showing cancellation of the chronograph disabling at the time of restart in the electronic timepiece shown in FIG. 46.

FIG. 67 is a flowchart showing a chronograph disabling canceling process in the electronic timepiece 1000. In the description with reference to FIG. 67, it is assumed that the secondary battery 1500 used as a power source has the charge-voltage characteristic that the voltage does not rapidly rise after charging starts.

The power-supply voltage of the secondary battery 1500 is detected by the voltage detection circuit 1812, and it is determined whether or not the detected voltage is equal to or more than a predetermined voltage (e.g., 1.2 V) (Step ST11).

When the power-supply voltage of the secondary battery 1500 is equal to or more than the predetermined voltage, a voltage detection signal SDK is output from the voltage detection circuit 1770 to the first chronograph disabling latch circuit 1734. In Step ST12, the first chronograph disabling latch circuit 1734 outputs an L-level latch signal S1 to the start/stop control circuit 1731 and the second chronograph disabling latch circuit 1735 (Step ST12).

When the output of the first chronograph disabling latch circuit 1735 drops to the L level (disabling cancellation), the following processes are performed in the start/stop control circuit 1731. In the first process, the sampling pulse generating circuit 1731*a* is released from the reset state, and starts to output sampling pulses for detecting the state of the switch 1821 based on the signal A. In the second process, the switch state holding circuit 1731*b* is released from the state in which the signal B is set at the L level (start state). In this way, the sampling of the state of the start/stop switch 1821 is started to be pulled down.

In Step ST 14, the signal B changes to the H level with the sampling timing (on the rising edge) of the signal A (Step ST 15), or remains at the L level, according to the state of the start/stop switch 1821.

In Step ST 16, the latch signal S1 drops to the L level (at the time of Step S12) to cancel the reset of the latch, the signal B rises to the H level (as the result of Step ST14), and the latch signal S2 drops to the L level.

The output of the reset control signal SRC from the mode control circuit 1824 due to the chronograph disabling is stopped, and disabling of the chronograph reference signal generator circuit 1825 is canceled (Step ST17). Therefore, when the start/stop switch 1821 is turned on in this state by operating the start/stop button 1201, the chronograph reference signal generator circuit 1825 outputs a chronograph reference signal SCB, so that the movement of the hands in the chronograph section 1200 is started.

The time measurement device 1000 is provided with the timer circuit 1780 for measuring a fixed time. When the time measurement device 1000 is disabled, the following processes are performed instead of the above-described processes.

In this state, the timer circuit 1780 shown in FIG. 64 is operating. The timer circuit 1780 performs, for example, the following processes.

In the first process, a timing (e.g., 10 seconds) from the cancellation of the oscillation stop detection (oscillation start) to the first detection of the power-supply voltage of the secondary battery 1500 is predetermined. After the timer circuit 1780 ensures the time of charging by manually shaking the electronic timepiece 1000 (hereinafter referred to as "hand shake"), the voltage of the secondary battery 1500 is detected by the voltage detection circuit 1812, and disabling is canceled. In the second process, when the power-supply voltage of the secondary battery 1500 is detected, and all the voltage detection results in a fixed time are equal to or more than a predetermined voltage (e.g., 1.3 [V]), the timer circuit 1780 cancels disabling.

Figure 68:
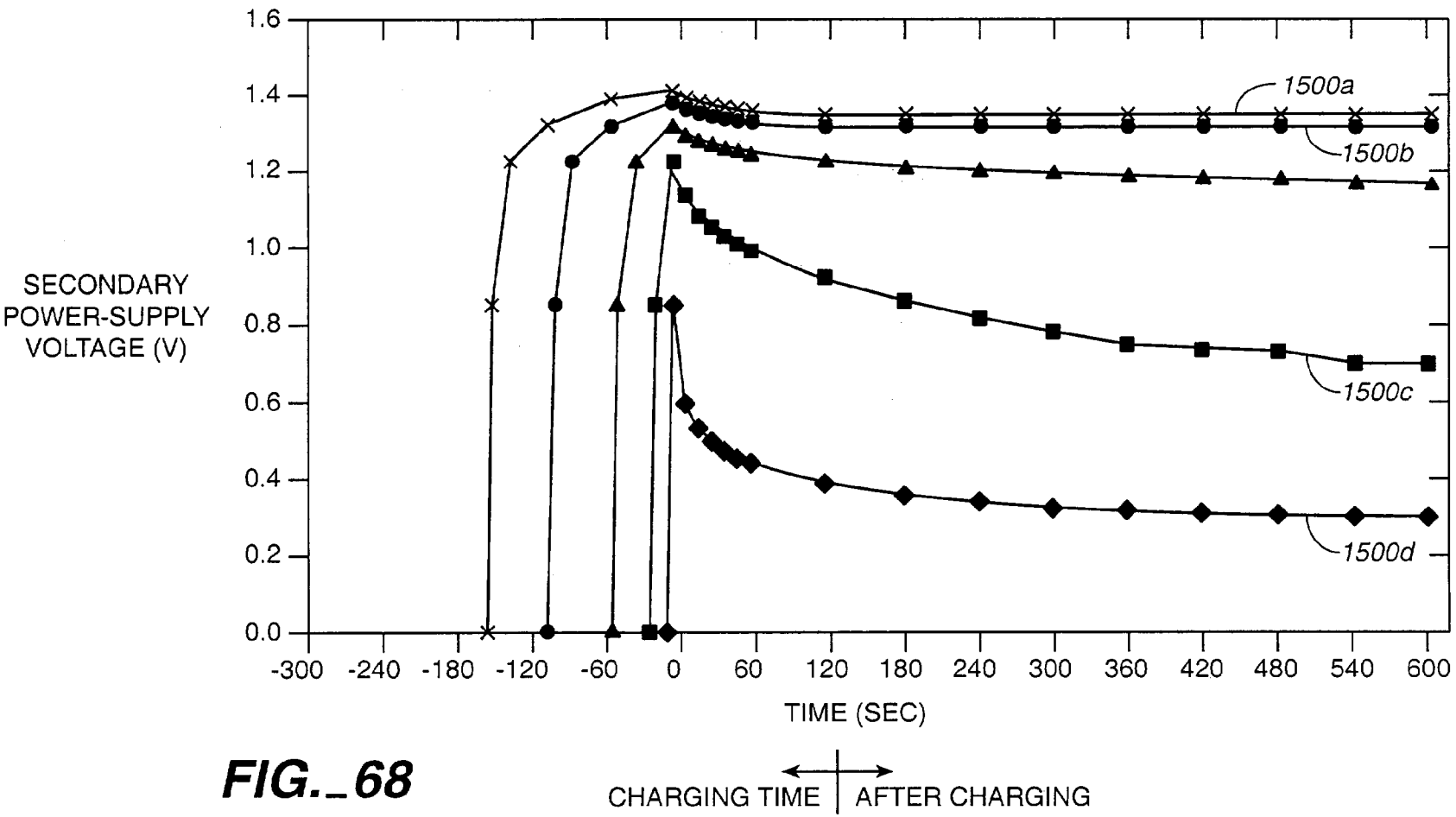
FIG. 68 is a view showing the charge-voltage characteristics of a secondary battery shown in FIG. 62.

The reason why such usage of the timer circuit 1780 is effective will be described below. The voltage of the secondary battery 1500 sometimes rapidly rises when charging is rapidly performed by hand-shake charging or the like. In this case, the voltage detection circuit 1812 is not able to calculate the charge capacity based on the results 1500*c* and 1500*d* of detection of the voltages of the secondary battery 1500 that has rapidly risen, such as voltages in FIG. 68. For this reason, the method is effective in which the operation of the chronograph is guaranteed by canceling disabling in the state in which sufficient electric energy is stored in the secondary battery 1500 after charging is performed for a fixed time. The flowchart shown in FIG. 67 shows the process that does not use the timer circuit 1780 having such functions (it is described as the process using the secondary battery 1500 having good charge-voltage characteristics without the circuit).

Figure 69:
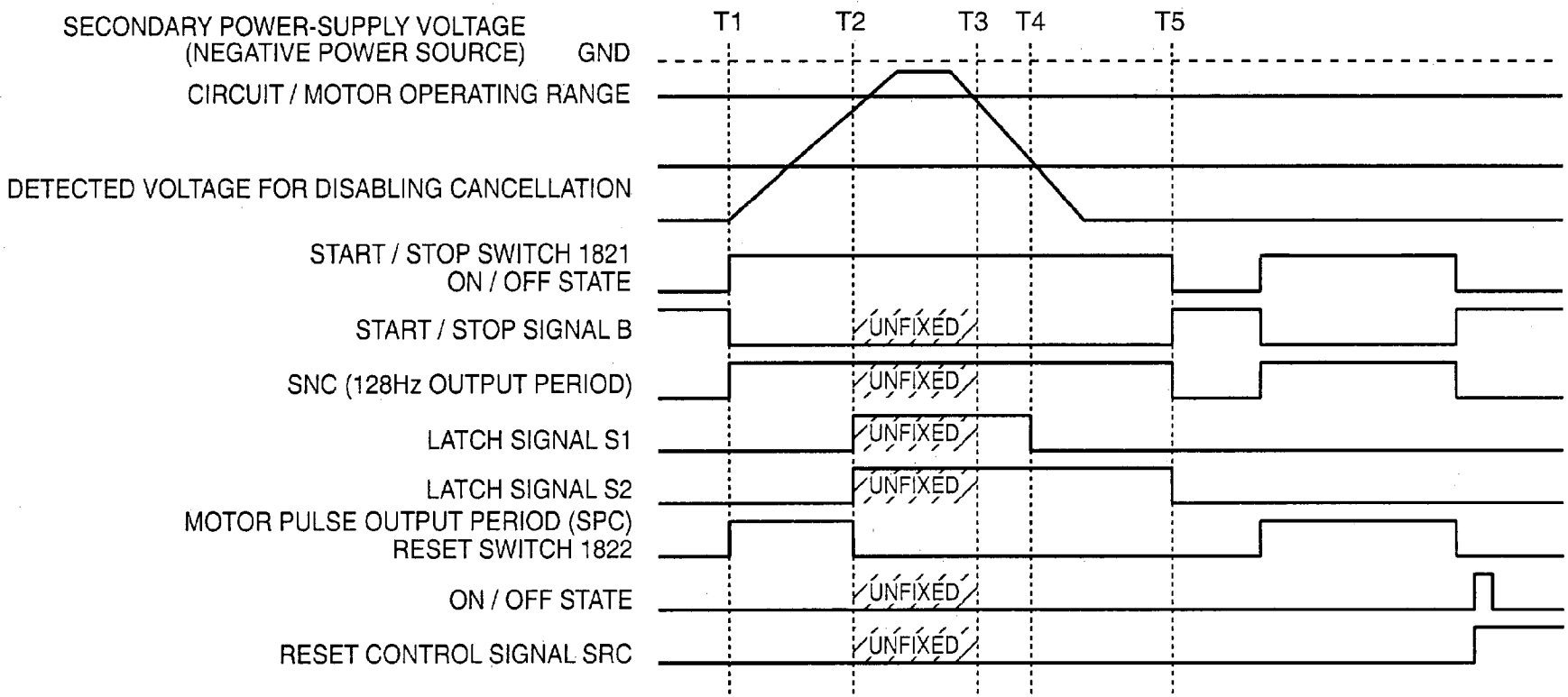
FIG. 69 is a timing chart showing the operations of the sections at the time of restart in the electronic timepiece shown in FIG. 46.

FIG. 69 is a timing chart showing the disabling process shown in FIG. 66 and the disabling canceling process shown in FIG. 67 in the electronic device.

Disabling Process

At the point T1, the start/stop switch 1821 is turned on, thereby bringing about a clocking mode. The voltage of the secondary battery 1500 is below the operating voltage for the circuits and the motor 1400 at the time T2. Since the voltage is below the voltage required for the circuit operation from the point T2 to the point T3, the states of the signals are unstable, and a motor pulse SPC is not output. Since the output of the first chronograph disabling latch circuit 1734 rises to the H level when the voltage rises to enable the operation immediately after the point T3, sampling of the start/stop control circuit 1731 is stopped in response to this signal, the start/stop signal B output from the start/stop control circuit 1731 is fixed to the L level, and the output of the second chronograph disabling latch circuit 1735 is reset to the H level. Furthermore, since the latch signal S2 is high, the reset control signal SRC output from the OR circuit 1736 rises to the H level, thereby resetting (initializing) the chronograph reference signal generator circuit 1825 and the automatic stop counter 1829.

Disabling Canceling Process

When the voltage of the secondary battery 1500 exceeds a predetermined voltage at the point T4, the output of the first chronograph disabling latch circuit 1734 drops to the L level, and the reset of the start/stop control circuit 1731 and the second chronograph disabling latch circuit 1735 is canceled. In response to this reset cancellation, the start/stop control circuit 1731 starts to sample the state of the switch 1821. In a case in which the input from the start/stop switch 1821 is high as shown in FIG. 69, the start/stop signal B output from the start/stop control circuit 1731 remains low. Therefore, the latch signal S2 output from the second chronograph disabling latch circuit 1735 is held high.

When the start/stop switch 1821 is lowered to the L level at the point T5, the start/stop signal B rises to the H level with a sampling timing of the start/stop switch 1821, and this signal is input to the second chronograph disabling latch circuit 1735, thereby lowering the latch signal S2 to the L level. From this point, the output of the AND circuit 1737 is controlled only by the start/stop signal B of the start/stop control circuit 1731. That is, chronograph measurement is allowed to be started and stopped (and reset) by operating the start/stop switch 1821 (and the reset switch 1822).

In this way, after the power-supply voltage of the secondary battery 1500 falls below the operating voltage and the operation is prohibited, even when the power-supply voltage recovers above the operating voltage, if it does not reach the operating voltage sufficient for the operation of the chronograph section 1200 and the like, the chronograph function is disabled. Moreover, the chronograph function is prevented from operating independently of the intention of the user when the charge amount of the secondary battery 1500 reaches an amount sufficient for use (secondary power-supply voltage). When the secondary battery 1500 is sufficiently charged by power generation by the power generator 1600, and the voltage thereof exceeds the above-described predetermined voltage, disabling of the chronograph is cancelled. Therefore, even when the chronograph section 1200 is subsequently driven again, the operation is prevented from being disabled again due to the drop of the power-supply voltage of the secondary battery 1500 below the operating voltage.

As described above, according to the present invention, when the voltage of the power-supply battery falls below the operating voltage in the chronograph clocking mode in the electronic timepiece, the chronograph section and the like are disabled. The voltage of the power-supply battery is periodically detected by the voltage detection circuit. When the voltage exceeds the predetermined voltage, disabling of the chronograph or the like is cancelled. Accordingly, since the chronograph section is allowed to start working after the voltage of the power-supply battery sufficiently recovers, time measurement by the chronograph section is prevented from being stopped again due to the fall of the power-supply voltage below the operating voltage during the time measurement.

In this way, according to the present invention, when the power-supply voltage recovers above the operating voltage after it falls below the operating voltage and the chronograph is stopped, the chronograph reliably functions without stopping again.

The present invention is not limited to the above embodiment, and various modifications are possible without departing from the scope of the claims.

For example, the present invention is also applicable to a portable watch, a table clock, a wristwatch, a wall clock, or the like.

In addition, while the secondary battery to be charged by the power generator has been described as an example of the power-supply battery in the electronic timepiece, a conventional power-supply battery, such as a button battery, a solar battery, or the like may be adopted instead of or in addition to the secondary battery.

While the chronograph has been described as an example of a time measuring function of time measurement device, a timer serving as a function for similarly measuring time may be used instead.

As described above, according to the present invention, while the user measures time with the time measurement device having the time measuring function, even if the operation of the time measurement device is stopped due to the fall of voltage resulting from insufficient charge capacity of the power-supply battery, the time measurement device can be reliably driven again by recharging the power-supply battery.

According to the present invention, when the time measurement device is disabled, the detecting section is stopped, which makes it possible to reduce the power consumption in the time measurement device during the disabled state.

According to the present invention, while the user measures time with the time measurement device having the time measuring function, even if the operation of the time measurement device is stopped due to the fall of voltage resulting from insufficient charge capacity of the power-supply battery, the time measurement device can be reliably driven again by charging the power-supply battery until a given time elapses.

According to the present invention, while the user measures time with the time measurement device having the time measuring function, even if the operation of the time measurement device is stopped due to the fall of voltage resulting from insufficient charge capacity of the power-supply battery, the time measurement device can be reliably driven again by charging the power-supply battery until the charging voltage exceeds a predetermined voltage.

According to the present invention, while the user measures time with the time measurement device having the time measuring function, even if the operation of the time measurement device is stopped due to the fall of voltage resulting from insufficient charge capacity of the power-supply battery, the time measurement device can be reliably driven again by charging the power-supply battery until a given time elapses while the charge voltage is above the predetermined voltage. For this reason, the time measurement device is not influenced by insufficient charge capacity and the like depending on the characteristics of the power-supply battery.

According to the present invention, the operations that are independent of the intention of the user are prevented.

According to the present invention, when time is measured by the time measurement device having the functions of measuring an arbitrary time, and when the operation of the time measurement device is stopped due to the voltage fall resulting from insufficient charge capacity of the power-supply battery, the time measurement device can be reliably driven again by recharging the power-supply battery.

According to the present invention, it is possible to prevent the measured time from being inadvertently initialized during time measurement performed by the user with the time measuring function.

According to the present invention, while the users measure time with the time measurement device having the time measuring function, and when the operation of the time measurement device is stopped by the voltage fall resulting from insufficient charge capacity of the power-supply battery, the time measurement device can be reliably driven again by recharging the power-supply battery by the power generator.

According to the present invention, while the user measures time with the time measurement device having the time measuring function, even when the operation of the time measurement device is stopped by the voltage fall resulting from insufficient charge capacity of the power-supply battery, the time measurement device can be reliably driven again by recharging the power-supply battery by the power generator with vibrations being given to the time measurement device by the user.

According to the present invention, while the user measures time with the time measurement device having the time measuring function, even when the operation of the time measurement device is stopped by the voltage fall resulting from insufficient charge capacity of the power-supply battery, the user operates the stem so that power is generated by the power generator, and the power-supply battery is recharged, which can reliably drive the time measurement device again.

According to the present invention, in a wristwatch that the user ordinarily wears, when the operation of the wristwatch is stopped due to the voltage fall resulting from insufficient charge capacity of the power-supply battery, the time measurement device can be reliably driven again by recharging the power-supply battery by the power generator.

According to the present invention, while the user measures time with the time measurement device having the time measuring function, even when the operation is stopped due to the voltage fall resulting from insufficient charging, the operation can be reliably restarted by recharging the power-supply battery.

INDUSTRIAL APPLICABILITY

In this way, the present invention is suitable for use as a multifunctional time measurement device having hands, and for a time measurement method.

What is claimed is:

1. A time measurement device having a hand, wherein the hand is stopped at a position a predetermined time elapsed from a maximum continuously measurable time when a time measured by a time measurement function exceeds the maximum continuously measurable time, the time measurement device further comprising a safety mechanism for preventing the time measured from being initialized during time measurement, and an actuating mechanism for mechanically initializing the time measured after the time measurement.

2. A time measurement device according to claim 1, wherein the predetermined time is a time in which a hand is advanced a preset time from the continuously maximum measurable time.

3. A time measurement device according to claim 1 wherein the predetermined time is a time in which a plurality of hands are positioned in a preset direction after the continuously maximum measurable time.

4. A time measurement device according to claim 1, wherein the predetermined time is a time in which a plurality of hands are positioned at almost the same angle position after the continuously maximum measurable time.

5. A time measurement device according to claim 1, wherein the time measuring function is a chronograph.

6. A time measurement device according to claim 1, wherein a power-supply battery is a rechargeable, and is charged by a power-generating device.

7. A time measurement device according to claim 6, wherein a hand for measuring the minimum unit time is continuously turning during time measurement.

8. A time measurement device having a hand, comprising:

a measuring section for measuring time;

a hand moving section for moving the hand when time measurement is started in the measuring section;

a comparing section for comparing the value measured by the measuring section with a preset value; and a hand movement stopping section for stopping the movement of the hand at a hand position a predetermined time elapsed from the maximum measurement time based on the result of comparison by the comparing section.

9. A time measurement device having a hand, comprising:

a time measuring function having the capability of measuring time;

a motor for driving the time measuring function;

a control circuit for controlling the driving of the motor so as to start/stop time measurement by the time measuring function; and a control section having an automatic stop counter for measuring the elapsed time from the start of time measurement based on a signal from the control circuit and outputting an automatic stop signal to the control circuit when the maximum measurement time elapses, wherein the automatic stop counter stops the driving of the time measuring function when the hand turns to the preset hand position after a predetermined time elapses from the maximum measurement time during time measurement by the time measuring function.

10. A time measurement device according to claim 9, wherein the automatic stop counter outputs the automatic stop signal when a plurality of hands in the time measuring function turn to the preset hand positions.

11. A time measurement device according to claim 10, wherein the automatic stop counter counts pulses for timing the output of motor pulses for driving the motor, and outputs the automatic stop signal when the count reaches a value corresponding to the automatic stop position.

12. A time measurement method using a hand, comprising the steps of:

measuring time by a measuring section;

moving the hand by a hand moving section when time measurement is started in the measuring section;

comparing a value measured by the measuring section with a preset value by a comparing section; and stopping the movement of the hand at a hand position a predetermined time elapsed from the maximum measurement time by a hand movement stopping section based on the result of comparison by the comparing section.

13. A time measurement method using a hand, comprising the steps of:

measuring time by a time measuring function;

driving the time measuring function by a motor;

controlling the driving of the motor by a control circuit so as to start/stop time measurement by the time measuring function; and measuring an elapsed time from the start of time measurement by an automatic stop counter based on a signal from the control circuit and outputting an automatic stop signal to the control circuit when the maximum measurement time elapses, wherein the control section controls the control circuit and the automatic stop counter, and the automatic stop counter stops the driving of the time measuring function when the hand turns to a preset hand position after a predetermined time elapses from the maximum measurement time during time measurement by the time measuring function.

* * * * *